US010676239B2

(12) United States Patent
Allegretti et al.

(10) Patent No.: US 10,676,239 B2
(45) Date of Patent: Jun. 9, 2020

(54) BULK MATERIAL SHIPPING CONTAINER

(71) Applicant: SANDBOX LOGISTICS, LLC, Houston, TX (US)

(72) Inventors: C. John Allegretti, Barrington Hills, IL (US); Kevin Sylvester Corrigan, Forest Park, IL (US); Margarito Guerrero, Bellwood, IL (US); Felix Guerrero, Bellwood, IL (US)

(73) Assignee: SANDBOX LOGISTICS, LLC, Houston, TX (US)

( * ) Notice: Subject to any disclaimer, the term of this patent is extended or adjusted under 35 U.S.C. 154(b) by 143 days.

(21) Appl. No.: 15/634,018

(22) Filed: Jun. 27, 2017

(65) Prior Publication Data

US 2018/0002066 A1 Jan. 4, 2018

Related U.S. Application Data

(60) Provisional application No. 62/357,023, filed on Jun. 30, 2016.

(51) Int. Cl.
*B65D 19/06* (2006.01)
*B65D 19/38* (2006.01)

(52) U.S. Cl.
CPC ..... *B65D 19/06* (2013.01); *B65D 19/38* (2013.01); *B65D 2519/00029* (2013.01); (Continued)

(58) Field of Classification Search
CPC ..... B65D 19/06; B65D 77/061; B65D 19/38; B65D 2519/00029; B65D 2519/00034; B65D 2519/00174; B65D 2519/00955; B65D 2519/00965; B65D 2519/00064; B65D 2519/00069; B65D 2519/00196; (Continued)

(56) References Cited

U.S. PATENT DOCUMENTS 572,468 A 12/1896 Brown
710,611 A 10/1902 Ray
(Continued)

FOREIGN PATENT DOCUMENTS

DE 4008147 9/1990
EP 0016977 10/1980
(Continued)

OTHER PUBLICATIONS

Krisry International, Inc., Corner Castings and Fittings, printed from http://www.krisryinc.com/products/cornercastings.html, printed Jun. 20, 2016, available before Oct. 28, 2009 (6 pages).

*Primary Examiner* — Chun Hoi Cheung
(74) *Attorney, Agent, or Firm* — Lorenz & Kopf LLP

(57) ABSTRACT

A bulk material shipping container including a pallet, a compartment configured to receive, hold, and release materials and connected to and supported by the pallet, a material unloading assembly positioned under a bottom portion of the compartment, configured to facilitate the release or unloading of materials from the compartment, and connected to and supported by the pallet, and a material loading assembly configured to facilitate the loading of material into the compartment and connected to and partially supported by a top wall assembly of the compartment.

33 Claims, 144 Drawing Sheets

(52) U.S. Cl.
CPC ..... *B65D 2519/00034* (2013.01); *B65D 2519/00064* (2013.01); *B65D 2519/00069* (2013.01); *B65D 2519/0096* (2013.01); *B65D 2519/00169* (2013.01); *B65D 2519/00174* (2013.01); *B65D 2519/00273* (2013.01); *B65D 2519/00293* (2013.01); *B65D 2519/00323* (2013.01); *B65D 2519/00343* (2013.01); *B65D 2519/00502* (2013.01); *B65D 2519/00567* (2013.01); *B65D 2519/00796* (2013.01); *B65D 2519/00805* (2013.01); *B65D 2519/00965* (2013.01)

(58) Field of Classification Search
CPC ..... B65D 2519/00273; B65D 2519/00293; B65D 2519/00323; B65D 2519/00343; B65D 2519/00502; B65D 2519/00567; B65D 2519/00796; B65D 2519/00805
USPC ..... 206/396, 590, 596
See application file for complete search history.

(56) References Cited

U.S. PATENT DOCUMENTS

| | | | |
|---|---|---|---|
| 917,646 | A | 4/1909 | Otto |
| 2,385,245 | A | 9/1945 | Willoughby |
| 2,462,693 | A | 2/1949 | Wabshaw |
| 2,563,470 | A | 8/1951 | Kane |
| 2,622,771 | A | 12/1952 | Tulou |
| 2,652,174 | A | 9/1953 | Shea |
| 2,670,866 | A | 3/1954 | Glesby |
| 2,678,737 | A | 5/1954 | Mangrum |
| 2,802,603 | A | 8/1957 | McCray |
| 2,865,521 | A | 12/1958 | Fisher et al. |
| 2,894,666 | A | 7/1959 | Campbell, Jr. |
| 3,049,248 | A | 8/1962 | Heltzel et al. |
| 3,083,879 | A | 4/1963 | Coleman |
| 3,151,779 | A | 10/1964 | Rensch et al. |
| 3,270,921 | A | 9/1966 | Nadolske |
| 3,294,306 | A | 12/1966 | Areddy |
| 3,318,473 | A | 5/1967 | Jones et al. |
| 3,343,688 | A | 9/1967 | Ross |
| 3,406,995 | A | 10/1968 | McCarthy |
| 3,407,971 | A | 10/1968 | Oehler |
| 3,476,270 | A | 11/1969 | Cox et al. |
| 3,602,400 | A | 8/1971 | Cooke |
| 3,752,511 | A | 8/1973 | Racy |
| 3,785,534 | A | 1/1974 | Smith |
| 3,797,727 | A | 3/1974 | Downing et al. |
| 3,802,584 | A | 4/1974 | Sackett, Sr. et al. |
| 3,904,105 | A | 9/1975 | Booth |
| 3,955,703 | A | 5/1976 | Zebarth |
| 3,986,708 | A | 10/1976 | Heltzel et al. |
| 3,999,290 | A | 12/1976 | Wood |
| 4,019,634 | A | 4/1977 | Bonnot |
| 4,019,635 | A | 4/1977 | Boots |
| 4,023,719 | A | 5/1977 | Noyon |
| 4,056,295 | A | 11/1977 | Downing |
| 4,058,239 | A | 11/1977 | Van Mill |
| 4,138,163 | A | 2/1979 | Calvert et al. |
| 4,178,117 | A | 12/1979 | Brugler |
| 4,204,773 | A | 5/1980 | Bates |
| 4,247,228 | A | 1/1981 | Gray et al. |
| 4,258,953 | A | 3/1981 | Johnson |
| 4,280,640 | A | 7/1981 | Daloisio |
| 4,282,988 | A | 8/1981 | Hulbert, Jr. |
| 4,313,708 | A | 2/1982 | Tiliakos |
| 4,331,252 | A | 5/1982 | Carren |
| 4,397,406 | A | 8/1983 | Croley |
| 4,398,653 | A | 8/1983 | Daloisio |
| 4,448,296 | A | 5/1984 | Tabler |
| 4,466,541 | A | 8/1984 | Tabler et al. |
| 4,470,518 | A | 9/1984 | Stein |
| 4,485,910 | A | 12/1984 | Tabler |
| 4,572,368 | A | 2/1986 | Miller et al. |
| 4,573,577 | A | 3/1986 | Miller |
| 4,574,962 | A | 3/1986 | Tabler et al. |
| 4,600,103 | A | 7/1986 | Tabler |
| D285,219 | S | 8/1986 | Stein |
| 4,620,644 | A | 11/1986 | Miller |
| 4,626,166 | A | 12/1986 | Jolly |
| 4,643,310 | A | 2/1987 | Deaton et al. |
| 4,648,199 | A | 3/1987 | Deaton et al. |
| 4,648,200 | A | 3/1987 | Miller et al. |
| D289,788 | S | 5/1987 | Deaton et al. |
| D290,778 | S | 7/1987 | Tabler |
| 4,688,675 | A | 8/1987 | Miller et al. |
| 4,701,095 | A | 10/1987 | Berryman et al. |
| D292,718 | S | 11/1987 | Stein |
| 4,724,976 | A | 2/1988 | Lee |
| 4,756,420 | A | 7/1988 | Deaton |
| 4,760,922 | A | 8/1988 | Northgrave |
| 4,779,751 | A | 10/1988 | Munroe |
| 4,804,082 | A | 2/1989 | Stein |
| 4,809,851 | A | 3/1989 | Oestreich, Jr. et al. |
| 4,832,200 | A | 5/1989 | Deaton et al. |
| RE32,966 | E | 6/1989 | Miller et al. |
| 4,848,605 | A | 7/1989 | Wise |
| 4,856,681 | A | 8/1989 | Murray |
| D304,120 | S | 10/1989 | Buchanan et al. |
| 4,890,740 | A | 1/1990 | Tabler |
| 4,917,255 | A | 4/1990 | Foy et al. |
| 4,919,583 | A | 4/1990 | Speakman, Jr. |
| D307,718 | S | 5/1990 | Tabler |
| 4,936,458 | A | 6/1990 | Tabler et al. |
| 4,946,068 | A | 8/1990 | Erickson et al. |
| 4,948,186 | A | 8/1990 | Pruitt |
| 4,956,821 | A | 9/1990 | Fenelon |
| RE33,384 | E | 10/1990 | Miller et al. |
| 4,960,207 | A | 10/1990 | Tabler et al. |
| 4,966,310 | A | 10/1990 | Hawkins |
| 4,974,737 | A | 12/1990 | Miller |
| 4,993,883 | A | 2/1991 | Jones |
| 4,995,522 | A | 2/1991 | Barr |
| 5,036,979 | A | 8/1991 | Selz |
| 5,094,356 | A | 3/1992 | Miller |
| 5,096,096 | A | 3/1992 | Calaunan |
| 5,224,635 | A | 7/1993 | Wise |
| 5,232,120 | A | 8/1993 | Dunken et al. |
| 5,269,455 | A | 12/1993 | Grigsby et al. |
| 5,277,014 | A | 1/1994 | White |
| 5,290,139 | A | 3/1994 | Hedrick |
| 5,330,069 | A | 7/1994 | Jamison et al. |
| 5,339,996 | A | 8/1994 | Dubbert et al. |
| 5,373,961 | A | 12/1994 | Harris et al. |
| 5,375,730 | A | 12/1994 | Bahr et al. |
| 5,392,946 | A | 2/1995 | Holbrook et al. |
| 5,402,915 | A | 4/1995 | Hogan |
| 5,413,154 | A | 5/1995 | Hurst, Jr. et al. |
| 5,439,113 | A | 8/1995 | Elvin-Jensen |
| 5,441,321 | A | 8/1995 | Karpisek |
| 5,445,289 | A | 8/1995 | Owen |
| 5,524,750 | A | 6/1996 | Miller |
| 5,564,599 | A | 10/1996 | Barber et al. |
| 5,667,090 | A | 9/1997 | Langham, Jr. et al. |
| 5,673,791 | A | 10/1997 | Jamison |
| 5,715,962 | A | 2/1998 | McDonnell |
| 5,722,550 | A | 3/1998 | Ficker |
| 5,722,552 | A | 3/1998 | Olson |
| 5,788,121 | A | 8/1998 | Sasaki et al. |
| 5,803,296 | A | 9/1998 | Olson |
| 5,829,616 | A | 11/1998 | Daniel et al. |
| 5,836,480 | A | 11/1998 | Epp et al. |
| 5,845,799 | A | 12/1998 | Deaton |
| 5,878,903 | A | 3/1999 | Ung |
| 5,927,356 | A | 7/1999 | Henderson |
| 5,927,558 | A | 7/1999 | Bruce |
| 5,960,974 | A | 10/1999 | Kee et al. |
| 5,971,219 | A | 10/1999 | Karpiesek |
| 5,997,099 | A | 12/1999 | Collins |
| 6,010,022 | A | 1/2000 | Deaton |
| 6,059,372 | A | 5/2000 | McDonald et al. |
| 6,112,929 | A | 9/2000 | Ota |
| 6,205,938 | B1 | 3/2001 | Foley et al. |

(56) References Cited

U.S. PATENT DOCUMENTS 6,247,594 B1 6/2001 Garton
6,253,948 B1 7/2001 Ficker
6,328,183 B1 12/2001 Coleman
6,491,343 B2 12/2002 Yamazaki
6,537,015 B2 3/2003 Lim et al.
6,547,127 B2 4/2003 Bradford et al.
6,568,567 B2 5/2003 McKenzie et al.
6,622,849 B1 9/2003 Sperling
6,776,300 B2 8/2004 Walsh et al.
6,783,032 B2 8/2004 Fons
6,902,061 B1 6/2005 Elstone
6,968,946 B2 11/2005 Shert
7,008,163 B2 3/2006 Russell
7,032,765 B2 4/2006 Miller et al.
7,100,791 B2 9/2006 Berger
7,100,896 B1 9/2006 Cox
7,240,681 B2 7/2007 Saik
7,252,309 B2 8/2007 Eng Soon et al.
7,284,579 B2 10/2007 Elgan
7,353,962 B2 4/2008 Parnall et al.
D575,062 S 8/2008 Wolf
7,431,173 B2 10/2008 Thorpe
7,475,796 B2 1/2009 Garton
7,500,817 B2 3/2009 Furrer et al.
7,543,539 B2 6/2009 Miller
7,556,166 B2 7/2009 Parnall et al.
7,762,281 B2 7/2010 Schuld
8,201,520 B2 6/2012 Meritt
8,387,824 B2 3/2013 Wietgrefe
8,434,990 B2 5/2013 Claussen
D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 11/2013 Oren et al.
8,607,289 B2 12/2013 Brown et al.
8,616,370 B2 12/2013 Allegretti et al.
8,622,251 B2 1/2014 Oren
8,668,430 B2 3/2014 Oren et al.
D703,582 S 4/2014 Oren
8,827,118 B2 9/2014 Oren
8,887,914 B2 11/2014 Allegretti et al.
8,915,691 B2 12/2014 Mintz
RE45,713 E 10/2015 Oren et al.
9,162,603 B2 10/2015 Oren
RE45,788 E 11/2015 Oren et al.
9,248,772 B2 2/2016 Oren
RE45,914 E 3/2016 Oren et al.
9,296,518 B2 3/2016 Oren
9,309,064 B2 * 4/2016 Sheesley ..... B65D 88/129
9,340,353 B2 5/2016 Oren et al.
9,358,916 B2 6/2016 Oren
9,394,102 B2 7/2016 Oren et al.
9,403,626 B2 8/2016 Oren
9,421,899 B2 8/2016 Oren
9,440,785 B2 9/2016 Oren et al.
9,446,801 B1 9/2016 Oren
9,475,661 B2 10/2016 Oren
9,511,929 B2 12/2016 Oren
9,522,816 B2 12/2016 Taylor
9,527,664 B2 12/2016 Oren
9,580,238 B2 2/2017 Friesen et al.
RE46,334 E 3/2017 Oren et al.
D780,883 S 3/2017 Schaffner et al.
D783,771 S 4/2017 Stegemoeller et al.
D783,772 S * 4/2017 Stegemoeller, III ..... D23/202
9,617,065 B2 4/2017 Allegretti et al.
9,617,066 B2 4/2017 Oren
9,624,030 B2 4/2017 Oren et al.
9,624,036 B2 4/2017 Luharuka et al.
9,643,774 B2 5/2017 Oren
9,656,799 B2 5/2017 Oren et al.
9,669,993 B2 6/2017 Oren et al.
9,670,752 B2 6/2017 Glynn et al.
9,676,554 B2 6/2017 Glynn et al.
9,682,815 B2 6/2017 Oren
9,694,970 B2 7/2017 Oren et al.
9,701,463 B2 7/2017 Oren et al.
9,718,609 B2 8/2017 Oren et al.
9,718,610 B2 8/2017 Oren
9,725,233 B2 8/2017 Oren et al.
9,725,234 B2 8/2017 Oren et al.
9,738,439 B2 8/2017 Oren et al.
RE46,531 E 9/2017 Oren et al.
9,758,081 B2 9/2017 Oren
9,758,993 B1 9/2017 Allegretti et al.
9,771,224 B2 9/2017 Oren et al.
9,783,338 B1 10/2017 Allegretti et al.
9,796,504 B1 10/2017 Allegretti et al.
9,809,381 B2 * 11/2017 Oren ..... B65D 88/30
9,828,135 B2 11/2017 Allegretti et al.
2001/0022308 A1 9/2001 Epp et al.
2002/0023994 A1 2/2002 De Shann
2002/0070215 A1 6/2002 Walsh et al.
2003/0019875 A1 1/2003 Woram
2003/0024971 A1 2/2003 Jones et al.
2004/0074922 A1 4/2004 Bothor et al.
2004/0118725 A1 6/2004 Shuert
2004/0222222 A1 11/2004 Parnall et al.
2004/0232146 A1 11/2004 Kessler et al.
2006/0266747 A1 11/2006 Stolzman
2007/0210080 A1 9/2007 Hooper
2007/0241104 A1 10/2007 Huizingh et al.
2007/0278223 A1 12/2007 Ficker
2007/0290471 A1 12/2007 Sexton
2008/0029546 A1 2/2008 Schuld
2008/0029553 A1 2/2008 Culleton
2008/0169285 A1 7/2008 Marazita et al.
2008/0179054 A1 7/2008 McGough et al.
2008/0179322 A1 7/2008 Parnall et al.
2008/0179324 A1 7/2008 McGough et al.
2008/0226434 A1 9/2008 Smith et al.
2009/0000527 A1 1/2009 Ficker
2009/0078410 A1 3/2009 Krenek et al.
2009/0129903 A1 5/2009 Lyons, III
2009/0314791 A1 12/2009 Hartley et al.
2011/0011893 A1 1/2011 Cerny
2011/0168593 A1 7/2011 Neufeld et al.
2012/0017812 A1 1/2012 Renyer et al.
2012/0102848 A1 * 5/2012 Atiyeh, Sr. ..... E04D 13/155
52/96
2013/0206415 A1 8/2013 Sheesley
2013/0209204 A1 8/2013 Sheesley
2014/0023463 A1 1/2014 Oren
2014/0083554 A1 * 3/2014 Harris ..... B65D 88/32
141/1
2014/0305769 A1 * 10/2014 Eiden, III ..... B65G 65/42
198/443
2015/0003955 A1 1/2015 Oren et al.
2015/0284194 A1 10/2015 Oren et al.
2015/0375930 A1 12/2015 Oren et al.
2016/0031658 A1 2/2016 Oren et al.
2016/0039433 A1 2/2016 Oren et al.
2016/0046438 A1 2/2016 Oren et al.
2016/0046454 A1 2/2016 Oren et al.
2016/0068342 A1 3/2016 Oren et al.
2016/0130095 A1 5/2016 Oren et al.
2016/0244279 A1 8/2016 Oren et al.
2016/0264352 A1 9/2016 Oren
2016/0332809 A1 11/2016 Harris
2016/0332811 A1 11/2016 Harris
2017/0129696 A1 5/2017 Oren
2017/0144834 A1 5/2017 Oren et al.
2017/0190523 A1 7/2017 Oren et al.
2017/0203915 A1 7/2017 Oren
2017/0225883 A1 8/2017 Oren
2017/0240350 A1 8/2017 Oren et al.
2017/0240361 A1 8/2017 Glynn et al.
2017/0240363 A1 8/2017 Oren

(56) References Cited

U.S. PATENT DOCUMENTS

| | | | |
|---|---|---|---|
| 2017/0267151 | A1 | 9/2017 | Oren |
| 2017/0283165 | A1 | 10/2017 | Oren et al. |

FOREIGN PATENT DOCUMENTS

| | | |
|---|---|---|
| EP | 1598288 | 11/2005 |
| EP | 2937826 | 10/2015 |
| FR | 2640598 | 6/1990 |
| GB | 2066220 | 7/1981 |
| GB | 2 204 847 | 11/1988 |
| JP | 2008239019 | 10/2008 |
| NL | 8105283 | 6/1983 |
| WO | WO01076960 | 10/2001 |
| WO | WO03024815 | 3/2003 |
| WO | WO 2007/010262 | 1/2007 |
| WO | WO2007081556 | 7/2007 |
| WO | WO 2008/012513 | 1/2008 |
| WO | WO2009087338 | 7/2009 |
| WO | WO2013095871 | 6/2013 |
| WO | WO2013142421 | 9/2013 |
| WO | WO2014018129 | 1/2014 |
| WO | WO2014018236 | 1/2014 |
| WO | WO2015119799 | 8/2015 |
| WO | WO2015191150 | 12/2015 |
| WO | WO2015192061 | 12/2015 |
| WO | WO2016044012 | 3/2016 |
| WO | WO2016160067 | 10/2016 |
| WO | WO2016178691 | 11/2016 |
| WO | WO2016178692 | 11/2016 |
| WO | WO2016178694 | 11/2016 |
| WO | WO2016178695 | 11/2016 |
| WO | WO2017014768 | 1/2017 |
| WO | WO2017014771 | 1/2017 |
| WO | WO2017014774 | 1/2017 |
| WO | WO2017027034 | 2/2017 |
| WO | WO2017095423 | 6/2017 |

* cited by examiner

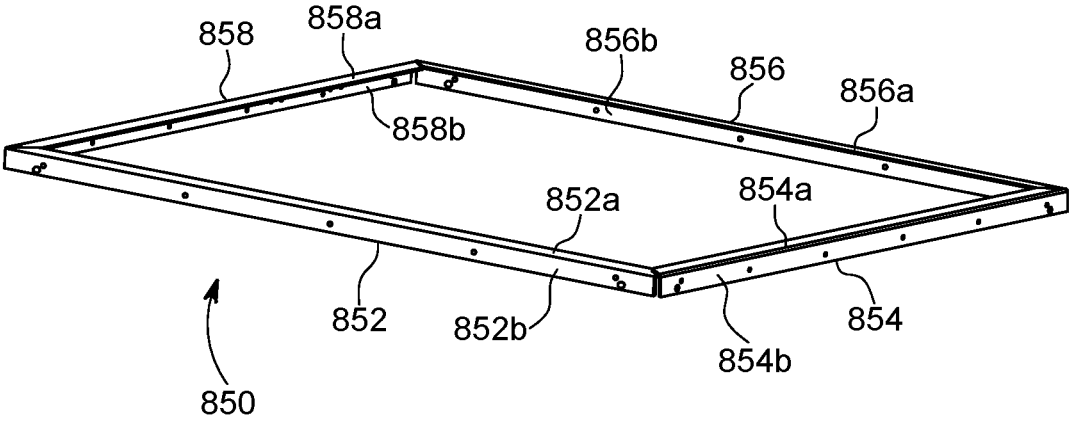
FIG. 13AAA
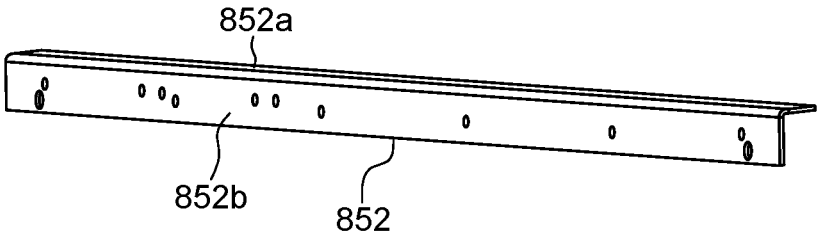
FIG. 13BBB

BULK MATERIAL SHIPPING CONTAINER

PRIORITY

This application claims priority to and the benefit of U.S. Provisional Patent Application No. 62/357,023, filed on Jun. 30, 2016, the entire contents of which are incorporated herein by reference.

BACKGROUND

Various bulk material shipping containers are known. Such known material bulk shipping containers are typically used to transport a wide range of products, parts, components, items, and other materials such as, but not limited to, seeds, shavings, fasteners, dry bulk, plastic resins, and granular materials (such as but not limited to cement or sand). These are sometimes called loose materials.

There is a continuing need for better bulk material shipping containers for loose materials that are stronger than various known containers, more durable than various known containers, lighter than various known containers having similar weight capacities, easier to repair than various known containers, easier to reconstruct than various known containers, that are configured to hold greater volumes of materials than various known containers, configured to hold greater weights of materials than various known containers, and configured to have a better weight to holding cargo capacity than various known containers.

SUMMARY

Various embodiments of the present disclosure provide a bulk material shipping container that provides various advantages over previously known commercially available bulk shipping material containers.

For purposes of brevity, the bulk material shipping container of the present disclosure may sometimes be referred to herein as a material shipping container, a shipping container, or simply as a container. For purposes of brevity, a person who uses the container may sometimes be referred to herein as a "user" or an "operator", a person who loads materials in a container may sometimes be referred to herein as a "loader," and a person who removes the materials from a container may sometimes be referred to herein as an "unloader."

Various embodiments of the bulk material shipping container of the present disclosure each include: (a) a pallet; (b) a compartment connected to and supported by the pallet; (c) a material unloading assembly positioned under a bottom portion of the compartment and connected to and supported by the pallet; and (d) a material loading assembly connected to and supported by the top wall assembly of the compartment.

In various embodiments, pallet of the bulk material shipping container includes: a front support, a first or left side support, a rear support, a second or right side support, a first fork lift tine receiving tube, a second fork lift tine receiving tube, a first material unloading assembly support, a second material unloading assembly support, a first stabilizer brace, a second stabilizer brace, a first bottom corner assembly, a second bottom corner assembly, a third bottom corner assembly, and a fourth bottom corner assembly.

In various embodiments, the pallet is configured such that parts of the front support, the left side support, the rear support, and the right side support, respectively, integrally co-act with or form parts of the first bottom corner assembly, the second bottom corner assembly, the third bottom corner assembly, and the fourth bottom corner assembly to provide an improved pallet and an improved overall container that is stronger than various known containers, more durable than various known containers, configured to hold greater volumes of materials than various known containers, configured to hold greater weights of materials than various known containers, and configured to have a better weight to holding cargo capacity than various known containers.

In various embodiments, the configuration, arrangement, and attachment of the other components of the pallet also provide an improved pallet and an improved overall container that is stronger than various known containers, more durable than various known containers, configured to hold greater volumes of materials than various known containers, configured to hold greater weights of materials than various known containers, and configured to have a better weight to holding cargo capacity than various known containers.

In various embodiment, the compartment of the bulk material shipping container is connected to and supported by the pallet, configured to receive, hold, and release materials, and includes: a first upright corner assembly, a second upright corner assembly, a third upright corner assembly, a fourth upright corner assembly, an interior bottom wall assembly, an interior bottom wall support assembly, an exterior front wall assembly, an exterior first or left side wall assembly, an exterior rear wall assembly, an exterior second or right side wall assembly, a first upper corner assembly, a second upper corner assembly, a third upper corner assembly, a fourth upper corner assembly, and a top wall assembly.

In various embodiments, the first upright corner assembly, the second upright corner assembly, the third upright corner assembly, the fourth upright corner assembly, the interior bottom wall assembly, the interior bottom wall support assembly, the exterior front wall assembly, the exterior first or left side wall assembly, the exterior rear wall assembly, the exterior second or right side wall assembly, the first upper corner assembly, the second upper corner assembly, the third upper corner assembly, the fourth upper corner assembly, and the top wall assembly of the compartment of the bulk material shipping container co-act to provide an improved compartment and an improved overall container that is stronger than various known containers, more durable than various known containers, configured to hold greater volumes of materials than various known containers, configured to hold greater weights of materials than various known containers, and configured to have a better weight to holding cargo capacity than various known containers.

In various embodiments, the material unloading assembly of the bulk material shipping container is positioned under a bottom portion of the compartment, configured to facilitate the release or unloading of materials from the compartment, and connected to and supported by the pallet. In various embodiments, the material unloading assembly includes a first guide rail or J-channel, a second guide rail or J-channel, a gate assembly, a gate movement assembly, and a rear material director. The gate movement assembly is configured to cause the gate assembly to move from a closed position to a fully opened position, and to move from the fully opened position to the closed position. In various embodiments, the configuration, arrangement, and attachment of the first guide rail or J-channel, the second guide rail or J-channel, the gate assembly, and the gate movement assembly of the material unloading assembly provide an intentional looseness that facilitates or allows more play or side to side movement in the gate assembly that enables the gate assembly to continue to open or close if the gate assembly becomes skewed, off-center, or misaligned. This enables the material unloading assembly and the entire shipping container to be manufactured with reasonable manufacturing tolerance limits. In this illustrated embodiment, the configuration, arrangement, and attachment of the first guide rail or J-channel, the second guide rail or J-channel, the gate assembly, and the rear material director of the material unloading assembly provide material leakage prevention. In this illustrated embodiment, the configuration, arrangement of the gate assembly also provides additional stability and damage prevention. Thus, in various embodiments, the material unloading assembly of the bulk material shipping container provides an improved material unloading assembly and an improved overall container that is stronger than various known containers, more durable than various known containers, holds greater volumes of materials than various known containers, holds greater weights of materials than various known containers, and has a better weight to holding cargo capacity than various known containers.

In various embodiments, the material loading assembly of the bulk material shipping container is configured to facilitate the loading of materials into the compartment and connected to and partially supported by the top wall assembly of the compartment, and includes a hatch collar assembly, a hatch rail guide assembly, a hatch assembly, and a hatch movement assembly, the hatch movement assembly configured to cause the hatch assembly to move from a closed position to a fully opened position, and to move from the fully opened position to the closed position.

In various embodiments, the combination of the hatch collar assembly, the hatch rail guide assembly, the hatch assembly, and the hatch movement assembly of the material loading assembly of the bulk material shipping container provide an improved material loading assembly and an improved overall container that is stronger than various known containers, more durable than various known containers, holds greater volumes of materials than various known containers, holds greater weights of materials than various known containers, has a better weight to holding cargo capacity than various known containers, and additionally provides a more weather tight container than various known containers.

Each shipping container of the present disclosure is configured to directly receive, hold, and release materials without a liner although a liner may be employed in accordance with the present disclosure. Various embodiments of the container of the present disclosure can be stacked when being filled, when being emptied, for shipping or transit, and/or storage.

Various embodiments of the shipping container of the present disclosure are primarily made from a combination of steel, stainless steel, and a composite material (such as a fiber glass material or fiberboard components). If one of the components or sections of the container is damaged, that section can be fixed to reduce: (a) cost; (b) time out of service for the container; and (c) additional material and/or energy waste.

Additional features and advantages of the present invention are described in, and will be apparent from, the following Detailed Description of Exemplary Embodiments and the figures.

DESCRIPTION OF THE DRAWINGS

FIG. 13AA is a fragmentary inner perspective view of one of the corner assemblies of the compartment of the bulk material shipping container of FIG. 1, showing one of the winged panel supports connected to one of the W-shaped corner members, and one of the upper corners of one of the panels of the interior bottom wall assembly connected to that winged panel support.

FIG. 13BB is a fragmentary exploded inner perspective view of the upper corners of two adjacent panels of the interior bottom wall assembly, and the upper V-shaped sealing plate of the compartment of the bulk material shipping container of FIG. 1, shown removed from the panels of the interior bottom wall assembly.

FIG. 13CC is a fragmentary inner perspective view of the upper corners of two adjacent panels of the interior bottom wall assembly, and the upper V-shaped sealing plate of the compartment of the bulk material shipping container of FIG. 1 connected to the panels of the interior bottom wall assembly.

FIG. 13DD is a fragmentary inner perspective view of one of the corner assemblies and two panels of the interior bottom wall assembly of the compartment of the bulk material shipping container of FIG. 1, showing the upper corners of two adjacent panels of the interior bottom wall assembly, and showing the V-shaped sealing plate.

FIG. 13EE is a fragmentary inner perspective view of one of the corner assemblies and two panels of the interior bottom wall assembly of the compartment of the bulk material shipping container of FIG. 1, showing the upper corners of two adjacent panels of the interior bottom wall assembly, and showing the V-shaped sealing plate.

FIG. 13FF is a fragmentary perspective view of a bottom portion of the compartment of the bulk material shipping container of FIG. 1, showing part of the interior bottom wall support assembly including two inner wedge shaped interior bottom wall supports and two outer wedge shaped interior bottom wall supports on the left side of the container.

FIG. 13GG is a fragmentary exploded perspective view of two sets of two inner wedge shaped interior bottom wall supports and two outer wedge shaped interior bottom wall supports on the left and rear sides of the container, and the associated tube supports of the interior bottom wall support assembly of the compartment of the bulk material shipping container of FIG. 1.

FIG. 13HH is a fragmentary perspective view of the sets of two inner wedge shaped interior bottom wall supports and two outer wedge shaped interior bottom wall supports on the left and rear sides of the container, and the associated tube supports of the interior bottom wall support assembly of the compartment of the bulk material shipping container of FIG. 1.

FIG. 13II is a fragmentary perspective view of two of the outer wedge shaped interior bottom wall supports of the interior bottom wall support assembly of the compartment of the bulk material shipping container of FIG. 1, shown attached to part of the pallet.

FIG. 13JJ is an enlarged perspective view of one of the tube supports of the interior bottom wall support assembly of the compartment of the bulk material shipping container of FIG. 1.

FIG. 13KK is an enlarged perspective view of another one of the tube supports of the interior bottom wall support assembly of the compartment of the bulk material shipping container of FIG. 1.

FIG. 13LL is a fragmentary outer perspective view of the top of one of the upright corner assemblies of the compartment of the bulk material shipping container of FIG. 1, shown with an upper corner assembly connected to the W-shaped corner member of that upright corner assembly.

FIG. 13MM is an inner perspective view of one of the upper corner assembly of the compartment of the bulk material shipping container of FIG. 1, removed from the container.

FIG. 13NN is an inner exploded perspective view of one of the top corner assemblies of the compartment of the bulk material shipping container of FIG. 1, shown removed from the container.

FIG. 13OO is an exploded side perspective view of one of the top corner assemblies of the compartment of the bulk material shipping container of FIG. 1, shown removed from the container.

FIG. 13PP is an enlarged top perspective view of one of the top corner pins of the compartment of the bulk material shipping container of FIG. 1.

FIG. 13QQ is an enlarged perspective view of one of the top corner pins of the compartment of the bulk material shipping container of FIG. 1.

FIG. 13RR is an enlarged side view of one of the top corner pins of the compartment of the bulk material shipping container of FIG. 1.

FIG. 13SS is an enlarged bottom view of one of the top corner pins of the compartment of the bulk material shipping container of FIG. 1.

FIG. 13TT is an enlarged front view of the front kick plate (with a viewing port) of the front wall assembly of the compartment of the bulk material shipping container of FIG. 1.

FIG. 13UU is an enlarged front view of the front kick plate (with a viewing port) of the front wall assembly and two of the panels of the interior bottom wall assembly of the compartment of the bulk material shipping container of FIG. 1.

FIG. 13VV is an enlarged perspective view of a first one of the outer wall braces of the front wall assembly and side wall assembly of the compartment of the bulk material shipping container of FIG. 1.

FIG. 13WW is an enlarged perspective view of a second one of the outer wall braces of the front wall assembly and side wall assembly of the compartment of the bulk material shipping container of FIG. 1.

FIG. 13XX is an enlarged fragmentary perspective view of one end of the second one of the outer wall braces of the front wall assembly and side wall assembly of the compartment of the bulk material shipping container of FIG. 1.

FIG. 13YY is an enlarged fragmentary exploded perspective view of the second one of the outer wall braces of the front wall assembly and side wall assembly of the compartment of the bulk material shipping container of FIG. 1.

FIG. 13ZZ is an enlarged exploded inner perspective view of the side seal plates adjacent to one of the W-shape corner members of one of the upright corner assemblies of the compartment of the bulk material shipping container of FIG. 1.

FIG. 13AAA is an enlarged top perspective view of part of the top assembly of the compartment of the bulk material shipping container of FIG. 1, shown removed from the container.

FIG. 13BBB is an enlarged fragmentary top perspective view of the front L-shaped angle top support of the top assembly of the compartment of the bulk material shipping container of FIG. 1.

FIG. 17A is a perspective view of two bulk material shipping containers of FIG. 1 positioned on two adjacent material unloading devices of the present disclosure.

FIG. 17B is a front view of the two bulk material shipping containers of FIG. 1 positioned on the two adjacent material unloading devices of FIG. 17A.

FIG. 17C is a rear view of one of the bulk material shipping containers of FIG. 1 positioned on one of the two adjacent material unloading devices of FIG. 17A.

FIG. 17D is a right side view of one of the bulk material shipping containers of FIG. 1 positioned on another one of the two adjacent material unloading devices of FIG. 17A.

FIGS. 18A and 18B are front perspective views of a hatch opening and closing assembly of the present disclosure, shown attached to a container of the present disclosure.

FIGS. 18C and 18D are side perspective views of the hatch opening and closing assembly of FIGS. 18A and 18B, shown attached to a container of the present disclosure.

FIG. 19 is a top perspective view of the bulk material shipping container of another example embodiment of the present disclosure.

FIG. 20 is a vertical cross-sectional top front perspective view of the bulk material shipping container of FIG. 19, showing the hatch assembly of the material loading assembly in the closed position, and showing the gate assembly of the material unloading assembly in the closed position.

FIG. 21 is a vertical cross-sectional perspective view of the bulk material shipping container of FIG. 19, showing the hatch assembly of the material loading assembly in the closed position, and showing the gate assembly of the material unloading assembly in the closed position.

FIG. 22 is a top front perspective view of the bulk material shipping container of FIG. 19, with the top wall assembly of the compartment removed and with the composite panels of the exterior front, rear, and side wall assemblies removed.

FIG. 23 is a bottom front perspective view of the bulk material shipping container of FIG. 19, showing the gate assembly of the material unloading assembly in the closed position.

FIG. 24 is a left side top perspective view of the bulk material shipping container of FIG. 19, with part of the top wall assembly of the compartment removed and with the composite panels of the exterior walls removed.

Figure 19:
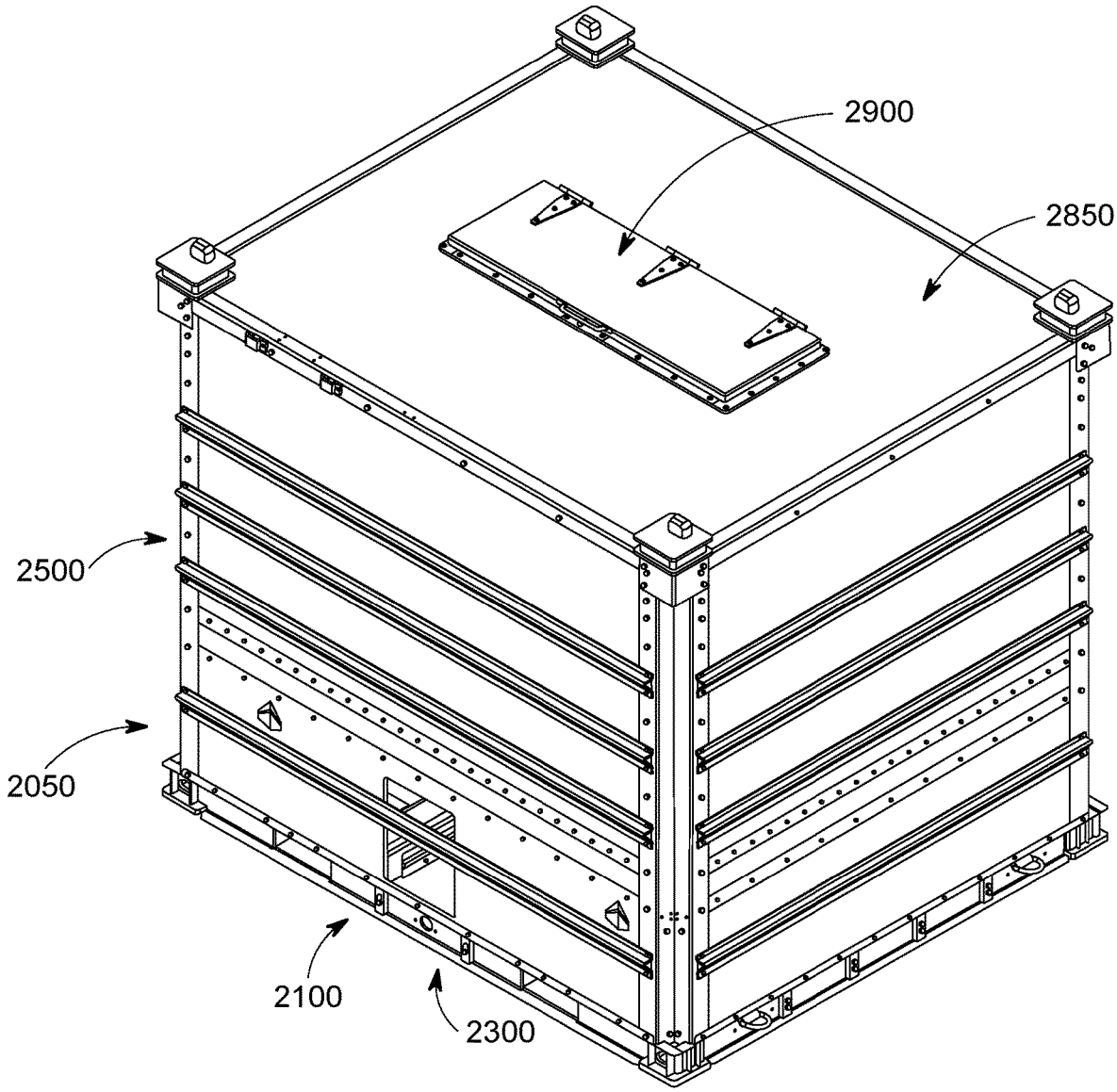
Figure 20:
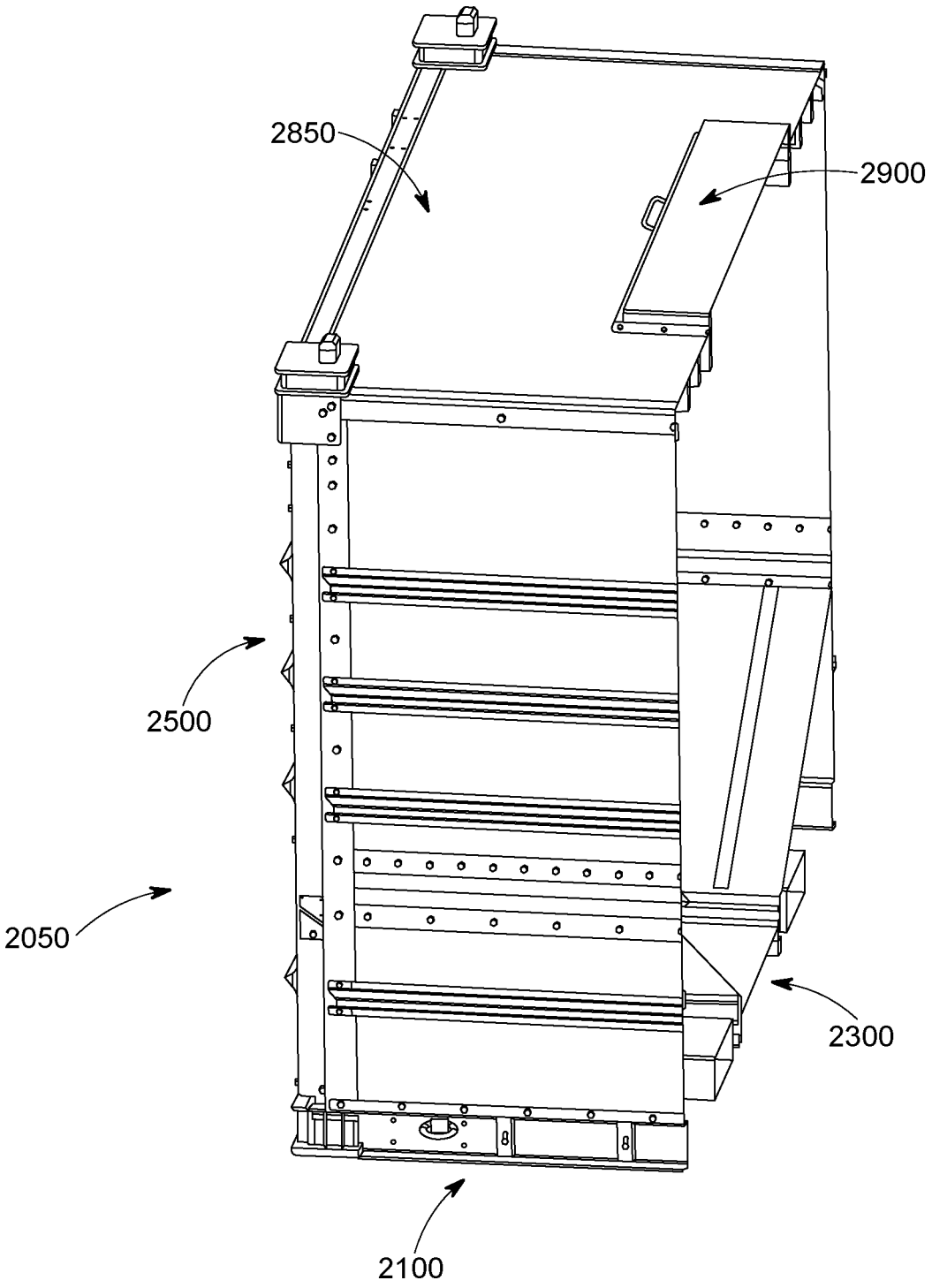
Figure 21:
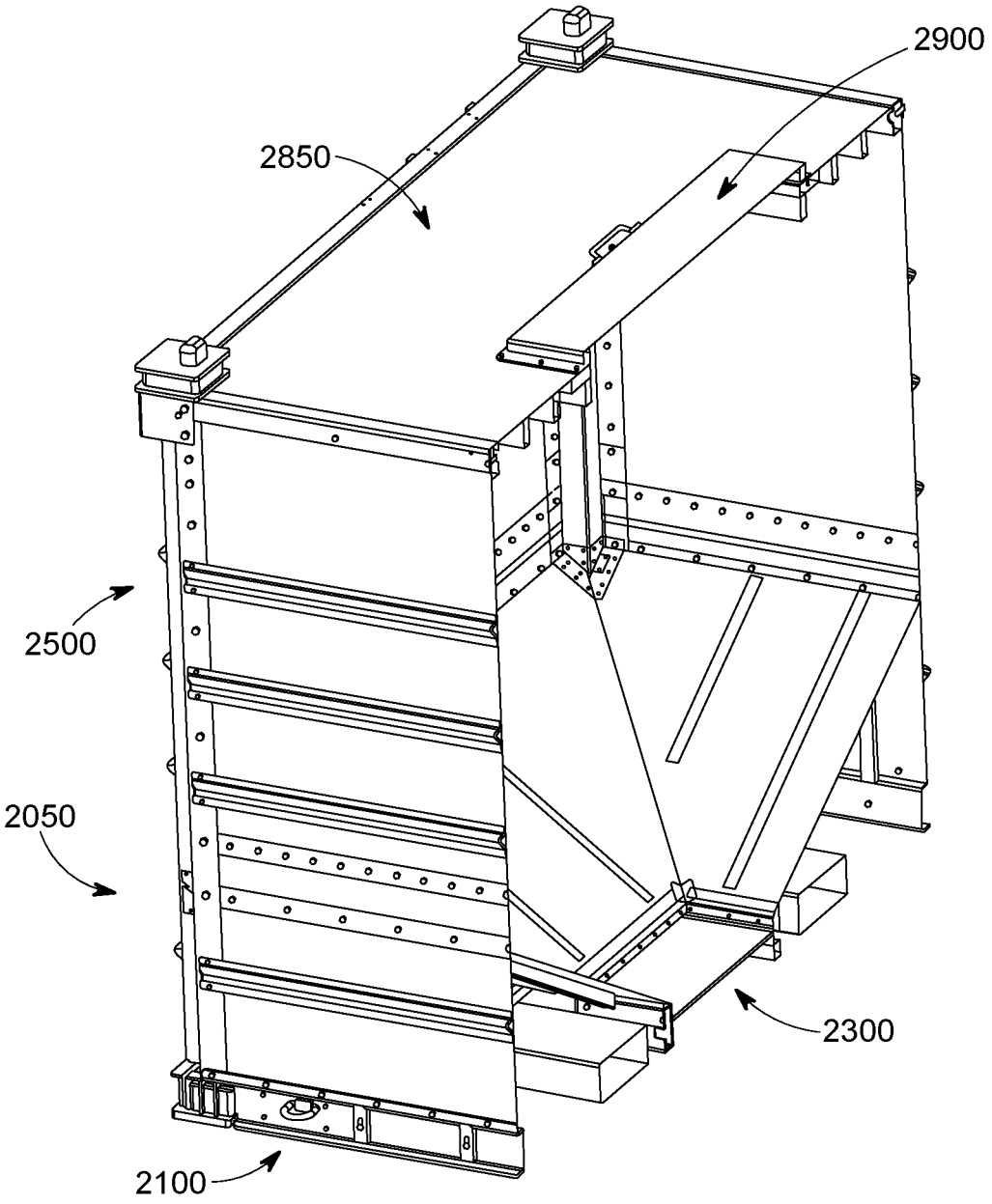
Figure 22:
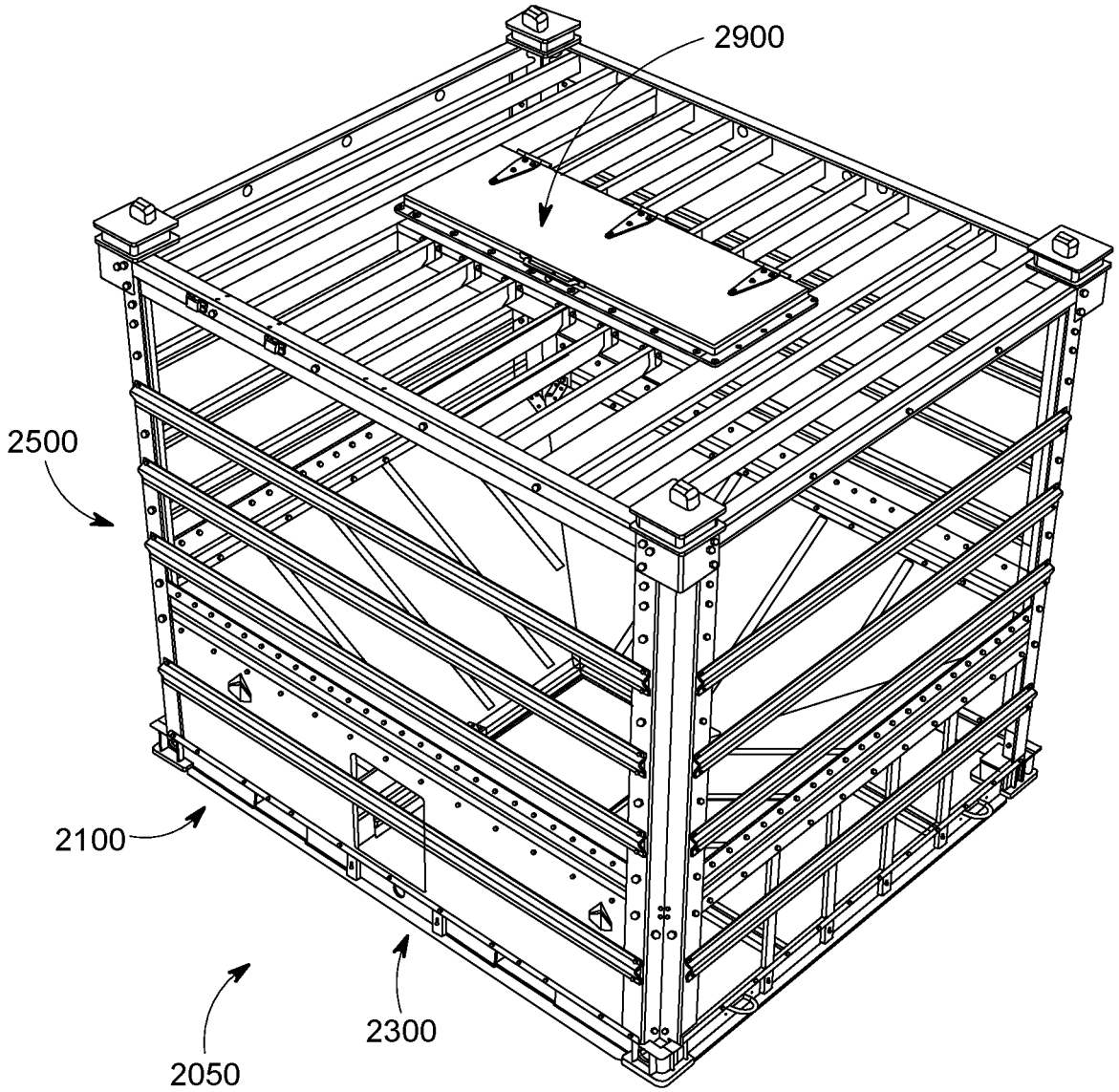
Figure 23:
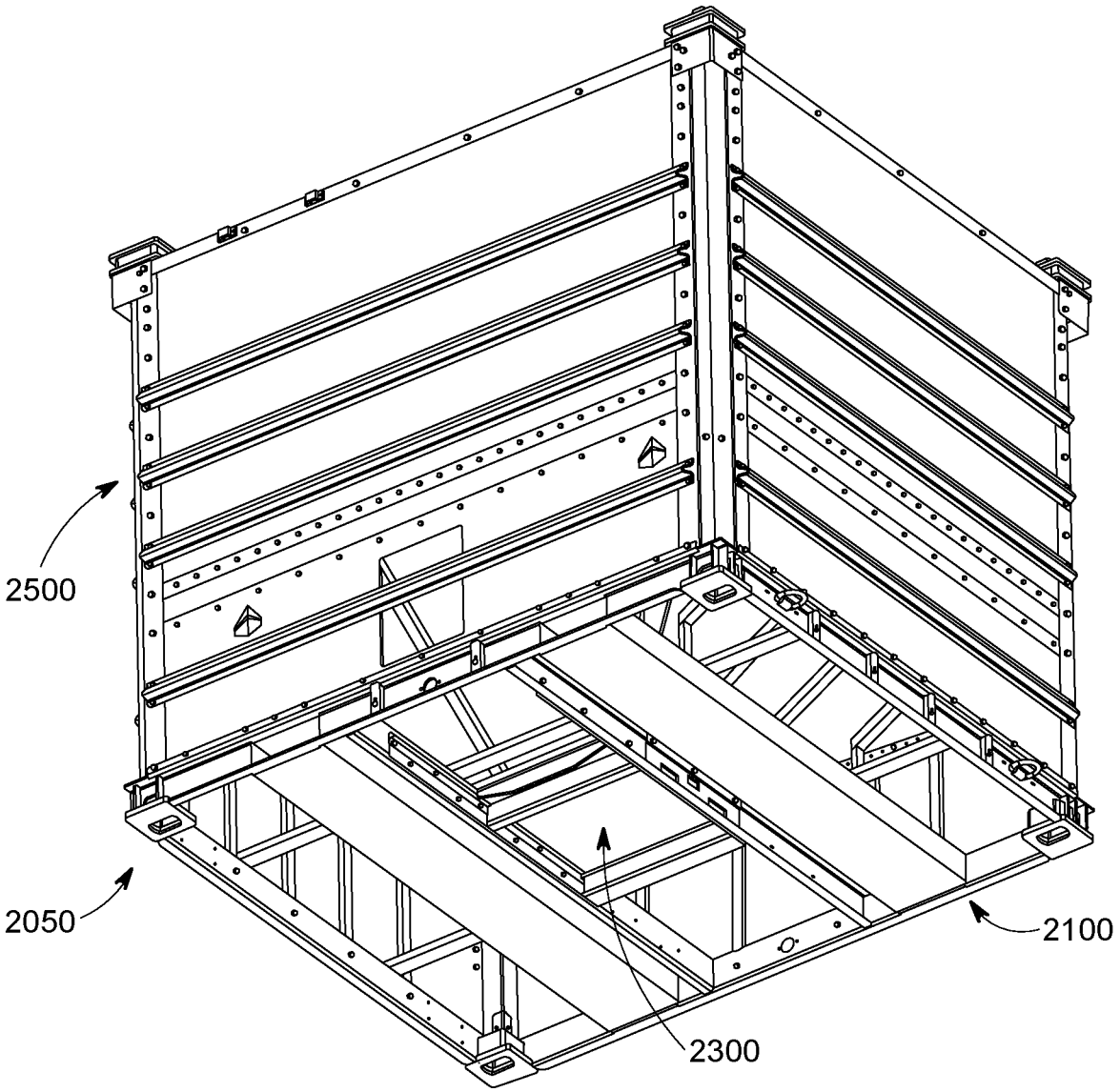
Figure 24:
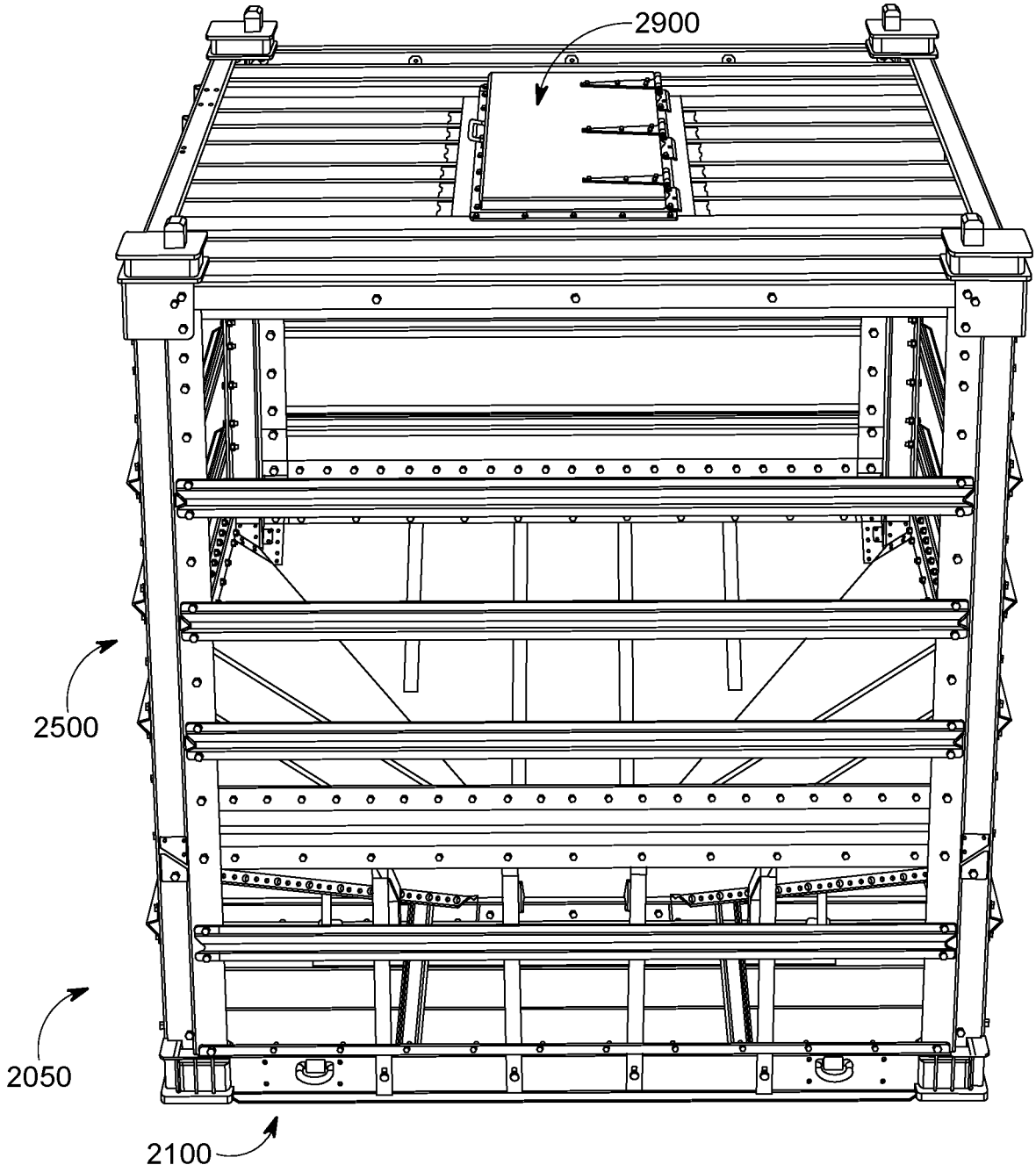
Figure 25:
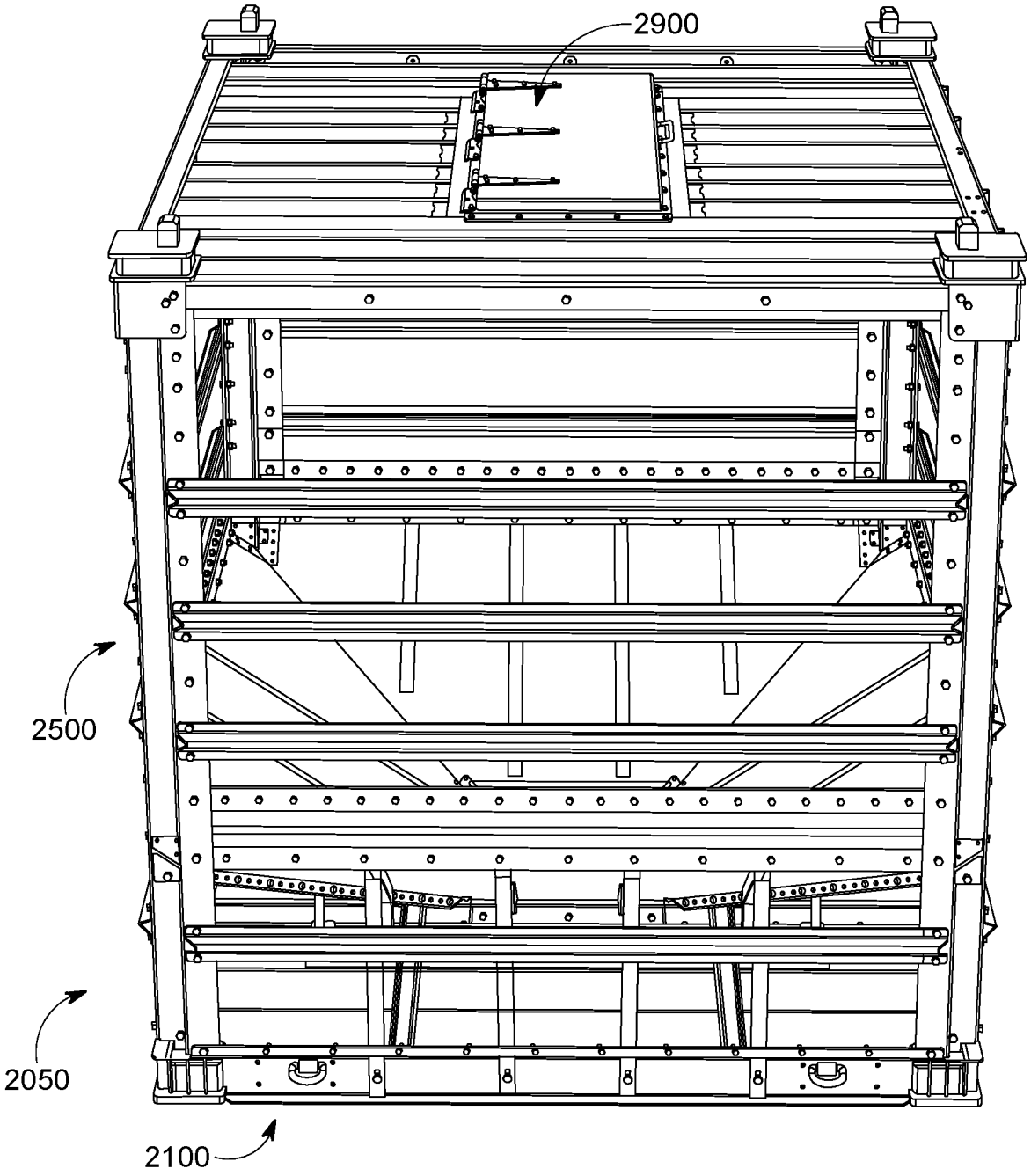

FIG. 25 is a right side top perspective view of the bulk material shipping container of FIG. 19, with part of the top wall assembly of the compartment removed and with the composite panels of the exterior walls removed.

Figure 26:
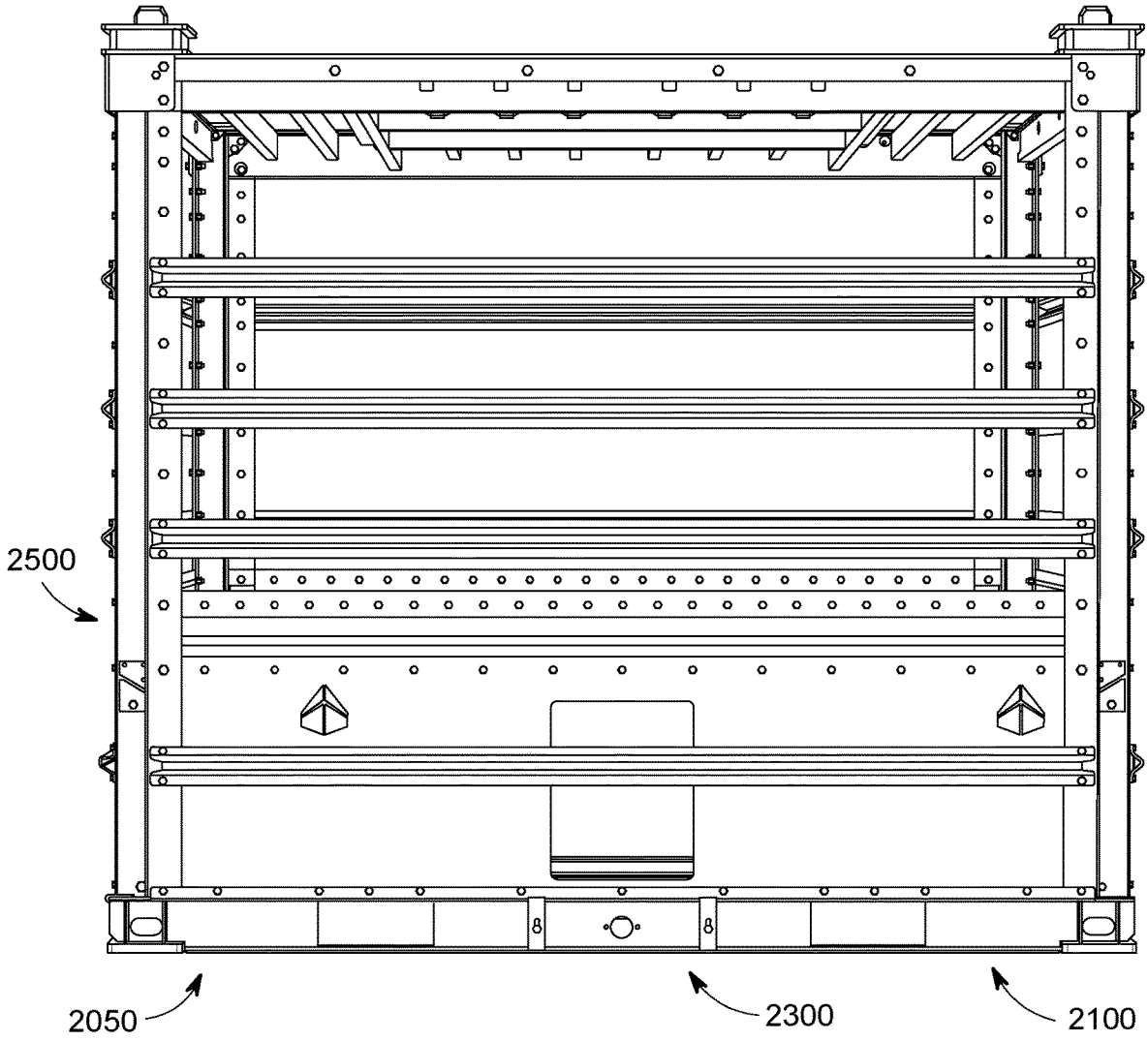

FIG. 26 is a front view of the bulk material shipping container of FIG. 19, with part of the top wall assembly of the compartment removed and with the composite panels of the exterior front, rear, and side wall assemblies removed.

Figure 27:
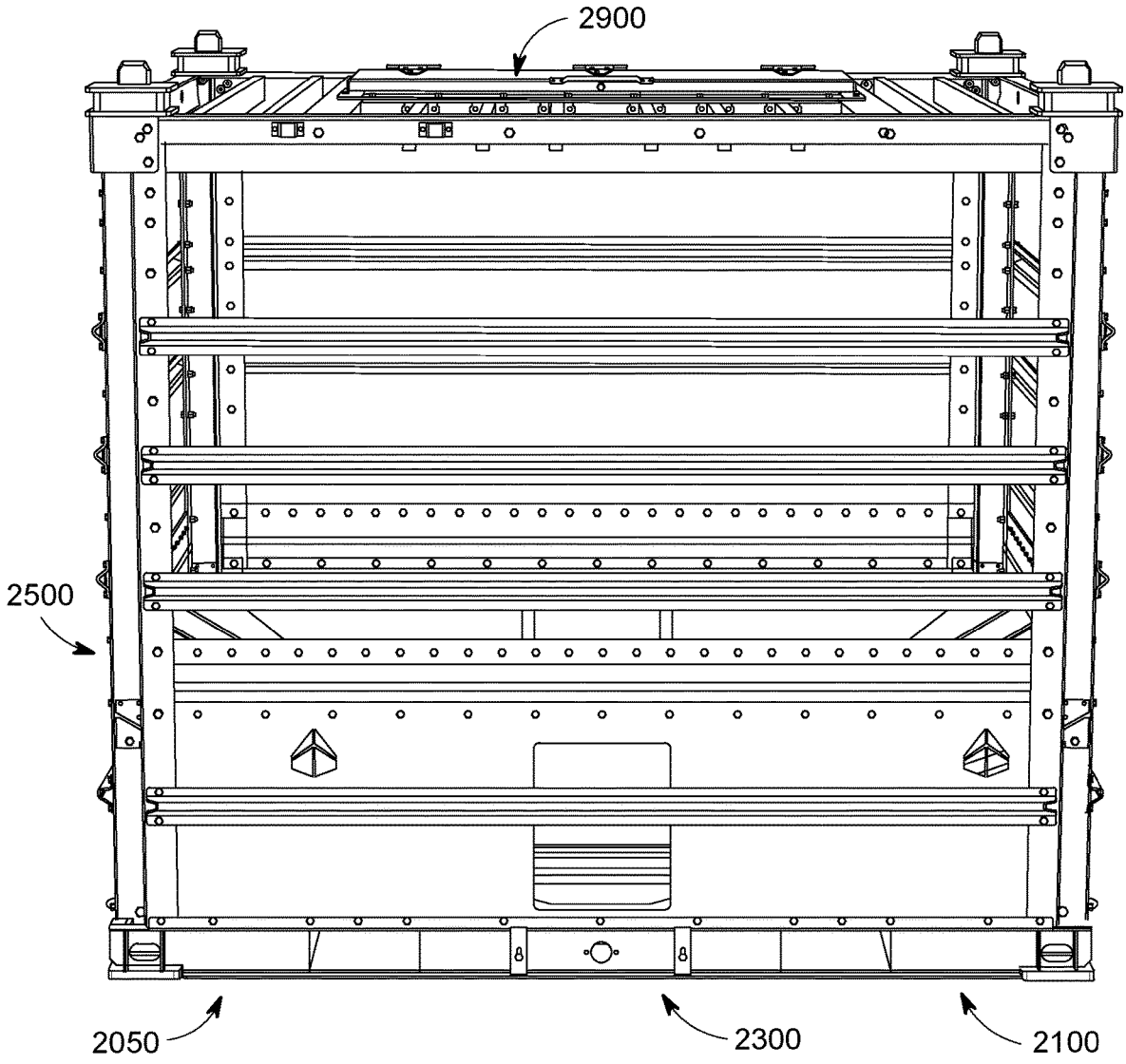

FIG. 27 is a front perspective view of the bulk material shipping container of FIG. 19, with part of the top wall assembly of the compartment removed and with the composite panels of the exterior front, rear, and side wall assemblies removed.

Figure 28:
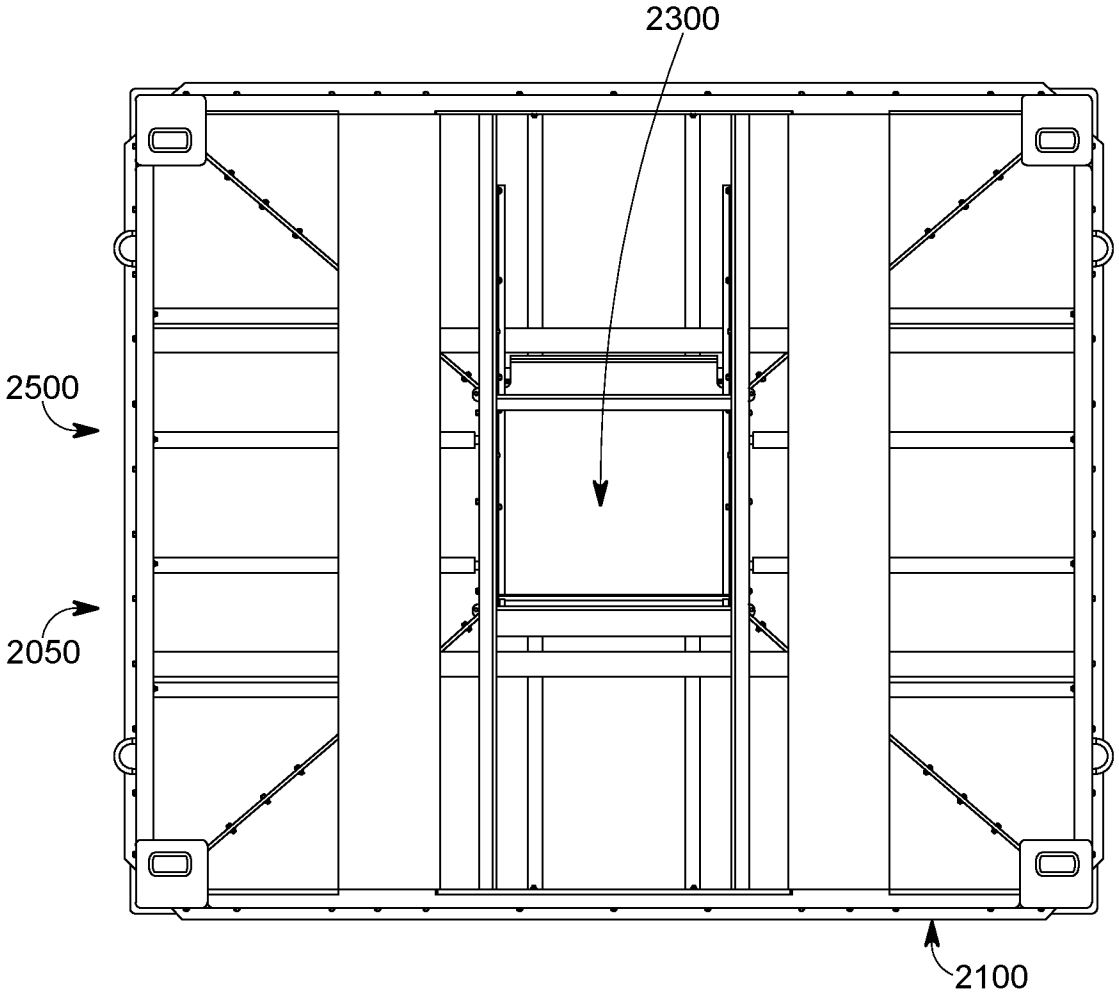

FIG. 28 is a bottom view of the bulk material shipping container of FIG. 19.

Figure 29A:
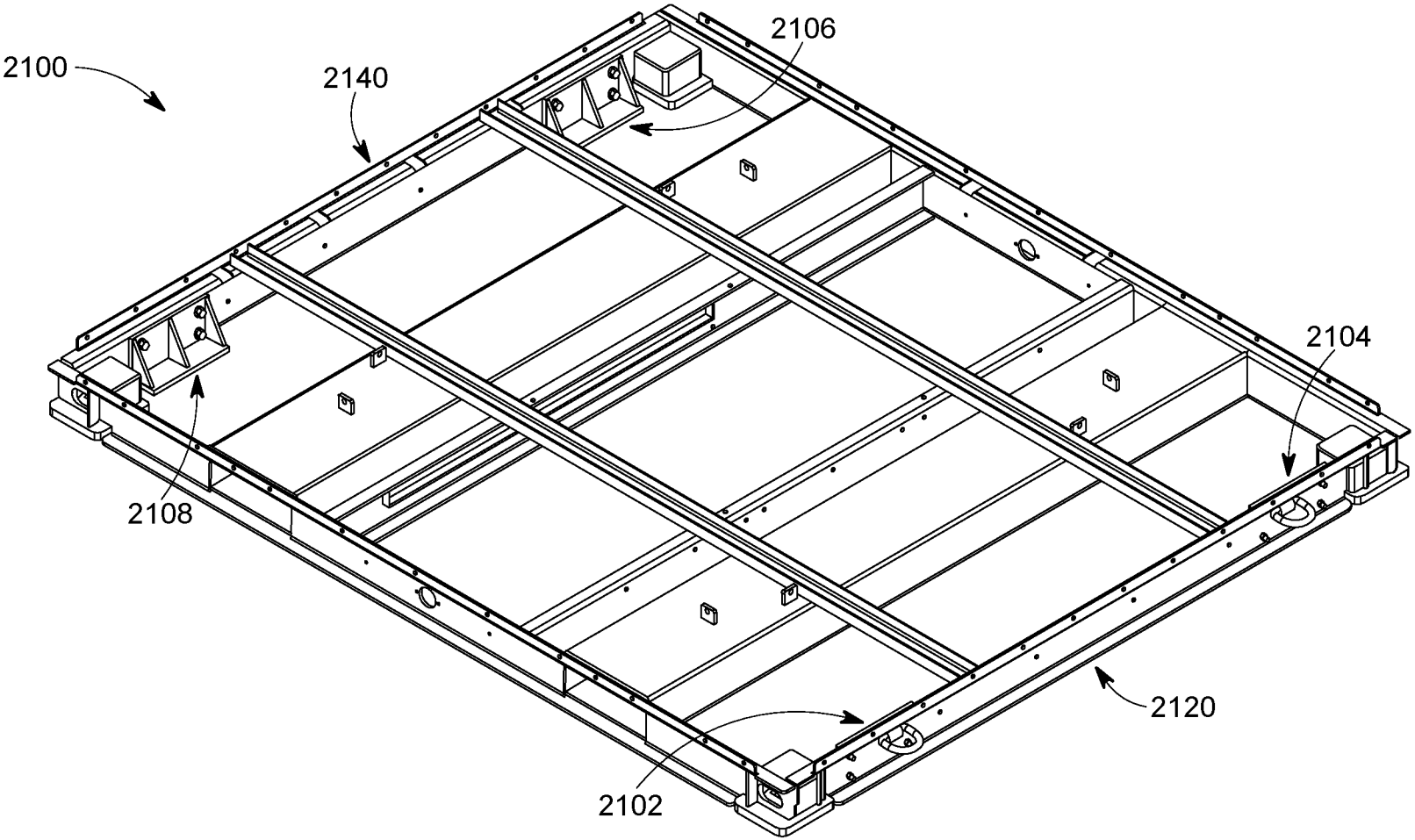

FIG. 29A is a top perspective view of the pallet of the bulk material shipping container of FIG. 19, showing a first load cell engagement bracket, a second load cell engagement bracket, a third load cell engagement bracket, and a fourth load cell engagement bracket each connected to and extending downwardly from the pallet of the bulk material shipping container.

Figure 29B:
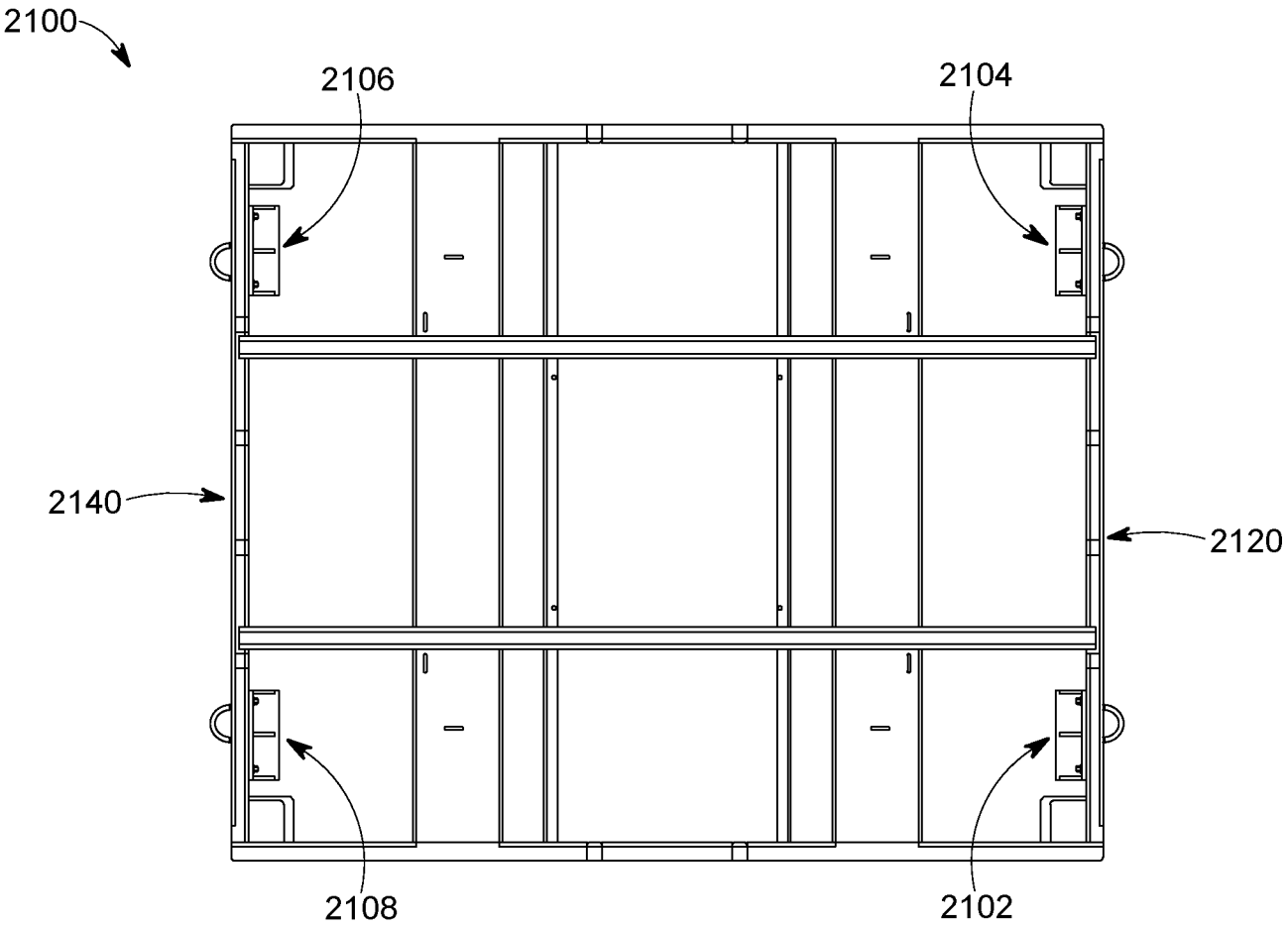

FIG. 29B is a top view of the pallet of the bulk material shipping container of FIG. 19, showing the first load cell engagement bracket, the second load cell engagement bracket, the third load cell engagement bracket, and the fourth load cell engagement bracket each connected to and extending downwardly from the pallet of the bulk material shipping container.

Figure 29C:
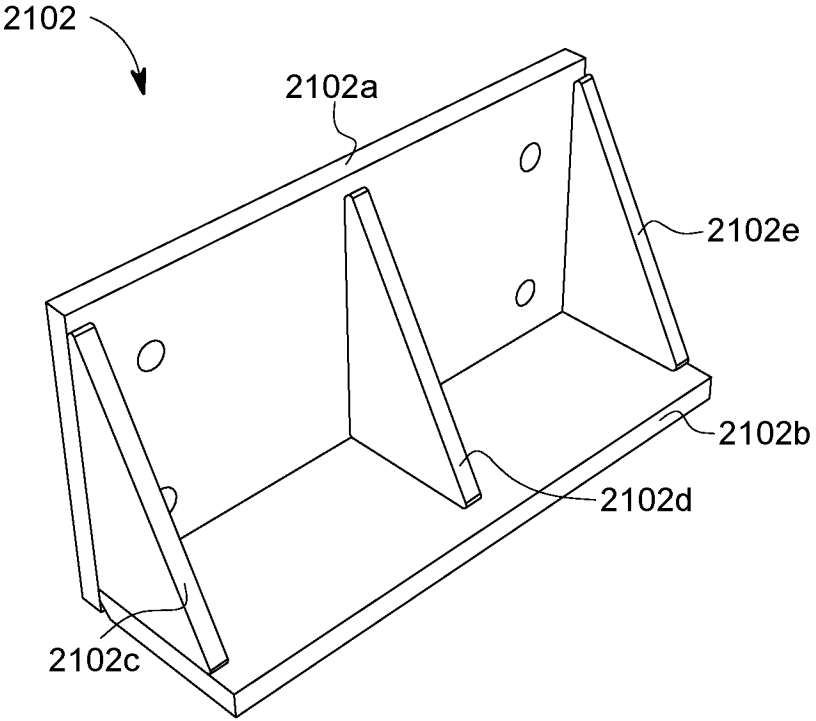

FIG. 29C is an enlarged perspective view of one of the load cell engagement brackets of the pallet of the bulk material shipping container of FIG. 19.

Figure 30A:
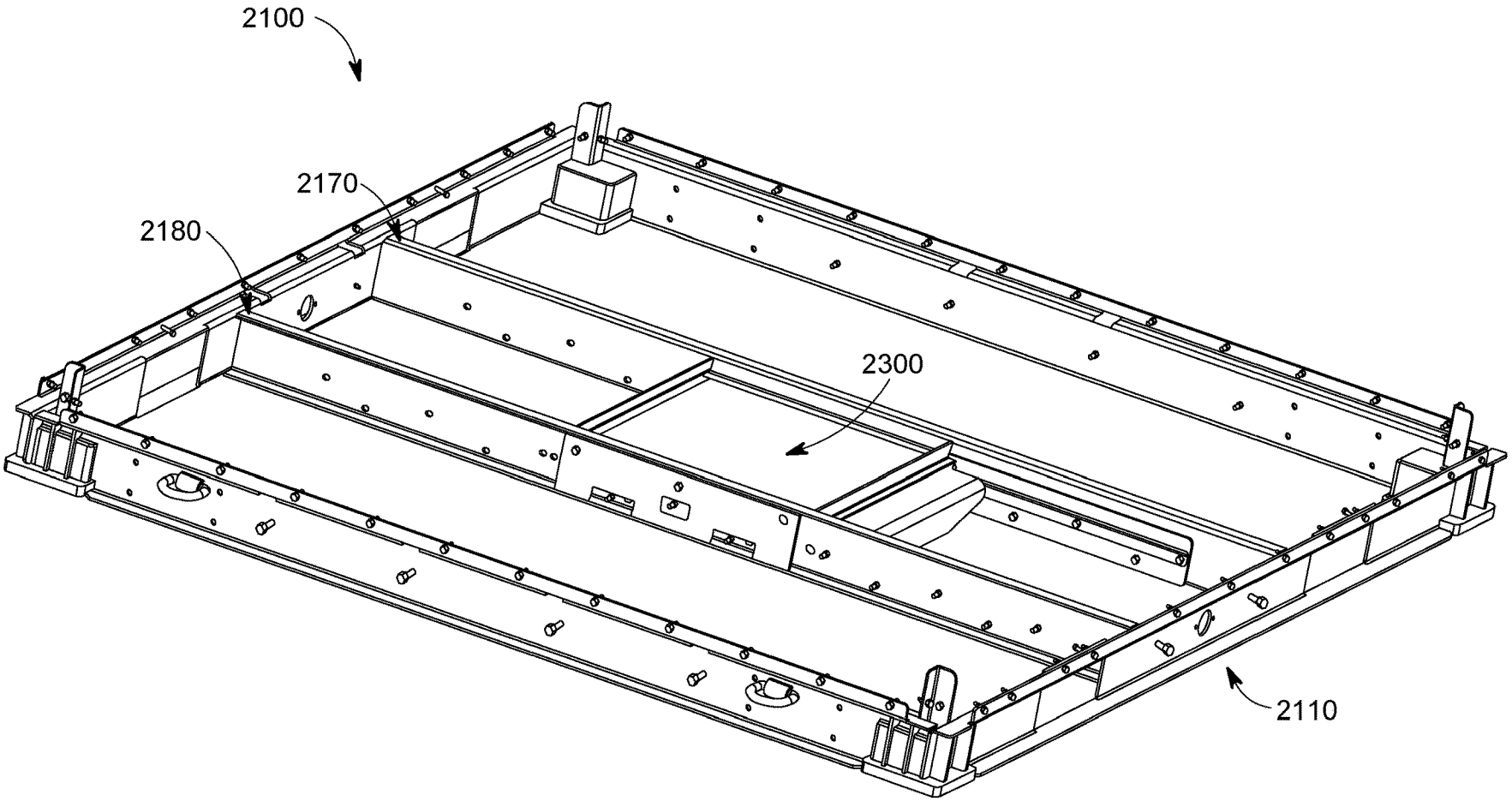

FIG. 30A is a right side perspective view of the material unloading assembly of the bulk material shipping container of FIG. 19 shown connected to the pallet of the bulk material shipping container of FIG. 19, showing the material unloading assembly in the closed position, and showing the first, second, third, and fourth load cell engagement brackets removed from the pallet.

Figure 30B:
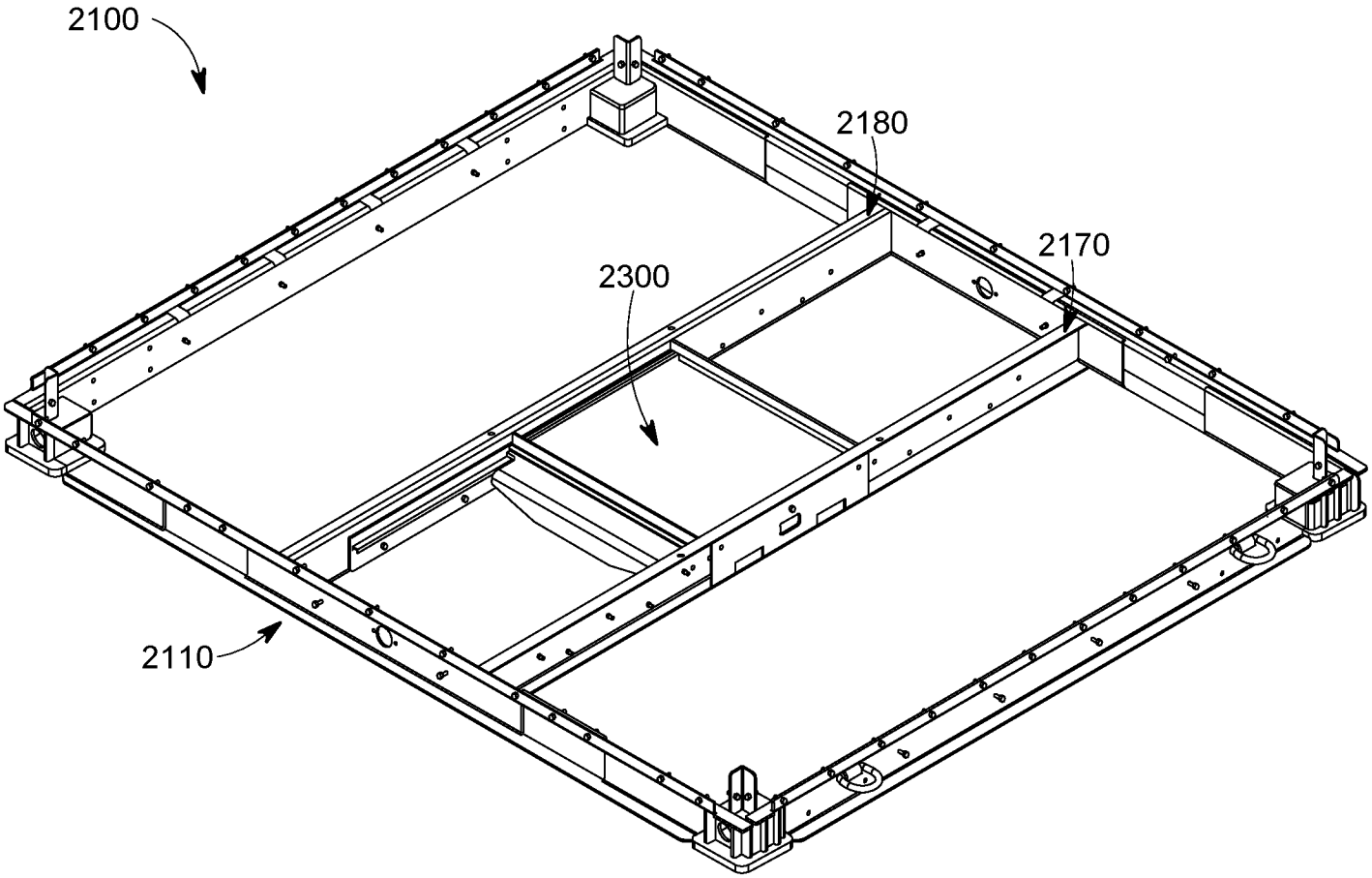

FIG. 30B is a top perspective view of the material unloading assembly connected to the pallet of the bulk material shipping container of FIG. 19, showing the material unloading assembly in the closed position, and showing the first, second, third, and fourth load cell engagement brackets removed from the pallet.

Figure 30C:
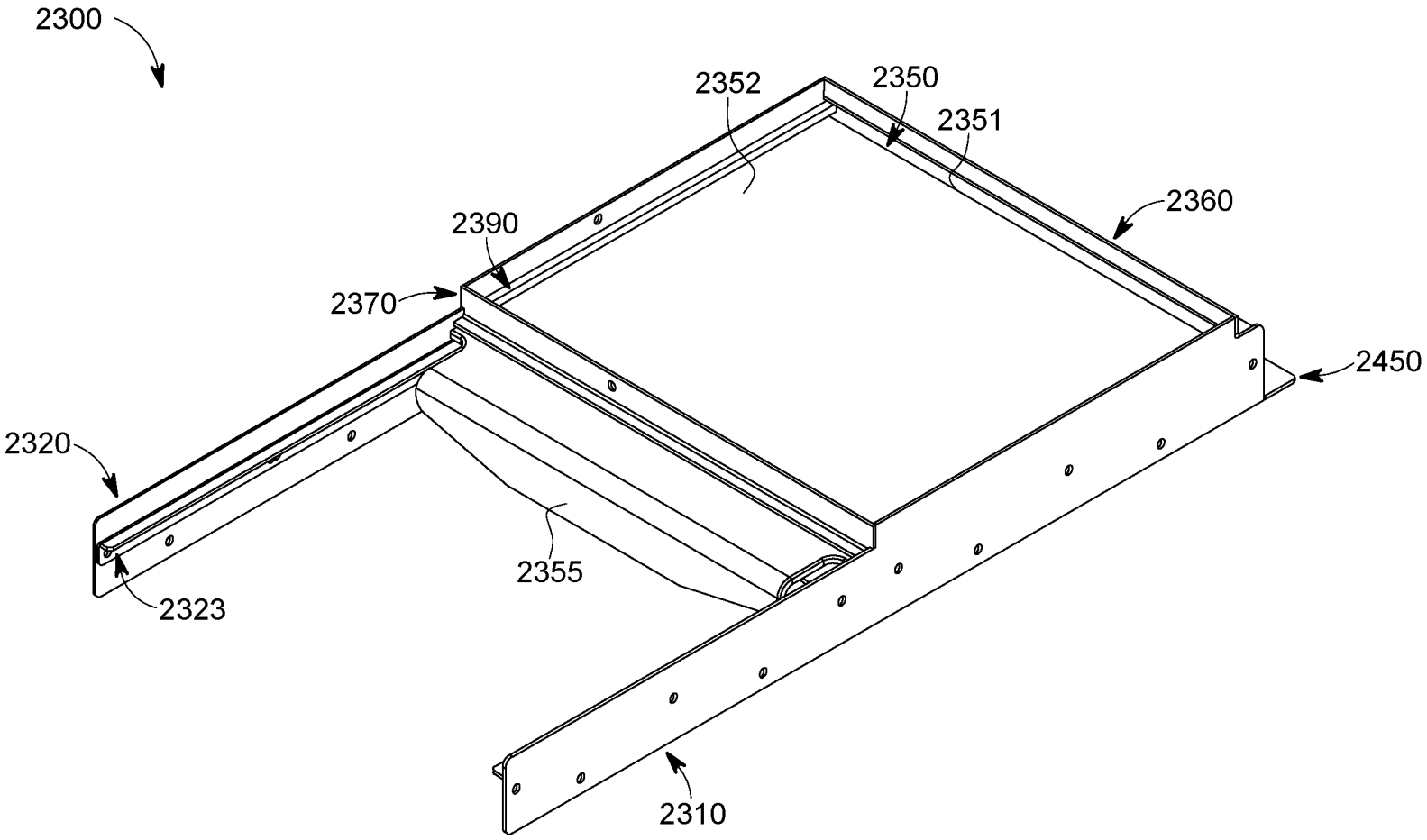

FIG. 30C is a top perspective view of the material unloading assembly shown removed from the rest of the pallet of the bulk material shipping container of FIG. 19, and showing the material unloading assembly in the closed position.

Figure 30D:
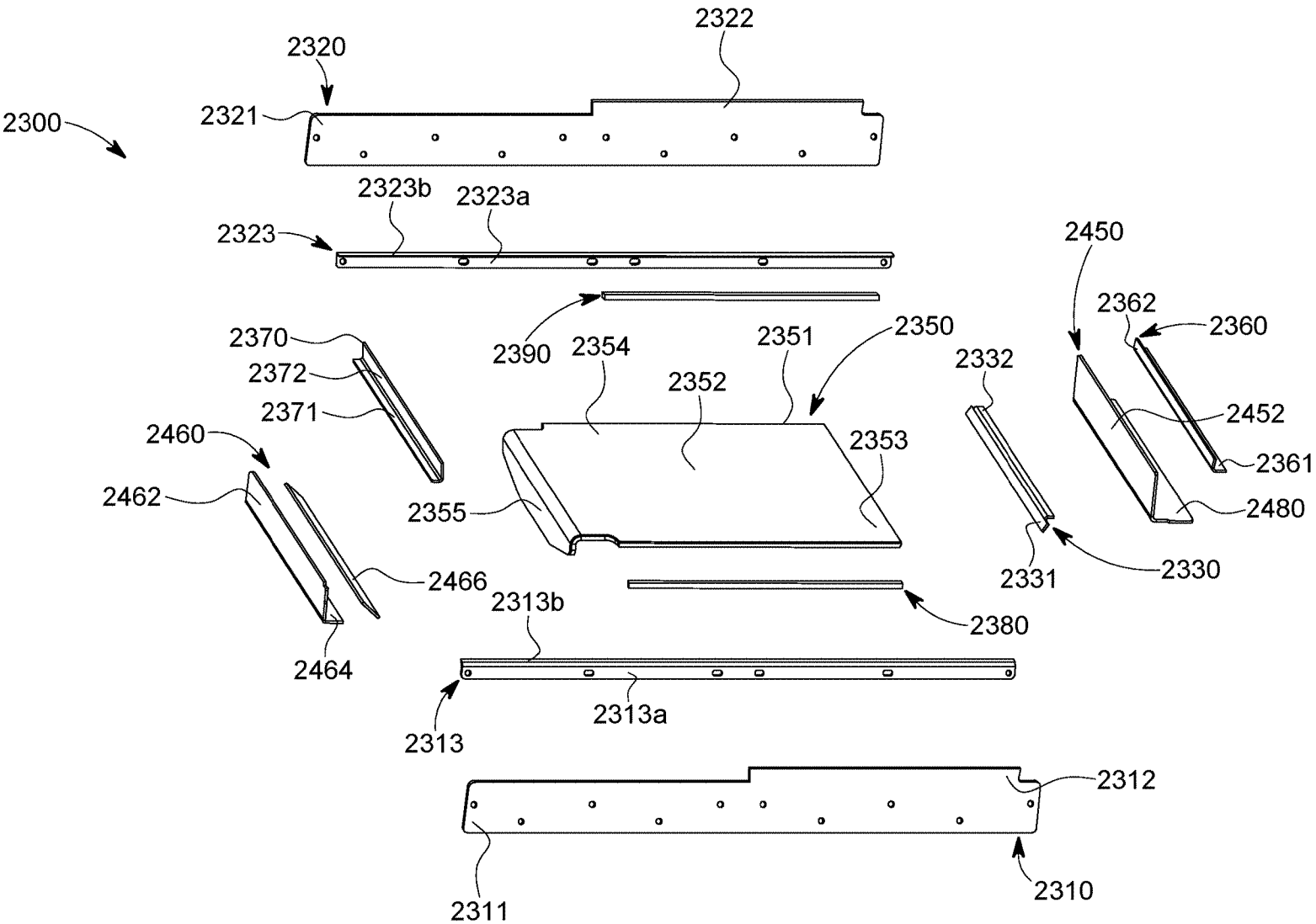

FIG. 30D is an enlarged exploded perspective view of the material unloading assembly of the bulk material shipping container of FIG. 19.

Figure 30E:
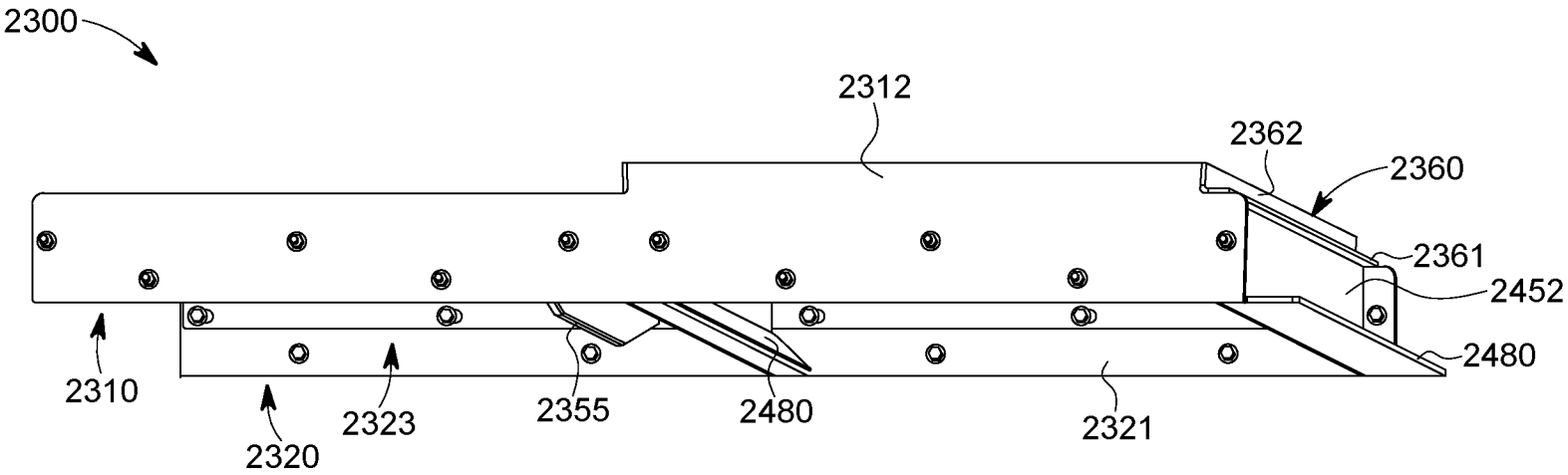

FIG. 30E is a bottom perspective view of the material unloading assembly shown removed from the rest of the pallet of the bulk material shipping container of FIG. 19, and showing the material unloading assembly in the closed position.

Figure 30F:
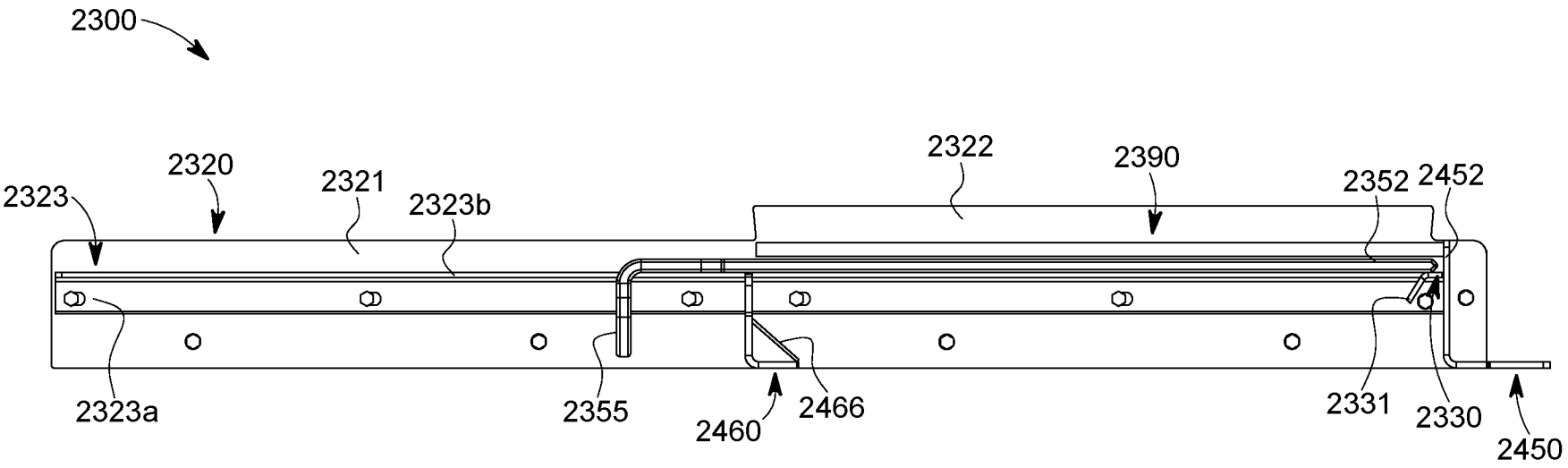

FIG. 30F is a left side cross-sectional view of the material unloading assembly shown removed from the rest of the pallet of the bulk material shipping container of FIG. 19.

Figure 30G:
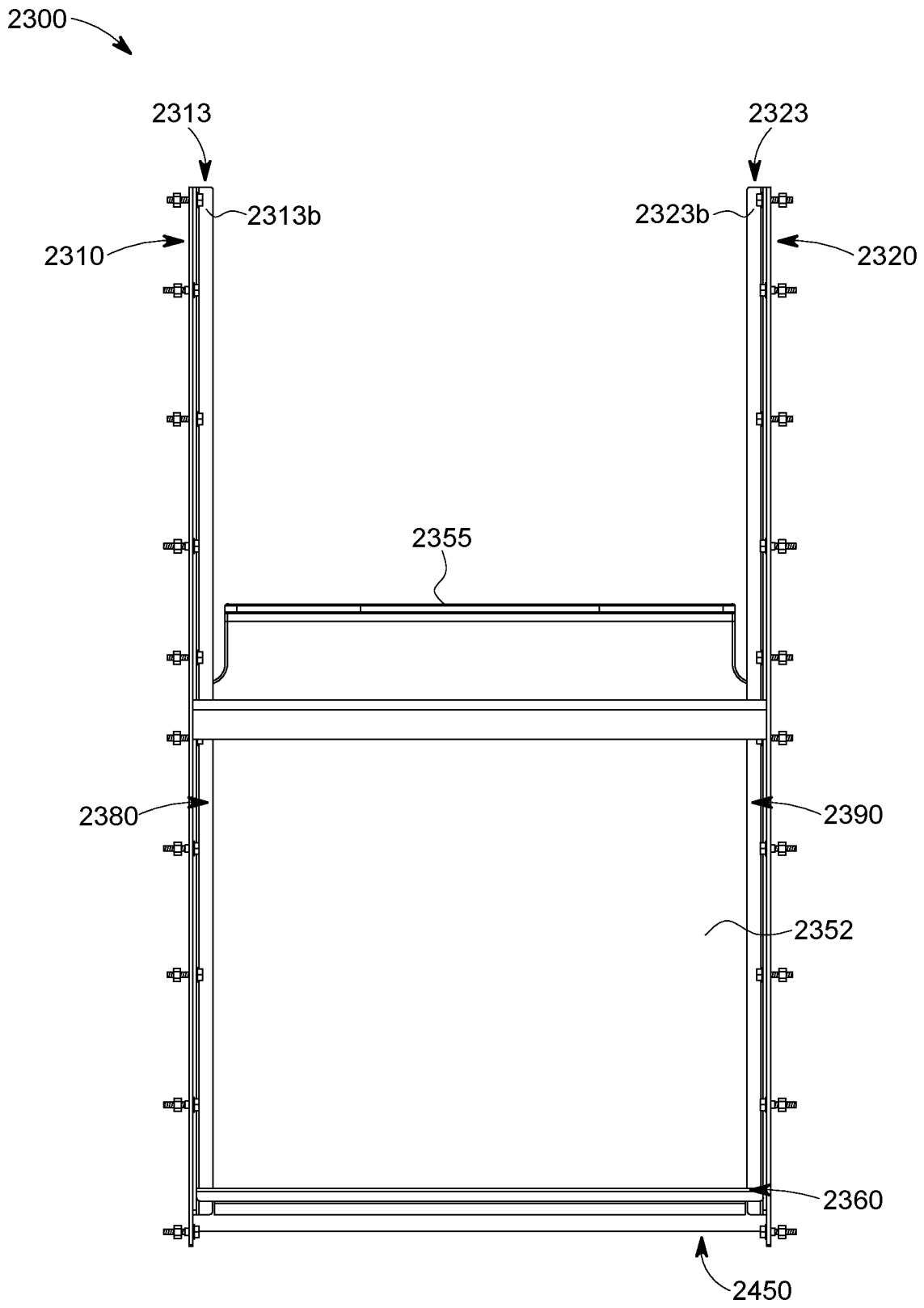

FIG. 30G is a top view of the material unloading assembly shown removed from the pallet of the bulk material shipping container of FIG. 19, and showing the material unloading assembly in the closed position.

Figure 31A:
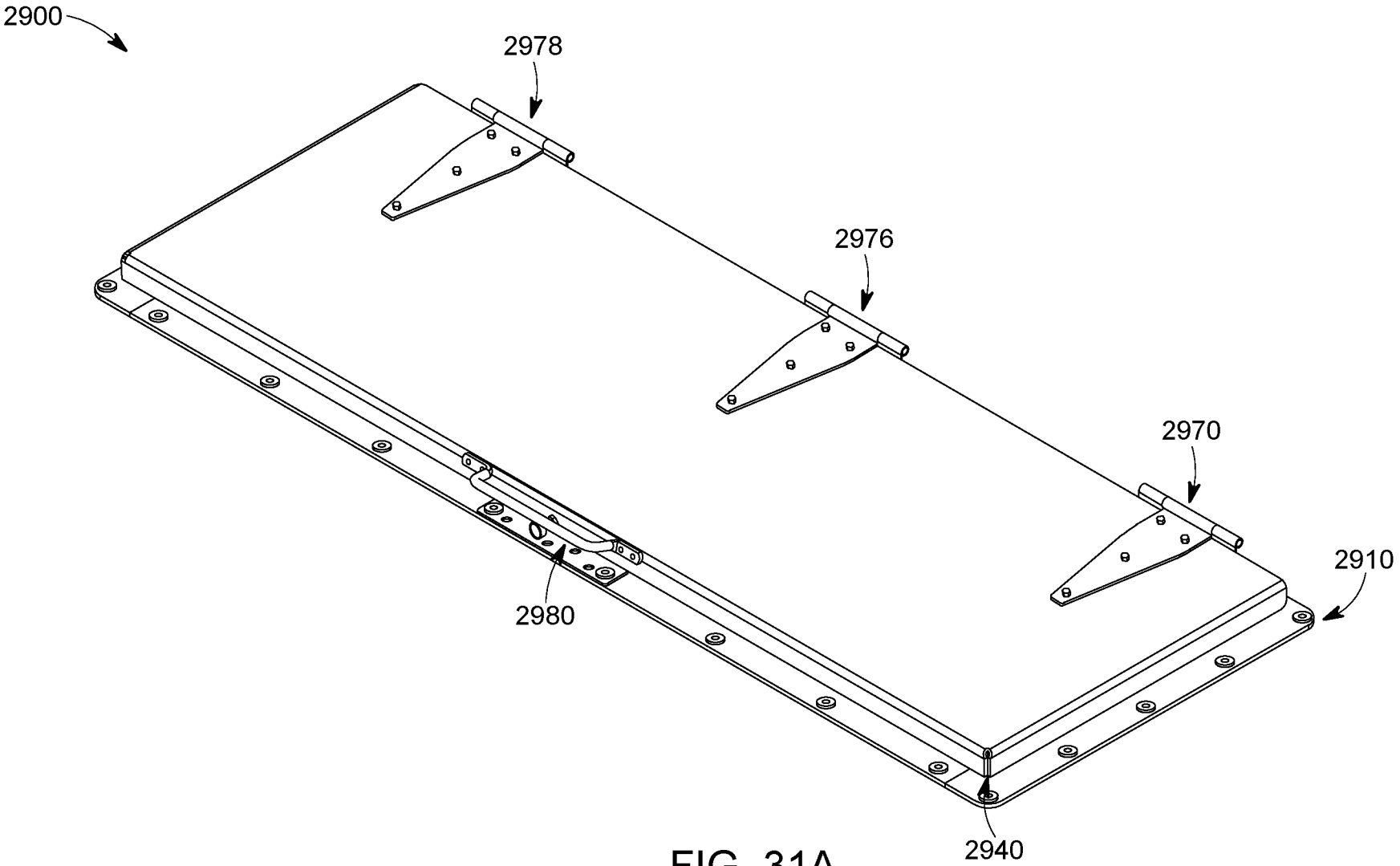

FIG. 31A is a top perspective view of the material loading assembly of the bulk material shipping container of FIG. 19, shown removed from the rest of the container.

Figure 31B:
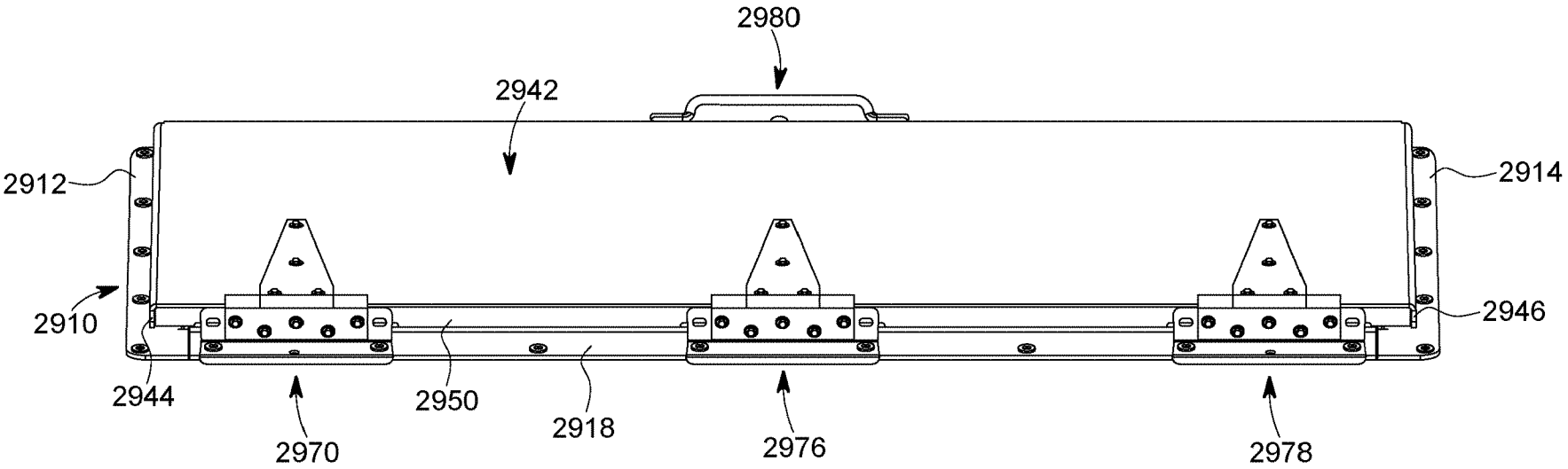

FIG. 31B is a top rear perspective view of the material loading assembly of the bulk material shipping container of FIG. 19, shown removed from the rest of the container.

Figure 31C:
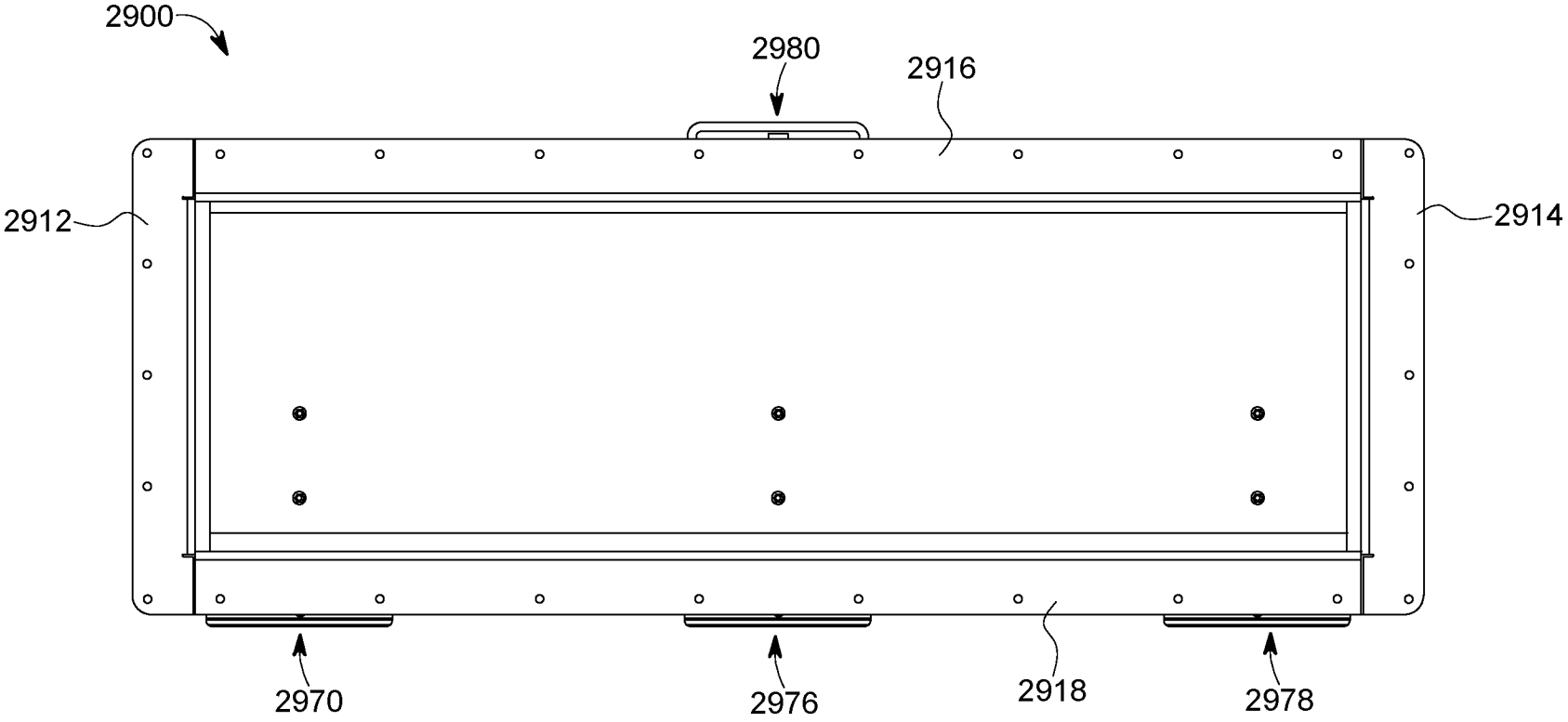

FIG. 31C is a bottom view of the material loading assembly of the bulk material shipping container of FIG. 19, shown removed from the rest of the container.

Figure 31D:
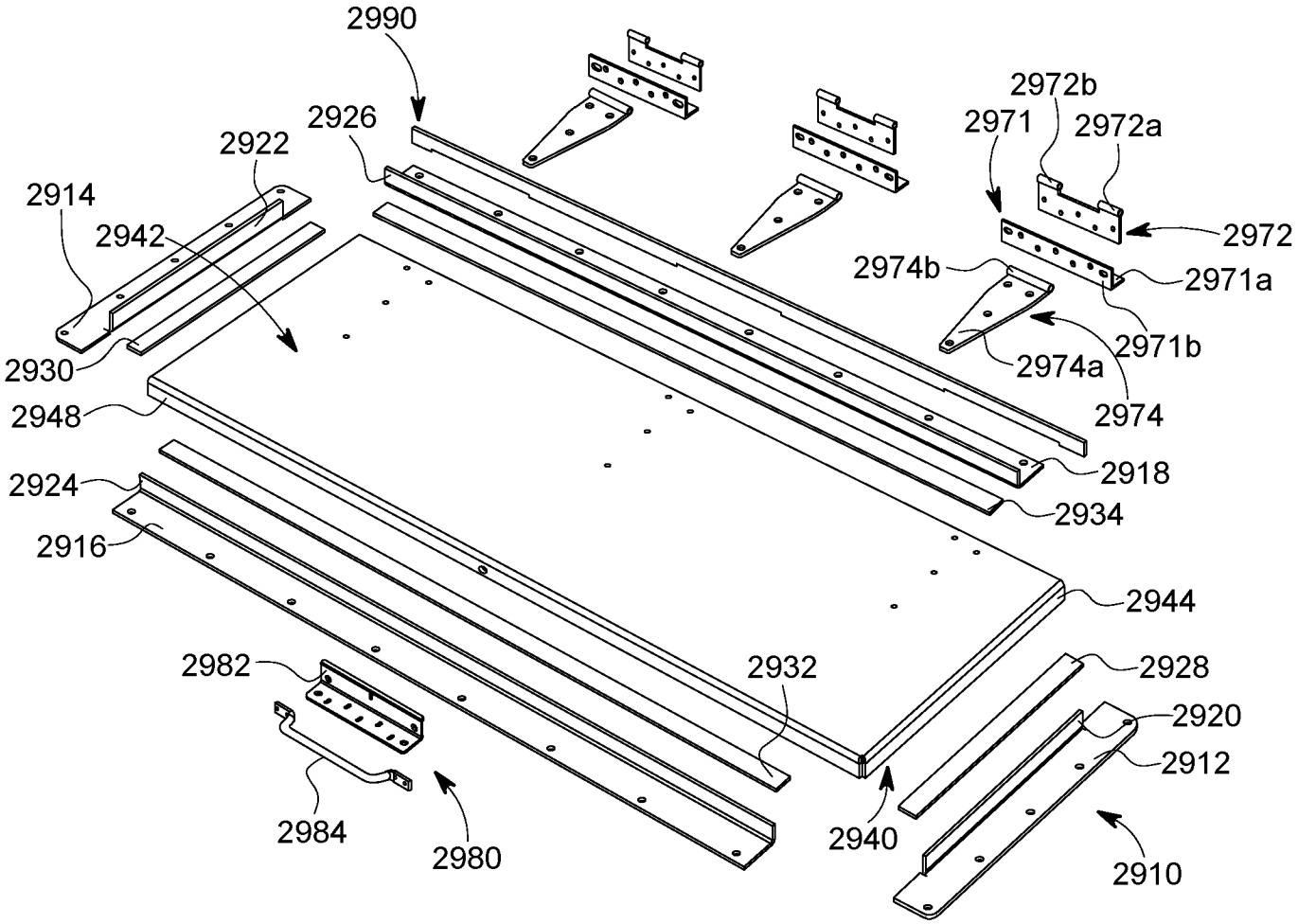

FIG. 31D is an exploded perspective view of the material loading assembly of the bulk material shipping container of FIG. 19.

Figure 31E:
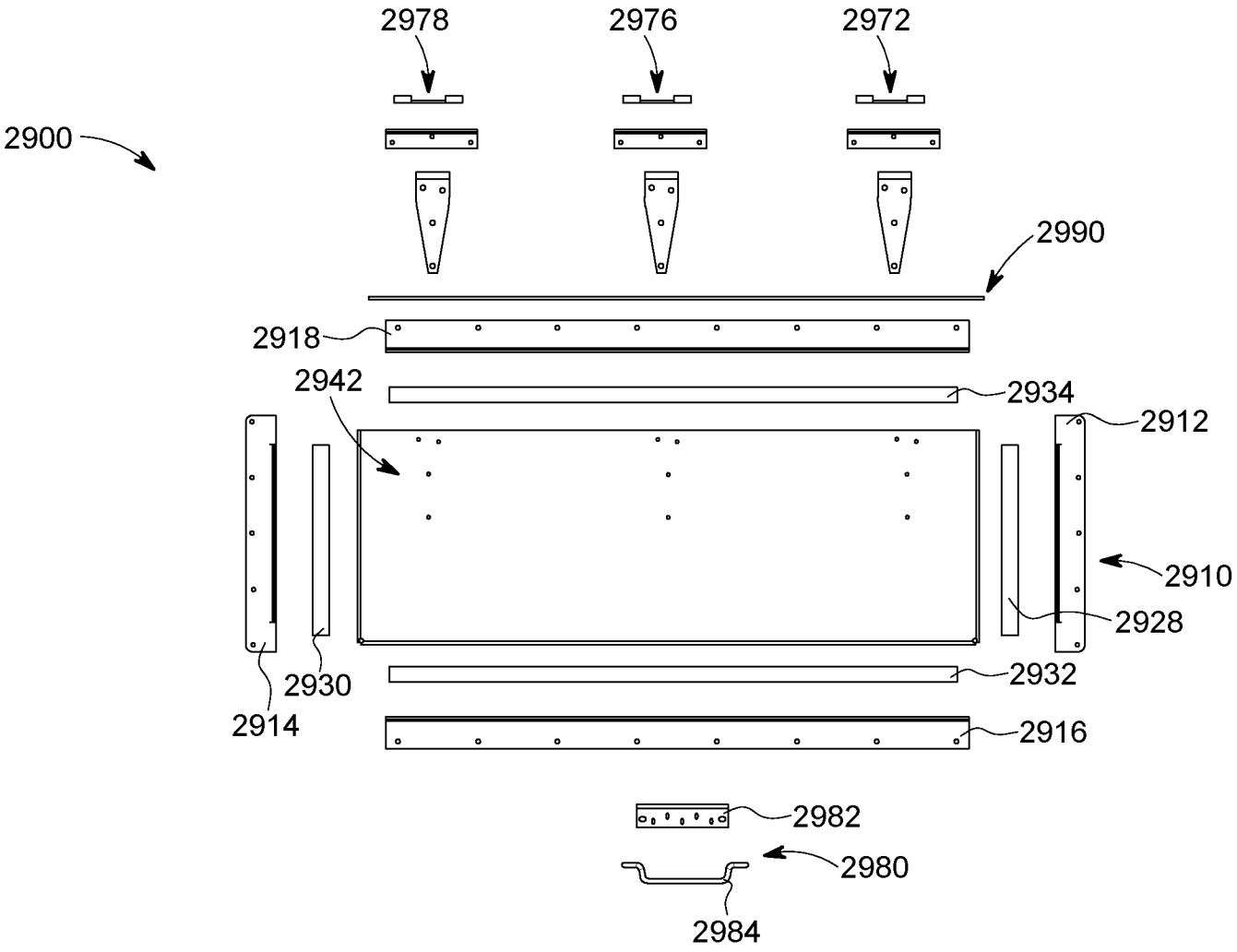

FIG. 31E is a top exploded view of the material loading assembly of the bulk material shipping container of FIG. 19.

DETAILED DESCRIPTION OF EXEMPLARY EMBODIMENTS

Referring now to the drawings, FIGS. 1 to 14T illustrate one example embodiment of the bulk material shipping container of the present disclosure. This example bulk material shipping container, which is generally indicated by numeral 50, is configured to receive, hold, and release materials of substantial weight and volume.

Generally, as shown in FIGS. 1 to 10, this illustrated example embodiment of the shipping container 50 of the present disclosure includes: (a) a pallet 100 (shown in FIGS. 1 to 10 and 11A to 11O); (b) a compartment 500 (shown in FIGS. 1 to 10, 11L to 11O, and 13A to 13BBB) connected to and supported by the pallet 100; (c) a material unloading assembly 300 (shown in FIGS. 1 to 10, 11L to 11O, and 12A to 12P) positioned under a bottom portion of the compartment 500 and connected to and supported by the pallet 100; and (d) a material loading assembly 900 (shown in FIGS. 1 to 10, and 14A to 14T) connected to and supported by the top wall assembly 850 of the compartment 500. The pallet 100 is configured to facilitate movement of the container 50 and to facilitate stacking of multiple containers 50. The material unloading assembly 300 is connected to the pallet 100 and configured to facilitate the release or unloading of materials from the compartment 500 of the container 50. The compartment 500 is connected to and supported by the pallet 100 and configured to receive, hold, and release materials. The material loading assembly 900 is connected to and supported by the top wall assembly 850 of the compartment 500 and configured to facilitate the loading of material into the compartment 500 and to prevent contaminants from entering the compartment 500. It should be appreciated that the container 50 generally includes a front side, a rear or back side opposite the front side, a right side, a left side opposite the right side, a bottom side, and a top side.

As further explained below, the shipping container of the present disclosure provides an improved bulk material shipping container for loose materials that is stronger than various known containers, more durable than various known containers, lighter than various known containers having similar weight capacities, easier to repair than various known containers, easier to reconstruct than various known containers, configured to hold greater volumes of materials than various known containers, configured to hold greater weights of materials than various known containers, and configured to have a better weight to holding cargo capacity than various known containers.

The Illustrated Example Pallet

Figure 11A:
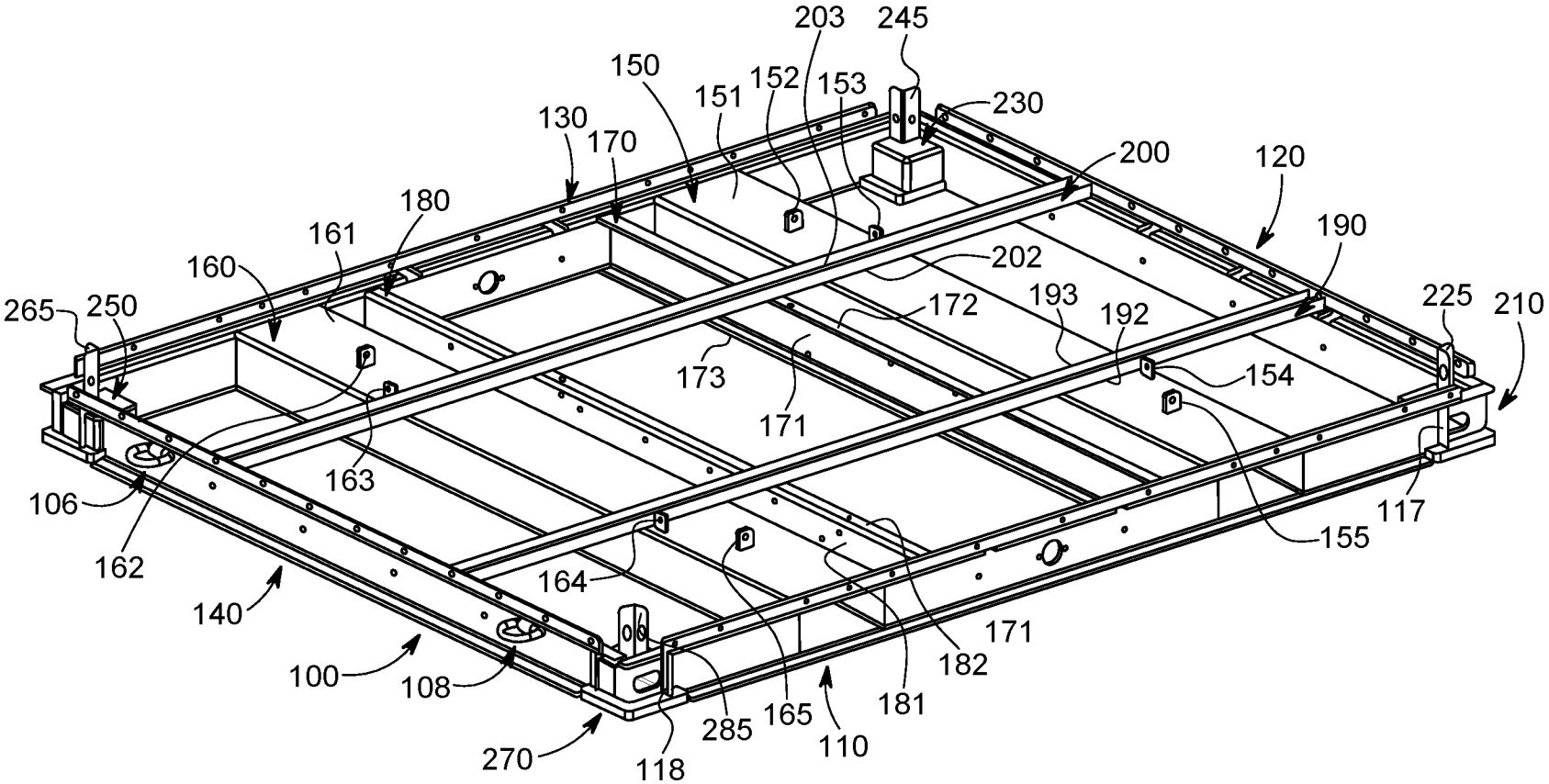
FIG. 11A is an enlarged top perspective view of the pallet of the bulk material shipping container of FIG. 1, shown removed from the container.
Figure 11B:
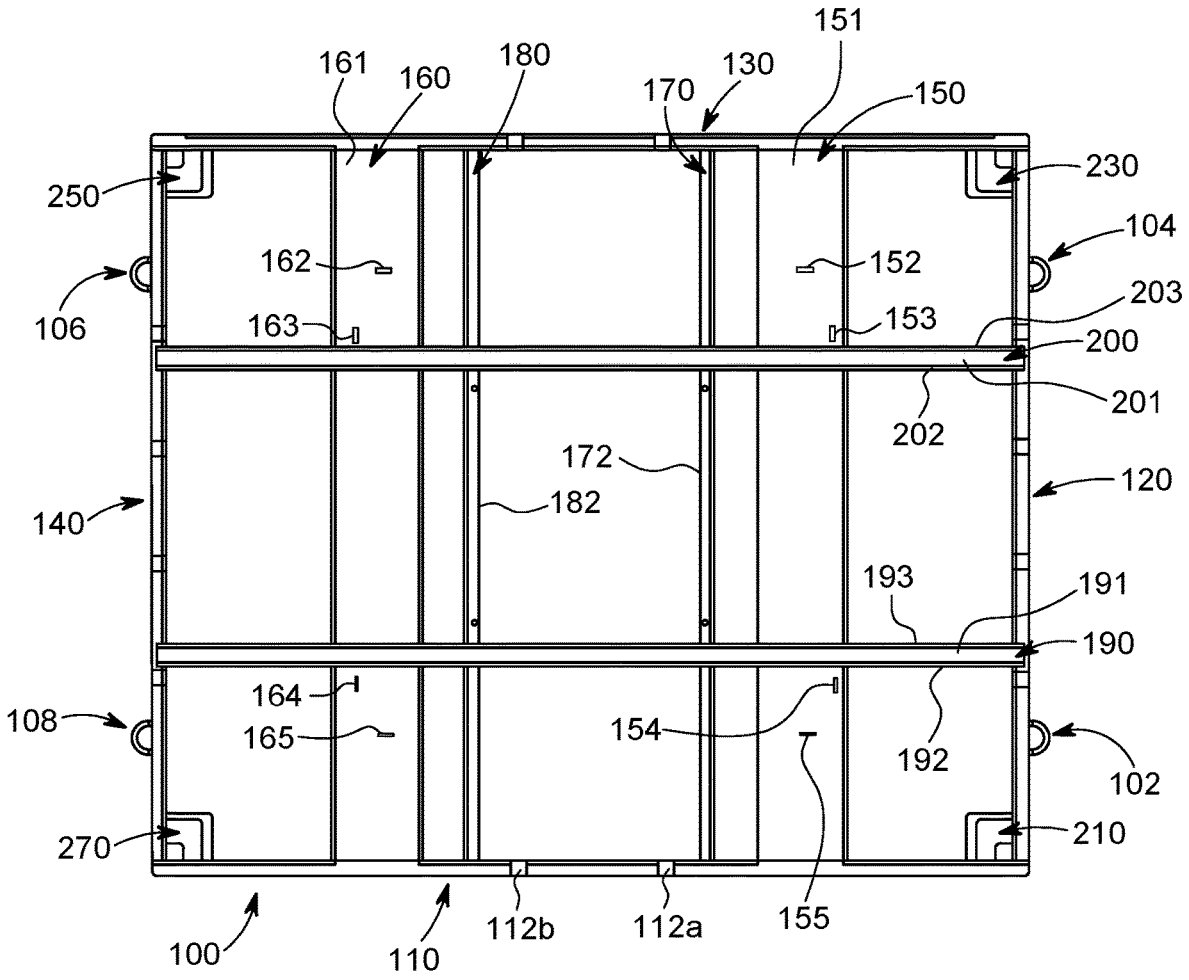
FIG. 11B is an enlarged top view of the pallet of the bulk material shipping container of FIG. 1, shown removed from the container.
Figure 11C:
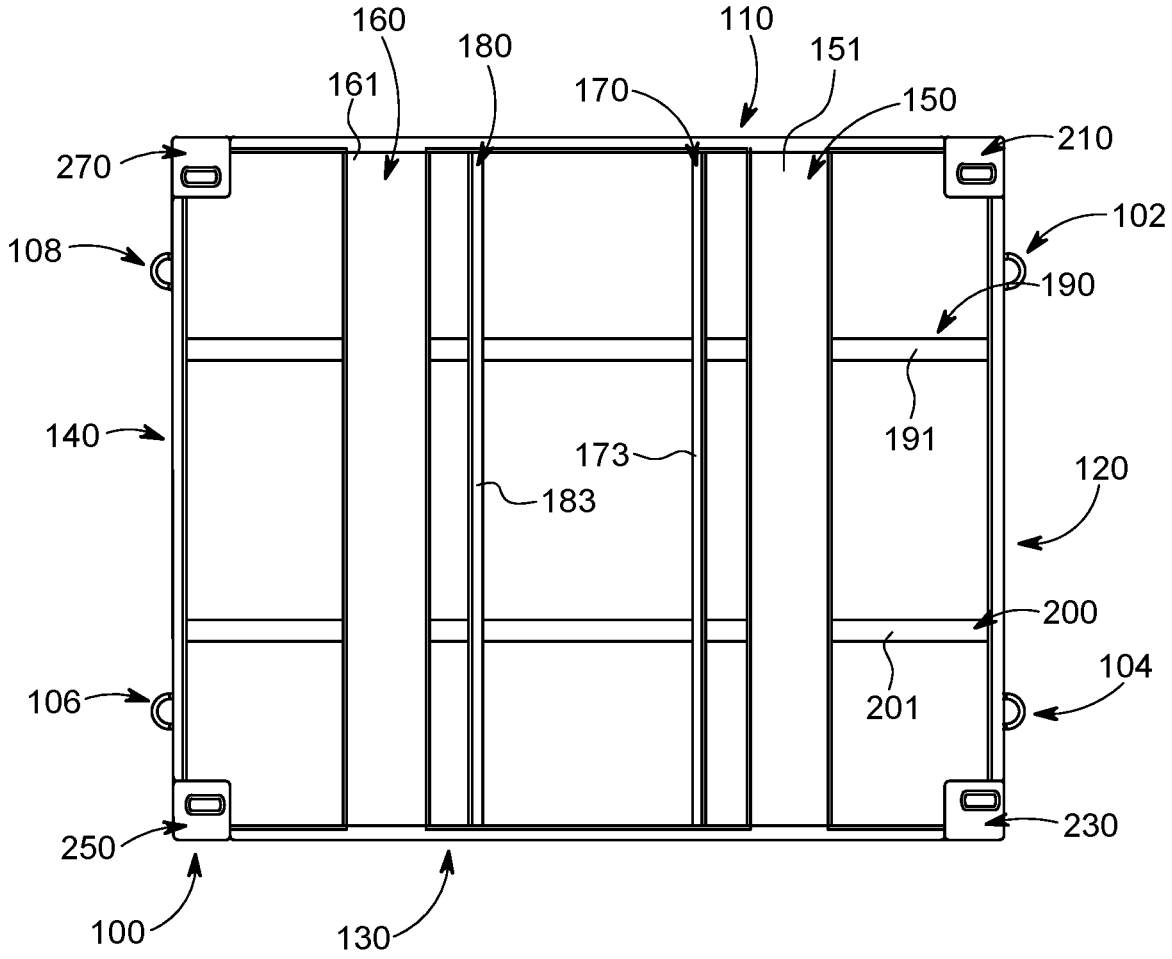
FIG. 11C is an enlarged bottom view of the pallet of the bulk material shipping container of FIG. 1, shown removed from the container.
Figure 11D:
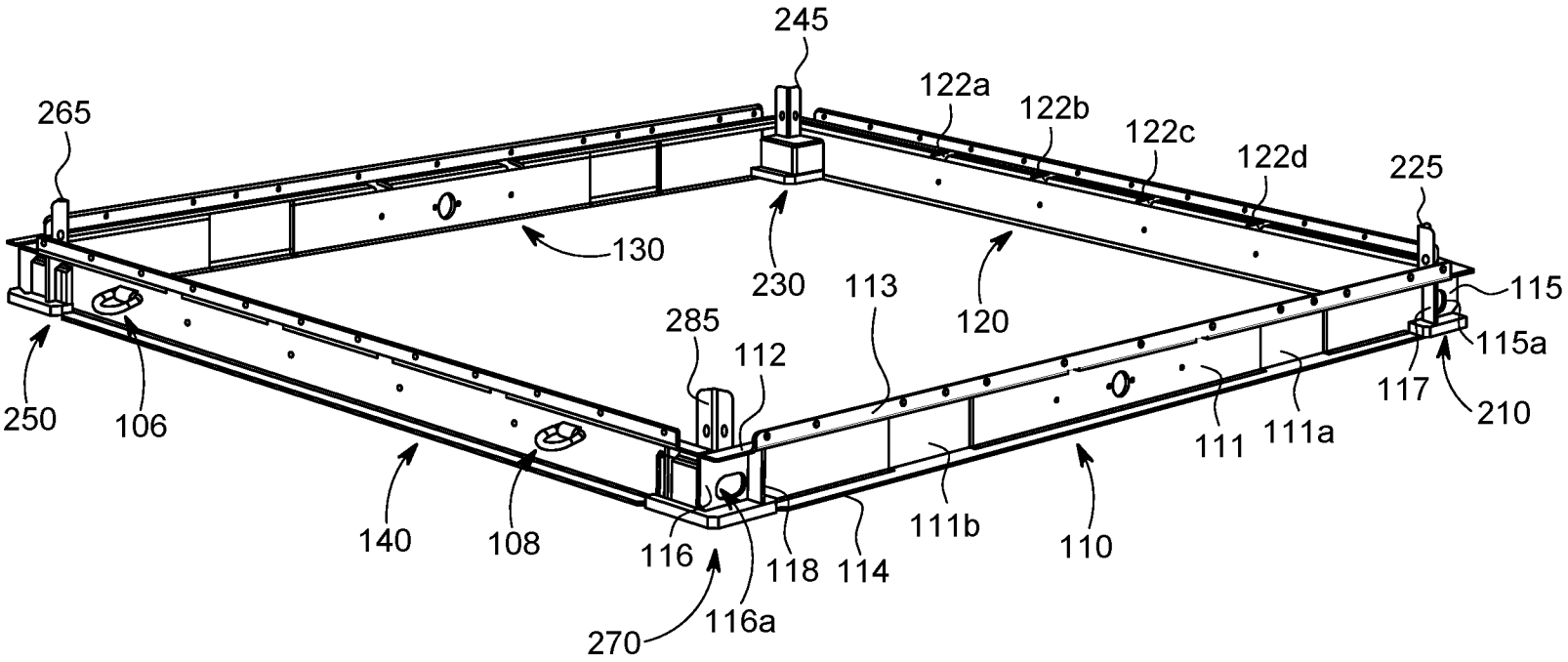
FIG. 11D is an enlarged perspective view of the front support, rear support, right side support, and left side support of the pallet of the bulk material shipping container of FIG. 1, shown removed from the container.
Figure 11E:
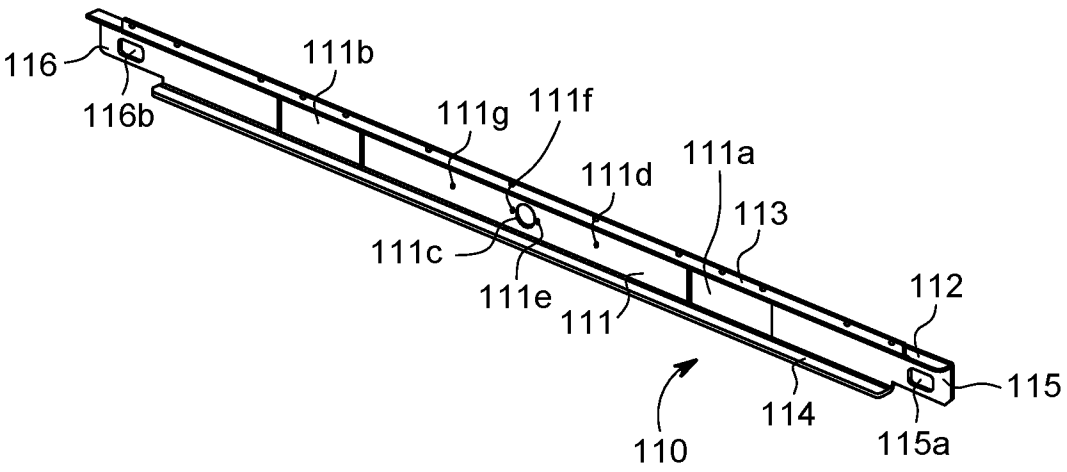
FIG. 11E is an enlarged perspective view of the front (or rear) support of the pallet of the bulk material shipping container of FIG. 1, shown removed from the rest of the pallet.
Figure 11F:
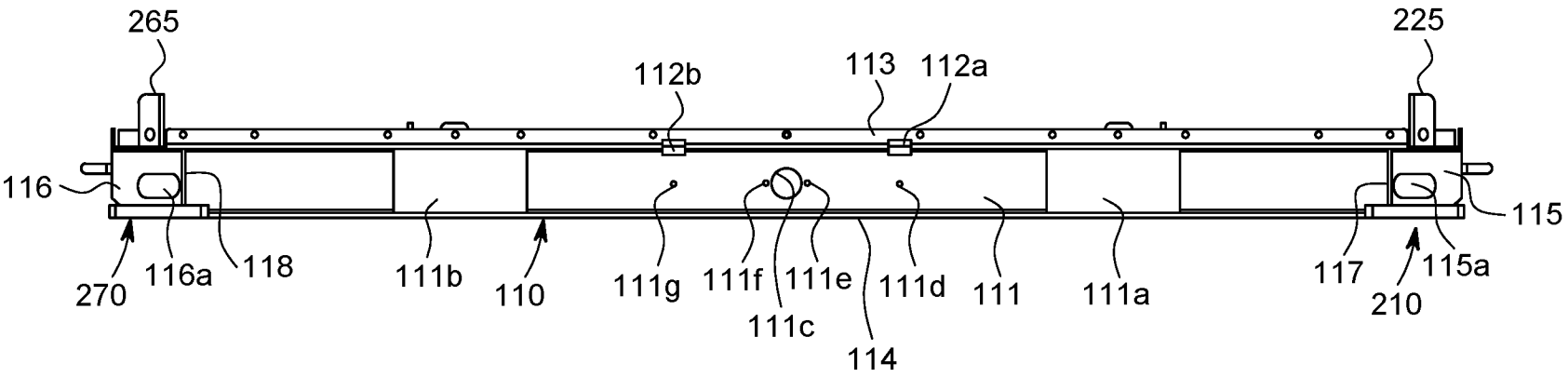
FIG. 11F is an enlarged front view of the front (or rear) support of the pallet of the bulk material shipping container of FIG. 1, shown connected to the rest of the pallet.
Figure 11G:
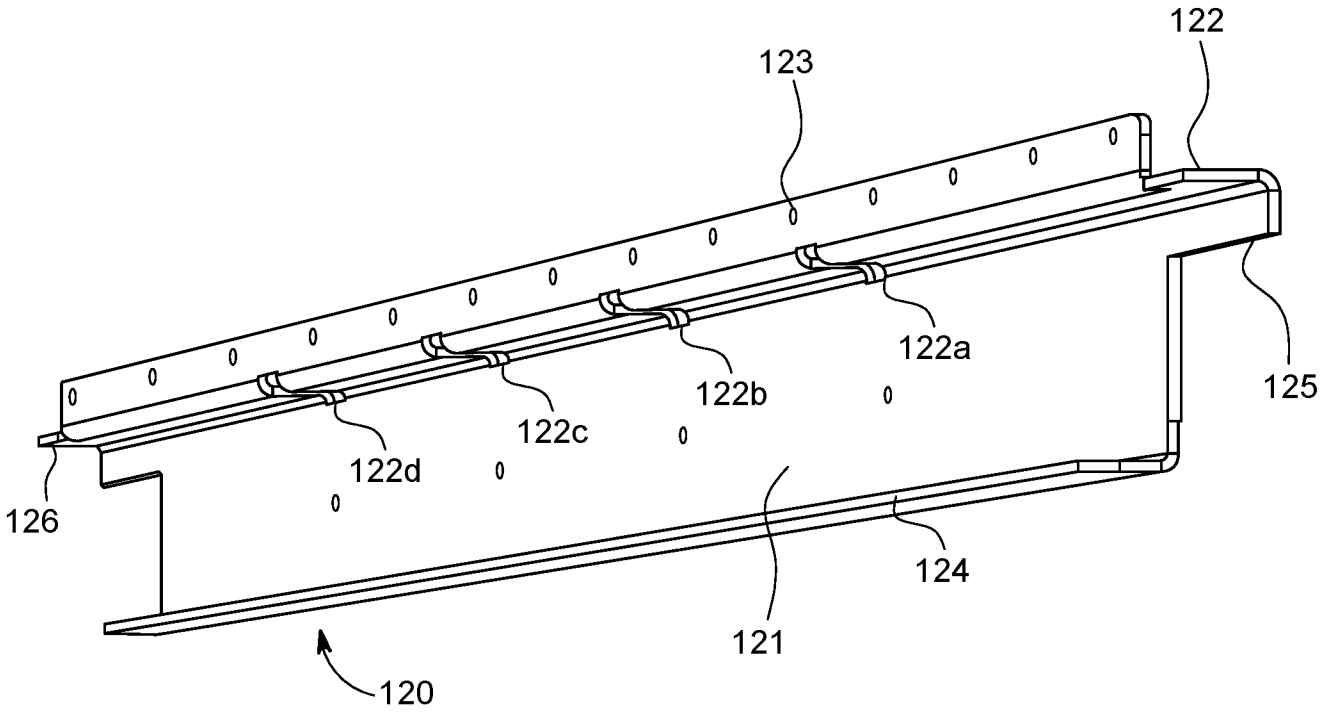
FIG. 11G is an enlarged perspective front view of the left (or right) side support of the pallet of the bulk material shipping container of FIG. 1, shown removed from the rest of the pallet.
Figure 11H:
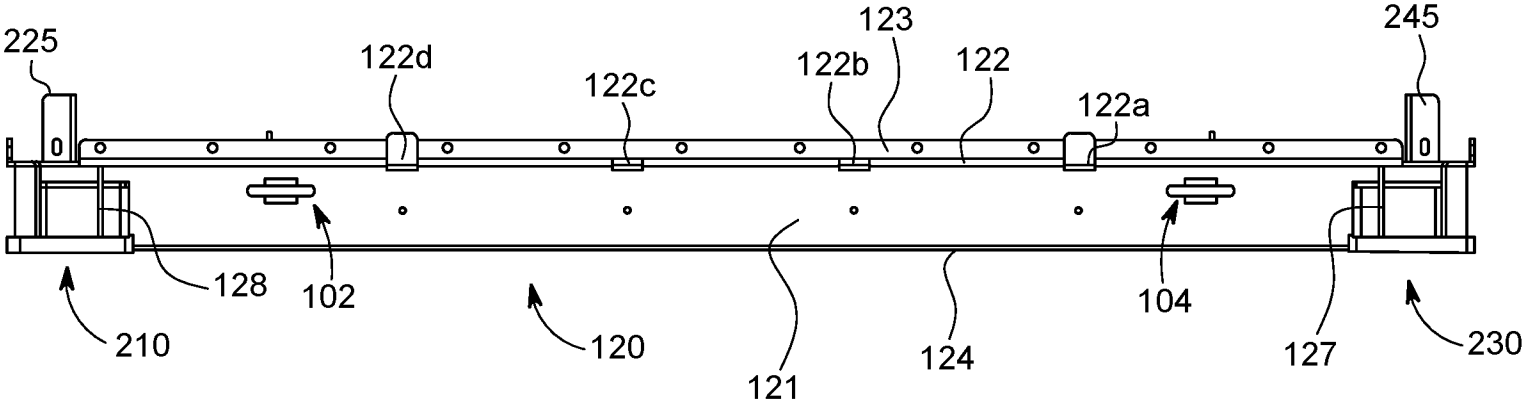
FIG. 11H is an enlarged side view of the left (or right) side support of the pallet of the bulk material shipping container of FIG. 1, shown connected to the rest of the pallet.
Figure 11I:
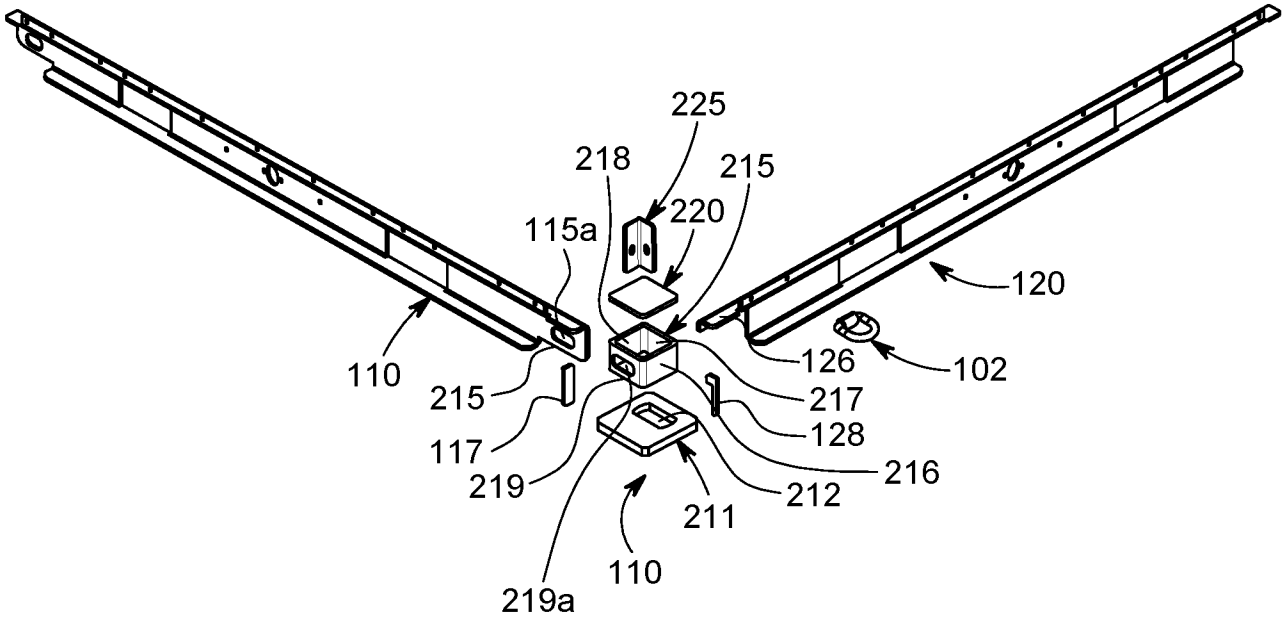
FIG. 11I is an enlarged fragmentary exploded perspective view of the front support, the left side support, and the bottom corner assembly connectable to the front support and the left side support of the pallet of the bulk material shipping container of FIG. 1.
Figure 11J:
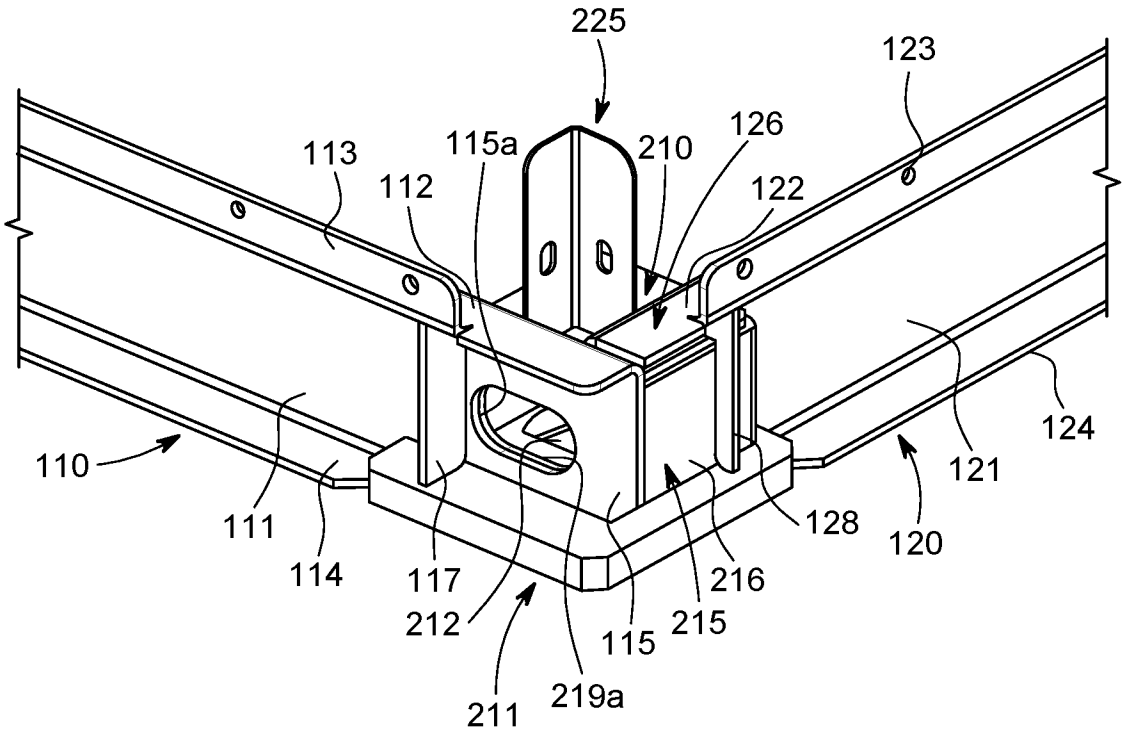
FIG. 11J is an enlarged fragmentary assembled perspective view of the front support, left side support, and the bottom corner assembly connected to the front support and the left side support of the pallet of the bulk material shipping container of FIG. 1.
Figure 11K:
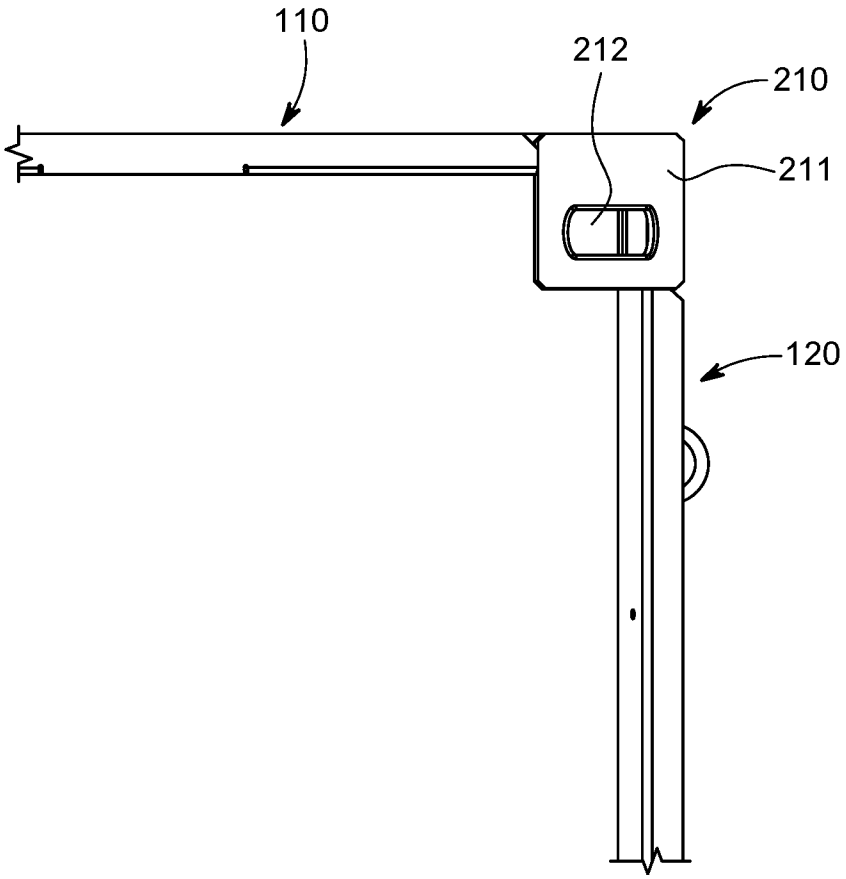
FIG. 11K is an enlarged fragmentary assembled bottom view of the front support, left side support, and the bottom corner assembly connected to the front support and the left side support of the pallet of the bulk material shipping container of FIG. 1.
Figure 11L:
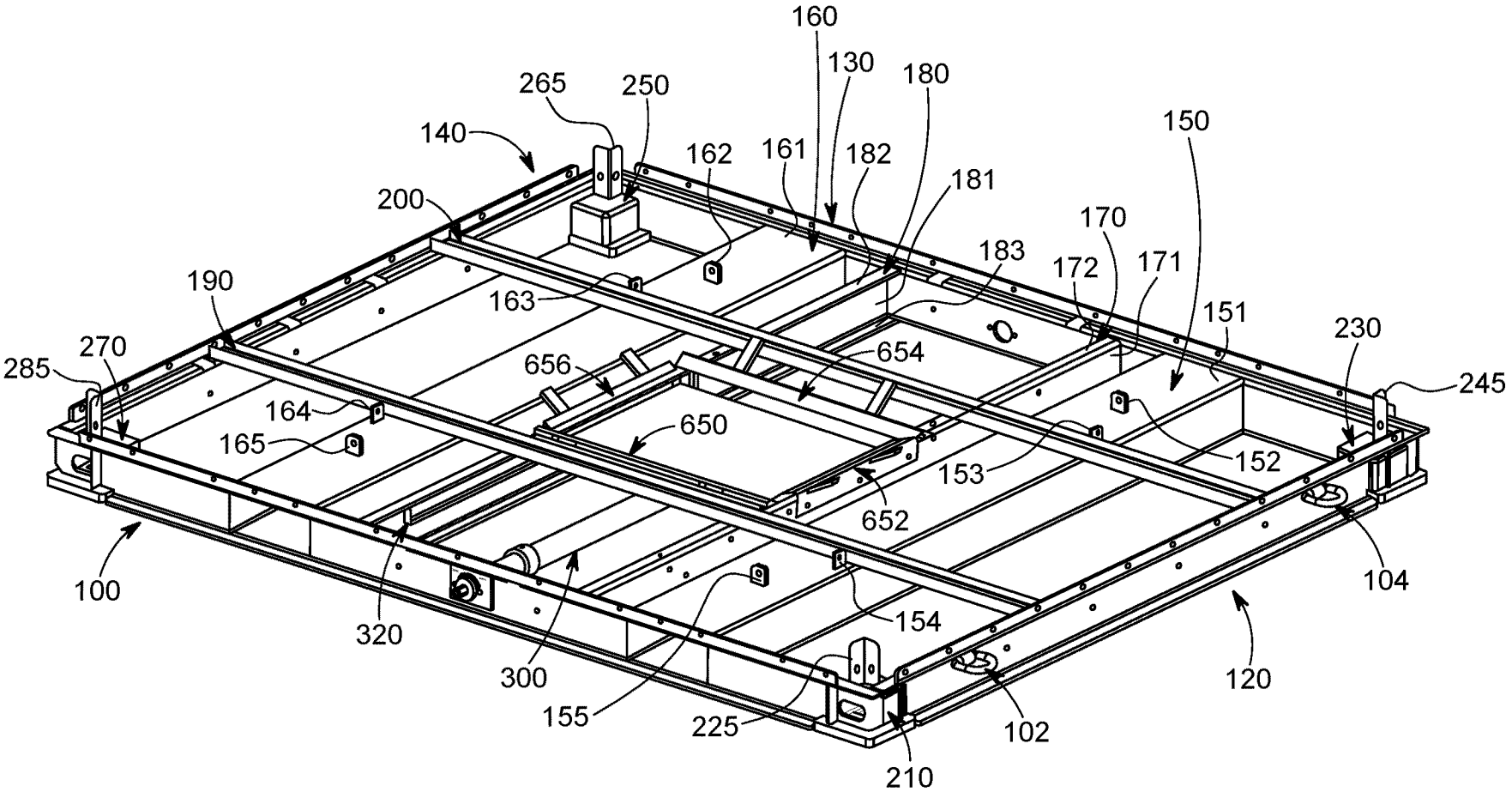
FIG. 11L is an enlarged top perspective view of the pallet, the material unloading assembly, and part of the compartment of the bulk material shipping container of FIG. 1, shown removed from the rest of the container, showing the material unloading assembly connected to and supported by the pallet, showing the gate assembly of the material unloading assembly in the closed position, and showing the tube supports connected to the pallet.
Figure 11M:
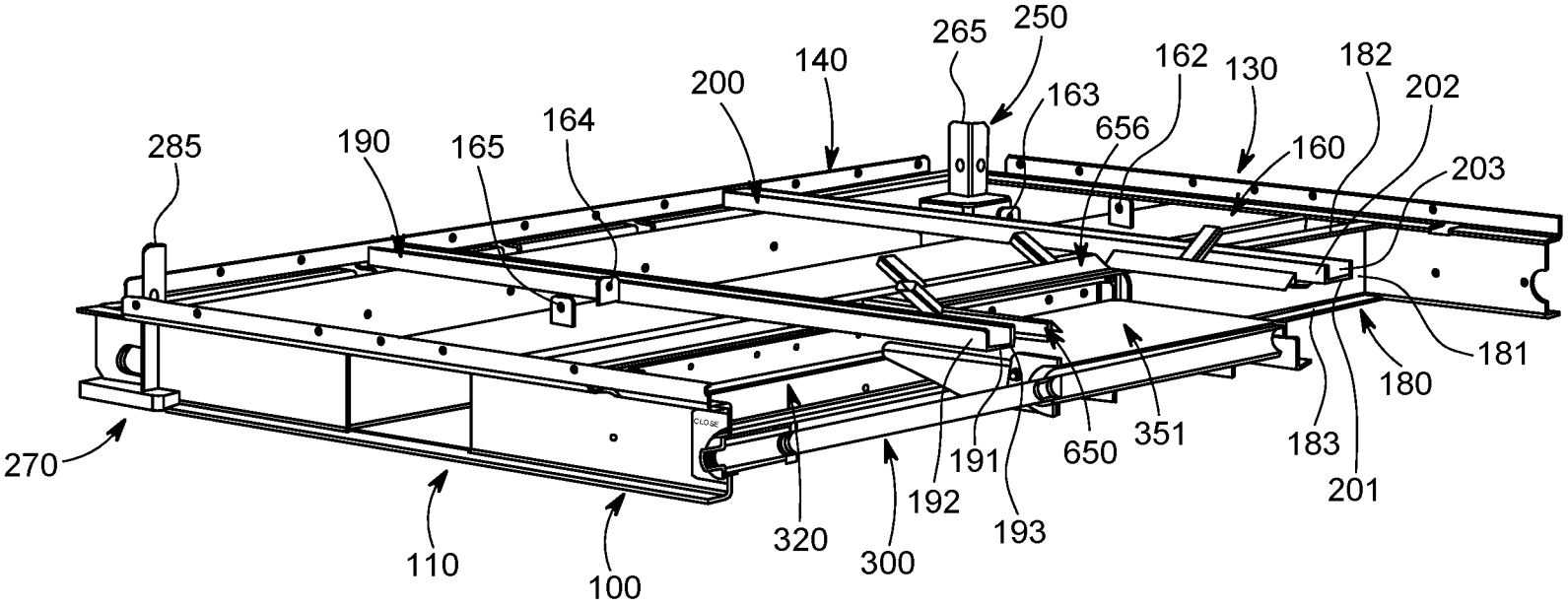
FIG. 11M is an enlarged vertical cross-sectional top perspective view of the pallet, the material unloading assembly, and part of the compartment of the bulk material shipping container of FIG. 1, shown removed from the rest of the container, showing the material unloading assembly connected to and supported by the pallet, showing the gate assembly of the material unloading assembly in the closed position, and showing tube supports connected to the pallet.
Figure 11N:
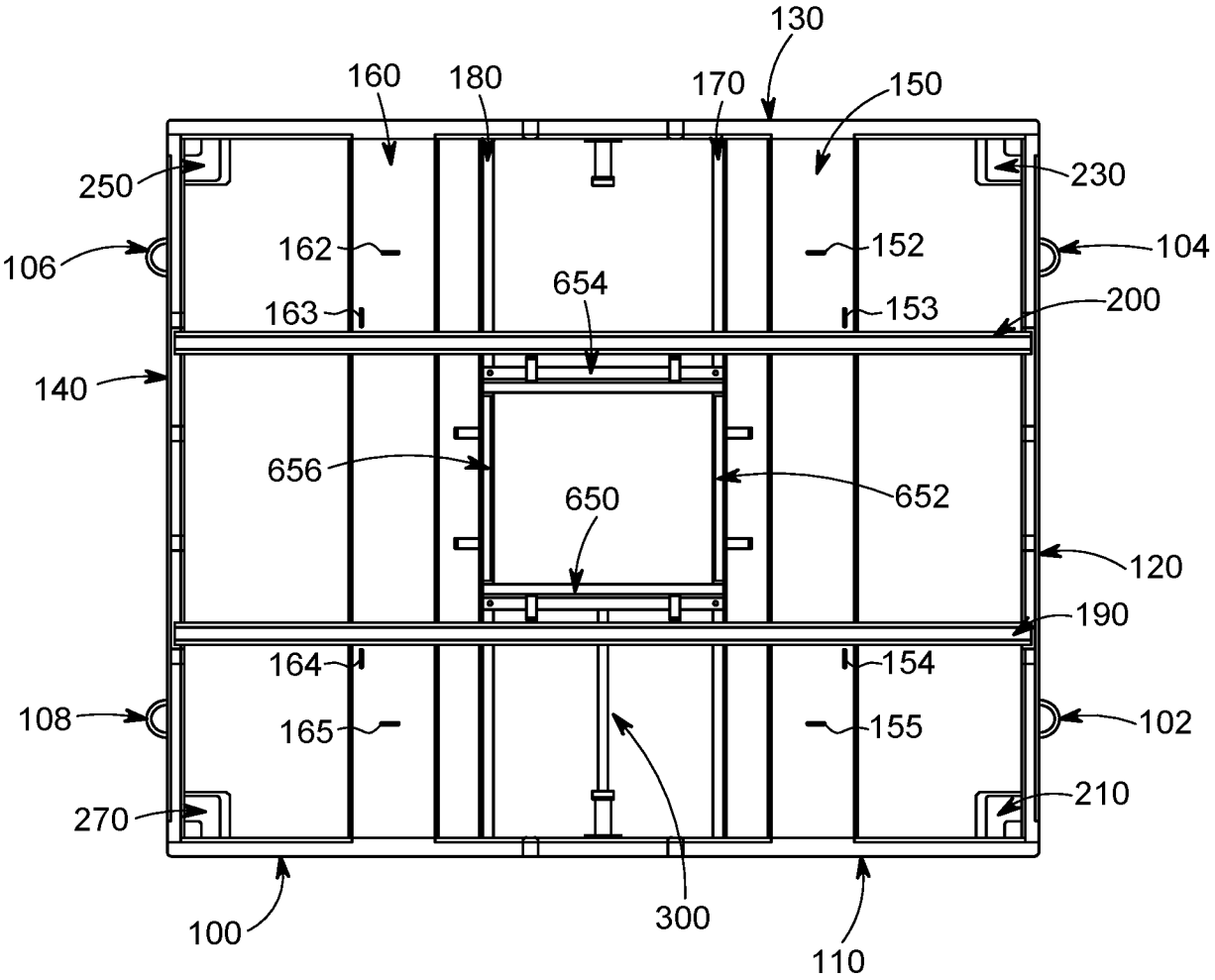
FIG. 11N is an enlarged top view of the pallet, the material unloading assembly, and part of the compartment of the bulk material shipping container of FIG. 1, shown removed from the rest of the container, showing the material unloading assembly connected to and supported by the pallet, showing the gate assembly of the material unloading assembly in the closed position, and showing the tube supports connected to the pallet.
Figure 11O:
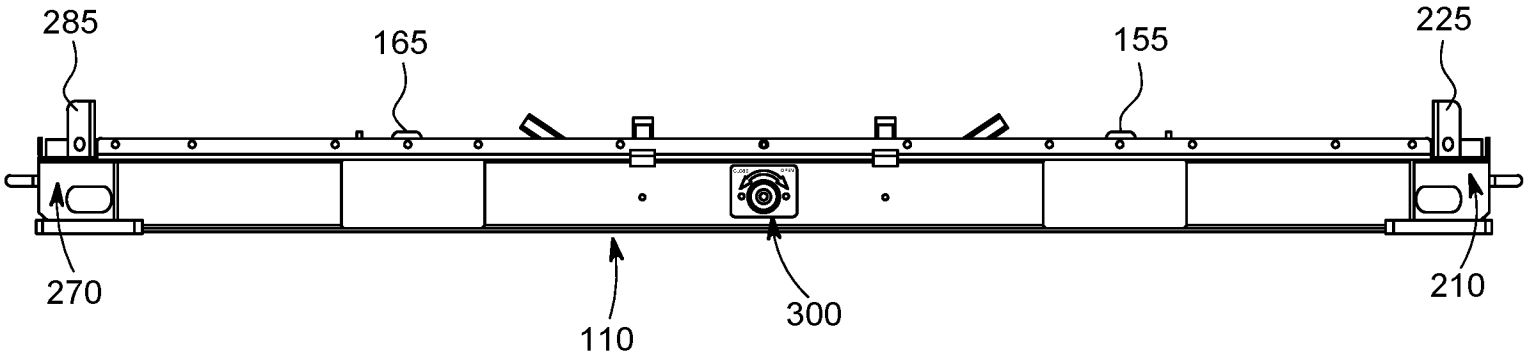
FIG. 11O is an enlarged vertical cross-sectional top perspective view of the pallet, the material unloading assembly, and part of the compartment of the bulk material shipping container of FIG. 1, shown removed from the rest of the container, showing the material unloading assembly connected to and supported by the pallet, showing the gate assembly of the material unloading assembly in the closed position, and showing tube supports connected to the pallet.

More specifically, the pallet 100 of this illustrated embodiment of the shipping container 50 of the present disclosure is generally illustrated in FIGS. 1 to 10, and more specifically illustrated in FIGS. 11A to 11O. The pallet 100 is specifically configured to be lifted by a lifting vehicle such as a forklift truck to lift, move, and position or place the container 50 when the container 50 is: (a) manufactured; (b) transported to a material loading facility; (c) at a material loading facility; (d) moved and positioned in or on a transport vehicle at the material loading facility after loading materials in the container 50; (e) removed from a transport vehicle at a material unloading facility or storage facility; (f) at a container unloading facility or site or at a storage facility; (g) moved and positioned in or on a material unloading device for storage or emptying or another container at the material unloading facility for storage or emptying; (h) moved into another position or another location for customer storage, use, or emptying; and/or (i) moved and positioned in or on a transport vehicle at the material unloading facility after unloading the materials from the container 50. The container 50 and specifically the pallet 100 of the container 50 is configured to account for the use of forklift trucks that can engage the pallet 100 to: (a) lift the container 50; (b) move the container 50; (c) stack the container 50 on top of another container 50 or other device; (d) un-stack a stacked container 50 from another container 50 or other device; and (e) place the container 50 on a material unloading device (such as one of the material unloading devices shown in FIGS. 17A, 17B, 17C, and 17D).

The pallet 100 of this illustrated example embodiment of the container 50 generally includes: (a) a front support 110; (b) a first or left side support 120; (c) a rear support 130; (d) a second or right side support 140; (e) a first fork lift tine receiving tube 150; (f) a second fork lift tine receiving tube 160; (g) a first material unloading assembly support 170; (h) a second material unloading assembly support 180; (i) a first stabilizer or anti-racking brace 190; (j) a second stabilizer or anti-racking brace 200; (k) a first bottom corner assembly 210; (l) a second bottom corner assembly 230; (m) a third bottom corner assembly 250; (n) a fourth bottom corner assembly 270. In this illustrated embodiment as further discussed below, the pallet 100 is configured such that parts of the front support 100, the left side support 120, the rear support 130, and the right side support 140, respectively, integrally co-act with or form parts of the first bottom corner assembly 210, the second bottom corner assembly 230, the third bottom corner assembly 250, and the fourth bottom corner assembly 270 to provide an improved pallet 100 and an improved overall container 50 that is stronger than various known containers, more durable than various known containers, configured to hold greater volumes of materials, configured to hold greater weights of materials, and configured to have a better weight to holding cargo capacity. In this illustrated embodiment as further discussed below, the configuration, arrangement, and attachment of the other components of the pallet 100 also provide an improved pallet 100 and an improved overall container 50 that is stronger than various known containers, more durable than various known containers, configured to hold greater volumes of materials than various known containers, configured to hold greater weights of materials than various known containers, and configured to have a better weight to holding cargo capacity than various known containers.

The pallet 100 of this illustrated example embodiment of the container 50 also includes four D-rings 102, 104, 106, and 108 suitably respectively connected to the first or left side support 120 and the second or right side support 140 to facilitate general securement or securement to a transport vehicle or unloading device using one or more securing devices (such as chains or ropes). It should be appreciated that the quantity and placement of the D-rings can vary in accordance with the present disclosure.

In this illustrated embodiment, the front support 110, the first or left side support 120, the rear support 130, the second or right side support 140, the first fork lift tine receiving tube 150, the second fork lift tine receiving tube 160, the first material unloading assembly support 170, the second material unloading assembly support 180, the first stabilizer brace 190, the second stabilizer brace 200, the first bottom corner assembly 210, the second bottom corner assembly 230, the third bottom corner assembly 250, the fourth bottom corner assembly 270, and the D-rings are all formed from steel and connected by welding to provide suitable structural strength and rigidity. However, it should be appreciated that in alternative embodiments of the present disclosure, the pallet 100 or one or more parts thereof can be made from other suitably strong materials (such as wood, plastic, or composite or fiber glass materials) and that two or more parts thereof can be suitably connected in other manners (such as by fasteners).

As shown in FIGS. 11D, 11E, 11F, 11I, and 11J, the front support 110 includes an elongated steel member having an elongated vertically extending body 111, an elongated horizontally outwardly extending shoulder 112 integrally connected to the top of body 111, an elongated vertically extending head 113 integrally connected to the shoulder 112, an elongated horizontally outwardly extending foot 114 integrally connected to the bottom of the body 111, a first or left arm 115 integrally connected to and extending from the first or left side of the body 111, and a second or right left arm 116 integrally connected to and extending from the second or right side of the body 111. The body 111 defines a rectangular first tine receiving opening 111*a* and a spaced apart second rectangular tine receiving opening 111*b*. The body 111 also defines a material unloading assembly screw opening 111*c* and fastener openings 111*d*, 111*e*, 111*f*, and 111*g*. The shoulder 112 partially defines interior bottom wall support member openings 112*a* and 112*b*. The elongated vertically extending head 113 defines a series of fastener openings (not labeled) including corner section fastener openings and exterior wall fastener openings (not labeled).

The first or left arm 115 defines a corner pin viewing opening 115*a* that is aligned with a corner pin viewing opening 219*a* of the bottom corner assembly 210. Likewise, the second or right arm 116 defines a corner pin viewing opening 116*a* that is aligned with a corner pin viewing opening (not labeled) of the bottom corner assembly 270. These sets of aligned openings enable an operator of a forklift truck to see through the respective arms 115 and 116 of the front support 110 and through the first and fourth bottom corner assemblies 210 and 270. This enables the operator to determine if such bottom corner assemblies 210 and 270 are properly aligned with upstanding corner pins (not shown) of another container 50 (when such containers are stacked), of a transport device (not shown) when the container 50 is placed on such transport device, or of an unloading device (such as one of the unloading devices shown in FIGS. 17A, 17B, 17C, and 17D) when the container 50 is placed on such unloading device to determine the if the container 50 is being properly positioned.

The front support 110 of the pallet 100 further includes vertically extending corner stability or weight transfer braces 117 and 118 that respectively assist in transferring weight on the upright corner assemblies 210 and 270 (including the upright W-shaped corner members 211 and 571) to or through the front wall support 110 to the ground or other supporting member (such as another container, a transport device, or an unloading device).

As shown in FIGS. 11D, 11G, 11H, 11I, and 11J, the first or left side support 120 includes an elongated steel member having an elongated vertically extending body 121, an elongated horizontally outwardly extending shoulder 122 integrally connected to the top of body 121, an elongated vertically extending head 123 integrally connected to the shoulder 122, an elongated horizontally outwardly extending foot 124 integrally connected to the bottom of the body 121, a first or left arm 125 integrally connected to and extending from the first or left side of the body 121, and a second or right left arm 126 integrally connected to and extending from the second or right side of the body 121. The shoulder 122 partially defines interior bottom wall support tube member openings 122*a*, 122*b*, 122*c*, and 122*d*. The elongated vertically extending head 123 defines a series of fastener openings (not labeled) including corner section fastener openings and exterior wall fastener openings (not labeled).

The left side support 120 of the pallet 100 further includes vertically extending corner stability or weight transfer braces 127 and 128 (as shown in FIG. 11H) that respectively assist in transferring weight on the upright corner assemblies 210 and 230 (including the upright W-shaped corners members 211 and 231) to or through the left side support 120 to the ground or other supporting member (such as another container, a transport device, or an unloading device).

The rear support 130 in this illustrated example embodiment is identical to the front support 110 and thus includes an elongated steel member having an elongated vertically extending body, an elongated horizontally outwardly extending shoulder integrally connected to the top of body, an elongated vertically extending head integrally connected to the shoulder, an elongated horizontally outwardly extending foot integrally connected to the bottom of the body, a first or left arm integrally connected to and extending from the first or left side of the body, a second or right left arm integrally connected to and extending from the second or right side of the body, and vertically extending corner stability or weight transfer braces. For simplicity in manufacturing, the body of rear support 130 defines a material unloading assembly screw opening and fastener openings even though these openings are only needed for the front support 110 and not the rear support 130 in this illustrated example embodiment.

It should also be appreciated that alternative embodiments of the container of the present disclosure can include two opposing material unloading assemblies and that in such alternative embodiments, the material unloading assembly screw opening and fastener openings defined by the rear support 130 will be employed in such embodiments to support the second material unloading assembly. Various such embodiments include two gate assemblies (such as gate assembly 350 described below) with each being approximately half of its current size. Each such gate assembly will be opened from the respective side (i.e., the front gate assembly will be opened from the front side and the rear gate assembly will be opened from the rear side).

The second or right side support 140 in this illustrated example embodiment is identical to the first or left side support 120 and thus includes an elongated steel member having an elongated vertically extending body, an elongated horizontally outwardly extending shoulder integrally connected to the top of body, an elongated vertically extending head integrally connected to the shoulder, an elongated horizontally outwardly extending foot integrally connected to the bottom of the body, a first or left arm integrally connected to and extending from the first or left side of the body, a second or right left arm integrally connected to and extending from the second or right side of the body, and vertically extending corner stability or weight transfer braces.

As shown in FIGS. 11A, 11B, and 11C, the first forklift tine receiving tube 150 includes an elongated generally rectangular tubular body 151 having integrally connected top, bottom, and side walls (not labeled). A first end of the tubular body 151 is integrally connected to the interior side of the front support 110. A second opposite end of the tubular body 151 is integrally connected to the interior side of the rear support 130. The tubular body 151 defines a first tine receiving channel (not labeled) that extends from the front support 110 to the rear support 130. The first forklift tine receiving tube 150 further includes a plurality of upwardly extending interior bottom wall support member attachment brackets 152, 153, 154, and 155 that extend upwardly from the top wall of the tubular body 151.

Likewise, as shown in FIGS. 11A, 11B, and 11C, the second forklift tine receiving tube 160 includes an elongated tubular body 161 having integrally connected top, bottom, and side walls (not labeled). A first end of the tubular body 161 is integrally connected to the interior side of the front support 110. A second opposite end of the tubular body 161 is integrally connected to the interior side of the rear support 130. The tubular body 161 defines a second tine receiving channel (not labeled) that extends from the front support 110 to the rear support 130. The second forklift tine receiving tube 160 further includes a plurality of upwardly extending interior bottom wall support member attachment brackets 162, 163, 164, and 165 that extend upwardly from the top wall of the tubular body 161.

The aligned forklift tine receiving tubes 150 and 160 are positioned and spaced apart such that the forks or tines of a forklift truck can be inserted into these tubes or the channels formed by the tubes 150 and 160 to move and handle the container 50 as generally discussed above. The aligned forklift tine receiving tubes 150 and 160 are also configured and positioned such that multiple containers 50 can be stacked on top of one another without the tines or forks engaging or damaging the top wall assembly 850 of the compartment 500 of the lower container 50 or the material loading assembly 900 on the top wall assembly 850 of the compartment 500 of the lower container 50. It should thus be appreciated that the pallet 100 is configured to enable a forklift truck to move these containers when one container is stacked on another or lower container 50 without damaging the lower container 50. It should also be appreciated that the aligned forklift tine receiving tubes 150 and 160 serve or provide supporting functions in addition to the forklift truck tine receiving functions.

As shown in FIGS. 11A, 11B, and 11C, the first material unloading assembly support 170 is generally C-shaped and includes an elongated vertically extending body 171, an elongated transversely or horizontally extending shoulder 172 integrally connected to the top of the body 171, and an elongated transversely or horizontally extending foot 173 integrally connected to the bottom of the body 171. A first end of the first material unloading assembly support 170 is integrally connected to the interior side of the front support 110. A second opposite end of the first material unloading assembly support 170 is integrally connected to the interior side of the rear support 130. The first material unloading assembly support 170 is configured to partially support the material unloading assembly 300 as further described below.

As shown in FIGS. 11A, 11B, and 11C, the second material unloading assembly support 180 is generally C-shaped and includes an elongated vertically extending body 181, an elongated transversely or horizontally extending shoulder 182 integrally connected to the top of the body 181, and an elongated transversely or horizontally extending foot 183 integrally connected to the bottom of the body 181. A first end of the second material unloading assembly support 180 is integrally connected to the interior side of the front support 110. A second opposite end of the second material unloading assembly support 180 is integrally connected to the interior side of the rear support 130. The second material unloading assembly support 180 is configured to partially support the material unloading assembly 300 as further described below.

The first material unloading assembly support and the second material unloading assembly support 180 also support the tube supports 650, 652, 654, and 656 of the interior bottom wall support assembly as shown in FIGS. 11L, 11M, and 11N. More specifically, (a) tube support 650 is suitably connected by fasteners (not shown) to the top of shoulder 172 of the first material unloading assembly support 170 and to the top of shoulder 182 of the second material unloading assembly support 180; (b) the tube support 652 is suitably connected by fasteners (not shown) to the top of shoulder 172 of the first material unloading assembly support 170; (c) the tube support 654 is suitably connected by fasteners (not shown) to the top of shoulder 172 of the first material unloading assembly support 180 and to the top of shoulder 182 of the second material unloading assembly support 180; and (d) the tube support 656 is suitably connected by fasteners (not shown) to the top of shoulder 182 of the second material unloading assembly support 180. Thus, it should be appreciated that the first material unloading assembly support 170 and the second material unloading assembly support 180 serve or provide multiple supporting functions.

As shown in FIGS. 11A, 11B, and 11C, the first stabilizer or anti-racking brace 190 is generally C-shaped and includes an elongated horizontally extending body 191, an elongated vertically extending arm 192 integrally connected to one side of the body 191, and an elongated vertically extending arm 193 integrally connected to the opposite side of the body 191. A first end of the stabilizer brace 190 is integrally connected to the top side of the first side support 120. A second opposite end of the stabilizer brace 190 is integrally connected to the top side of the second side support 140. The stabilizer brace 190 is configured to partially support the material unloading assembly 300 by supporting the first material unloading assembly support 170 and by supporting the second material unloading assembly support 180. Specifically, the stabilizer brace 170 is welded to the top of the shoulder 172 of the first material unloading support 170 and is welded to the top of the shoulder 182 of the second material unloading support 180. The stabilizer brace 190 is configured to prevent any racking or distortion of the pallet 100.

As shown in FIGS. 11A, 11B, and 11C, the second stabilizer or anti-racking brace 200 is generally C-shaped and includes an elongated horizontally extending body 201, an elongated vertically extending arm 202 integrally connected to one side of the body 201, and an elongated vertically extending arm 203 integrally connected to the opposite side of the body 201. A first end of the stabilizer brace 200 is integrally connected to the top side of the first side support 120. A second opposite end of the stabilizer brace 200 is integrally connected to the top side of the second side support 140. The stabilizer brace 200 is configured to partially support the material unloading assembly 300. The stabilizer brace 180 is welded to the top of the shoulder 172 of the first material unloading support 170 and is welded to the top of the shoulder 182 of the second material unloading support. The stabilizer brace 200 is also configured to prevent any racking or distortion of the pallet 100.

In various embodiments of the present disclosure, the pallet 100 and specifically the first bottom corner assembly 210, the second bottom corner assembly 230, the third bottom corner assembly 250, and the fourth bottom corner assembly 270 are not standard ISO corners, but are rather each compatible with standard ISO corners to enable: (a) the container 50 of the present disclosure to be stacked on other containers with ISO corners; (b) other containers to be stacked on the container 50 of the present disclosure; (c) the transport of the container of the present disclosure on transport vehicles configured for containers with ISO corners; (d) the containers 50 of the present disclosure to be mounted on container unloading devices configured for containers with ISO corners; and (e) the containers 50 of the present disclosure to be mounted on container unloading devices configured for the containers of the present disclosure such as the material unloading devices shown in FIGS. 17A, 17B, 17C, and 17D.

The first bottom corner assembly 210 as shown in FIGS. 11I, 11J, and 11K includes a generally rectangular horizontally extending base 211, a horizontally extending tubular body 215 integrally connected to and extending upwardly from the base 211, a generally rectangular horizontally extending cap 220 integrally connected to the top of the horizontally extending tubular body 215, and a vertically extending corner support 225 integrally connected to and extending upwardly from the cap 220. The generally rectangular horizontally extending base 211 defines an inwardly offset corner pin receiving opening 212 (shown in FIGS. 10, 11I, 11J, and 11K) that is configured to receive an upwardly extending corner pin (such as the upwardly extending corner pin 766 of the upper corner assembly 750 further described below). In this example illustrated embodiment, the inwardly offset corner pin receiving opening 212 is angled or chamfered (i.e., wider at the bottom surface of the base 211 than the top surface of the base 211 as shown in FIG. 11K) to facilitate better receipt and alignment of an upwardly extending corner pin received by the first bottom corner assembly 210. As indicated below, such a corner pin 766 can be connected to and extend upwardly from the top of another bulk material shipping container 50, or from a bulk material shipping container transport vehicle (not shown) on which the container 50 is transported, or from a bulk material shipping container unloader device (such as shown in FIGS. 17A, 17B, 17C, and 17D) on which the container 50 is positioned. The tubular body 215 includes four connected upwardly or horizontally extending integrally connected upstanding walls 216, 217, 218, and 219. Wall 219 defines a corner pin viewing opening 219*a* that is configured to be aligned with aperture 115*a* defined by the arm 115 of the front support 110 as shown in FIG. 11J. As mentioned above, the corner pin viewing opening 115*a* of the front support 110 is aligned with a corner pin viewing opening 219*a* of the bottom corner assembly 210 to enable an operator of a forklift truck to see through the respective arm 115 of the front support 110 and through the first bottom corner assembly 210 to enable the operator to determine if such bottom corner assembly is properly aligned with an upstanding corner pin (not shown) of another container 50 (when such containers are stacked), of a transport device (not shown) when the container 50 is placed on such transport device, or of a unloading device (such as shown in FIGS. 17A, 17B, 17C, and 17D) when the container 50 is placed on such an unloading device to determine if the container 50 is being properly positioned.

The horizontally extending cap 220 is integrally connected to the top of the tubular body 215, and specifically vertically extending connected walls 216, 217, 218, and 219. The vertically extending corner support 225 that is integrally connected to and that extends upwardly from the cap 220 is configured to be engaged by and support the first W-shaped corner member of the upright corner assembly of the compartment 500 as further discussed below.

In this illustrated example embodiment, the front support 110 including the arm 115 is integrally connected (by welding) to (and thus co-acts with or forms part of) the first corner section assembly 210. More specifically, (a) the arm 115 is integrally connected to the base 111, the tubular body 215, the cap 220, and to the first side support 120; and (b) the foot 114 is integrally connected to the base 211.

In this illustrated example embodiment, the first side support 120 including the arm 126 is integrally connected (by welding) to (and thus co-acts with or forms part of) the first corner section assembly 210. More specifically, (a) the arm 126 is integrally connected to the tubular body 215, the cap 220, and to the first side support 120; and (b) the foot 124 is integrally connected to the base 211.

As shown in FIGS. 1 to 10, 11A, 11B, 11C, 11D, and 11H, the second bottom corner assembly 230 is a mirror image of the first bottom corner assembly 210 and thus includes a generally rectangular horizontally extending base, a horizontally extending tubular body connected to and extending upwardly from the base, a generally rectangular horizontally extending cap connected to the top of the horizontally extending tubular body, and a vertically extending corner support 245 connected to and extending upwardly from the cap wall. The generally rectangular horizontally extending base defines an inwardly offset corner pin receiving opening that is configured to receive a corresponding upwardly extending corner pin of another container, a transport vehicle, or unloading device.

In this illustrated example embodiment, (a) the first side support 120 is integrally connected (by welding) to (and thus co-acts with or forms part of) the second bottom corner assembly 230; and (b) the rear support 130 is integrally connected (by welding) to (and thus co-acts with or forms part of) the second bottom corner assembly 230.

As shown in FIGS. 1 to 10, 11A, 11B, 11C, and 11D, the third bottom corner assembly 250 is identical to the first bottom corner assembly 210 and thus includes a generally rectangular horizontally extending base, a horizontally extending tubular body connected to and extending upwardly from the base a generally rectangular horizontally extending cap connected to the top of the horizontally extending tubular body, and a vertically extending corner support 265 connected to and extending upwardly from the cap. The generally rectangular horizontally extending base defines an inwardly offset corner pin receiving opening that is configured to receive a corresponding upwardly extending corner pin of another container, a transport vehicle, or unloading device.

In this illustrated example embodiment, (a) the rear support 130 is integrally connected (by welding) to (and thus co-acts with or forms part of) the third bottom corner assembly 250; and (b) the second side support 140 is integrally connected (by welding) to (and thus co-acts with or forms part of) the third bottom corner assembly 250.

As shown in FIGS. 1 to 10, 11A, 11B, 11C, and 11D, the fourth bottom section corner assembly 270 is a mirror image of the first bottom corner assembly 210 and thus includes a generally rectangular horizontally extending base, a horizontally extending tubular body connected to and extending upwardly from the base a generally rectangular horizontally extending cap connected to the top of the horizontally extending tubular body, and a vertically extending corner support 285 connected to and extending upwardly from the cap. The generally rectangular horizontally extending base defines an inwardly offset corner pin receiving opening that is configured to receive a corresponding upwardly extending corner pin of another container, a transport vehicle, or unloading device.

In this illustrated example embodiment, (a) the second side support 140 is integrally connected (by welding) to (and thus co-acts with or forms part of) the fourth bottom corner assembly 270; and (b) the front support 110 is integrally connected (by welding) to (and thus co-acts with or forms part of) the fourth bottom corner assembly 270.

It should be appreciated that the above illustrated example embodiment enables the pallet 100 to support greater volumes of materials than various known containers, support greater weights of materials than various known containers, provide the container with a better weight to holding cargo capacity than various known containers. This is in part because the pallet and specifically the bottom corner assemblies, the W-shaped corner members (of the upright corner assemblies of the compartment), and the top corner assemblies (of the compartment) are specifically aligned for weight transfer to the ground or other supporting member. Additionally, this alignment and weight transfer provides the container with stacking strength for one or more stacked containers. The (a) pallet, and (b) the W-shaped corner assemblies, the top wall assembly, and the rest of the of the compartment as described below, provide a cage like system that enables the use of the composite panel or wall members (or FRP) described below that significantly reduces the tare weight or tare to cargo weight ratio. This cage like system thus: (i) supports greater volumes of materials than various known containers; (ii) supports greater weights of materials than various known containers; and (iii) provides the container with a better weight to holding cargo capacity than various known containers.

The Illustrated Example Material Unloading Assembly

The material unloading assembly 300 of this illustrated example embodiment of the shipping container 50 of the present disclosure is generally illustrated in FIGS. 1 to 10, and more specifically illustrated in FIGS. 11L, 11M, 11N, 11O, and 12A to 12P. The material unloading assembly 300 generally includes: (a) a first guide rail or J-channel 310; (b) a second guide rail or J-channel 320; (c) a gate assembly 350; (d) a gate movement assembly 400; and (e) a rear material director 450. The gate assembly 350 is specifically configured to be in a closed position (as shown in FIGS. 2, 10, 11L, 11M, and 11N) to prevent the release of materials held in the compartment 500, and to move to a plurality of different partially open positions and to a fully opened position (shown in FIGS. 3 and 12C) to enable the release of materials held in the compartment 500. In this illustrated embodiment, the configuration, arrangement, and attachment of the first guide rail or J-channel 310, the second guide rail 320, the gate assembly 350, the gate movement assembly 400, and the rear material director 450 of the material unloading assembly 300 provide an intentional looseness that facilitates or allows more play or side to side movement in the gate assembly 350 that enables the gate assembly 350 to continue to open or close if the gate assembly 350 becomes skewed, off-center, or misaligned. In other words, the material unloading assembly is self-correcting. This enables the material unloading assembly 300 and the entire container 50 to be manufactured with reasonable manufacturing tolerance limits.

In this illustrated embodiment, the configuration, arrangement, and attachment of the first guide rail or J-channel 310, the second guide rail 320, the gate assembly 350, and the rear material director 450 of the material unloading assembly 300 provide material leakage prevention. In this illustrated embodiment, the configuration and arrangement of the gate assembly 350 also provides additional stability and damage prevention. Thus, this illustrated embodiment of the material unloading assembly of the bulk material shipping container enables the container to be stronger than various known containers, to be more durable than various known containers, to hold greater volumes of materials than various known containers, to hold greater weights of materials than various known containers, and to have a better weight to holding cargo capacity than various known containers.

More specifically, in this illustrated embodiment, except as set forth below, the first guide rail or J-channel 310, the second guide rail or J-channel 320, the gate assembly 350, the gate movement assembly 400, and the material director 450 are all formed from steel to provide suitable structural strength and rigidity. However, it should be appreciated that in alternative embodiments, the material unloading assembly 300 or one or more parts thereof can be made from other suitably strong materials (such as wood, plastic, or composite or fiber glass materials).

The second guide rail or J-channel 320 as shown in FIGS. 12A, 12B, 12C, 12D, and 12N includes an elongated vertically extending attachment wall 321, an elongated horizontally inwardly extending base wall 322 integrally connected to the attachment wall 321, an elongated vertically upwardly extending gate assembly guide wall or lip 323 integrally connected to the base wall 322 and spaced from and generally parallel to the attachment wall 321, a vertically inwardly extending front end wall 322 integrally connected to the front end of the attachment wall 321, and a vertically inwardly extending rear end wall 325 integrally connected to the rear end of the attachment wall 321. The attachment wall 321, the base wall 322, the gate assembly guide wall or lip 323, the front end wall 323, and the rear end wall 325 define a channel 320*a* in which the lip 354 of the gate assembly 350 slides or moves as discussed below. The second guide rail or J-channel 320, and specifically the attachment wall 321 is suitably connected such as by fasteners (not shown) to the second material unloading assembly support 180 as shown in FIGS. 11L, 11M, 12C, and 12N. The second guide rail or J-channel 320, and specifically the attachment wall 321 is connected to the wall 181 of the second material unloading assembly support 180. The second guide rail or J-channel 320 extends toward the front support 110 of the pallet 100 to facilitate movement of the gate assembly 350 toward the front support 110 of the pallet 100.

The first guide rail or J-channel 310 is identical to the second guide rail or J-channel 320 in this illustrated example embodiment. Thus, the first guide rail or J-channel 310 includes an elongated vertically extending attachment wall, an elongated horizontally inwardly extending base wall integrally connected to the attachment wall, an elongated vertically upwardly extending gate assembly guide wall or lip integrally connected to the base wall and spaced from and generally parallel to the attachment wall, a vertically inwardly extending front end wall integrally connected to the front end of the attachment wall, and a vertically inwardly extending rear end wall integrally connected to the rear end of the attachment wall. The attachment wall, the base wall, the gate assembly guide wall or lip, the front end wall, and the rear end wall of the first guide rail or J-channel 310 define a channel in which the lip 353 of the gate assembly 350 slides or moves as discussed below. The first guide rail or J-channel, and specifically the attachment wall, is suitably connected such as by fasteners (not shown) to the wall 171 of first material unloading assembly support 170. The first guide rail or J-channel 310 extends toward the front support 110 of the pallet 100 to facilitate movement of the gate assembly 350 toward the front support 110 of the pallet 100.

The first guide rail or J-channel 310 extends parallel or substantially parallel to second guide rail or J-channel 320. The first guide rail or J-channel 310 and the second guide rail or J-channel 320 are also sized, aligned, and configured to support opposite sides of the gate assembly 350 and to generally guide the gate assembly 350 as the gate assembly 350 moves from the closed position, to each of the partially open positions, to the fully open position, and back from the fully opened position to the fully closed position. The first guide rail or J-channel 310 and the second guide rail or J-channel 320 enable relatively free movement of the gate assembly 350 and particularly the side lips 353 and 354 of the closure member 352 of the gate 351 of the gate assembly 350. This partly facilitates the relatively loose interconnection of the gate 351 on or relative to the J-channels 310 and 320 to facilitate free travel of the gate 351 relative to and on the J-channels, while also enabling the gate 351 and the gate movement assembly 350 to cause the gate 351 to self correct if it goes askew as it continues to open or close.

The upstanding front end walls of the guide rails or J-channels 310 and 320 function as stopping walls that prevent the gate 351 from moving too far toward the front support 110.

The material unloading assembly 300 of the container 50 is thus supported by the pallet 100 such that the gate assembly 350 is configured to be positioned under and adjacent to the bottom opening or chute 504 in or defined by the compartment 500 as described below.

Figure 3:
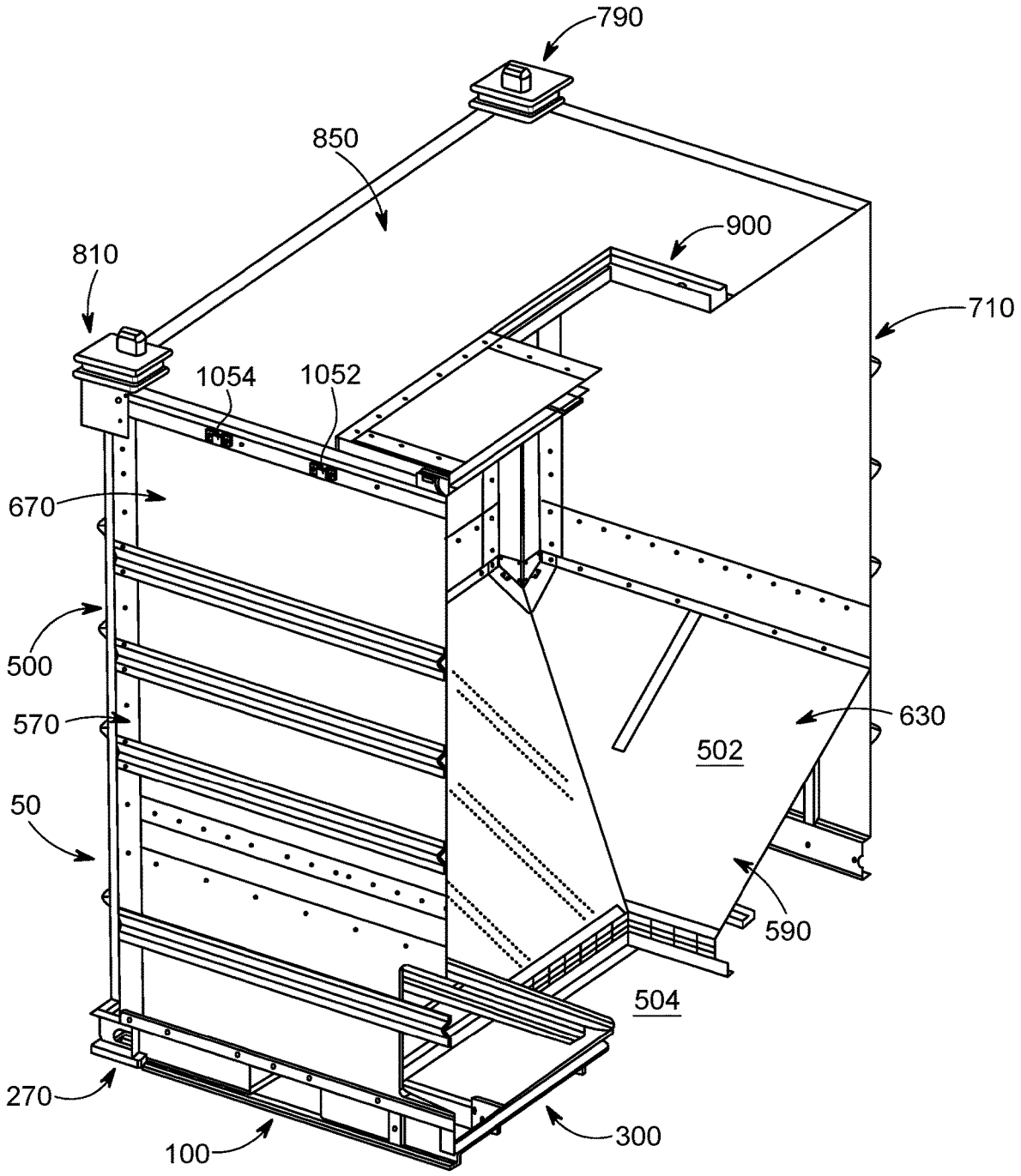
FIG. 3 is a vertical cross-sectional top front perspective view of the bulk material shipping container of FIG. 1, showing the hatch assembly of the material loading assembly in the open position, and showing the gate assembly of the material unloading assembly in the open position.
Figure 12A:
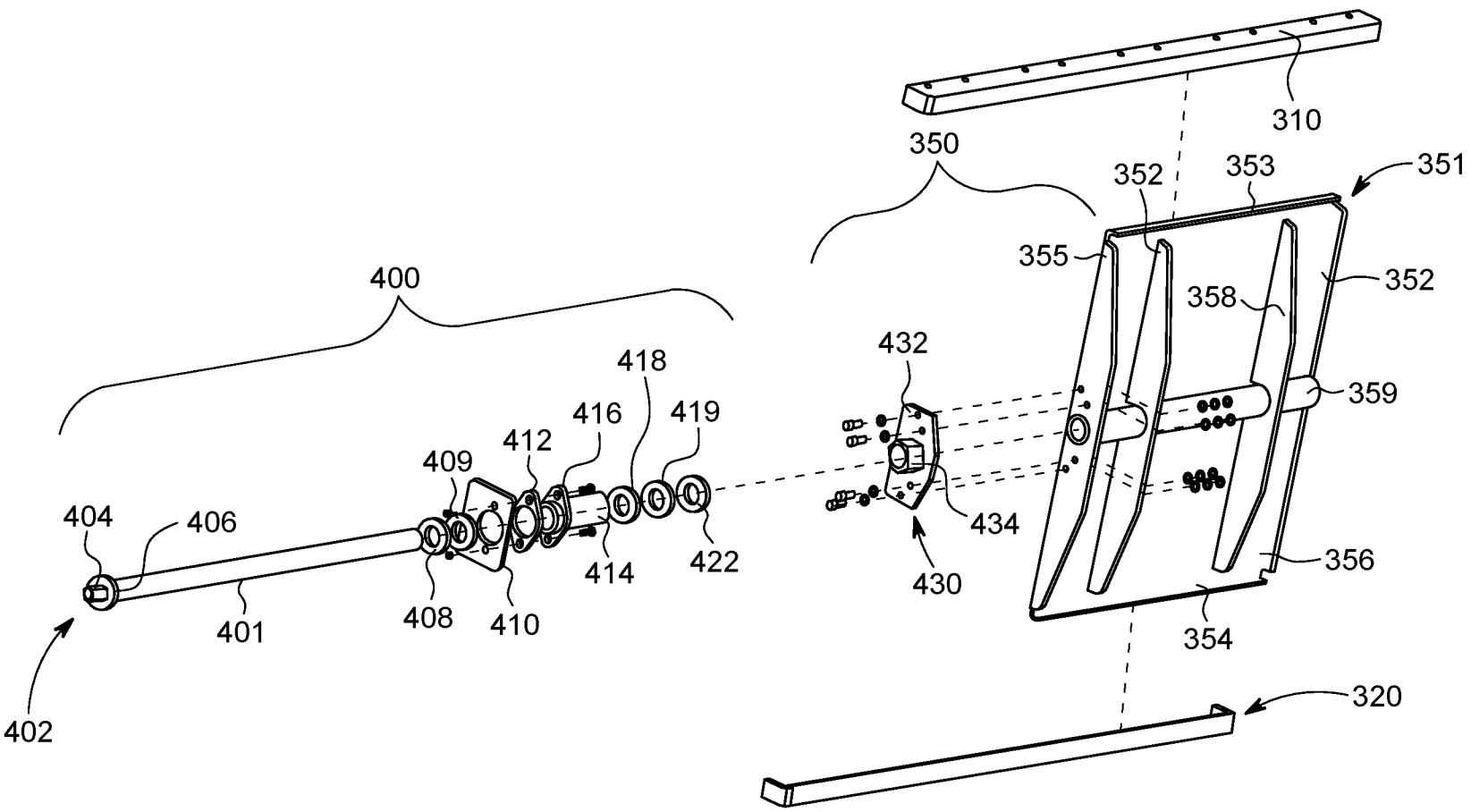
FIG. 12A is an exploded bottom perspective view of the material unloading assembly of the bulk material shipping container of FIG. 1, shown removed from the pallet and shown without the rear material director.
Figure 12B:
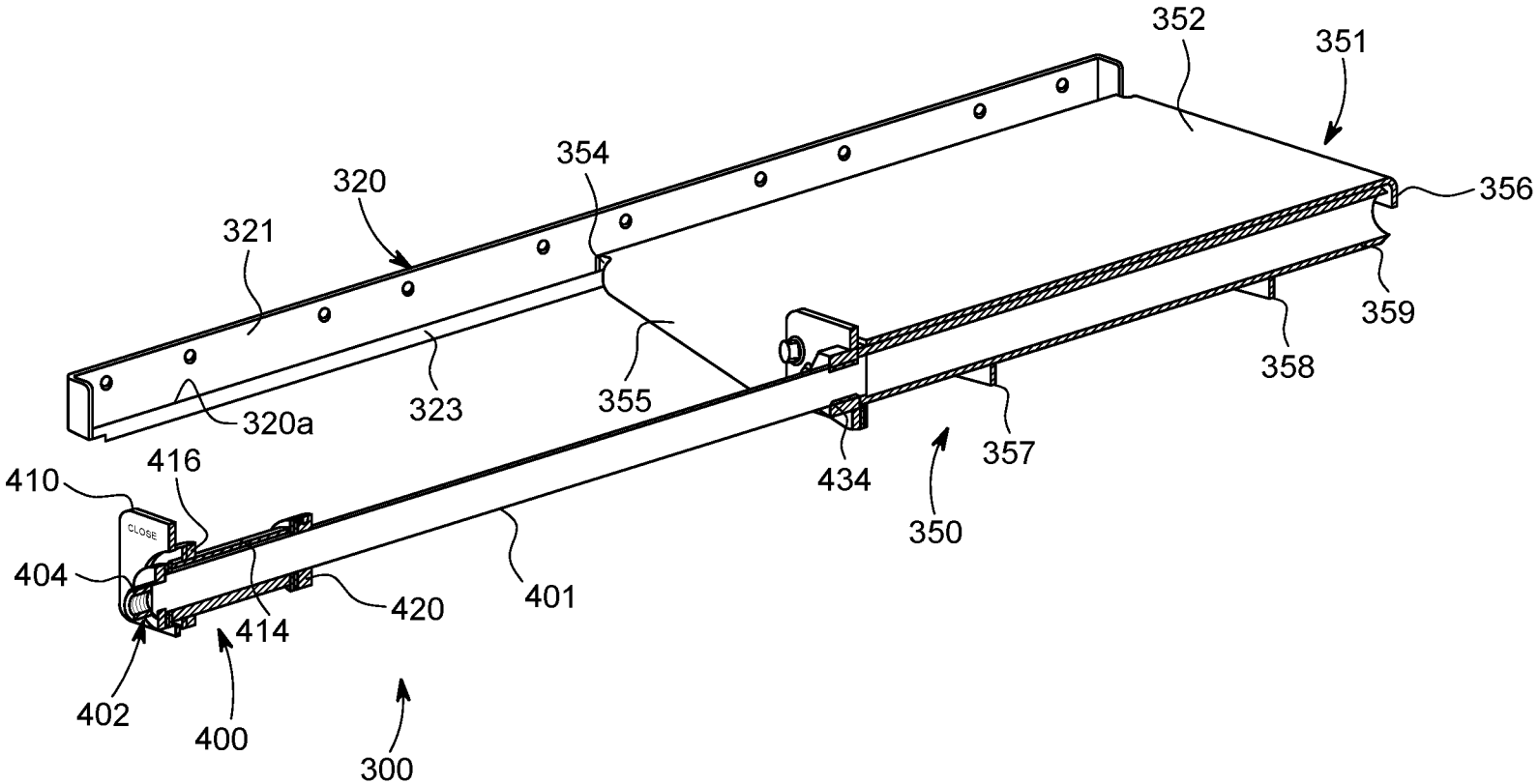
FIG. 12B is a vertical partial cross-sectional perspective view of the material unloading assembly of the bulk material shipping container of FIG. 1, shown removed from the pallet and shown without the rear material director.
Figure 12C:
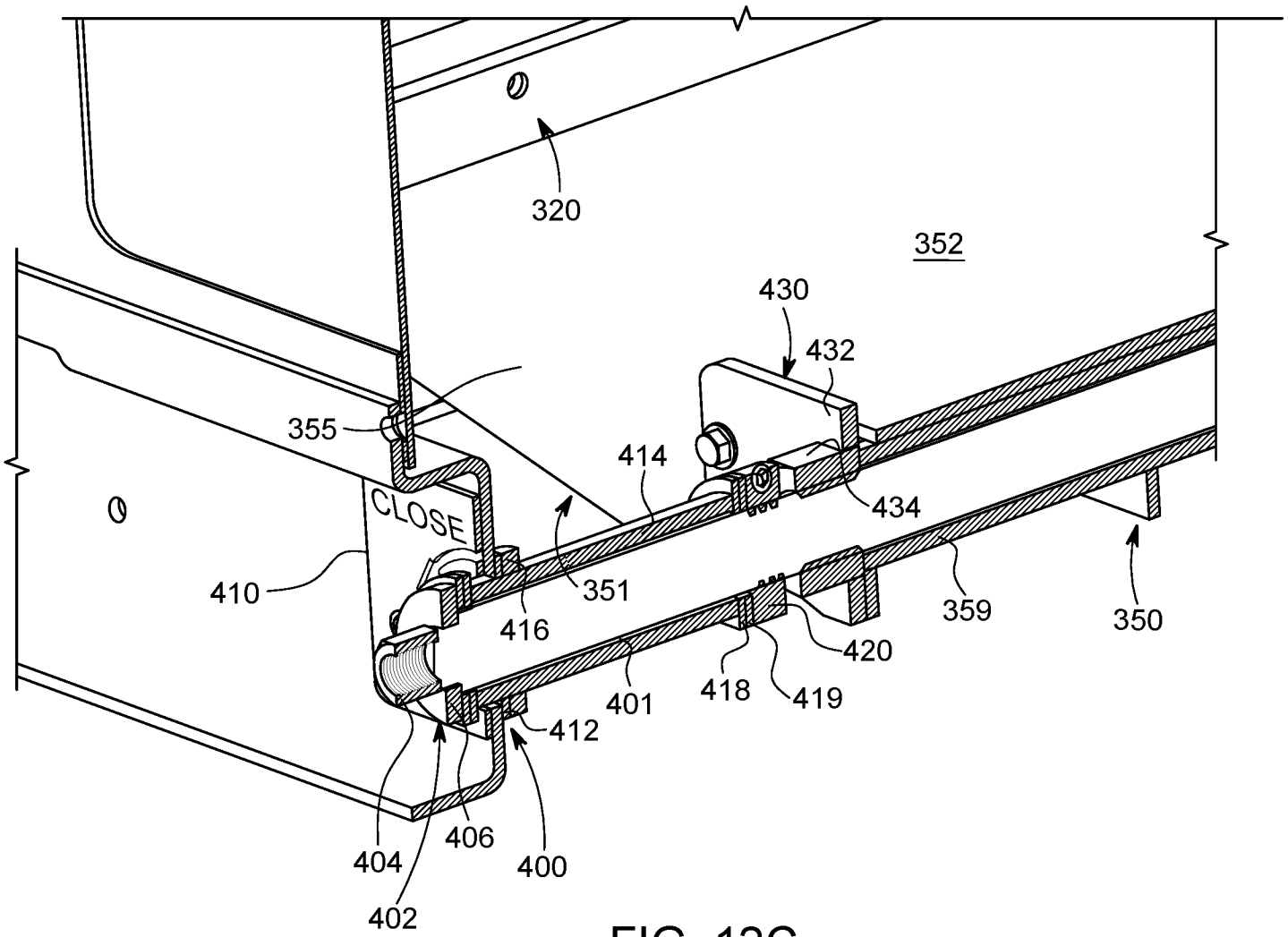
FIG. 12C is a further enlarged partial fragmentary cross-sectional perspective view of the material unloading assembly of the bulk material shipping container of FIG. 1, shown removed from the pallet and shown without the rear material director.
Figure 12D:
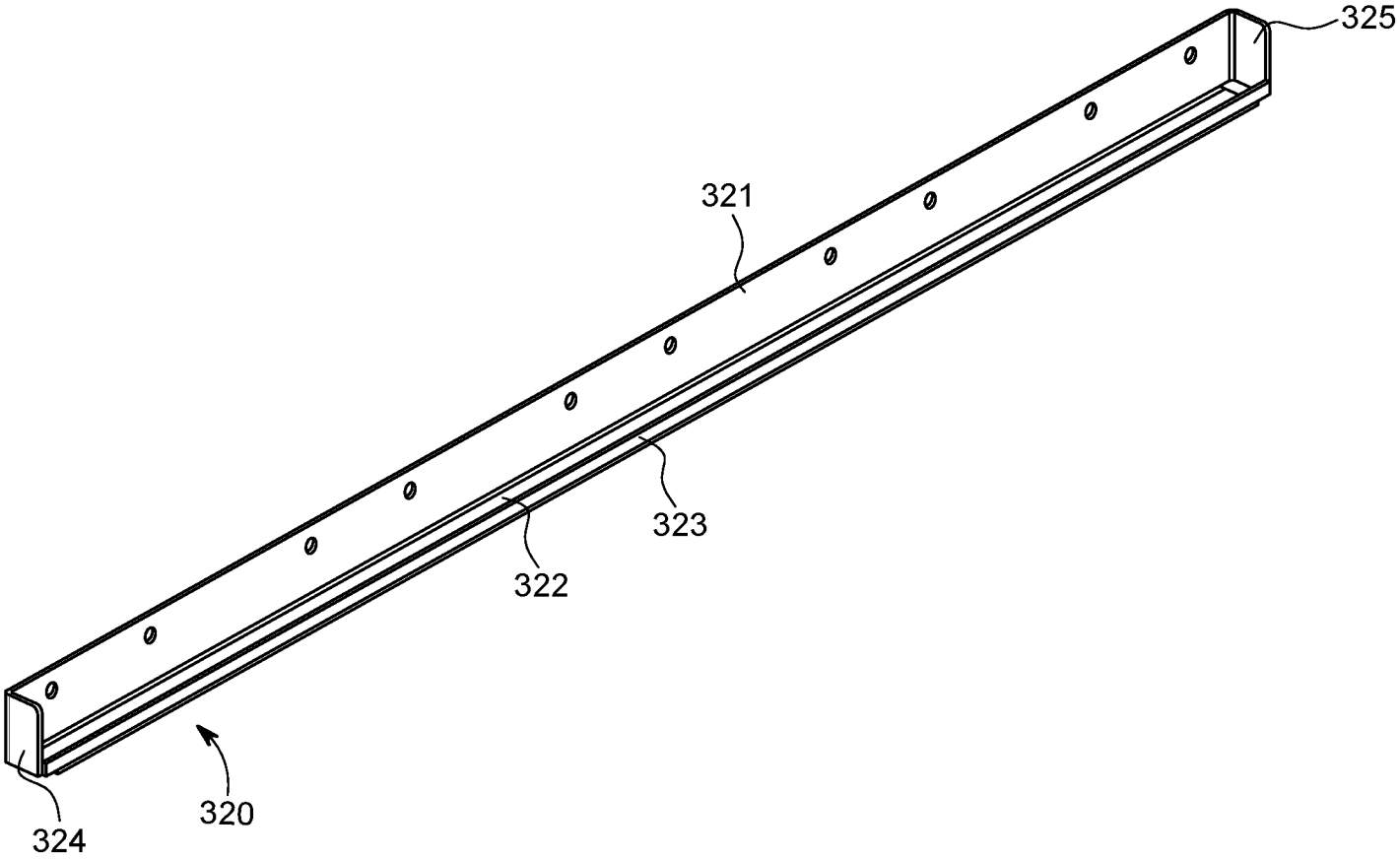
FIG. 12D is an enlarged perspective view of the second guide rail or second J-channel of the material unloading assembly of the bulk material shipping container of FIG. 1.
Figure 12E:
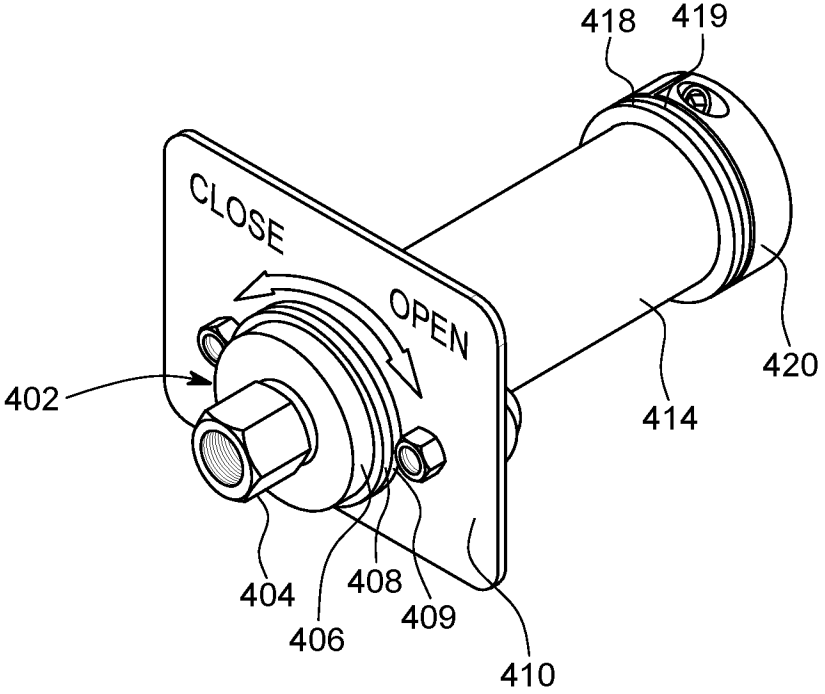
FIG. 12E is an enlarged perspective view of the front part of the material unloading assembly of the bulk material shipping container of FIG. 1.
Figure 12F:
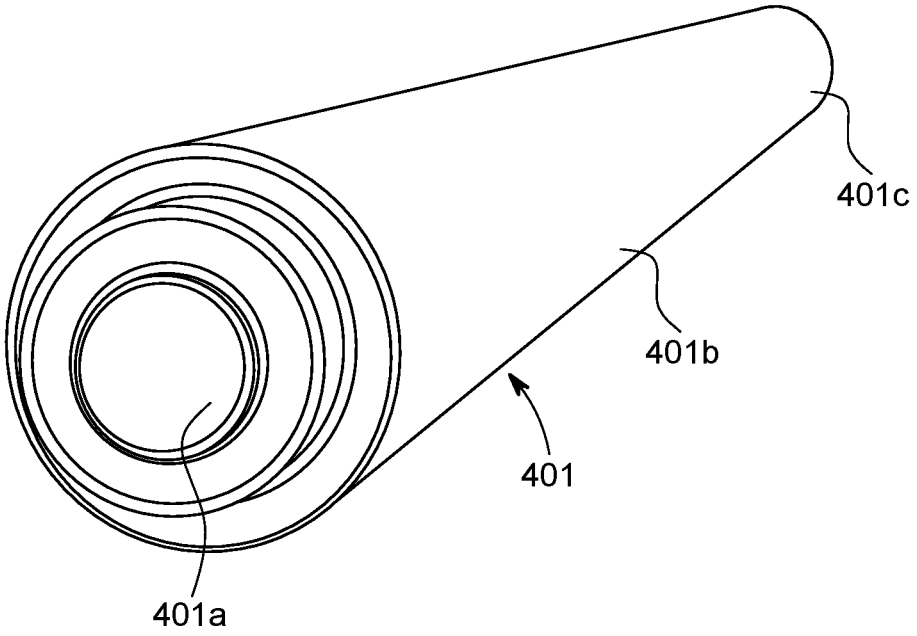
FIG. 12F is an enlarged side view of the gate screw of the material unloading assembly of the bulk material shipping container of FIG. 1.
Figure 12G:
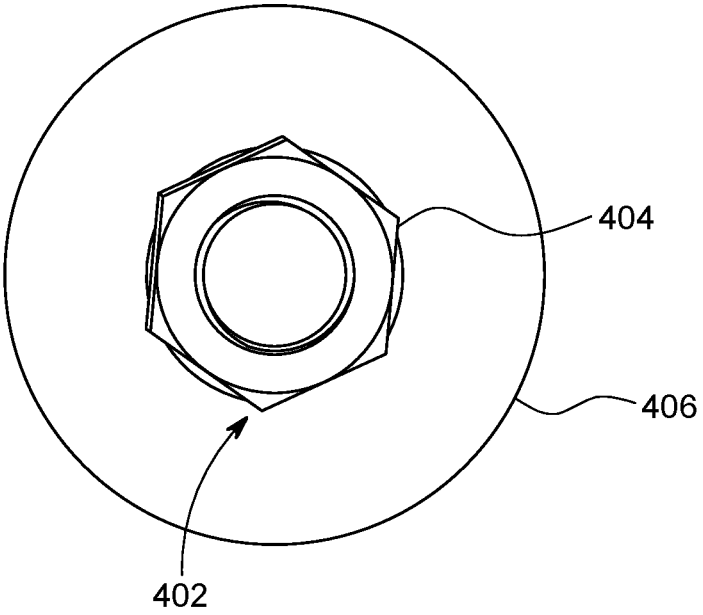
FIG. 12G is an enlarged end view of the gate screw, gate screw head, and gate screw bushing of the material unloading assembly of the bulk material shipping container of FIG. 1.
Figure 12H:
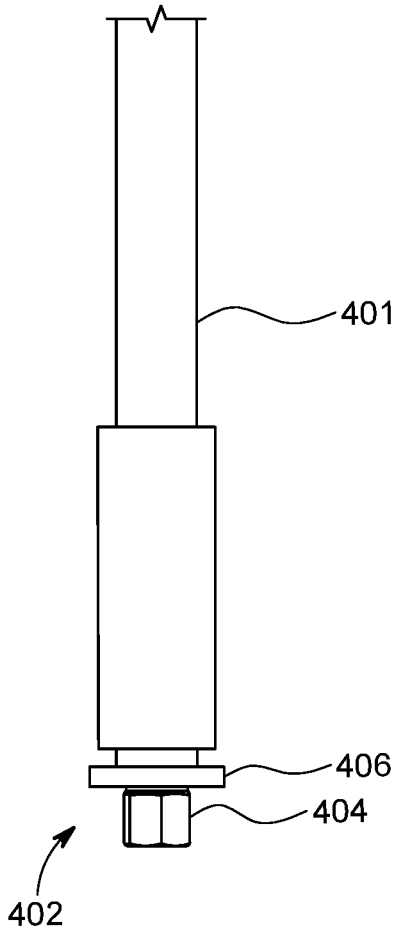
FIG. 12H is an enlarged side view of the gate screw, gate screw head, and gate screw bushing of the material unloading assembly of the bulk material shipping container of FIG. 1.
Figure 12I:
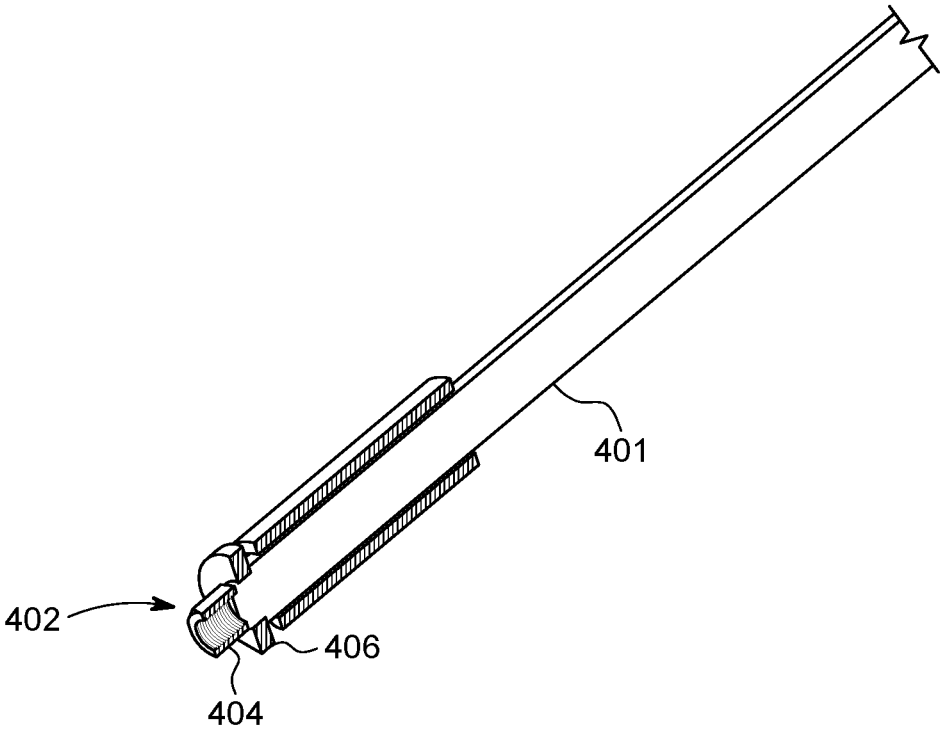
FIG. 12I is an enlarged vertical partial cross-sectional view of the gate screw, gate screw head, and gate screw bushing of the material unloading assembly of the bulk material shipping container of FIG. 1.
Figure 12J:
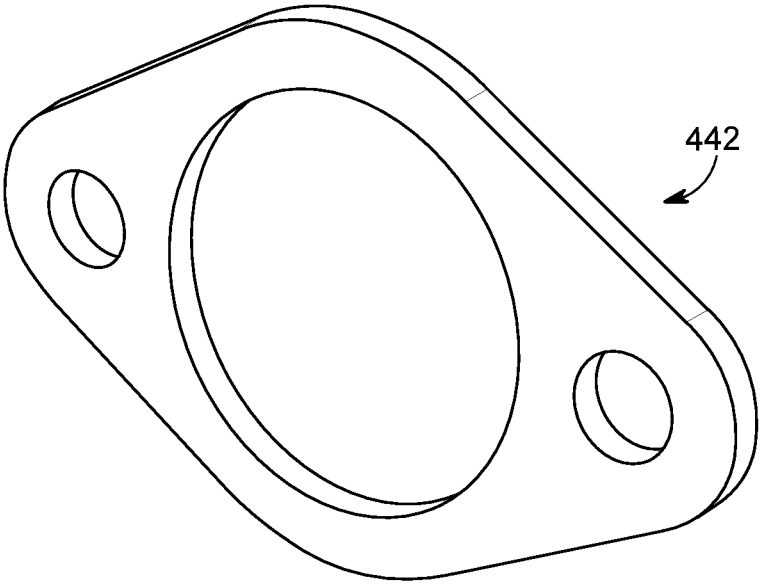
FIG. 12J is an enlarged end view of a first rubber gate screw bearing of the material unloading assembly of the bulk material shipping container of FIG. 1.
Figure 12K:
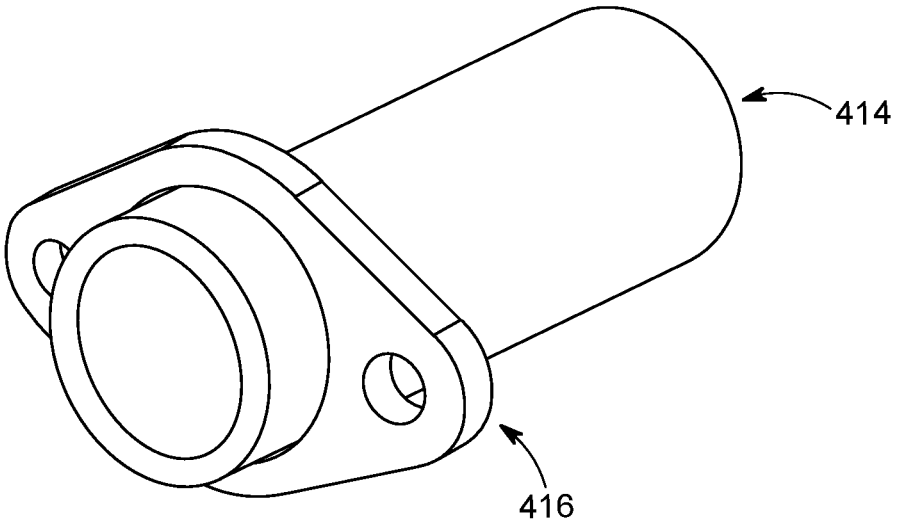
FIG. 12K is an enlarged end view of a second gate screw bearing and first stabilizer tube of the material unloading assembly of the bulk material shipping container of FIG. 1.
Figure 12L:
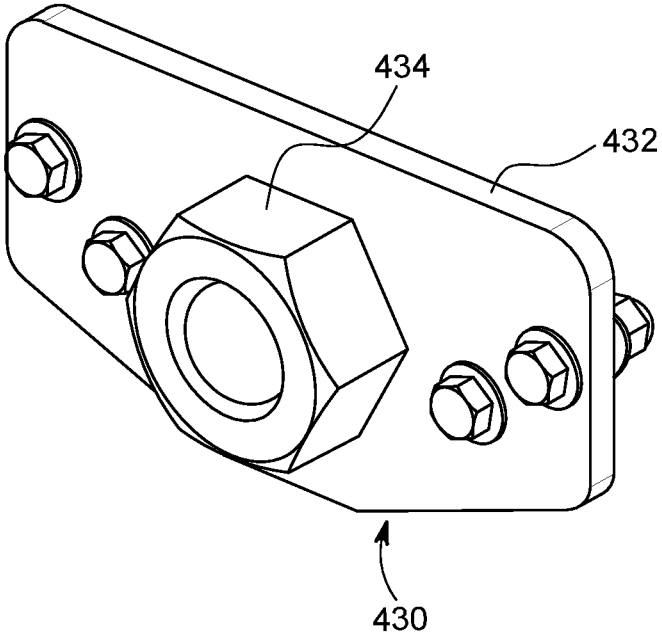
FIG. 12L is an enlarged perspective view of the gate screw mount of the material unloading assembly of the bulk material shipping container of FIG. 1.
Figure 12M:
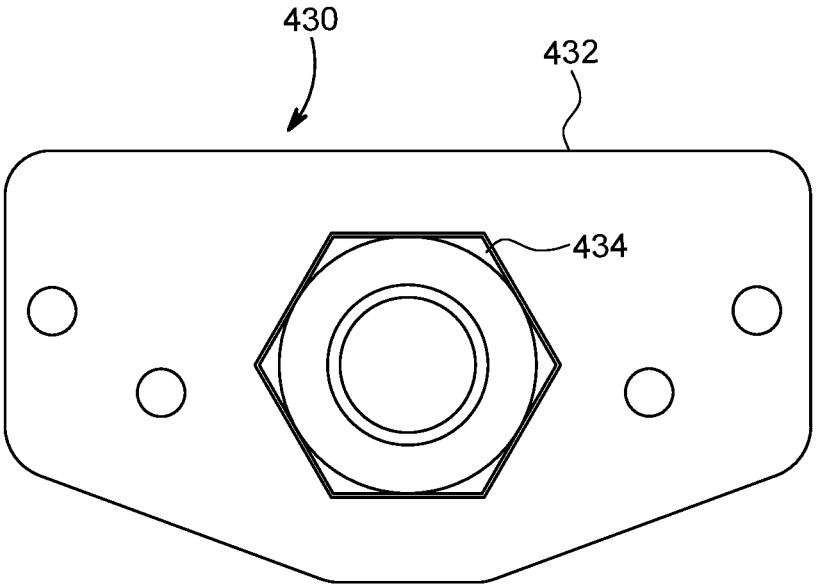
FIG. 12M is an enlarged front end view of the gate screw mount of the material unloading assembly of the bulk material shipping container of FIG. 1.
Figure 12N:
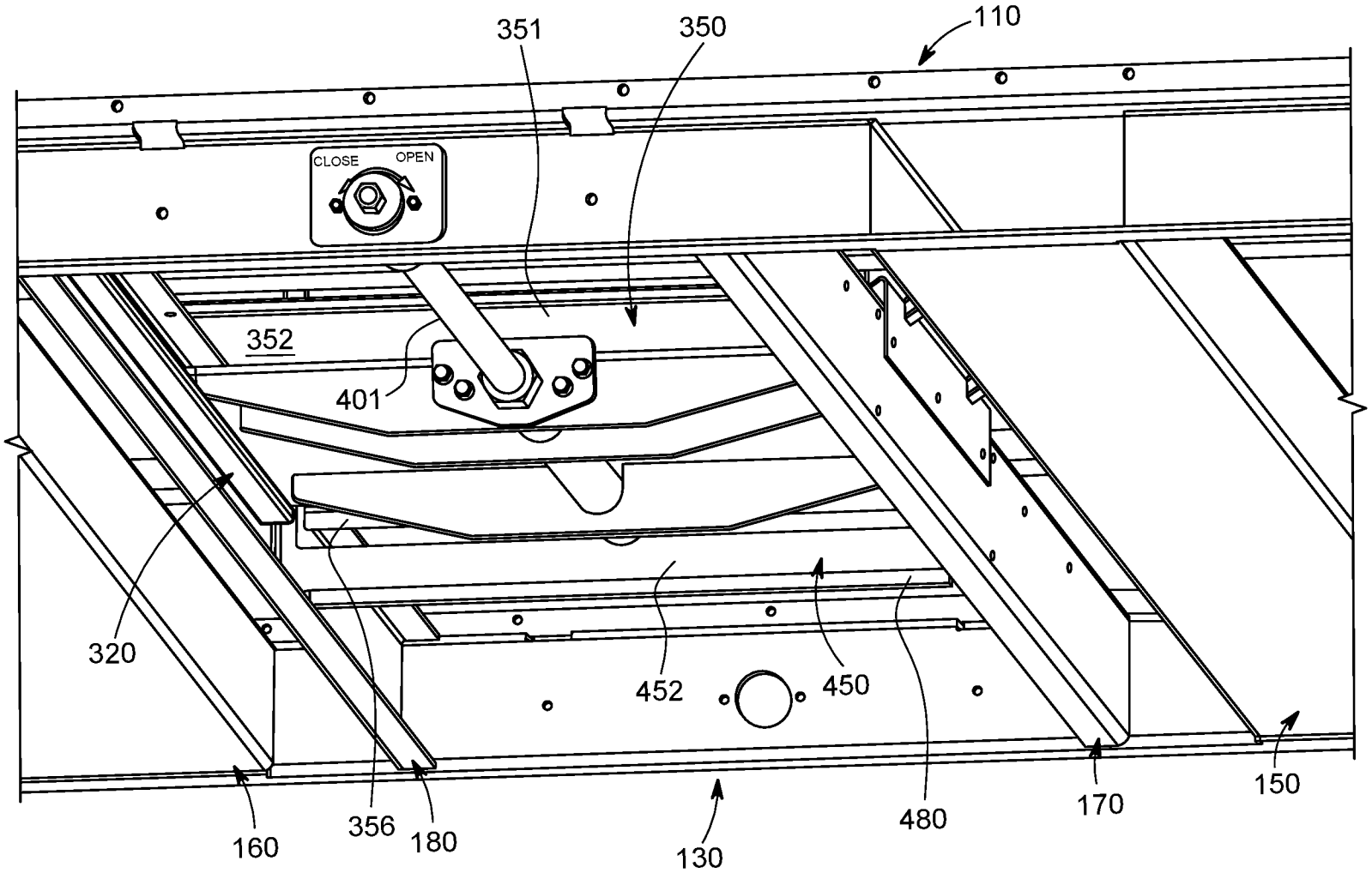
FIG. 12N is a bottom perspective view of the material unloading assembly of the bulk material shipping container of FIG. 1, shown connected to the pallet and showing the rear material director.
Figure 12O:
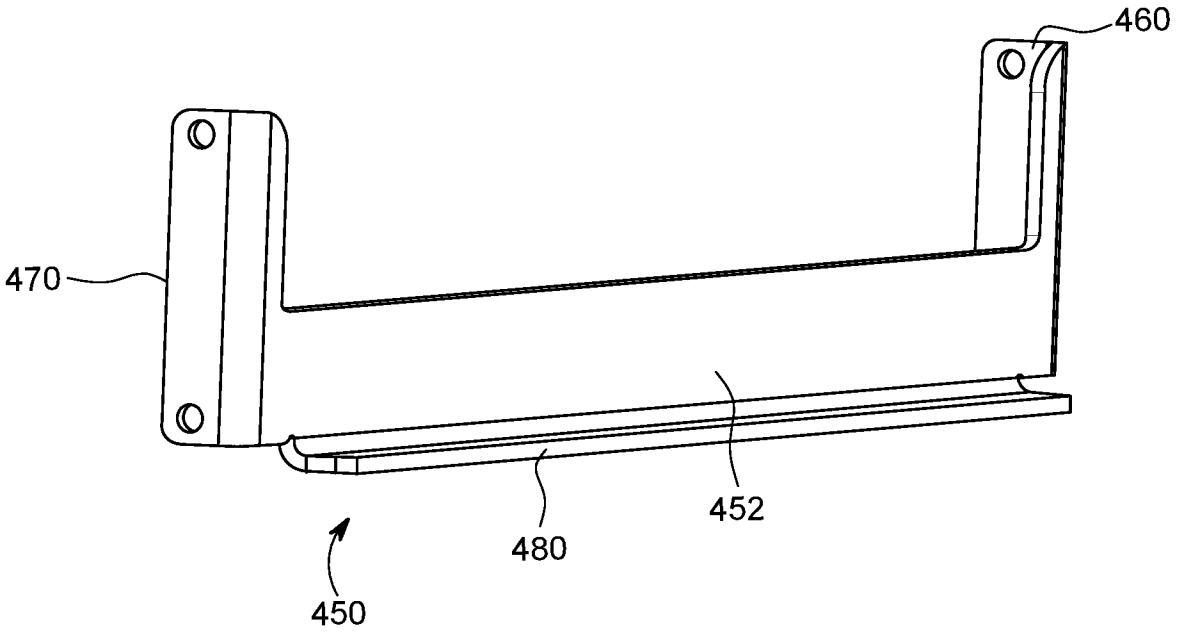
FIG. 12O is a front perspective view of the rear material director of the material unloading assembly of the bulk material shipping container of FIG. 1, shown removed from the pallet.
Figure 12P:
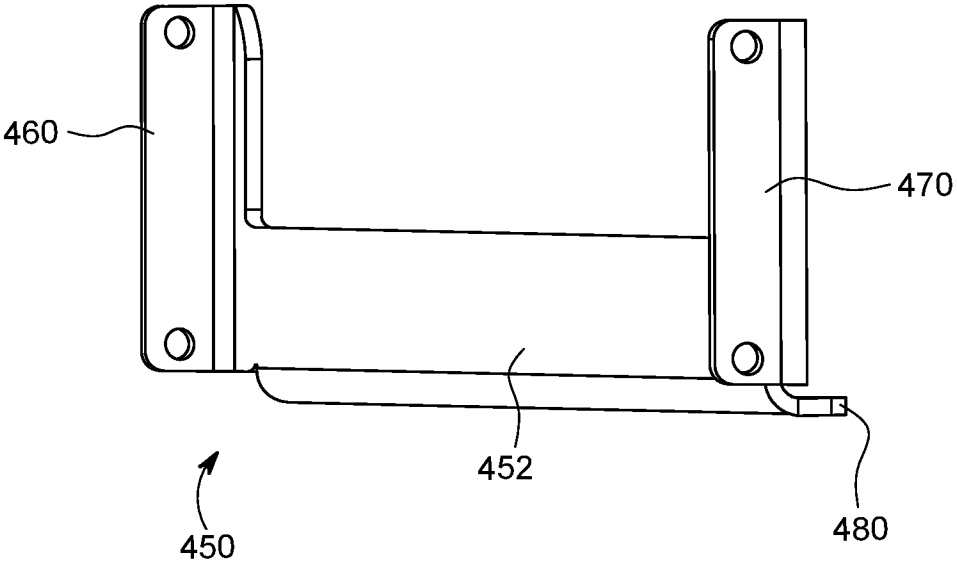
FIG. 12P is a rear perspective view of the rear material director of the material unloading assembly of the bulk material shipping container of FIG. 1, shown removed from the pallet.

As indicated above, the gate 351 of the gate assembly 350 includes a substantially flat generally rectangular closure member 352, a first or left downwardly extending side lip 353 integrally connected to a first or left side of the closure member 352, a second or right downwardly extending side lip 354 integrally connected to a second or right side of the closure member 352, a downwardly extending front end member 355 integrally connected to a front end of the closure member 352, a downwardly extending rear end member or material director 356 integrally connected to a rear end of the closure member 352. The gate 351 is movable or slidable from a closed position (as shown in FIGS. 1, 2, 4, 5, 9, 11L, 11M, 11N, and 12B), to a plurality of different partially opened positions (not shown), and then to a fully opened position (as shown in FIGS. 3 and 12C).

In this illustrated embodiment, the closure member 352 is made from steel to: (a) provide structural strength and rigidity; (b) facilitate ease of cleaning; (c) facilitate ease of repair; and (d) prevent contamination. However, it should be appreciated that in alternative embodiments, the gate and the guide rails can be made from other suitable materials.

The gate assembly 350 further includes a first downwardly extending intermediate support member or stiffener 357 integrally connected to an intermediate portion of the bottom of the closure member 352, and a second downwardly extending intermediate support member or stiffener 358 integrally connected to an intermediate portion of the bottom of the closure member 352.

The gate assembly 350 further includes a tubular cylindrical screw stabilizer 359 that extends through and is integrally connected to the front end member 355, the first intermediate support member or stiffener 357, and the second intermediate support member or stiffener 358. The tubular cylindrical screw stabilizer 359 assists in causing the elongated threaded screw 401 (described below) to spin in a more or substantially true manner.

The downwardly extending rear end member 356 functions as a secondary stopping member to prevent the gate 351 from moving too far forward toward the front support 110. The downwardly extending rear end member 356 also functions as a material director when the gate assembly 350 is in one of the partially opened positions or the fully opened position as further discussed below.

The gate movement assembly 400 includes an elongated threaded gate screw 401 having a first multi-level outer end 401*a*, a threaded (not shown) intermediate section 401*b*, and a threaded (not shown) opposite or inner end 401*c* that extends through and is threadably received in the screw receiver 430 (discussed below) and in the screw stabilizer 359. The elongated threaded gate screw 401 co-acts with the gate screw receiver 430 (that is integrally connected to the gate 351 of the gate assembly 350) such that rotation of the gate screw 401 causes movement of the gate screw receiver 430 and thus movement of the gate 351 and gate assembly 350 including the closure member 352 toward and away from the front support 110. This configuration enables the rotation of the gate screw 401 with minimal movement of the gate screw 401 relative to the front wall support 110 and to the gate assembly 350.

The gate movement assembly 400 includes a gate screw head 402 integrally connected to the first outer end 401*a* of the gate screw 401. The gate screw head 402 includes a nut 404 welded to the first level of the first outer end of the gate screw 401 and a first collar 406 welded to the second larger level of the first outer end of the gate screw 401.

The gate movement assembly 400 further includes a second washer 408 journaled about the gate screw 401, a gate first bushing 409 journaled about the gate screw 401, a gate screw direction plate 410 journaled about the gate screw 401 and connected to the first support 110 (by shoulder bolt fasteners), a first rubber impact-absorbing gate face plate 412 journaled about the gate screw 401 and connected to the first support 110 (by the shoulder bolt fasteners), a gate screw stabilizer tube 414 journaled about the gate screw 401, a second gate screw face plate 416 journaled about the gate screw stabilizer tube 410 and integrally connected thereto and further connected to the first support 110 (by the shoulder bolt fasteners), a third gate screw washer 418 journaled about the gate screw 401, a second gate screw bushing 419 journaled about the gate screw 401, a gate screw pressure clamp 420 journaled about the gates screw 401 and securely connected to the gate screw 401, and the gate screw receiver 430. The gate screw receiver 430 includes a gate screw mounting plate 432 and a threaded nut 434 integrally connected to and extending from the gate screw mounting plate 432, and a second impact-absorbing rubber gate screw face plate (not shown).

As mentioned above, the gate movement assembly 400 includes a first plurality of fasteners and particularly shoulder bolts and nuts (not labeled) that connect the direction plate 410, the first face plate 412, the second face plate 410 (and tube stabilizer 414) to opposite sides of the first support 110. The combination of the shoulder bolts and the first rubber impact-absorbing face plate 412 provide an intentional loose connection between: (a) the first support 110, and (b) the tube stabilizer 414, the second washer 408, the first bushing 409, and the second face plate 416, the third washer 418, the second bushing 419, and the pressure clamp 420 securely connected to the screw 401. This loose connection enables certain movements of the second washer 408, the first bushing 409, the stabilizer tube 414 and the second face plate 416, the third washer 418, the second bushing 419, and the pressure clamp 420 relative to the screw 401, and relatively free rotation or oscillation of the shoulder bolts. The combination of these components enable the screw 401 to spin in either direction without further extending outside of the front to rear width of the container 50.

The gate movement assembly 400 further includes a second plurality of fasteners such as bolts and nuts (not labeled) that attach the gate screw receiver 430 to the gate 351 and particularly the downwardly extending front end member 355 of the gate 351.

In this illustrated example embodiment, the gate screw 401 is a 1.5 inch diameter cylindrical threaded rod. It should be appreciated that the gate screw may be made in other suitable sizes and from other different materials such as other different types of steel in accordance with the present disclosure.

The gate screw head 402 is configured to be engaged or gripped by a socket, wrench, or other tool of the user to open and close the gate assembly 350 and particularly the gate 351. This configuration also inhibits or prevents the gate assembly 350 including the gate 351 from opening accidentally. In other words, this configuration of the material unloading assembly 300 and specifically the gate assembly 350 and the gate movement assembly 400 enable a user to secure the gate 351 in a closed position or any specific open position to prevent the gate assembly 350 from being accidentally moved at undesired points in time such as: (a) during loading of the container 50; (b) during transit of the container 50; or (c) at any other point in time prior to the time when an unloader wants to open the gate assembly 350.

It should be appreciated that placing the gate assembly 350 and particularly the gate 351 in a partially open or partially closed positioned enables the user to control the rate of emptying the materials from the container 50.

The rear material director 450 of the material unloading assembly 300 includes an elongated horizontally extending upstanding base wall 452, a first or left side vertically extending attachment arm 460 integrally connected to the left side of and transversely extending rearwardly from the upstanding base wall 452, a second or right side vertically extending attachment arm 470 integrally connected to the right side of and transversely extending rearwardly from the upstanding base wall 452, and a downwardly and rearwardly extending material director wall 480 integrally connected to the bottom of the upstanding base wall 452.

The rearwardly extending material director wall 480 of the upstanding base wall 452 co-acts with the downwardly extending rear end member or material director 356 of the closure member 352 of the gate 351 of the gate assembly 350 (when the gate 351 is moved to any of the plurality of different partially opened positions and to the fully opened position) to direct material held in the compartment 500 out of the compartment 500.

The rear material director 450 of the material unloading assembly 300 also functions as a backstop to prevent the rearwardly movement of the gate assembly 350.

The rear material director 450 of the material unloading assembly 300 is connected by fasteners (not shown) to the first material unloading assembly support 170 and the second material unloading assembly support 180. The rear material director 450 extends between the first material unloading assembly support 170 and the second material unloading assembly support 180. The rear material director 450 also prevents the first material unloading assembly support 170 and the second material unloading assembly support 180 from respectively bowing outwardly toward the left side and right sides of the container.

The Illustrated Example Compartment

Figure 13A:
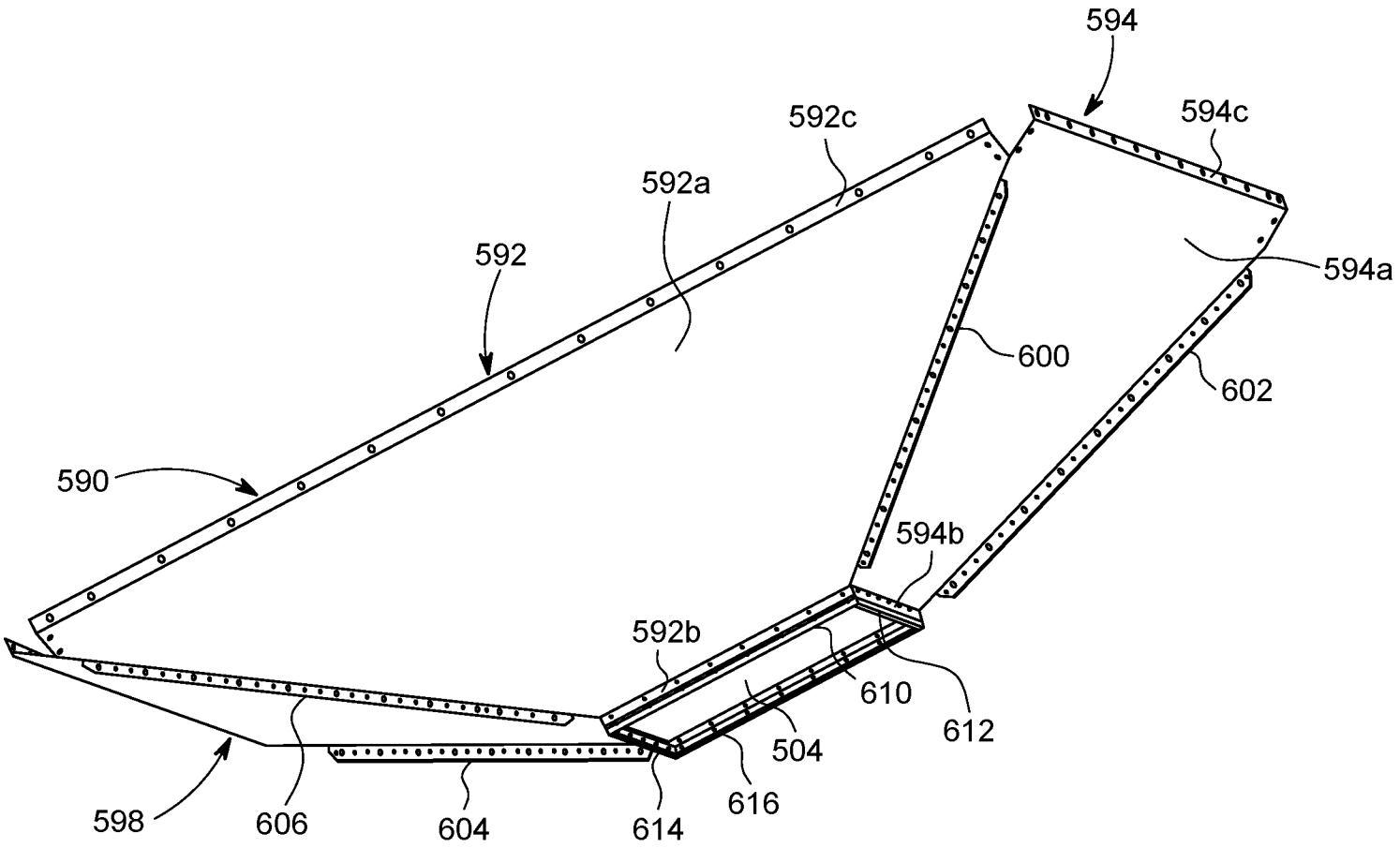
FIG. 13A is an enlarged bottom perspective view of the interior bottom wall assembly of the compartment of the bulk material shipping container of FIG. 1, shown removed from the container.
Figure 13B:
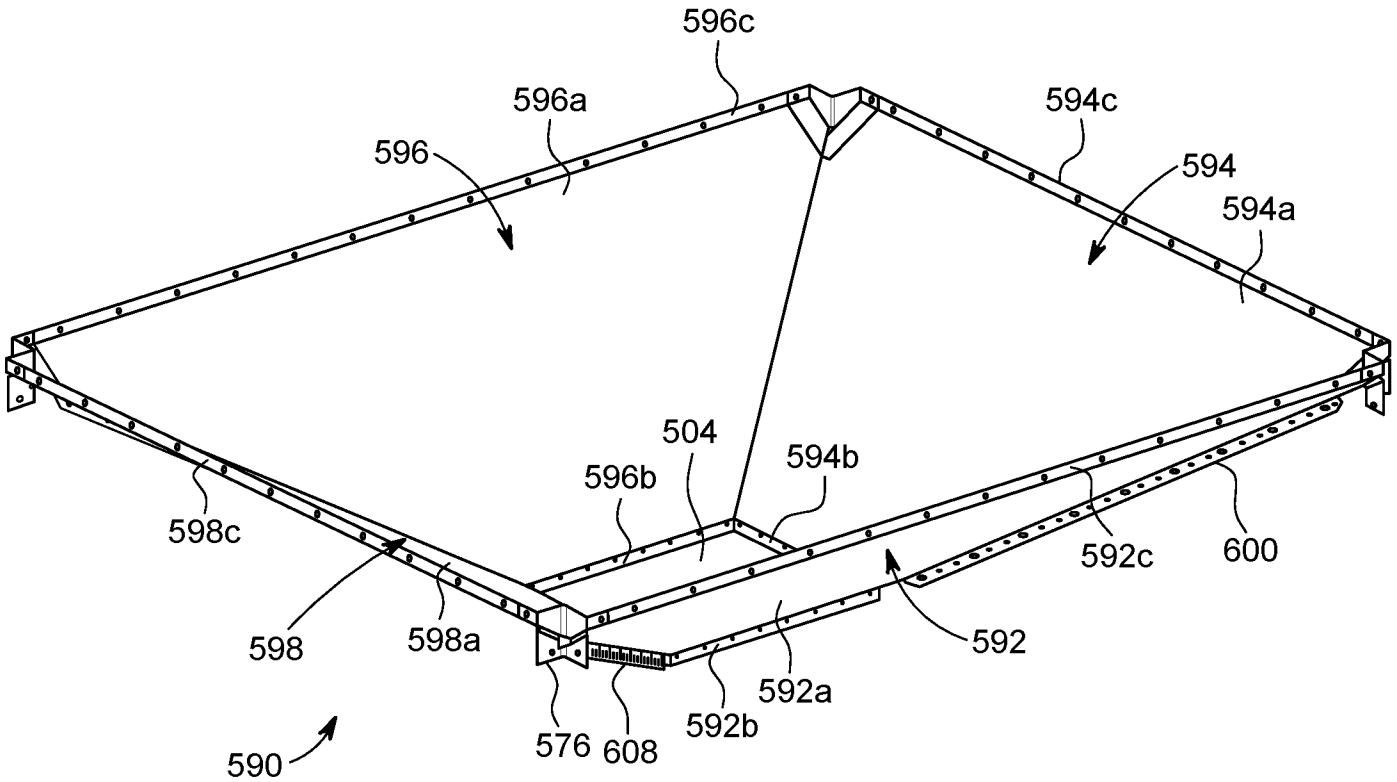
FIG. 13B is an enlarged top perspective view of the interior bottom wall assembly of the compartment of the bulk material shipping container of FIG. 1, shown removed from the container, and showing the winged panel supports and upper V-shaped sealing plates of the upright corner assemblies that partially support the interior bottom wall assembly.
Figure 13C:
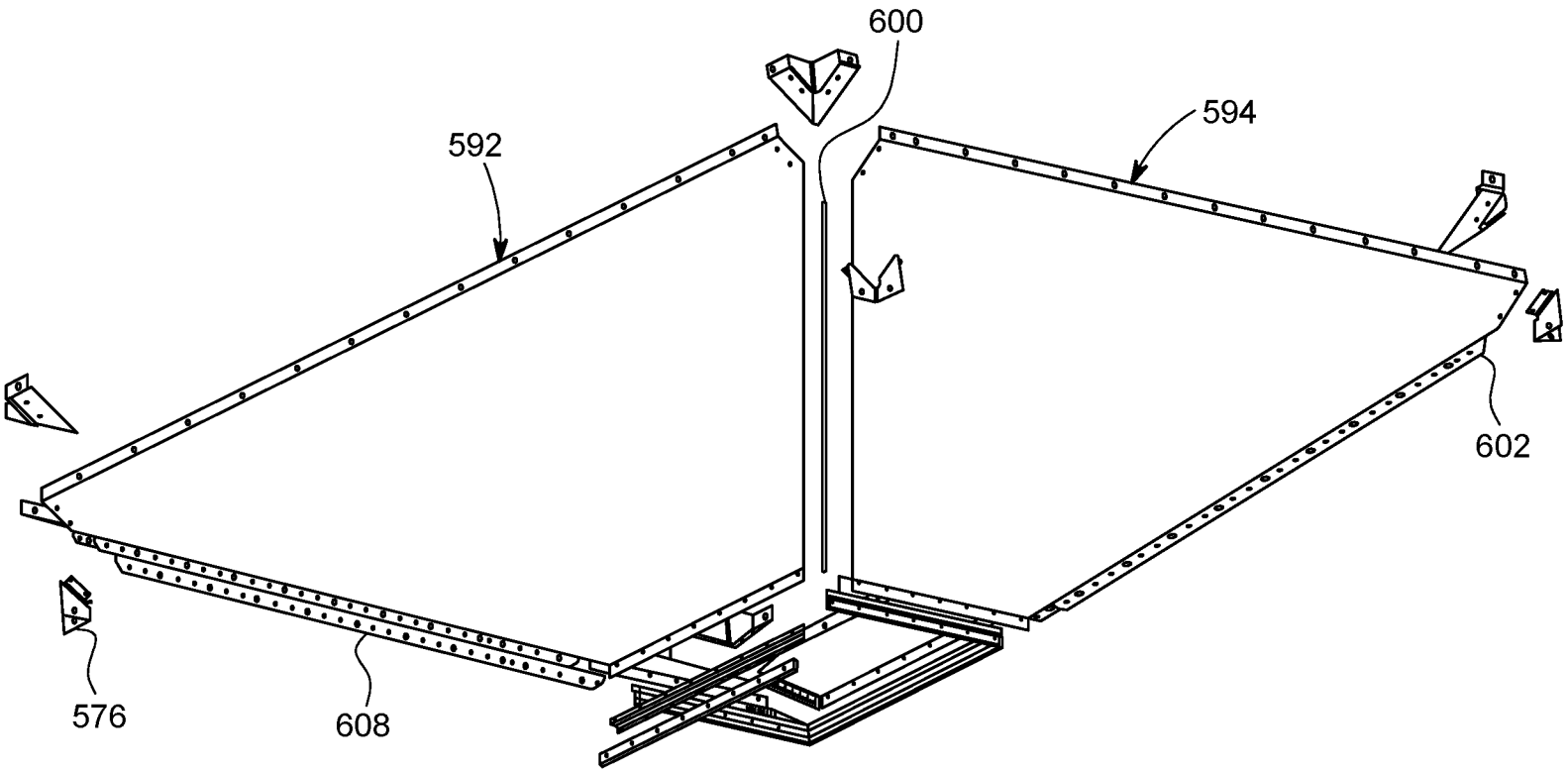
FIG. 13C is an enlarged exploded bottom perspective view of the interior bottom wall assembly of the compartment of the bulk material shipping container of FIG. 1, shown removed from the container, showing the winged panel supports and upper V-shaped sealing plates of the upright corner assemblies that partially support the interior bottom wall assembly.
Figure 13D:
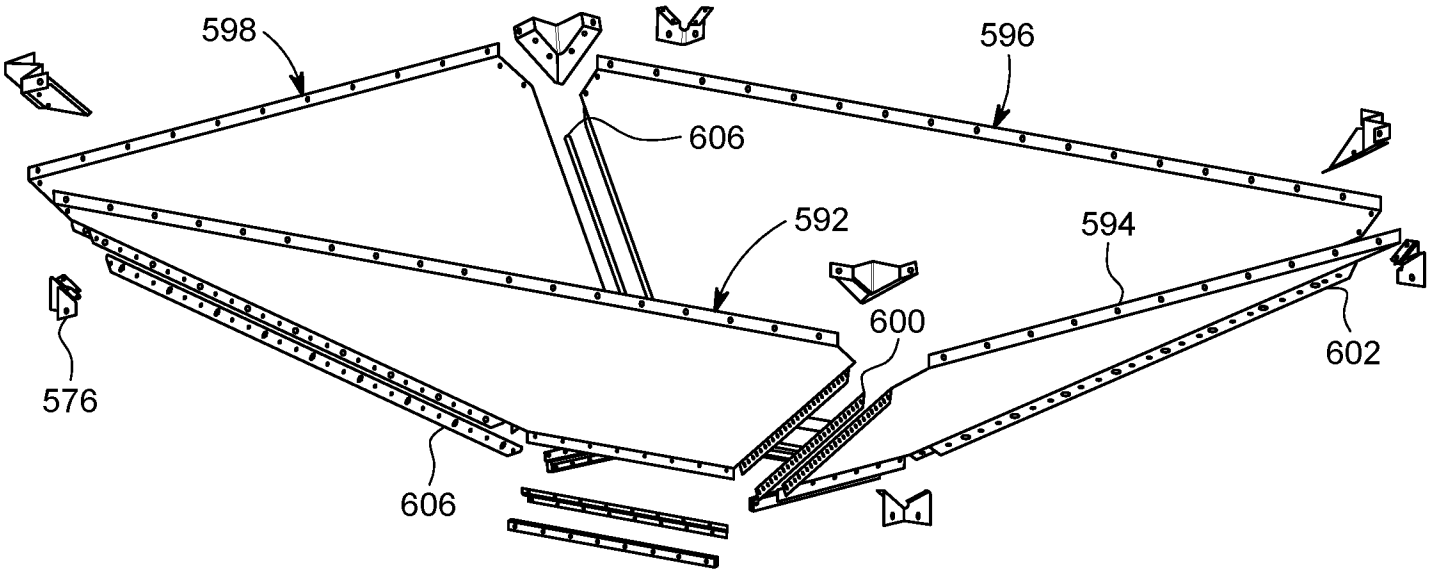
FIG. 13D is an enlarged exploded top perspective view of the interior bottom wall assembly of the compartment of the bulk material shipping container of FIG. 1, shown removed from the container, showing the winged panel supports and upper V-shaped sealing plates of the upright corner assemblies that partially support the interior bottom wall assembly.
Figure 13E:
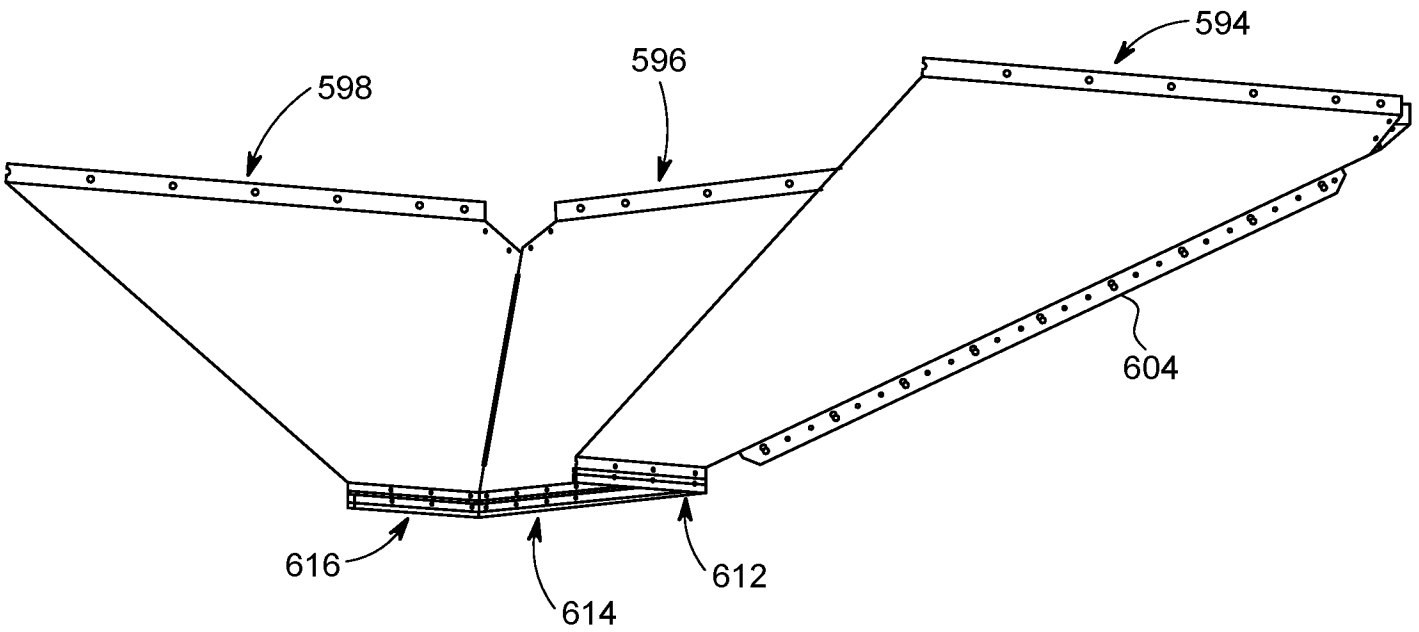
FIG. 13E is an enlarged vertical cross-sectional bottom perspective view of the interior bottom wall assembly of the compartment of the bulk material shipping container of FIG. 1, shown removed from the container.
Figure 13F:
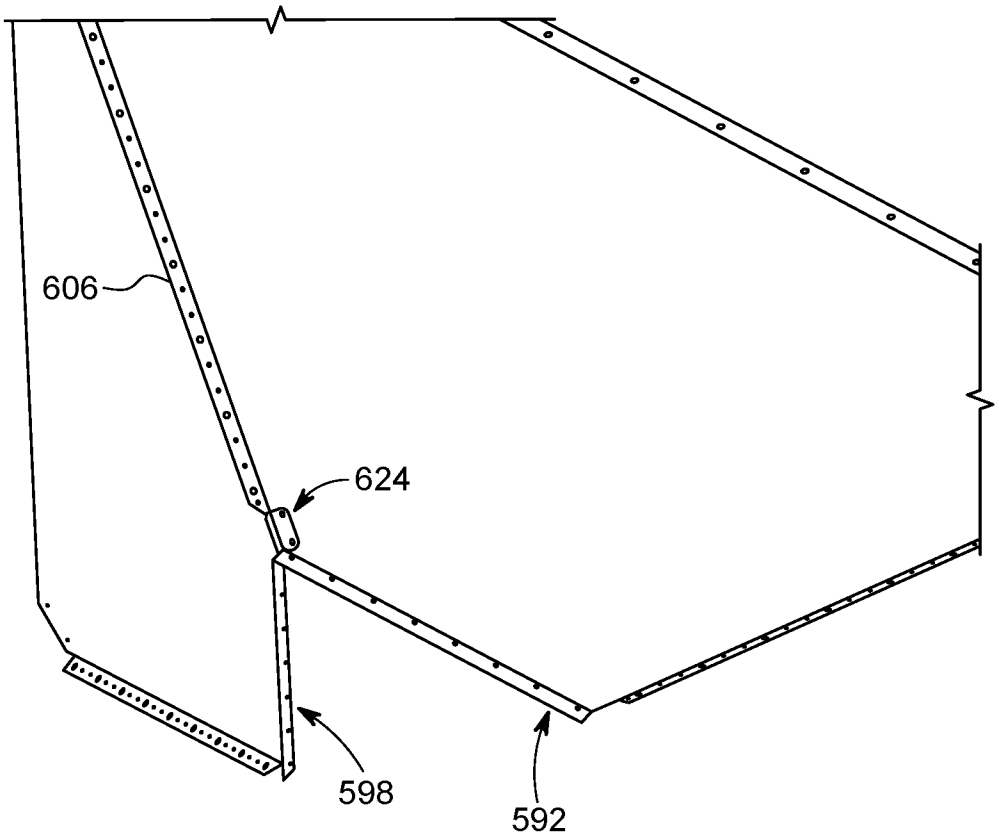
FIG. 13F is an enlarged fragmentary bottom perspective view of the two of the adjacent panels of the interior bottom wall assembly of the compartment of the bulk material shipping container of FIG. 1, shown removed from the container, and showing one of the butterfly leakage prevention plates of the interior bottom wall assembly.
Figure 13G:
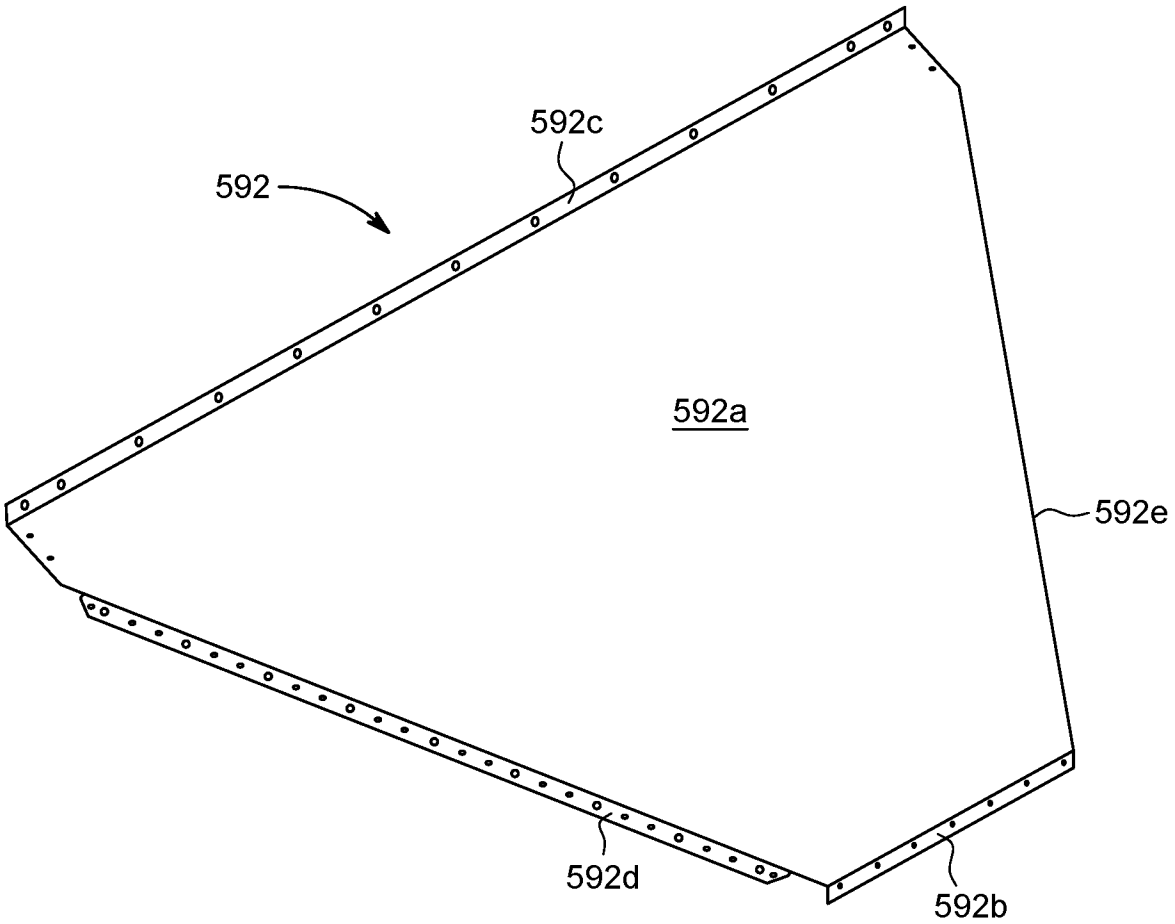
FIG. 13G is an enlarged top perspective view of one of the panels of the interior bottom wall assembly of the compartment of the bulk material shipping container of FIG. 1.
Figure 13H:
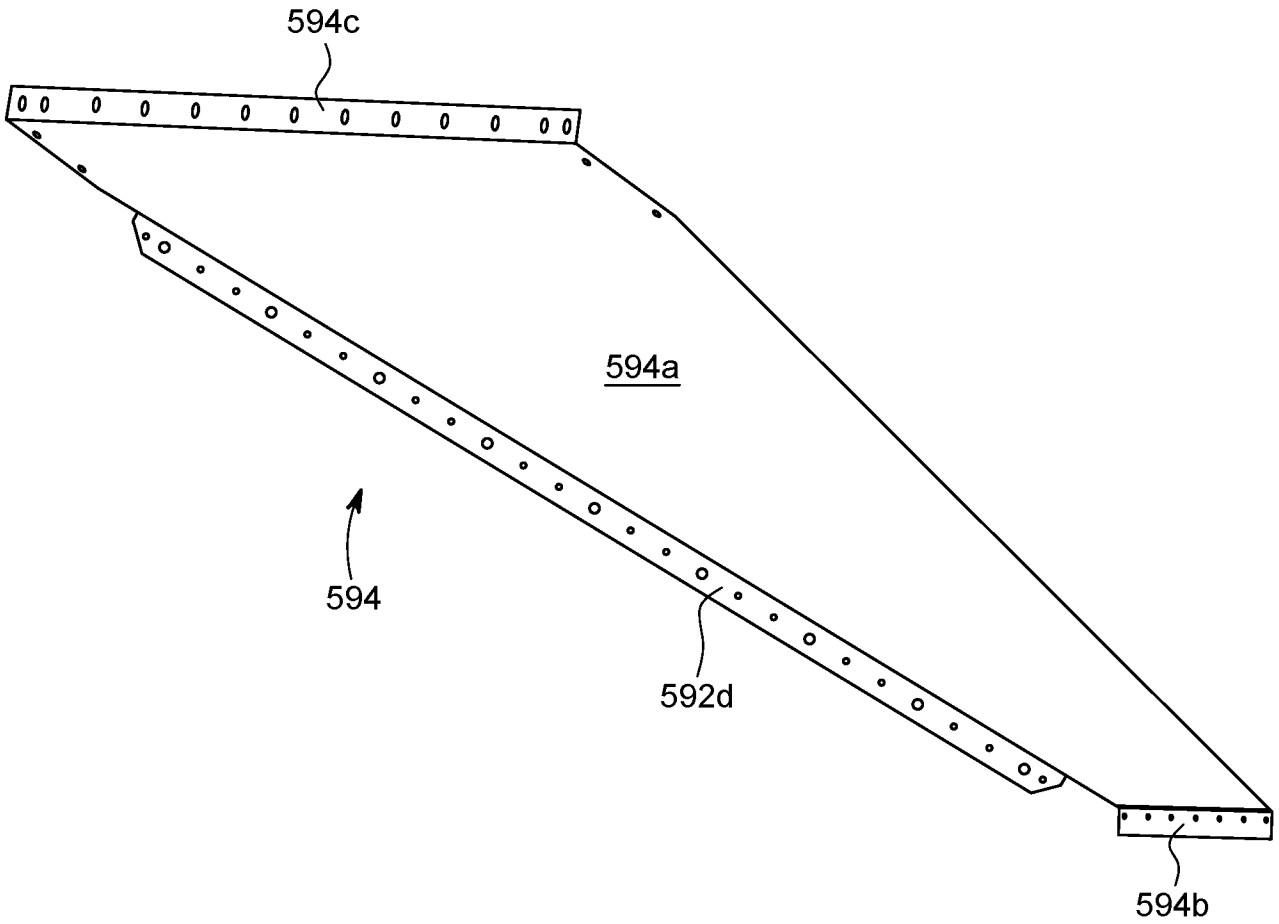
FIGS. 13H and 13I are enlarged top and bottom perspective views of another one of the panels of the interior bottom wall assembly of the compartment of the bulk material shipping container of FIG. 1.
Figure 13I:
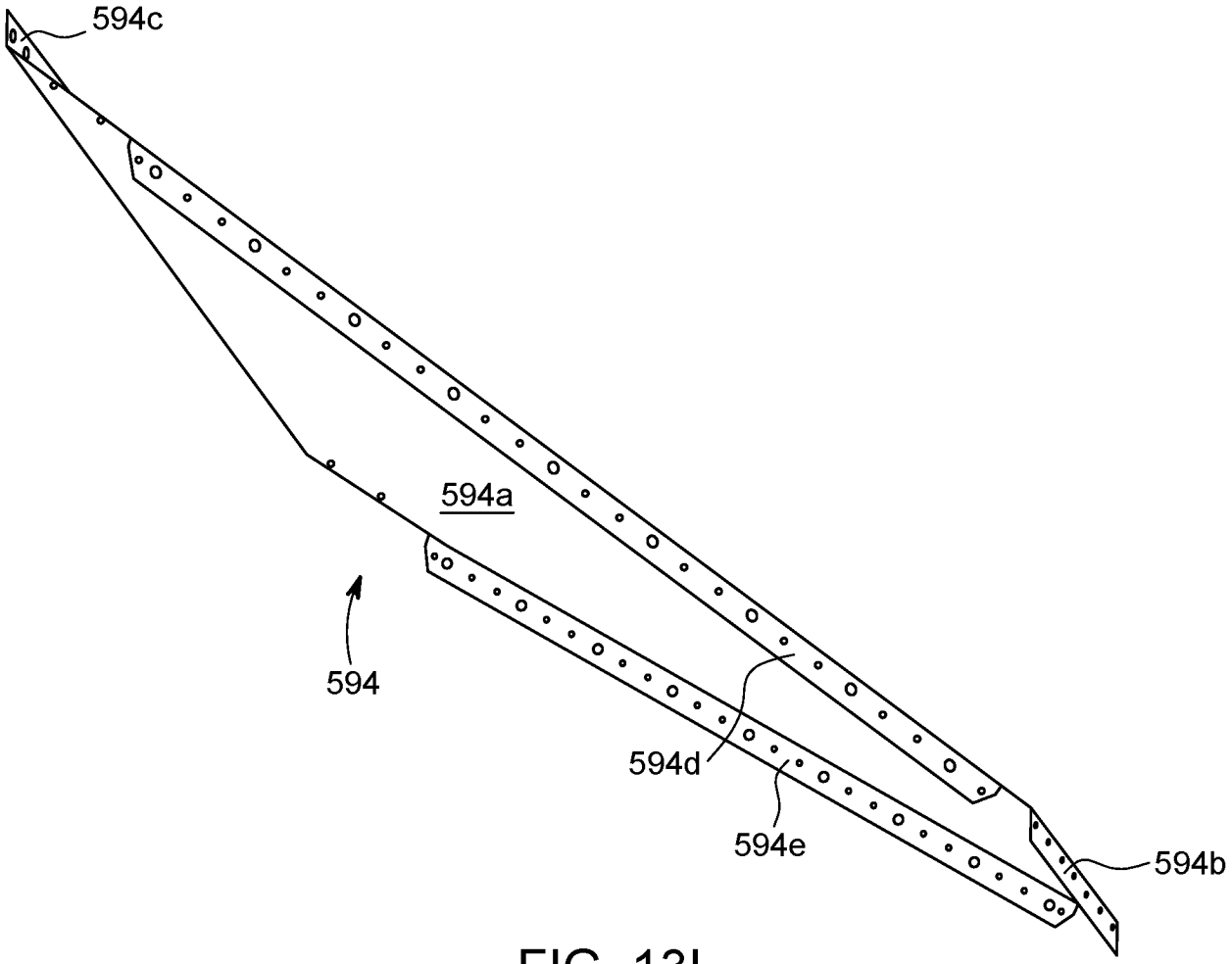
Figure 13J:
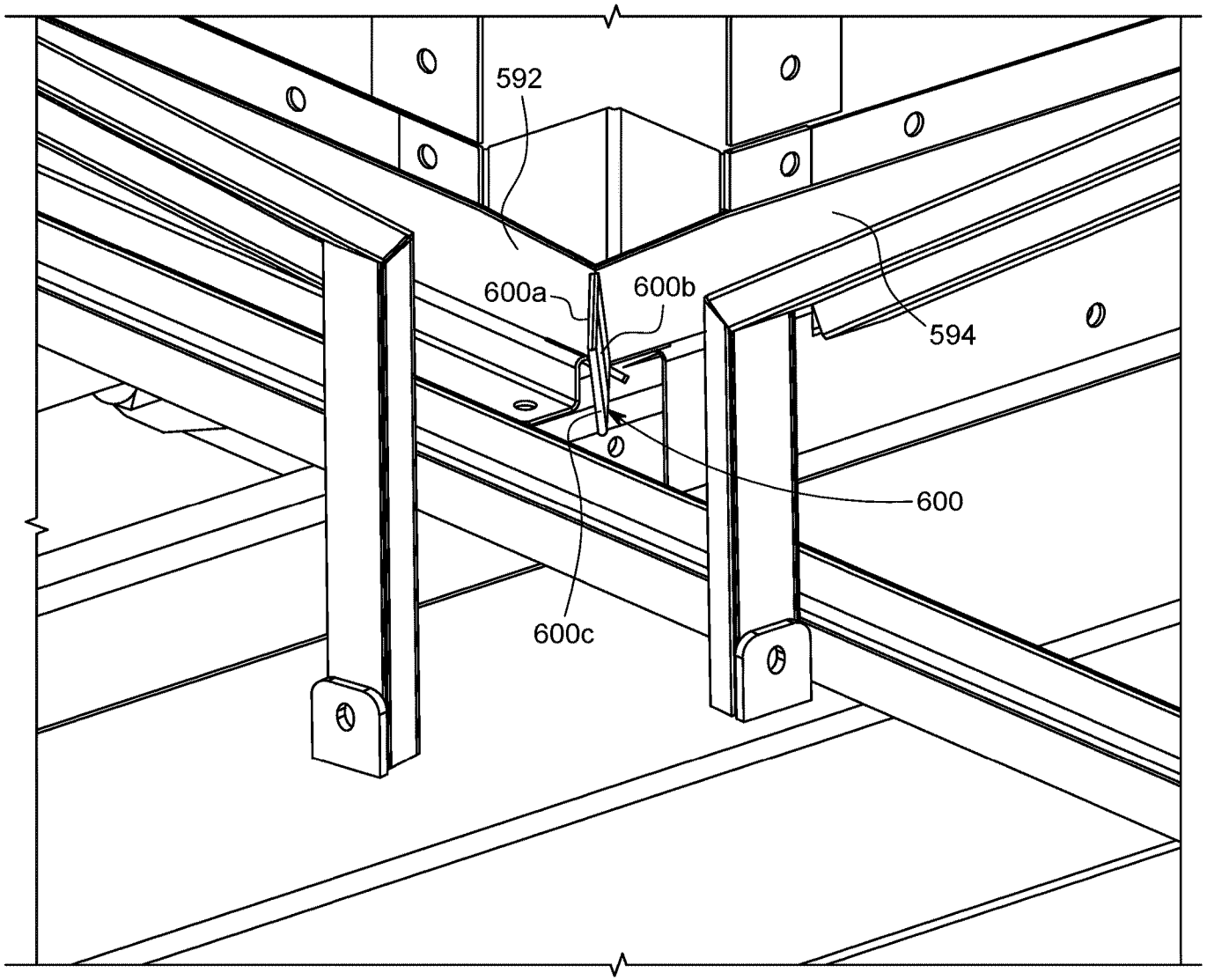
FIG. 13J is an enlarged fragmentary bottom perspective view of a lower part of the compartment of the bulk material shipping container of FIG. 1, showing one of the interior bottom wall leakage guards of the interior bottom wall assembly.
Figure 13K:
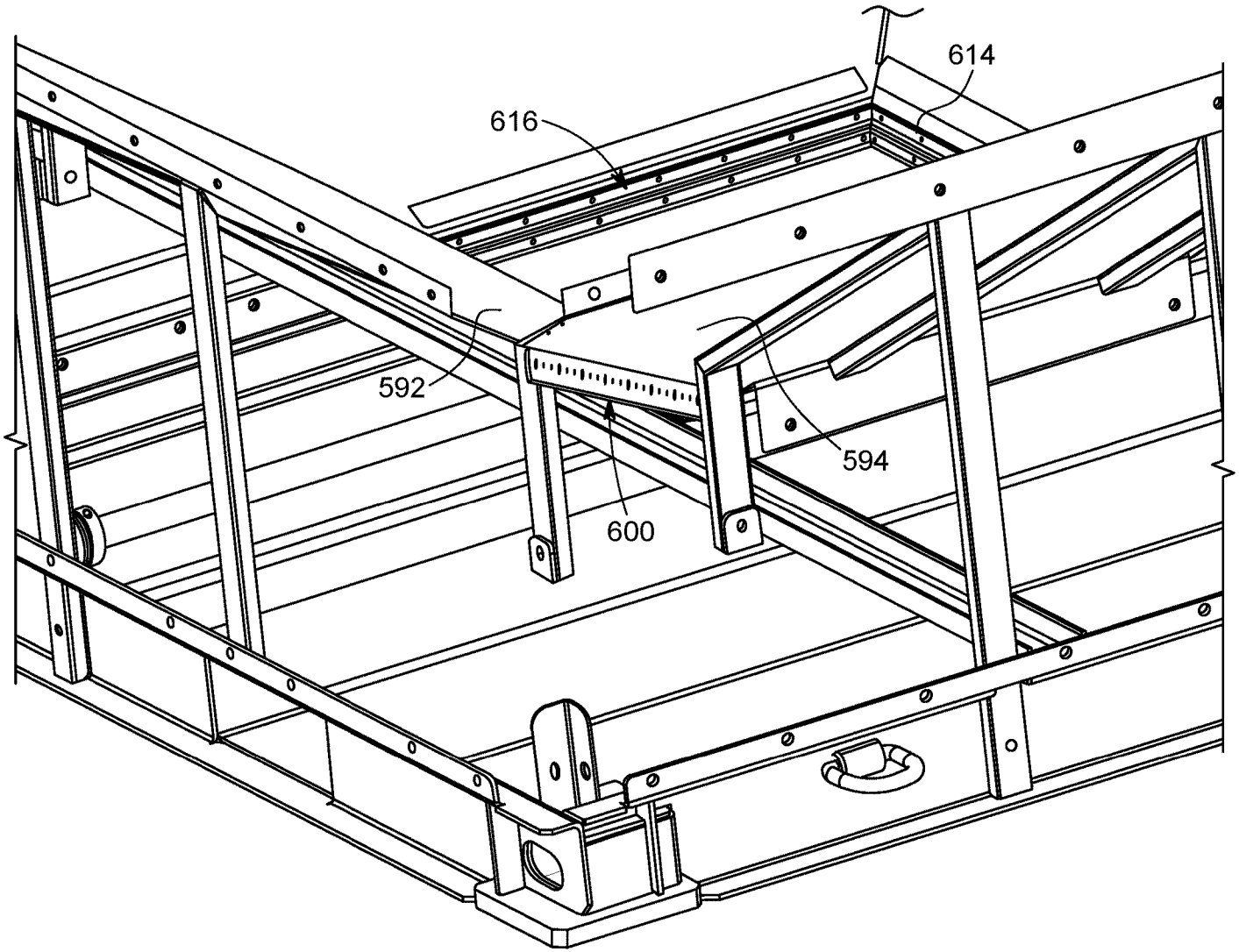
FIG. 13K is an enlarged fragmentary bottom perspective view of a lower part of the compartment of the bulk material shipping container of FIG. 1, showing one of the interior bottom wall leakage guards of the interior bottom wall assembly.

The compartment 500 of this illustrated example embodiment of the shipping container 50 of the present disclosure is generally illustrated in FIGS. 1 to 10, and more specifically illustrated in FIGS. 13A to 13BBB. The compartment 500 defines a chamber or material holding area 502 configured to receive, hold, and release materials (not shown).

The compartment 500 generally includes: (a) a first upright corner assembly 510; (b) a second upright corner assembly 530; (c) a third upright corner assembly 550; (d) a fourth upright corner assembly 570; (e) an interior bottom wall assembly 590; (f) an interior bottom wall support assembly 630; (g) an exterior front wall assembly 670; (h) an exterior first or left side wall assembly 690; (i) an exterior rear wall assembly 710; (j) an exterior second or right side wall assembly 730; (k) a first upper corner assembly 750; (l) an second upper corner assembly 770; (m) an third upper corner assembly 790; (n) a fourth upper corner assembly 810; and (o) a top wall assembly 850. The first upright corner assembly 510, the second upright corner assembly 530, the third upright corner assembly 550, the fourth upright corner assembly 570, the interior bottom wall assembly 590, the exterior front wall assembly 670, the exterior first or left side wall assembly 690, the exterior rear wall assembly 710, the exterior second or right side wall assembly 730, and the top wall assembly 850 define the compartment material holding area 502 that extends downwardly from the top wall assembly 850 toward the interior bottom wall assembly 590, and to a material release opening or chute 504 defined by the interior bottom wall assembly 590. In this illustrated embodiment of the material unloading assembly of the bulk material shipping container, the combination of the first upright corner assembly 510, the second upright corner assembly 530, the third upright corner assembly 550, the fourth upright corner assembly 570, the interior bottom wall assembly 590, the interior bottom wall support assembly 630, the exterior front wall assembly 670, the exterior left side wall assembly 690, the exterior rear wall assembly 710, the exterior right side wall assembly 730, the first upper corner assembly 750, the second upper corner assembly 770, the third upper corner assembly 790, the fourth upper corner assembly 810, and the top wall assembly 850, enables the container 50 to be stronger than various known containers, more durable than various known containers, hold greater volumes of materials than various known containers, hold greater weights of materials than various known containers, and have a better weight to holding cargo capacity than various known containers.

In this illustrated embodiment, except as set forth herein (such as for the composite panels of the exterior wall assemblies), the first upright corner assembly 510, the second upright corner assembly 530, the third upright corner assembly 550, the fourth upright corner assembly 570, the interior bottom wall assembly 590, the exterior front wall assembly 670, the exterior first or left side wall assembly 690, the exterior rear wall assembly 710, the exterior second or right side wall assembly 730, and the top wall assembly 850 are all formed from steel and suitably connected by fasteners or welding to provide suitable structural strength and rigidity. However, it should be appreciated that in alternative embodiments of the present disclosure, the compartment 500 or one or more parts thereof can be made from other suitably strong materials (such as wood, plastic, or composite or fiber glass materials) and that two or more parts thereof can be suitably connected in other manners.

Figure 13L:
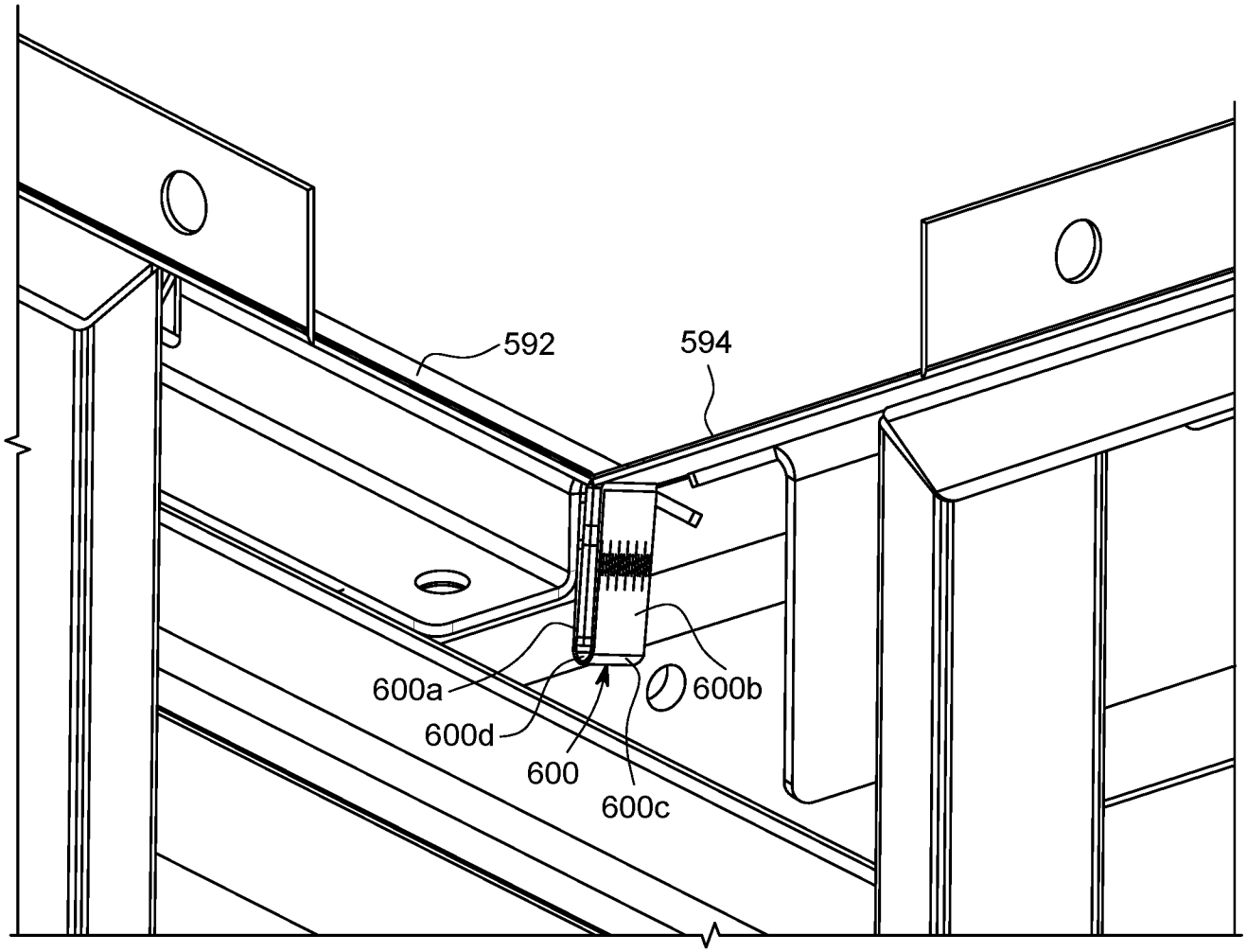
FIG. 13L is an enlarged fragmentary bottom perspective view of a lower part of the compartment of the bulk material shipping container of FIG. 1, showing one of the interior bottom wall leakage guards of the interior bottom wall assembly.
Figure 13M:
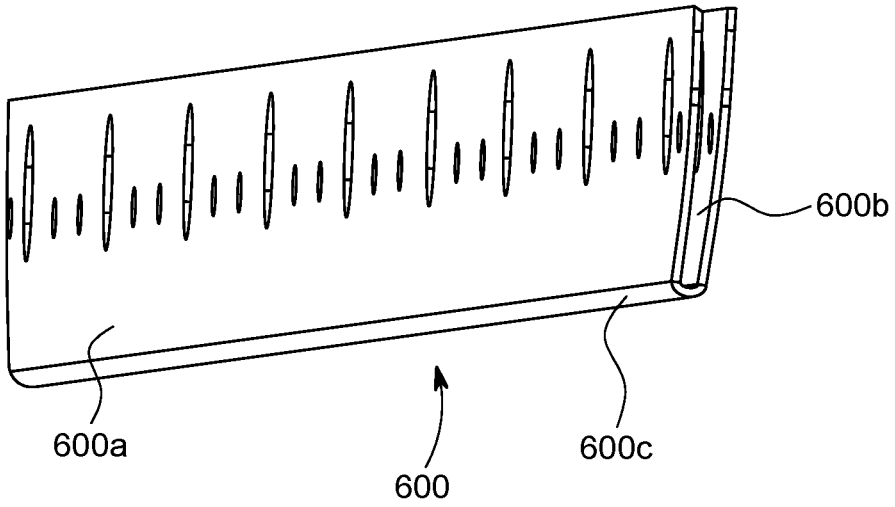
FIG. 13M is an enlarged side perspective view of one of the bottom wall leakage guards of the interior bottom wall assembly of the compartment of the bulk material shipping container of FIG. 1.
Figure 13N:
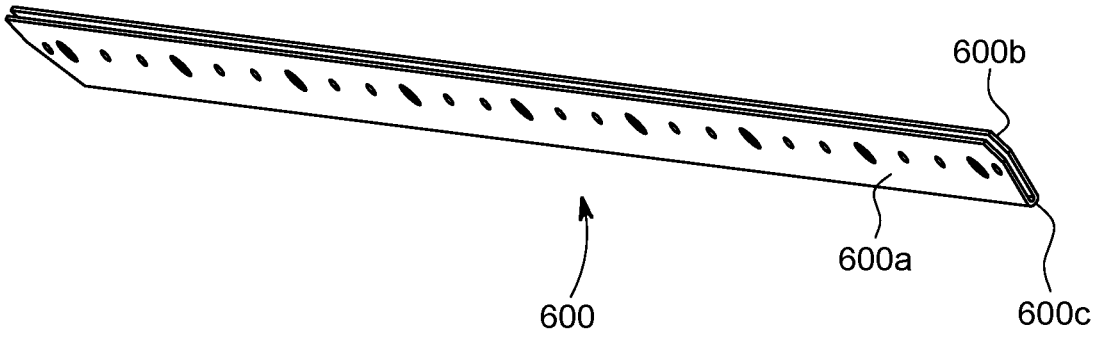
FIG. 13N is an enlarged top perspective side view of one of the bottom wall leakage guards of the interior bottom wall assembly of the compartment of the bulk material shipping container of FIG. 1.
Figure 13O:
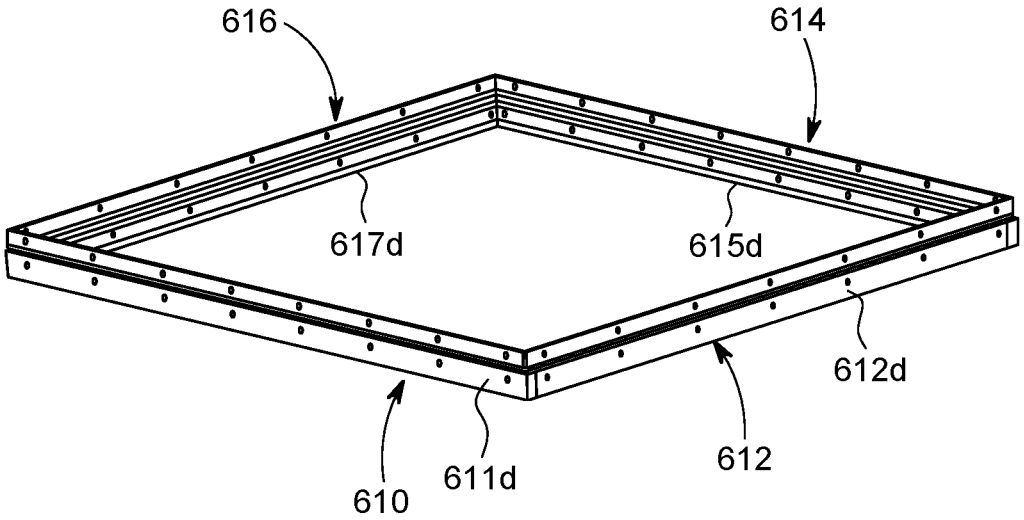
FIG. 13O is an enlarged perspective of the gate sealing members of the interior bottom wall assembly of the compartment of the bulk material shipping container of FIG. 1, shown removed from the rest of the interior bottom wall assembly.
Figure 13P:
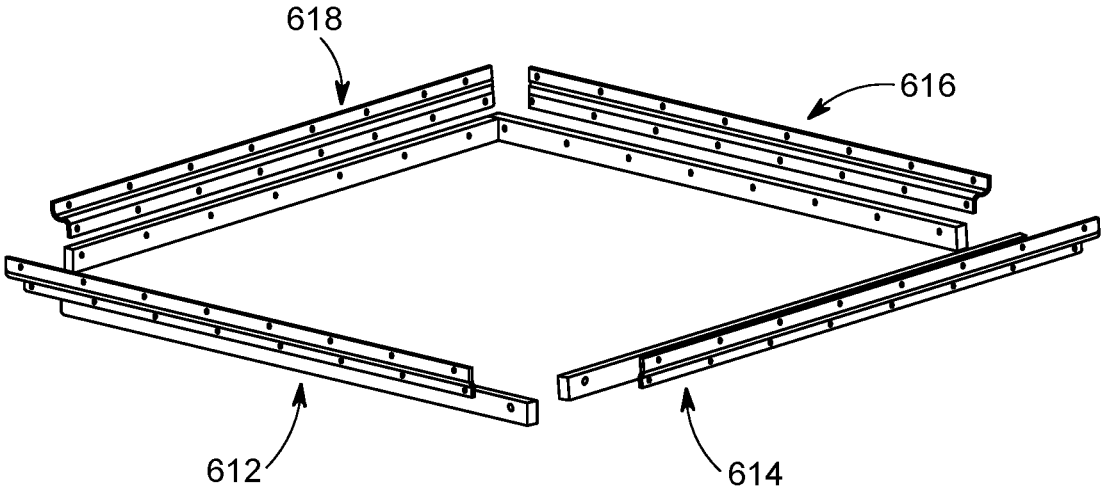
FIG. 13P is an enlarged exploded perspective of the gate sealing members of the interior bottom wall assembly of the compartment of the bulk material shipping container of FIG. 1, shown removed from the rest of the interior bottom wall assembly.
Figure 13Q:
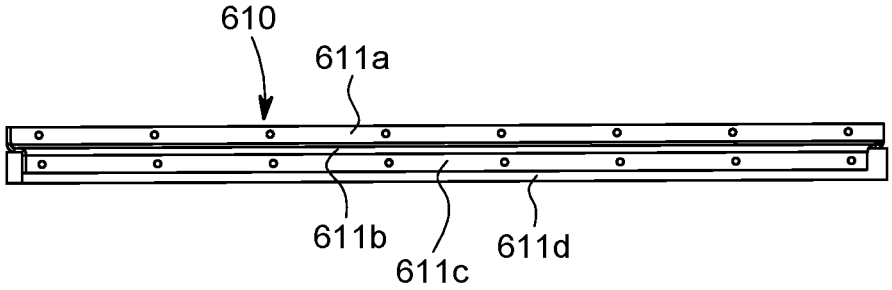
FIG. 13Q is an enlarged perspective view of one of the gate sealing members of the interior bottom wall assembly of the compartment of the bulk material shipping container of FIG. 1.
Figure 13R:
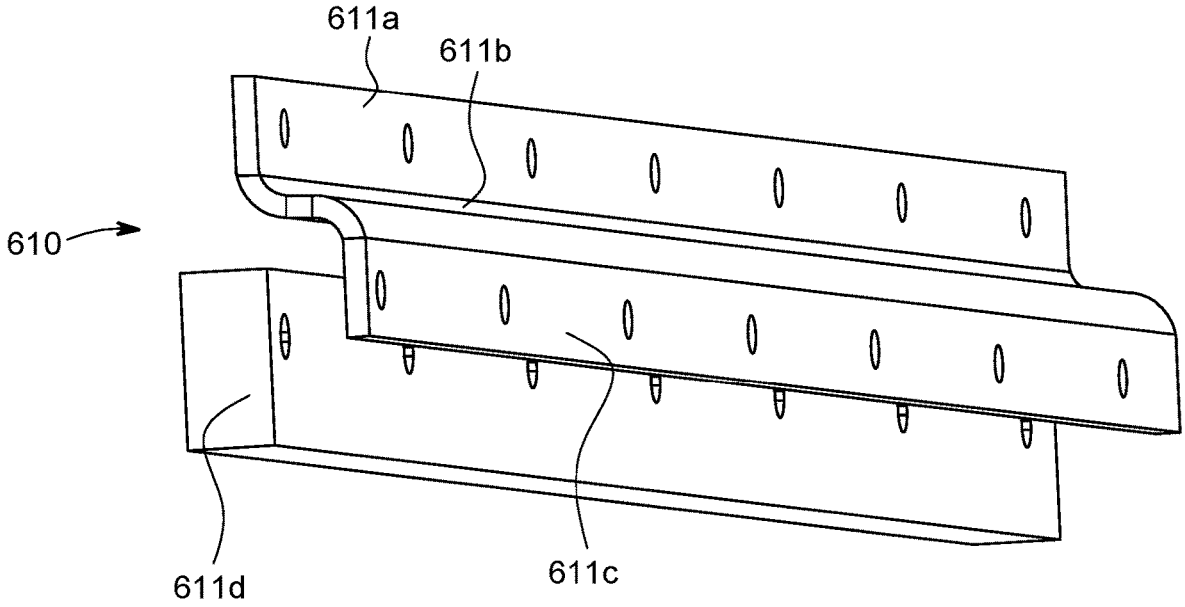
FIG. 13R is an enlarged exploded perspective view of one of the gate sealing members of the interior bottom wall assembly of the compartment of the bulk material shipping container of FIG. 1.
Figure 13S:
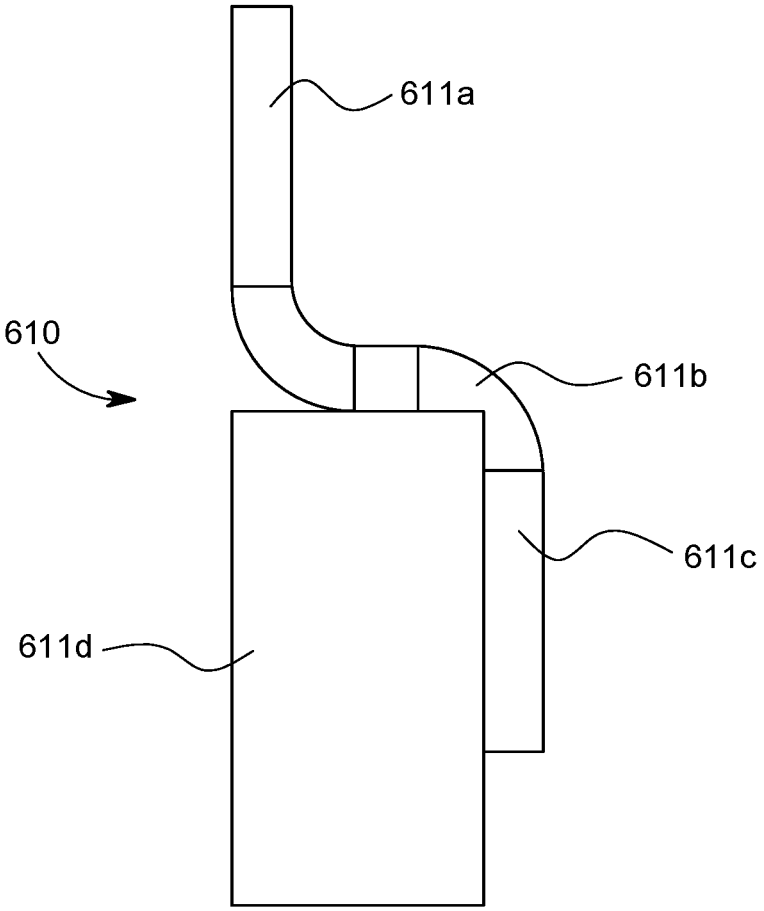
FIG. 13S is an enlarged end view of one of the gate sealing members of the interior bottom wall assembly of the compartment of the bulk material shipping container of FIG. 1.
Figure 13T:
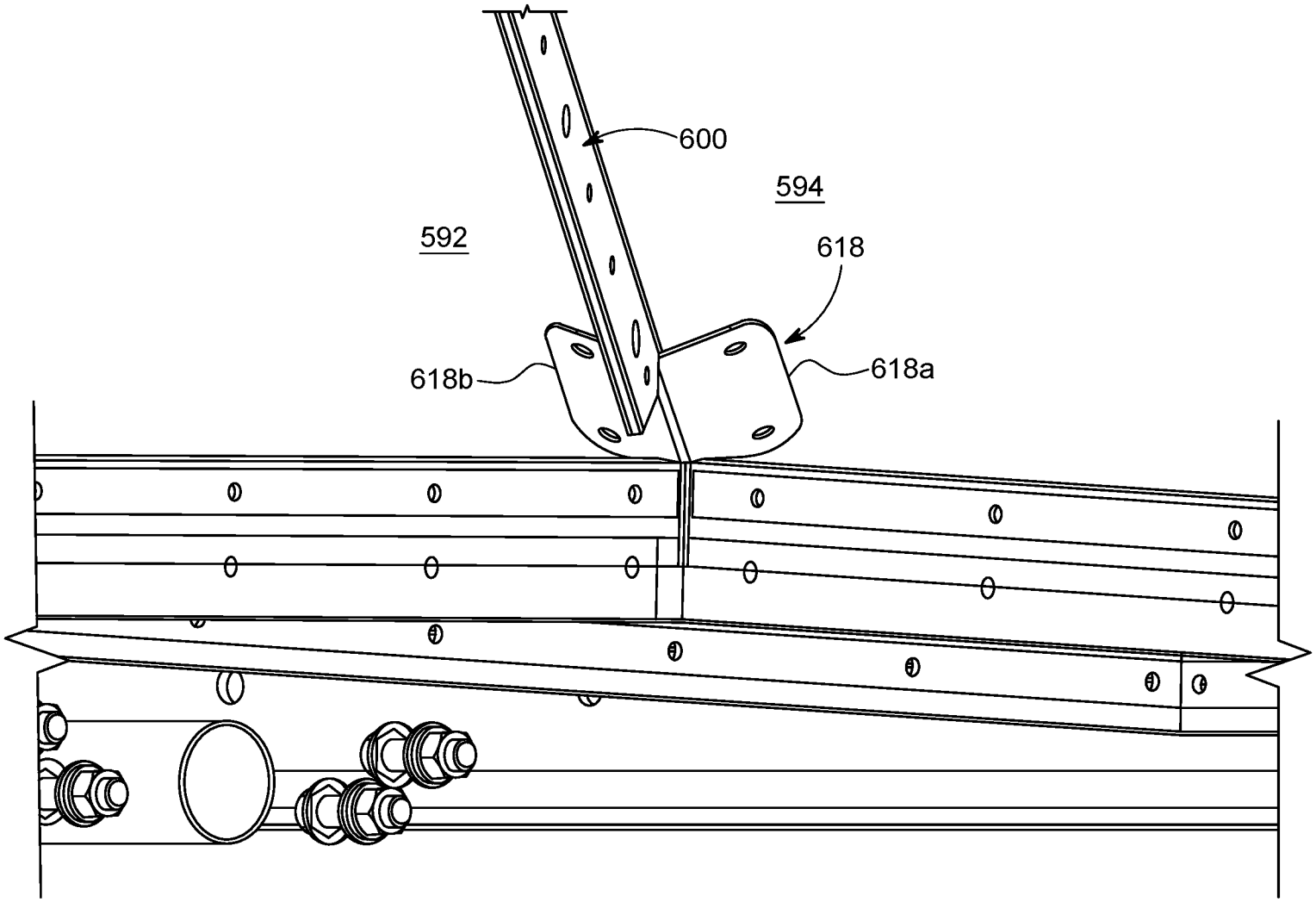
FIG. 13T is a fragmentary bottom perspective view of the bottom of one of the butterfly leakage prevention plates of the interior bottom wall assembly of the compartment of the bulk material shipping container of FIG. 1, shown connected to two adjacent panels of the interior bottom wall assembly.
Figure 13U:
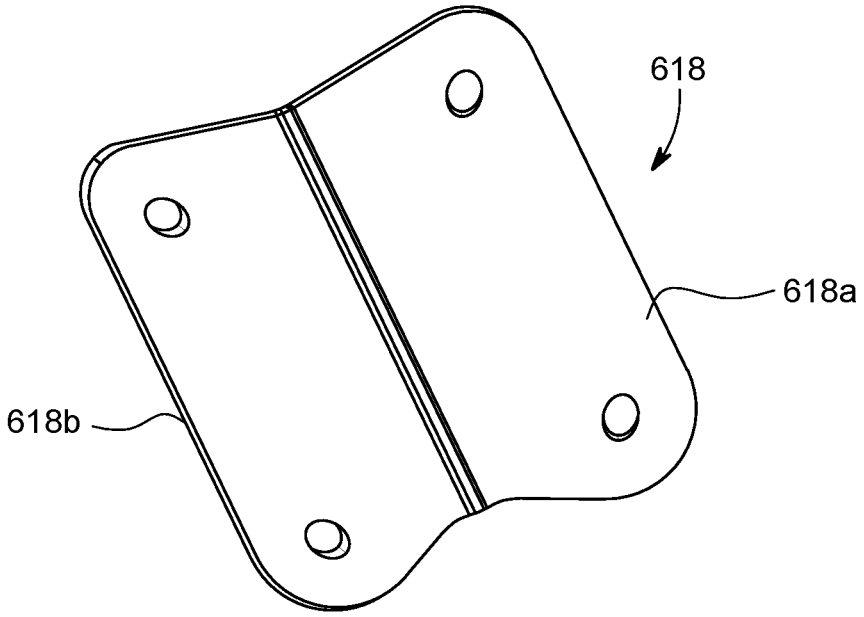
FIG. 13U is a top perspective view of one of the butterfly leakage prevention plates of the interior bottom wall assembly of the compartment of the bulk material shipping container of FIG. 1, shown connected to two adjacent panels of the interior bottom wall assembly.

More specifically, as shown in FIGS. 13B to 13U, the interior bottom wall assembly 590 includes: (i) an interior bottom wall defined by or including four connected downwardly angled panels 592, 594, 596, and 598 (shown in FIGS. 2, 3, 4, 5, 13A to 13L, 13T, 13AA to 13FF); (ii) four material leakage preventers 600, 602, 604, and 606 (shown in FIGS. 13A, 13C to 13F, 13J to 13N, 13T, and 13FF); (iii) four gate sealing members 610, 612, 614, and 616 (shown in FIGS. 13A, 13C to 13E, and 13O to 13T); and (iv) four butterfly leakage prevention plates 618 (shown in FIGS. 13T and 13U), 620 (not shown), 622 (not shown), and 624 (shown in FIG. 13F). The four panels 592, 594, 596, and 598 of the interior bottom wall assembly 590 and the four gate sealing members 610, 612, 614, and 616 define the material release opening or chute 504.

As shown in FIGS. 2, 3, 4, 5, 13A to 13L, 13T, 13AA to 13FF, the four downwardly angled panels 592, 594, 596, and 598 respectively have: (a) inwardly and downwardly extending sections 592*a*, 594*a*, 596*a*, and 598*a*; (b) vertically downwardly extending lower lips 592*b*, 594*b*, 596*b*, and 598*b* extending vertically downwardly from the sections 592*a*, 594*a*, 596*a*, and 598*a*; (c) vertically upwardly extending lower lips 592*c*, 594*c*, 596*c*, and 598*c* extending vertically upwardly from the sections 592*a*, 594*a*, 596*a*, and 598*a*; (d) downwardly extending left side lips 592*d*, 594*d*, 596*d*, and 598*d* extending downwardly from the left sides of sections 592*a*, 594*a*, 596*a*, and 598*a*; and (e) downwardly extending right side lips 592*e*, 594*e*, 596*e*, and 598*e* extending downwardly from the left sides of sections 592*a*, 594*a*, 596*a*, and 598*a*.

The lower edges of these four downwardly angled panels 592, 594, 596, and 598 are not directly supported in this illustrated example embodiment. Rather, the interior bottom wall panels 592, 594, 596, and 598 are supported at multiple locations above the lower edges of these four downwardly angled panels 592, 594, 596, and 598 by the interior bottom wall support assembly 630 as further discussed below. Thus, the four downwardly angled panels 592, 594, 596, and 598 are allowed to move or flex to a certain extent relative to each other and to the rest of the compartment 500 when supporting the materials loaded into the compartment 500.

In this various example embodiments of the present disclosure, the interior bottom wall assembly 590 (including each of the downwardly extending panels 592, 594, 596, and 598) is made of stainless steel, galvanized steel, or other suitable materials to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these components can be made from other suitable materials and that these components can be connected in other suitable manners.

As shown in FIGS. 13A, 13C to 13F, 13J to 13N, 13T, and 13FF, the four material leakage preventers 600, 602, 604, and 606 are each generally U-shaped elongated members that are configured to be connected to the adjacent side lips of the downwardly angled panels 592, 594, 596, and 598 to prevent material leakage between the downwardly angled panels 592, 594, 596, and 598. More specifically, as shown in FIGS. 13J, 13K, 13L, 13M, and 13N, material leakage preventer 600 includes a first outwardly extending elongated wall 600*a* and a second outwardly extending elongated wall 600*b* integrally connected by an elongated connector 600*c*. The first wall 600*a* and the second wall 600*b* are longer than the elongated connector 600*c*. The first wall 600*a*, the second wall 600*b*, and the connector 600*c* form a pocket 600*d* (shown in FIG. 13L) that is configured such that if any materials leak between the adjacent lips of adjacent panels, the pocket 600*d* will catch such materials and trap such materials and/or in various embodiments direct such materials downwardly toward the opening 504. The first wall 600*a* and the second wall 600*b* each have suitable fastener openings (not labeled) that enable the material leakage preventer 600 to be connected by fasteners (not shown) to the adjacent panels 592 and 594, and specifically to downwardly extending left side lip 592*d* of panel 592 and downwardly extending right side lip 594*e* of panel 594.

Each of the other material leakage preventers 602, 604, and 606 has the same configuration as material leakage preventer 600 and respectfully facilitate attachment of: (i) material leakage preventer 602 to downwardly extending left side lip 594*d* of panel 594 and downwardly extending right side lip 596*e* of panel 596; (ii) material leakage preventer 604 to downwardly extending left side lip 596*d* of panel 596 and downwardly extending right side lip 598*e* of panel 598; and (iii) material leakage preventer 608 to downwardly extending left side lip 598*d* of panel 598 and downwardly extending right side lip 592*e* of panel 592.

As shown in FIGS. 13A, 13C, 13D, 13E, 13K, 13O, 13P, 13Q, 13R, and 13S, the four gate sealing members 610, 612, 614, and 616 are respectively connected to the vertically downwardly extending lower lips 592*b*, 594*b*, 596*b*, and 598*b* of the panels or sections 592*a*, 594*a*, 596*a*, and 598*a* of the interior bottom wall assembly 590 by suitable fasteners (not shown). Gate sealing member 610 includes a vertically extending panel attachment elongated wall 611*a*, a transversely extending elongated extension wall 611*b* integrally connected to the attachment wall 611*a*, and a vertically extending elongated guide member attachment wall 611*c* integrally connected to the extension wall 611*b*. Gate sealing member 610 further includes an elongated guide member 611*d* suitably connected to the guide member attachment wall 611*c* such as by fasteners (not shown). In one embodiment, the guide member is partially made from a felt material. In this illustrated embodiment, wall 611*a*, wall 611*b*, and wall 611*c* are shorter than the guide member 611*d* to allow guide member 611*d* (and the other guide members) to respectively fill the spaces at the corner intersections of the four gate sealing members 610, 612, 614, and 616. The other gate sealing members 612, 614, and 616 have the same configuration as gate sealing member 610. When the four gate sealing members 610, 612, 614, and 616 are suitably and respectively connected to the vertically downwardly extending lower lips 592*b*, 594*b*, 596*b*, and 598*b* of the panels or sections 592*a*, 594*a*, 596*a*, and 598*a* (as shown in FIG. 13A), they define the opening 504.

The guide members 611*d*, 613*d*, 615*d*, and 617*d* of the four gate sealing members 610, 612, 614, and 616 have several functions. The guide members 611*d*, 613*d*, 615*d*, and 617*d* seal the corners of the panels or sections 592*a*, 594*a*, 596*a*, and 598*a*. The guide members 611*d*, 613*d*, 615*d*, and 617*d* also provide a seal or seals with top of the gate 351 of the gate assembly 350 of the material unloading assembly 300, and thus enable the gate 351 to be positioned below the lower edge of the lower lips of the panels. The guide members 611*d*, 613*d*, 615*d*, and 617*d* further enable the gate 351 to move freely while the material in the compartment 500 is still sealed above. The guide members additionally enable the material unloading assembly 300, the compartment 500, and the entire container 50 to be manufactured with reasonable tolerance limits while still providing a high performance seal. The guide members 611*d*, 613*d*, 615*d*, and 617*d* of the four gate sealing members 610, 612, 614, and 616 are each individually replaceable when worn or damaged.

The four gate sealing members 610, 612, 614, and 616 also co-act with the downwardly extending rear end member or material director 356 of the closure member 352 of the gate 351 of the gate assembly 350 (when the gate 351 is moved to any of the plurality of different partially opened positions and to the fully opened position) to direct material held in the compartment 500 out of the compartment 500. In other words, the shape of the four gate sealing members 610, 612, 614, and 616 assist in directing material from the compartment 500 through the opening 504.

Thus, the four gate sealing members 610, 612, 614, and 616 are configured to engage the top surface of the gate 351 of the gate assembly 350 of the material unloading assembly 300 to form a seal with the gate 351 to prevent leakage of material, to allow for and compensate for movement of the panels or sections 592*a*, 594*a*, 596*a*, and 598*a* of the interior bottom wall assembly 590 due to the weight of materials held by the compartment 500, to enable the material unloading assembly 300, the compartment 500, and the entire container to be manufactured with reasonable manufacturing tolerance limits, and to properly direct material out of the compartment.

The four butterfly leakage prevention plates 618, 620, 622, and 624 are also connected to the bottom corners of the panels or sections 592*a*, 594*a*, 596*a*, and 598*a* of the interior bottom wall assembly 590 to prevent leakage of materials held in the compartment 500. Butterfly leakage prevention plate 618 includes two integrally connected plates 816*a* and 618*b* as shown in FIGS. 13T and 13U. Butterfly leakage prevention plates 620, 622, and 624 are identical to butterfly leakage prevention plate 618 in this illustrated example embodiment.

The compartment 500 includes four upright corner assemblies 510, 530, 550, and 570. Each upright corner assembly 510, 530, 550, and 570 generally includes an elongated vertically extending upright W-shaped corner member, a winged panel support, and an upper V-shaped sealing plate as further described below.

The bottom portion of example upright corner assembly 570 (partially shown in FIGS. 13V and 13W) includes an elongated vertically extending upright W-shaped corner member 571. The example W-shaped corner member 571 includes four elongated vertically extending upright connected walls 572, 573, 574, and 575. Wall 573 extends generally transversely to and is integrally connected to wall 572. Wall 574 extends generally transversely to and is integrally connected to wall 573. Wall 575 extends generally transversely to and is integrally connected to wall 574. The bottom of the W-shaped corner member is connected to the pallet 100, and specifically: (a) the bottom of wall 573 is connected to the vertically extending corner support 275 of the bottom corner assembly 270 of the pallet 100 by one or more suitable fasteners (not shown); (b) the bottom of wall 574 is connected to the vertically extending corner support 275 of the bottom corner assembly 270 of the pallet 100 by one or more suitable fasteners (not shown); (c) the bottom of wall 572 is connected to the front support 110 of the pallet 100 by one or more suitable fasteners (not shown); and (d) the bottom of wall 575 is connected to the side support 140 of the pallet 110 by one or more suitable fasteners (not shown).

As mentioned above, each upright corner assembly 510, 530, 550, and 570 includes a winged panel support. The example winged panel support 576 is shown in FIGS. 13B, 13C, 13D, 13X, 13Y, 13Z, and 13AA, and includes: (a) vertically extending attachment walls 577*a* and 577*b* configured to be connected by fasteners (not shown) to vertically extending upright connected walls 573 and 574 of the W-shaped corner member 571; and (b) outwardly extending engagement walls 578*a* and 578*b* configured to engage configured to respectively support the bottom surfaces of the upper corner sections of the panels 592 and 598 that partially define the interior bottom wall of the interior bottom wall assembly 590.

As mentioned above and as shown in FIGS. 13B, 13C, 13D, 13BB, 13CC, and 13EE, each upright corner assembly 510, 530, 550, and 570 further includes an upper V-shaped sealing plate. The example upper V-shaped sealing plate 580 is formed from or includes two members integrally connected and more specifically includes: (a) vertically extending attachment walls 581*a* and 581*b* configured to be connected by fasteners (not shown) to vertically extending upright connected walls 573 and 574 of the W-shaped corner member 571; and (b) downwardly and then inwardly and downwardly extending corner support walls 582*a* and 582*b* respectively configured to be connected by fasteners (not shown) to vertically extending upright connected walls 572 and 575 of the W-shaped corner member 571. The example upper V-shaped sealing plate 580 engages the top surfaces of the upper corner sections of the panels 592 and 598 that define the interior bottom wall of the interior bottom wall assembly 590 to seal that corner from material leakage.

The winged panel support 576 and the upper V-shaped sealing plate 580 are configured to engage and sandwich the upper corner sections of the panels 592 and 598 that define the interior bottom wall of the interior bottom wall assembly 590. This provides additional support for the upper corner sections of the panels 592 and 598 and additionally prevents leakage of materials in the area where the upper corner sections of the panels 592 and 598 meet.

Similar to the first upright corner assembly 570, the second upright corner assembly 510 includes an elongated vertically extending W-shaped corner member, a winged panel support, and an upper V-shaped sealing plate.

Similar to the first upright corner assembly 570, the third upright corner assembly 530 includes an elongated vertically extending W-shaped corner member, a winged panel support, and an upper V-shaped sealing plate.

Similar to the first upright corner assembly 570, the fourth upright corner assembly 550 includes an elongated vertically extending W-shaped corner member, a winged panel support, and an upper V-shaped sealing plate.

The interior bottom wall support assembly 630 supports the interior bottom wall assembly 590 and includes: (i) tube supports 650, 652, 654, and 656; (ii) four sets of inner wedge shaped interior bottom wall supports; and (iii) four sets of outer wedge shaped interior bottom wall supports. Each different first and second set of supports support a respective different one of the panels 592, 594, 596, and 598 of the interior bottom wall assembly 590 of the compartment 500. In other words, each of the panels 592, 594, 596, and 598 is supported by two inner wedge shaped interior bottom wall supports and two outer wedge shaped interior bottom wall supports.

For example, as shown in FIGS. 5, 8, 10, 13FF, 13GG, 13HH, 13JJ, 13II, and 13KK, two inner wedge shaped interior bottom wall supports 632 and 636 and two outer wedge shaped interior bottom wall supports 642 and 646 support panel 594.

The inner wedge shaped interior bottom wall support 632 includes a vertically downwardly extending tube 633 integrally formed with an inwardly downwardly extending tube 634. The inwardly downwardly extending tube 634 is configured to mate with an upwardly outwardly extending tube 635 that extends from the tube support 652. The inner wedge shaped interior bottom wall support 632 including the tube 633, tube 634, and tube 635 is positioned under the panel 594 such that when weight is placed on the panel 594 and the panel 594 moves or flexes downwardly, the panel 594 engages and is supported by the tube 634.

Likewise, the inner wedge shaped interior bottom wall support 636 includes a vertically downwardly extending tube 637 integrally formed with an inwardly downwardly extending tube 638. The inwardly downwardly extending tube 638 is configured to mate with an upwardly outwardly extending tube 639 that extends from the tube support 652. The inner wedge shaped interior bottom wall support 636 including the tube 637, tube 638, and tube 639 is positioned under the panel 594 such that when weight is placed on the panel 594 and the panel 594 moves or flexes downwardly, the panel 594 engages and is supported by the tube 638.

The outer wedge shaped interior bottom wall support 642 includes a vertically downwardly extending tube 643 integrally formed with an inwardly downwardly extending tube 644, which is integrally formed with a vertically downwardly extending tube 645. The vertically downwardly extending tube 645 is supported by and connected to the first fork lift tine receiving tube 150. The vertically downwardly extending tube 645 is connected by a suitable fastener (not shown) to the upwardly extending interior bottom wall support member attachment bracket 154 that extends upwardly from the top wall of the tubular body 151 of the first fork lift tine receiving tube 150. The outer wedge shaped interior bottom wall support 642 including the tube 643, tube 644, and tube 645 is positioned under the panel 594 such that when weight is placed on the panel 594 and the panel 594 moves or flexes downwardly, the panel 594 engages and is supported by the tube 644.

Likewise, the outer wedge shaped interior bottom wall support 646 includes a vertically downwardly extending tube 647 integrally formed with an inwardly downwardly extending tube 648, which is integrally formed with a vertically downwardly extending tube 649. The vertically downwardly extending tube 649 is supported by and connected to the first fork lift tine receiving tube 150. The vertically downwardly extending tube 649 is connected by a suitable fastener (not shown) to the upwardly extending interior bottom wall support member attachment bracket 153 that extends upwardly from the top wall of the tubular body 151 of the first fork lift tine receiving tube 150. The outer wedge shaped interior bottom wall support 646 including the tube 647, tube 648, and tube 649 is positioned under the panel 594 such that when weight is placed on the panel 594 and the panel 594 moves or flexes downwardly, the panel 594 engages and is supported by the tube 648.

It should be appreciated that the tubes 633 and 637 of the two inner wedge shaped interior bottom wall supports 632 and 636 and the tubes 643 and 647 of the two outer wedge shaped interior bottom wall supports 642 and 646 extend through the shoulder 122 (and specifically the interior bottom wall support member openings 122*a*, 122*b*, 122*c*, and 122*d* defined by the shoulder 122) of the left side support 120 of the pallet 100 and rest on the base wall 124 of the left side support 120 to direct the weight of the materials held in the compartment 500 directly to the ground or other supporting surface. It should be appreciated that the tubes 645 and 649 of two outer wedge shaped interior bottom wall supports 642 and 646 rest on the tube 150 to direct the weight of the materials held in the compartment 500 to the pallet 100. It should be appreciated that this same configuration is also employed to partially support the right side of the compartment.

The two inner wedge shaped interior bottom wall supports for the front side of the interior bottom wall support assembly 630 likewise extend through the front support 110 of the pallet 100. The two inner wedge shaped interior bottom wall supports for the front side of the interior bottom wall support assembly 630 also are attached to support tube 650 which is connected to the pallet 100.

The two outer wedge shaped interior bottom wall supports for the front side of the interior bottom wall support assembly 630 rest on the shoulder 112 of the front wall support 110 of the pallet 100. The two outer wedge shaped interior bottom wall supports for the front side of the interior bottom wall support assembly 630 also rest on and are connected to the tubes 150 and 160 of the pallet 100.

Likewise, the two inner wedge shaped interior bottom wall supports for the rear side of the interior bottom wall support assembly 630 extend through the rear support 130 of the pallet 100. The two outer wedge shaped interior bottom wall supports for the rear side of the interior bottom wall support assembly 630 rest on the shoulder of the rear wall support 120 of the pallet 100.

The tube supports 650, 652, 654, and 656 are thus configured to partially support the sets of inner wedge shaped interior bottom wall supports and sets of outer wedge shaped interior bottom wall supports. For example, tube support 652 includes a horizontally extending attachment bar 652*a* and an upwardly extending support member 642*b*. Each other tube support also includes an attachment bar and a support member in various embodiments. The attachment bars are respectively attached by fasteners (not shown) to the first material unloading assembly support 170 and the second material unloading assembly support 180 as shown in FIGS. 11L, 11M, and 11N.

The compartment 500 includes four upper corner assemblies 750, 770, 790, and 810. As illustrated in FIGS. 13LL, 13MM, 13NN, 13OO, 13PP 13QQ, 13RR, and 13SS, the example upper corner assembly 750 is connected to the top of the W-shaped corner member of the upright corner assembly 510 that is connected to and extends upwardly from the pallet 100. The upper corner assembly 750 includes a horizontally extending base 751, a vertically downwardly extending corner connection bracket 755 integrally connected to the bottom of the base 751, a vertically extending tubular body 760 integrally connected to and extending upwardly from the top of the base 752, a generally rectangular horizontally extending cap 765 integrally connected to the top of the horizontally extending tubular body 760, and a vertically extending corner pin 770 integrally connected to and extending upwardly from the top of the cap 765.

The horizontally extending base 751 is identical to the cap 765 in this illustrated example embodiment, and includes a generally rectangular body 752 having a top surface, a bottom surface, a front edge, a rear edge, a first side edge, and a second side edge. The body 752 defines an off-center opening 753 for manufacturing purposes (i.e., that is needed for the cap 765 in this example illustrated embodiment).

The corner connection bracket 755 includes a first wall 756 and a transversely extending integrally connected second wall 758 that are connected to the top section of the upright corner assembly and particularly the walls 512 and 515 of the W-shaped corner member of the upright corner assembly 510 of the compartment 500. In addition to the fastener openings (not labeled), the walls 756 and 758 include fixturing opening 756*a* and 758*a* that surround the heads of bolts (not shown) that are employed to attach the top wall assembly 850 to the four upper corner assemblies 750, 770, 790, and 810.

The tubular body 760 includes four integrally connected upwardly extending walls 761, 762, 763, and 764, each having an upper edge, a bottom edge, an inner surface, and an outer surface.

The cap 765 is integrally connected to each of the upper edge of the upwardly extending walls 761, 762, 763, and 764 of the tubular body 760.

The corner pin 766 in this illustrated example embodiment is a solid piece of steel configured to fit into the corner pin receiver or opening of a bottom corner assembly of a pallet of another container stacked on container 50. The corner pin 766 includes a neck 767 and a head 768 that define generally flat continuous opposing side walls and generally curved end walls. The head 768 includes inwardly angled upwardly extending top walls and a horizontally extending top wall. The inwardly angled upwardly extending top walls assist in the alignment and centering of another container being stacked on container 50. The opposing flat sides of the head 768 of the corner pin 766 also facilitate alignment and centering of another container being stacked on container 50. The upwardly extending corner pin 766, as well as the other corner pins of the compartment 500 of the container 50, is also configured to be received by standard or other ISO corners.

The corner pin 766 is integrally connected at an offset position on the cap 756. More specifically, during assembly, the neck 767 of the corner pin 766 is inserted through the opening 765*a* in the top of the cap 756 and welded to the bottom surface of the cap 756. This enables a bottom corner assembly of another container to directly and flatly rest on the upper surface of the cap 756 without interference from any welds on the top surface of the cap 765. This provides for more level and secure stacking of the containers of the present disclosure.

The corner pin 766 in this illustrated example embodiment fits into an aperture of a standard ISO corner as well as into any of the bottom corner assemblies of the container of the present disclosure.

The second upper corner assembly 770 is a mirror image of the first upper corner assembly 750 in this illustrated example embodiment.

The third upper corner assembly 790 is identical to the first upper corner 750 in this illustrated example embodiment.

The fourth upper corner assembly 810 includes is a mirror image of the first upper corner assembly 750 in this illustrated example embodiment.

When a second or upper container 50 sits on a first or lower container 50, the pallet 100 of the second or top container rests on the caps of the first upper corner 750, the second upper corner 770, the third upper corner 790, and the fourth upper corner 810 of the lower container 50. The first upper corner 750, the second upper corner 770, the third upper corner 790, and the fourth upper corner 810 of the lower container 50 direct the weight of the second or upper top container 50 to the upright corners assemblies of the first or lower container rather than the exterior wall assemblies of the first or lower container. This prevents the weight of the second or upper container from damaging the exterior wall assemblies of the compartment and provides for better nesting of compatible containers.

The exterior front wall assembly 670 includes a composite panel 672 to minimize the weight of the container 50, a first or bottom elongated horizontally extending kick plate 676, a second or intermediate elongated horizontally extending seal plate 680, a first or lower elongated horizontally extending brace 682, a second or intermediate elongated horizontally extending brace 684, a third intermediate elongated horizontally extending brace 686, and a fourth or upper elongated horizontally extending brace 688 (as shown in FIGS. 1, 2, 3, 4, 6, 13TT, 13UU, 13WW, 13XX, and 13YY).

The composite panel 672 includes a top edge, a bottom edge, a left side edge, and a right side edge. The composite panel 672 extends from the upright corner assembly 510 to the upright corner assembly 570, and from the shoulder 112 of the front support 110 to the front L-shaped angle top support 852 of the top wall assembly 850. The composite panel 672 is connected by fasteners (not shown) to the upright corner assembly 510 and to the upright corner assembly 570 by respective side interior side sandwich plates (such as sandwich plate 673 shown in FIG. 13ZZ). The composite panel 672 is connected by fasteners (not shown) to the shoulder 112 of the front support 110 by the bottom of interior seal plate 681 and exterior kick plate 676. The composite panel 672 is also held in place by the second seal plate 680 and the top of interior seal plate 681 and fasteners (not shown). The composite panel 672 is connected by fasteners (not shown) to the front L-shaped angle top support 852 and an internal attachment plate (not shown) of the top assembly 850.

The first or bottom elongated horizontally extending kick plate 676 includes a substantially flat metal plate having a top edge, a bottom edge, a left side edge, and a right side edge. The first or bottom elongated horizontally extending kick plate 676 defines a central opening or viewing port 676*a* that enables a user see the operation of part of the material unloading assembly 300, and particularly the rotation of the screw 401 and the movement of the gate assembly 350 from closed position toward the fully open position, and back from the fully opened position to the closed position. The first or bottom elongated horizontally extending kick plate 676 extends from the upright corner assembly 510 to the upright corner assembly 570, and from the shoulder 112 of the front corner support 110 to the same height as the top of the lip 592*c* of the panel 592 as shown in FIG. 13UU. The top of the first or bottom elongated horizontally extending plate kick 676 is connected by fasteners (not shown) to the lip 592*c* of the panel 592 and to the bottom of an interior seal plate 681 shown in FIGS. 13DD and 13EE.

The second or intermediate elongated horizontally extending seal plate 680 includes a substantially flat metal plate having a top edge, a bottom edge, a left side edge, and a right side edge. The second or intermediate elongated horizontally extending seal plate 680 extends from the upright corner assembly 510 to the upright corner assembly 570. The second or intermediate elongated horizontally extending seal plate 680 facilitates the attachment of the top of the interior seal plate 681 shown in FIGS. 11DD and 13EE.

The interior seal plate 681 prevents leakage of materials from the compartment by facilitating an upward extension of or from the lip 592*c*. This upwardly extending plate or extension extends above the mid-point or pressure level of the compartment where any outward bowing would occur in the first wall assembly when the compartment contains heavy or dense materials, and thus prevents such materials from entering spaces formed between the lip 592 and the composite wall 672 due to any such outward bowing. The interior seal plate 681 additionally seals any spaces between the fasteners that hold the kick plate 676 to the upwardly extending lip 592*c* of panel 592 of the interior bottom wall assembly 590.

Figure 13V:
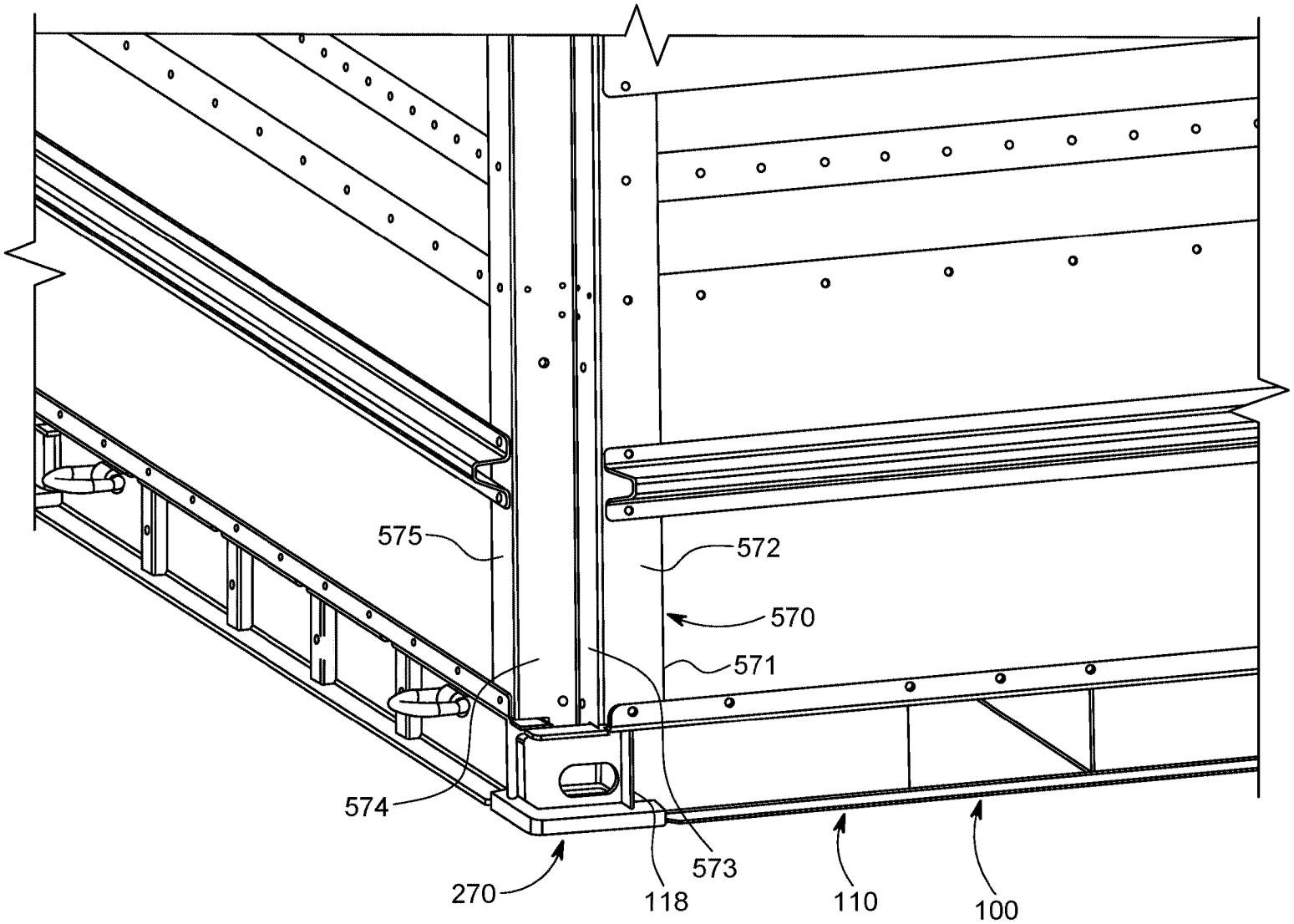
FIG. 13V is a fragmentary outer perspective view of the bottom section of one of the upright corner assemblies of the compartment of the bulk material shipping container of FIG. 1, shown connected to the bottom corner assembly of the pallet.

The first or lower elongated horizontally extending brace 682 (as shown in FIG. 13VV), includes an elongated vertically extending outer wall 682*a*, an upper elongated upwardly angled inwardly extending connection wall 682*b* integrally connected to the top of the outer wall 682*a*, a lower elongated downwardly angled inwardly extending connection wall 682*c* integrally connected to the bottom of the outer wall 682*a*, an upper elongated vertically extending base wall 682*d* integrally connected to the top of the connection wall 682*b*, and a lower elongated vertically extending base wall 682*e* integrally connected to the bottom of the connection wall 682*c*. The left side end of the brace 682, and particularly the left side end of the upper base wall 682*d* and lower base wall 682*e* are connected to the wall 572 of the corner support assembly 570 by suitable fasteners (not shown). The right side end of the brace 682, and particularly the right side end of the upper base wall 682*d* and the lower base wall 682*e* are connected to the wall 515 of the upright corner assembly 510 by suitable fasteners (not shown).

Figure 13W:
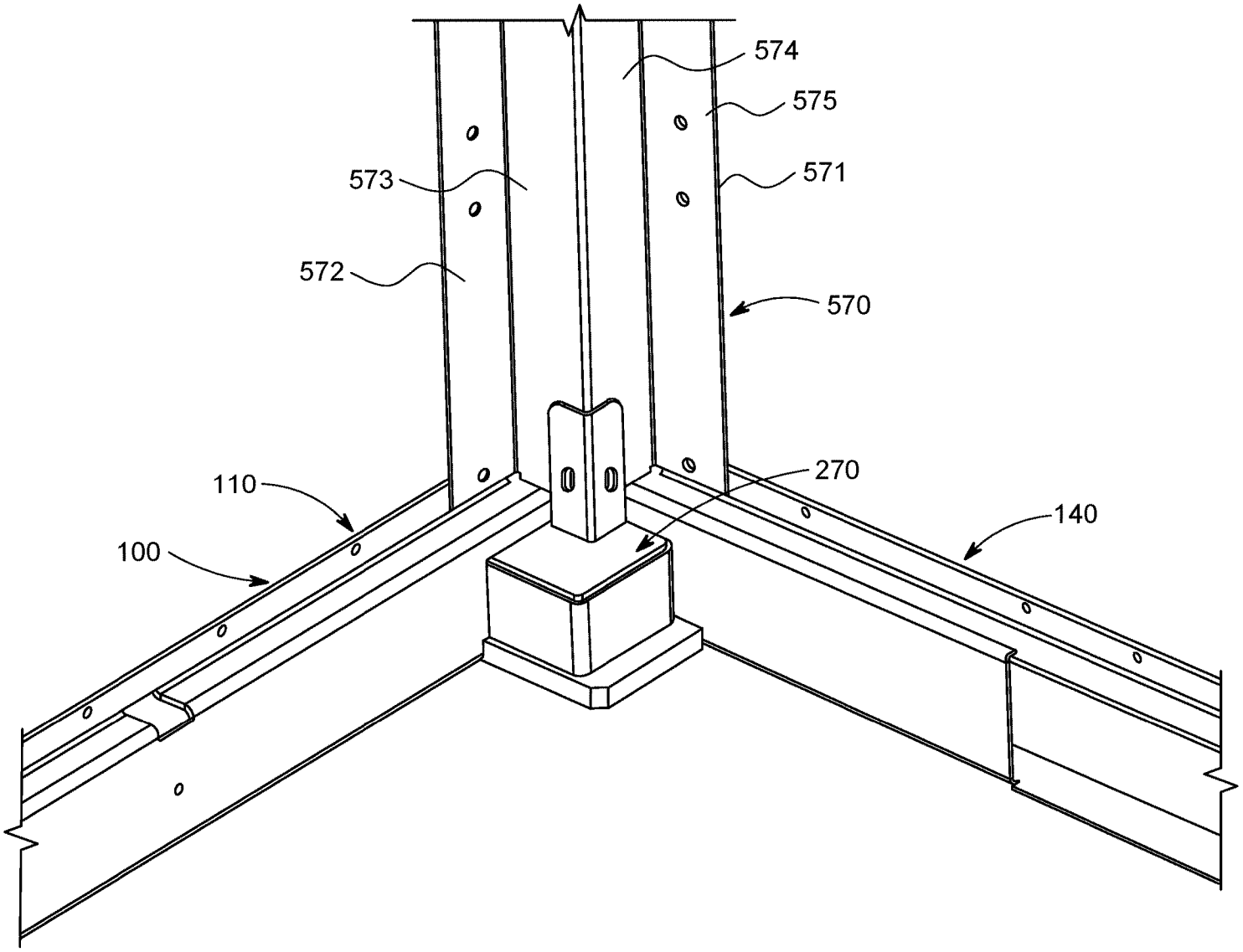
FIG. 13W is a fragmentary inner perspective view of the bottom section of one of the upright corner assemblies of the compartment of the bulk material shipping container of FIG. 1, shown connected to the bottom corner section assembly of the pallet.
Figure 13X:
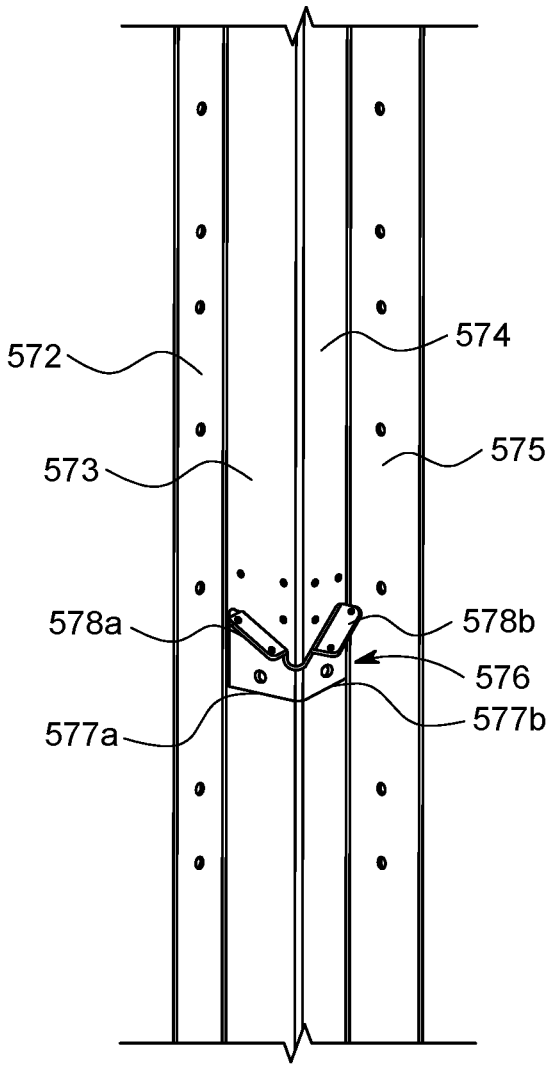
FIG. 13X is a fragmentary inner perspective view of one of the corner assemblies of the compartment of the bulk material shipping container of FIG. 1, showing one of the winged panel supports connected to one of the W-shaped corner members of one of the upright corner assemblies of the compartment.
Figure 13Y:
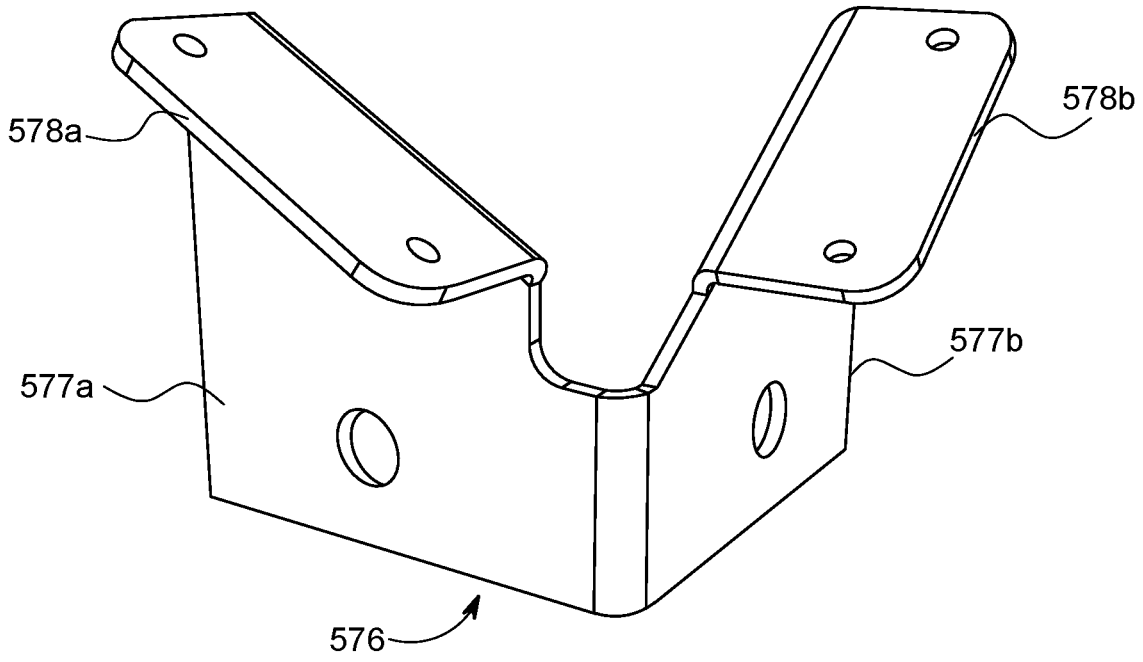
FIG. 13Y is an inner perspective view of one of the winged panel supports of one of the corner assemblies of the compartment of the bulk material shipping container of FIG. 1.
Figure 13Z:
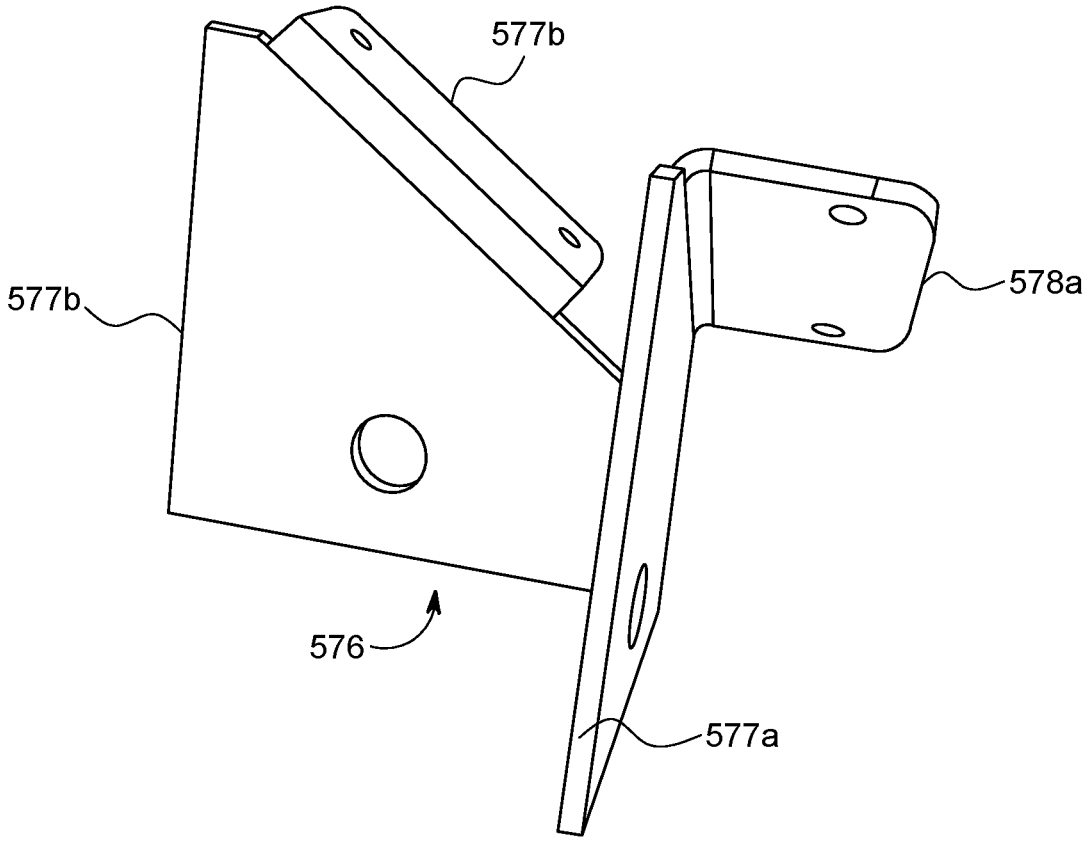
FIG. 13Z is an outer perspective view of one of the winged panel supports of one of the corner assemblies of the compartment of the bulk material shipping container of FIG. 1.
Figure 13A:
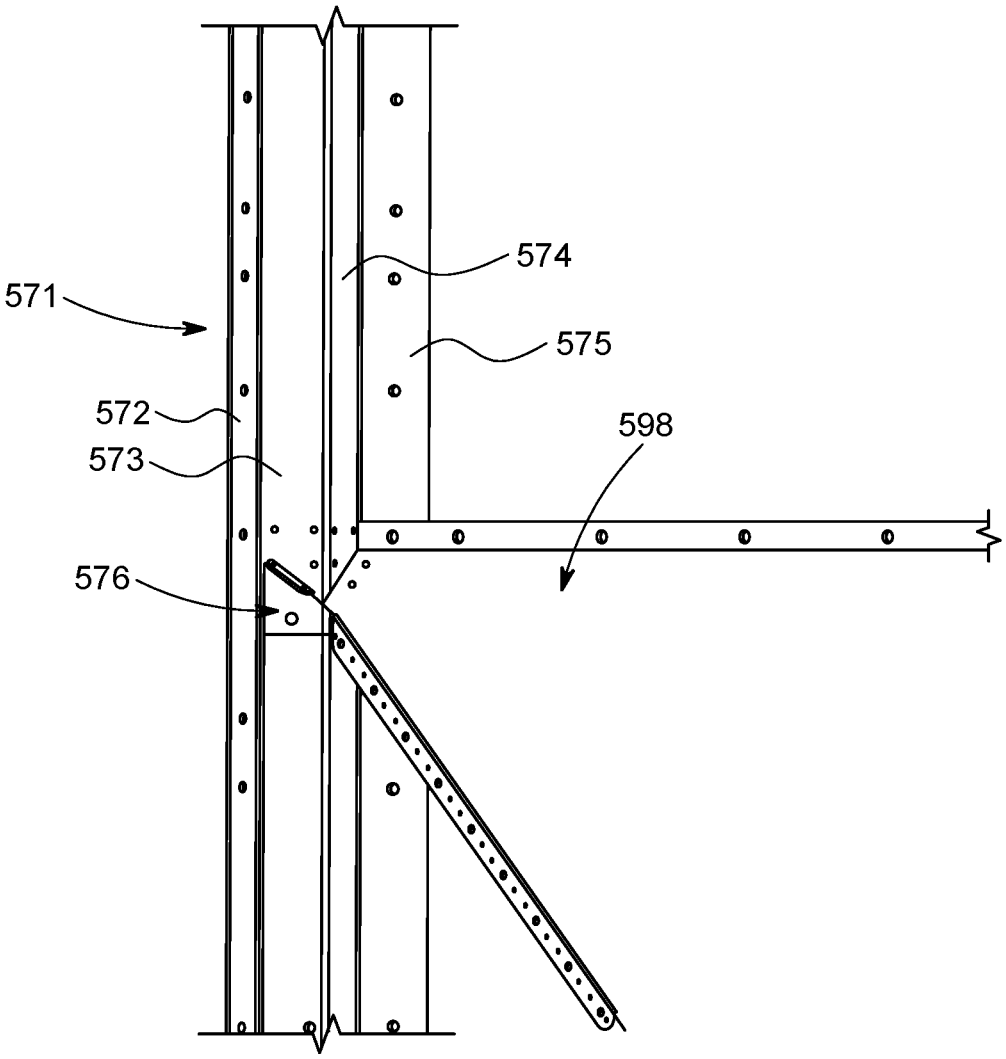
Figure 13B:
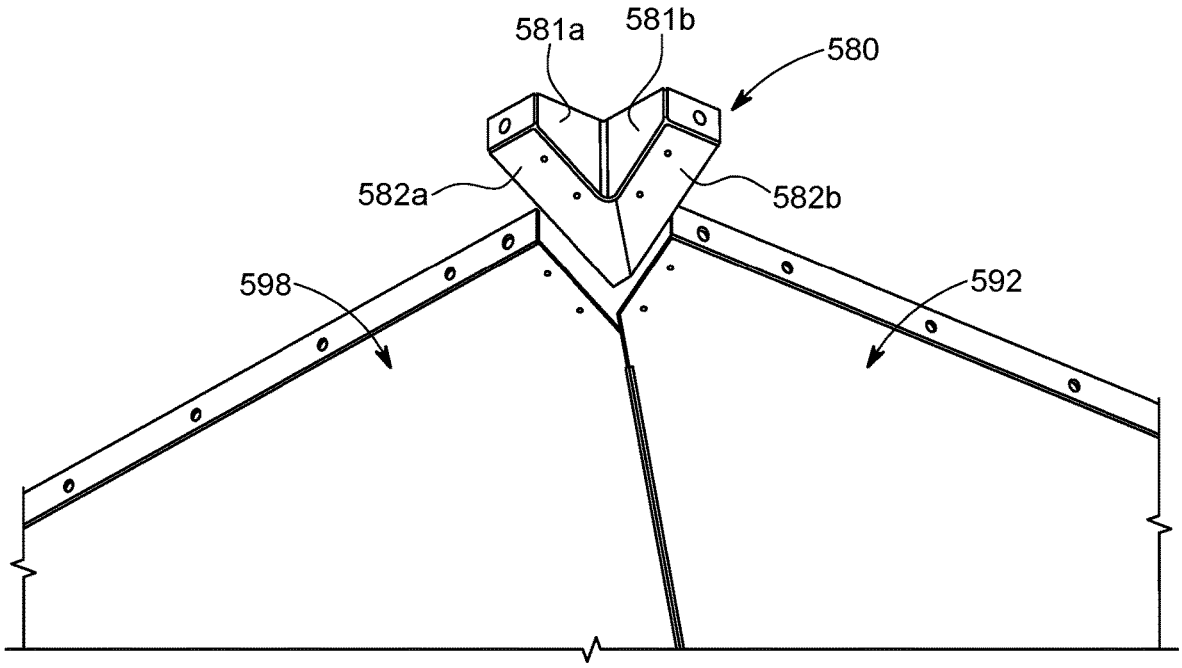
Figure 13C:
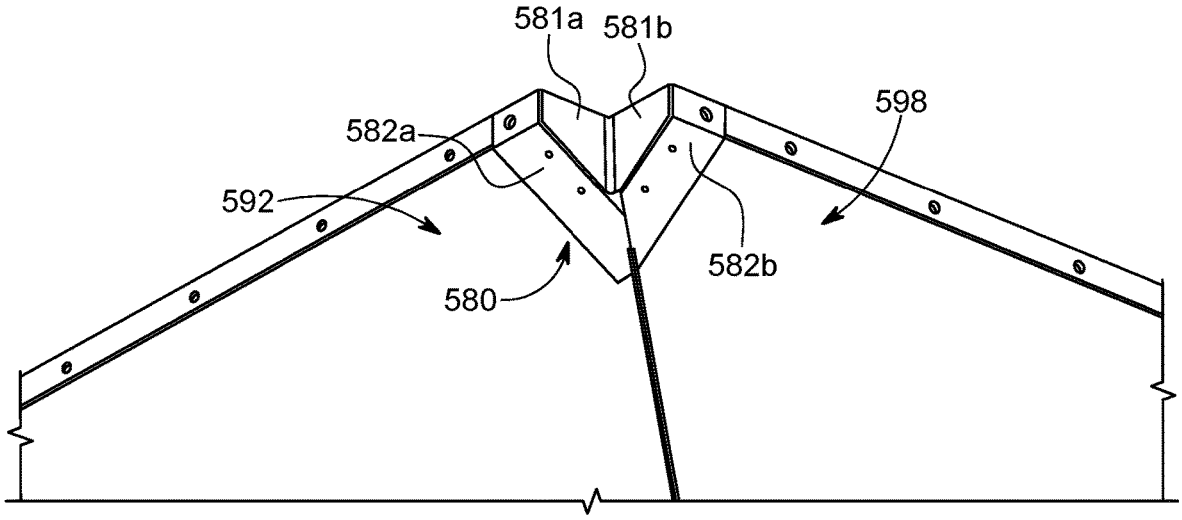
Figure 13D:
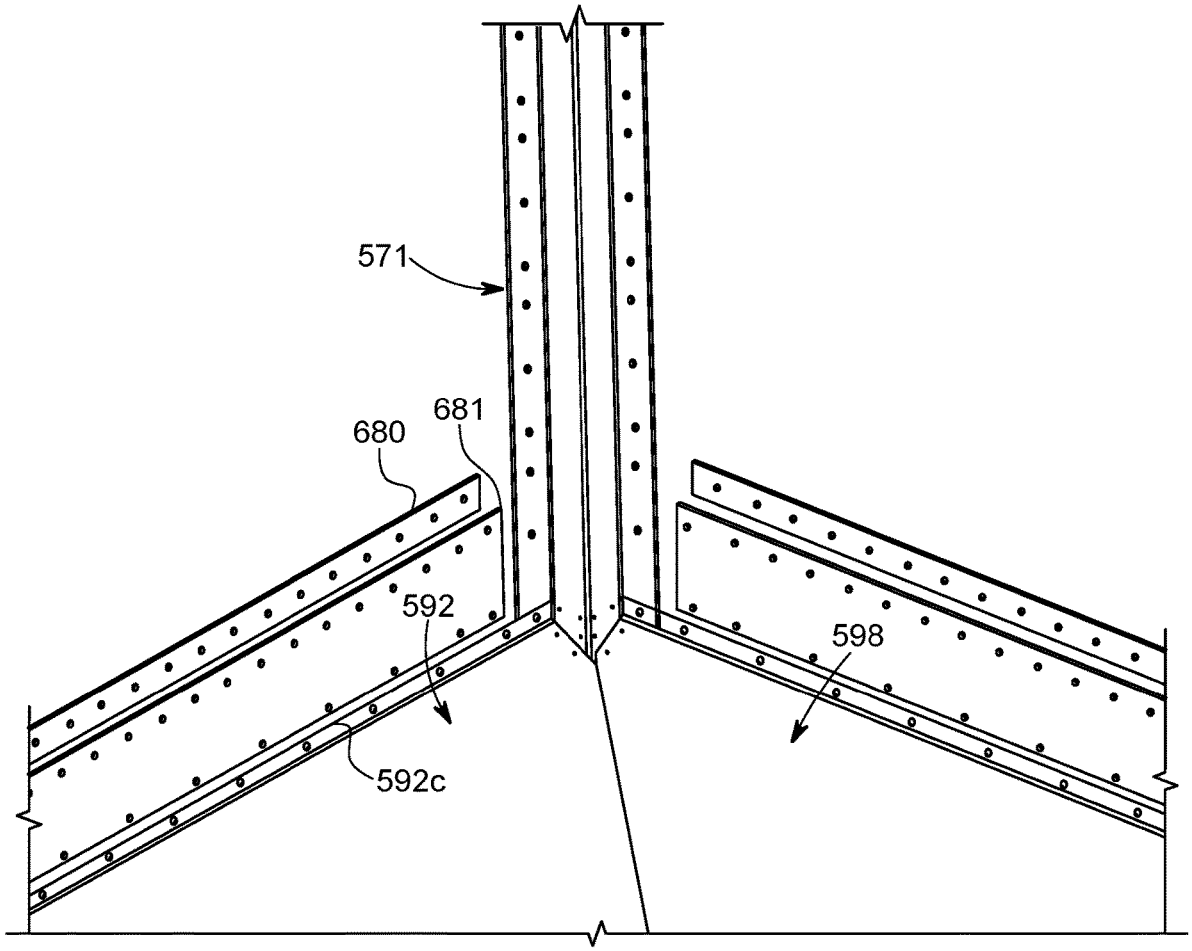
Figure 13E:
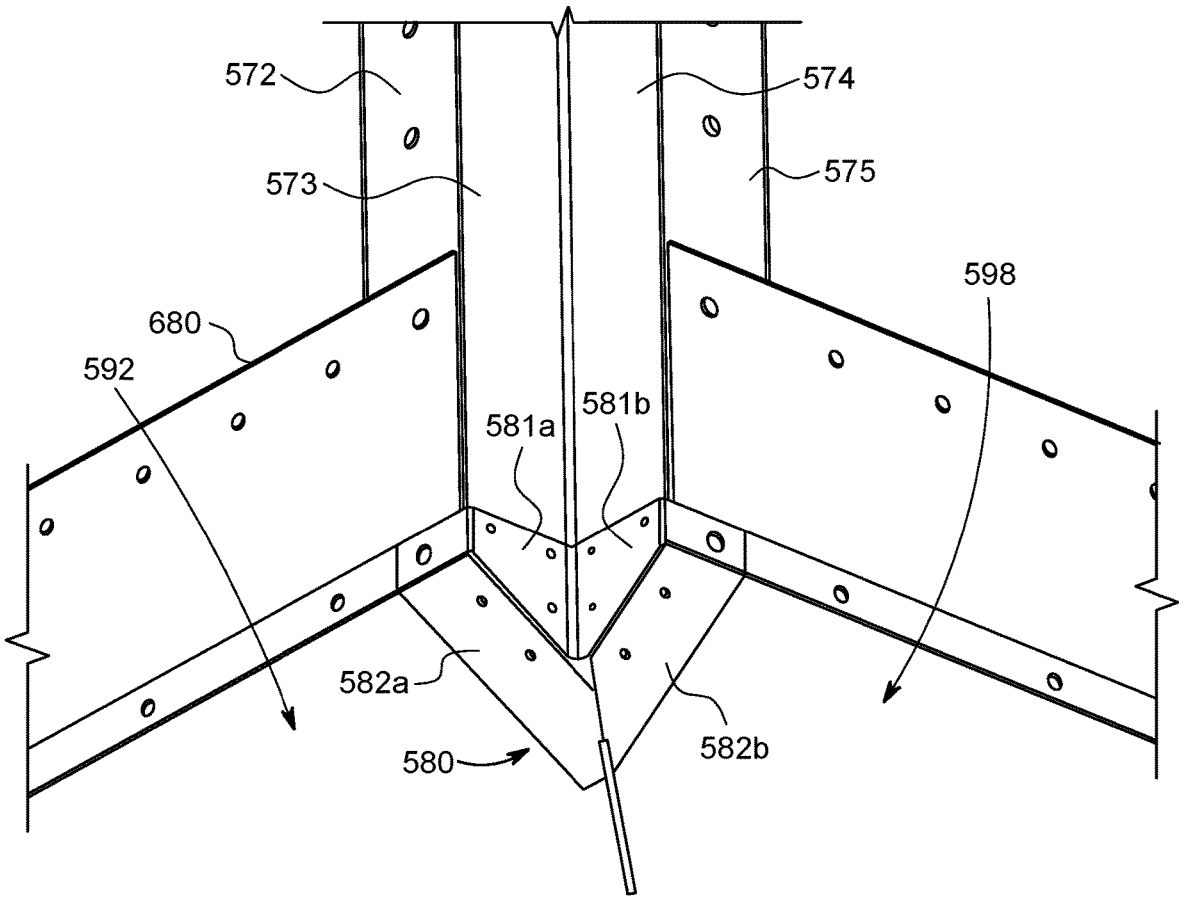
Figure 13F:
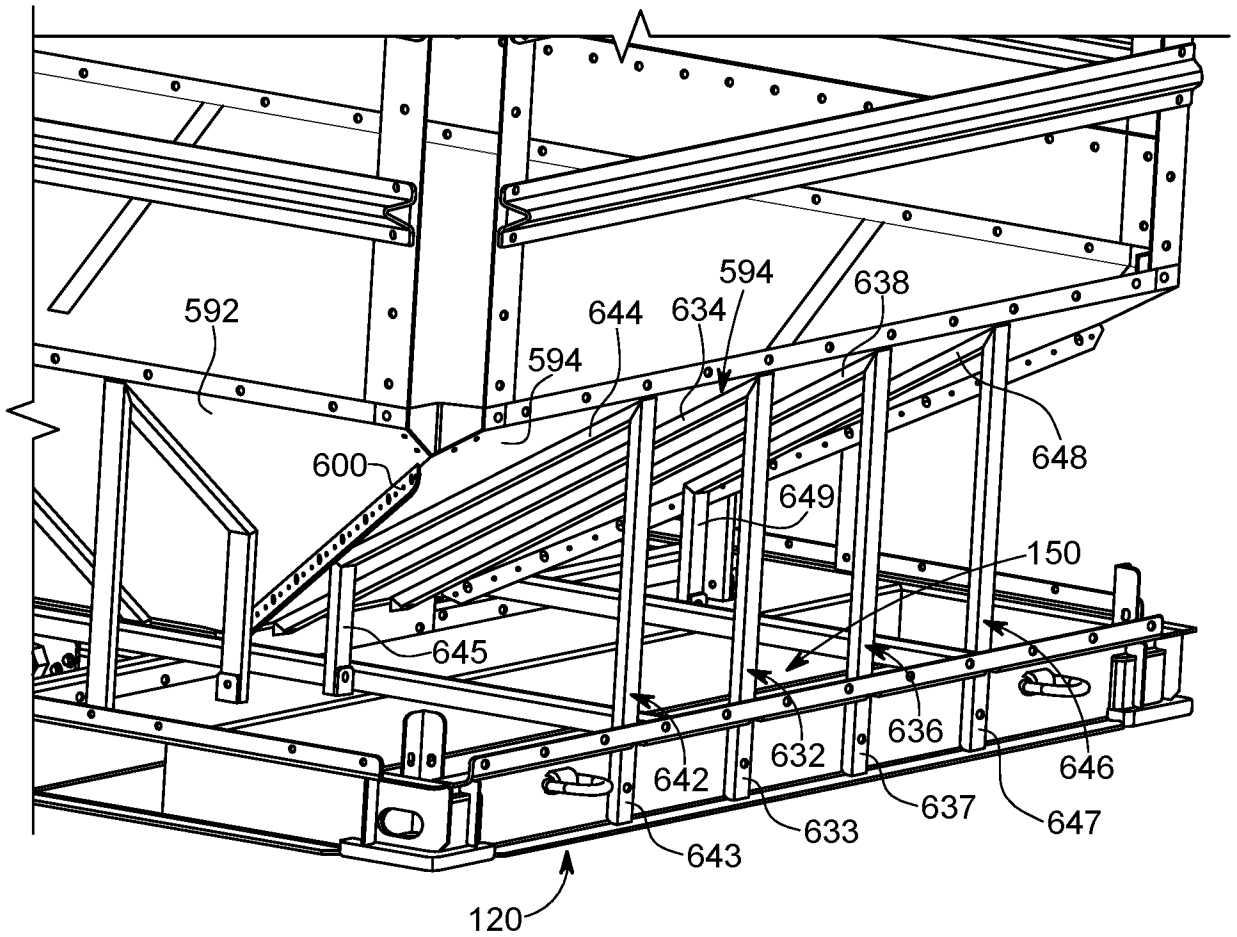
Figure 13G:
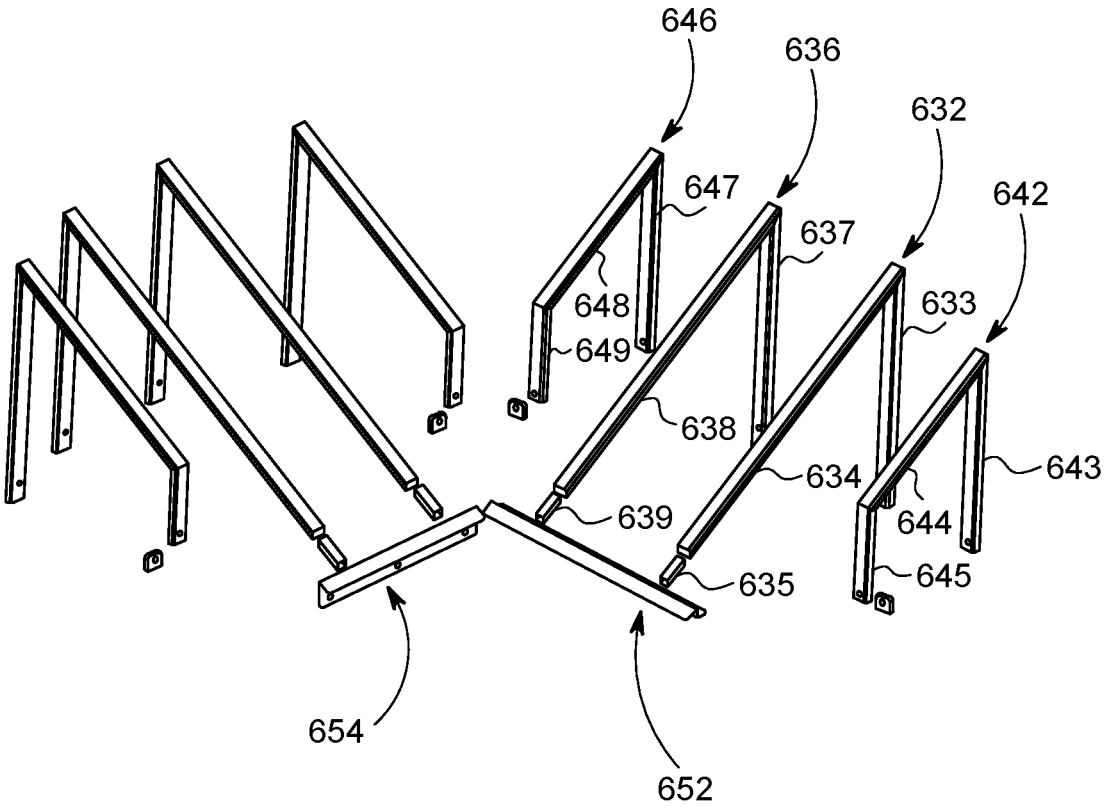
Figure 13H:
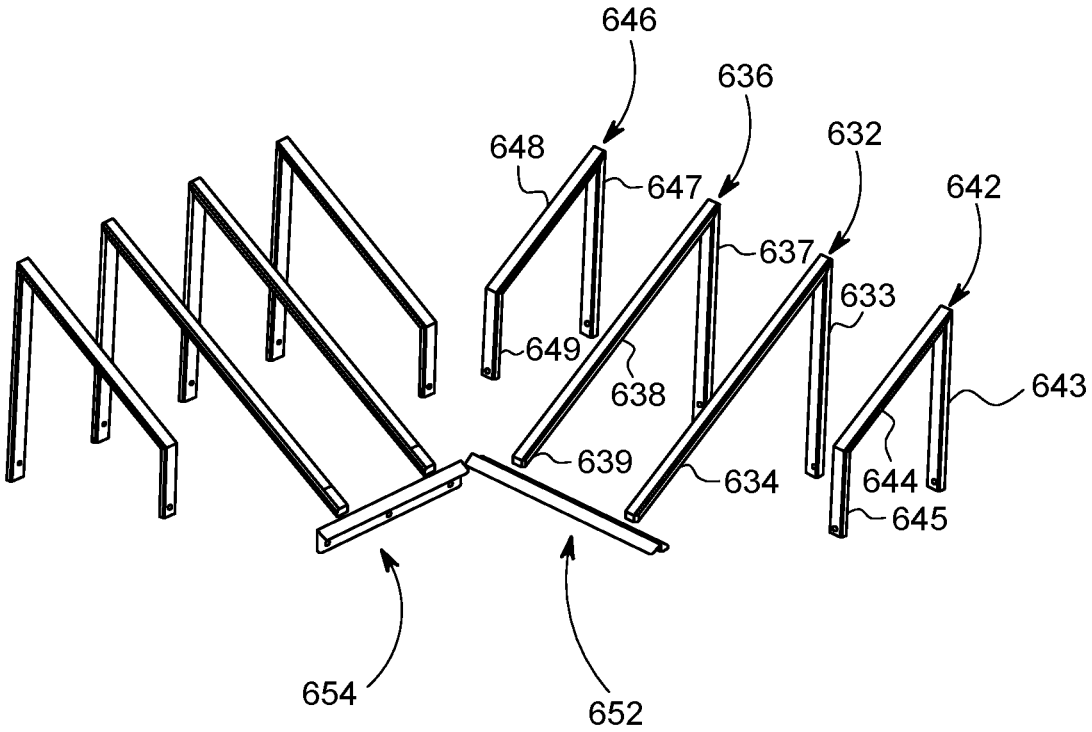
Figure 13I:
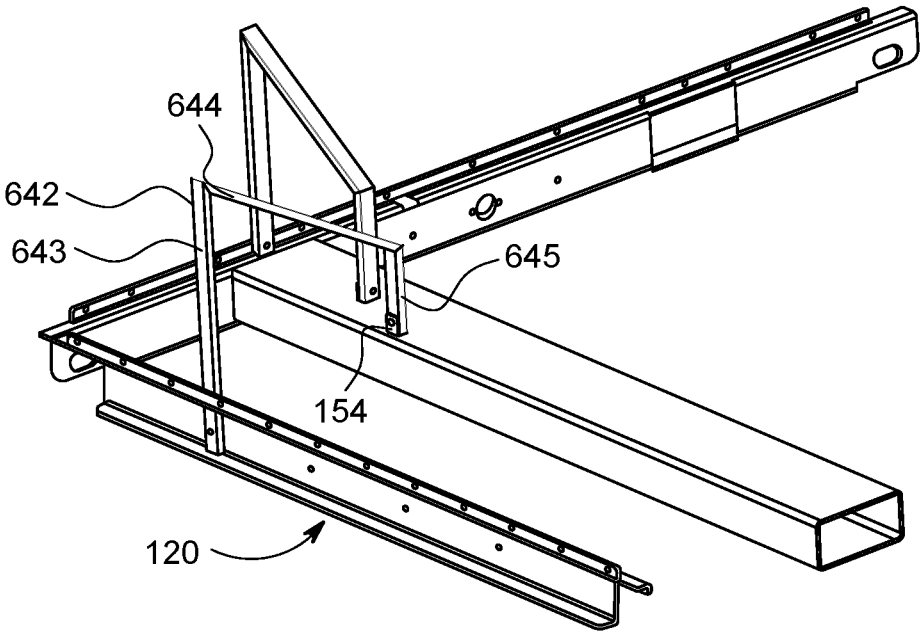
Figure 13J:
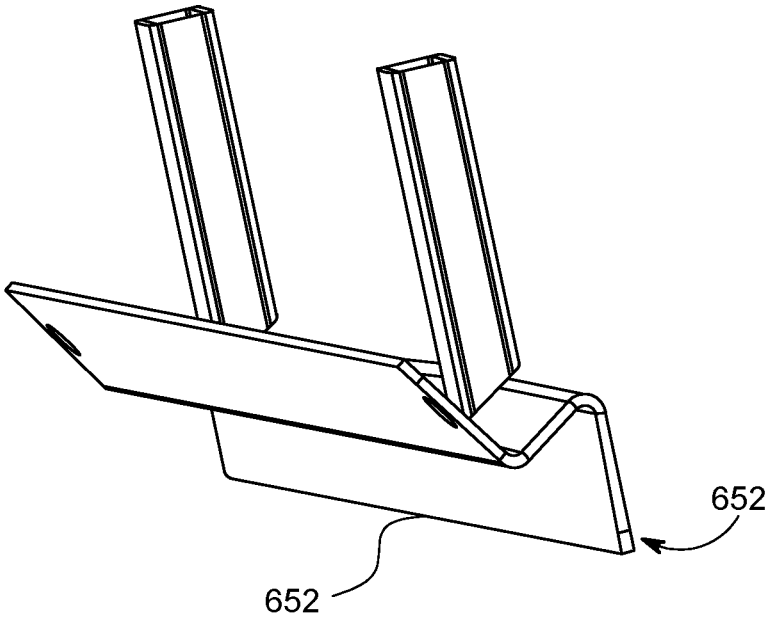
Figure 13K:
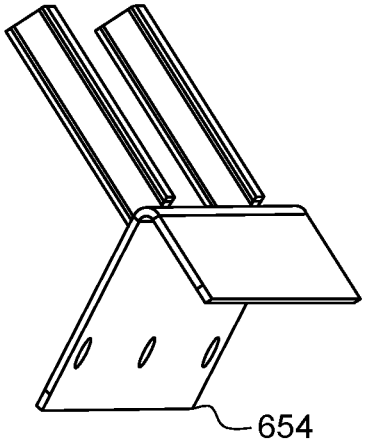
Figure 13L:
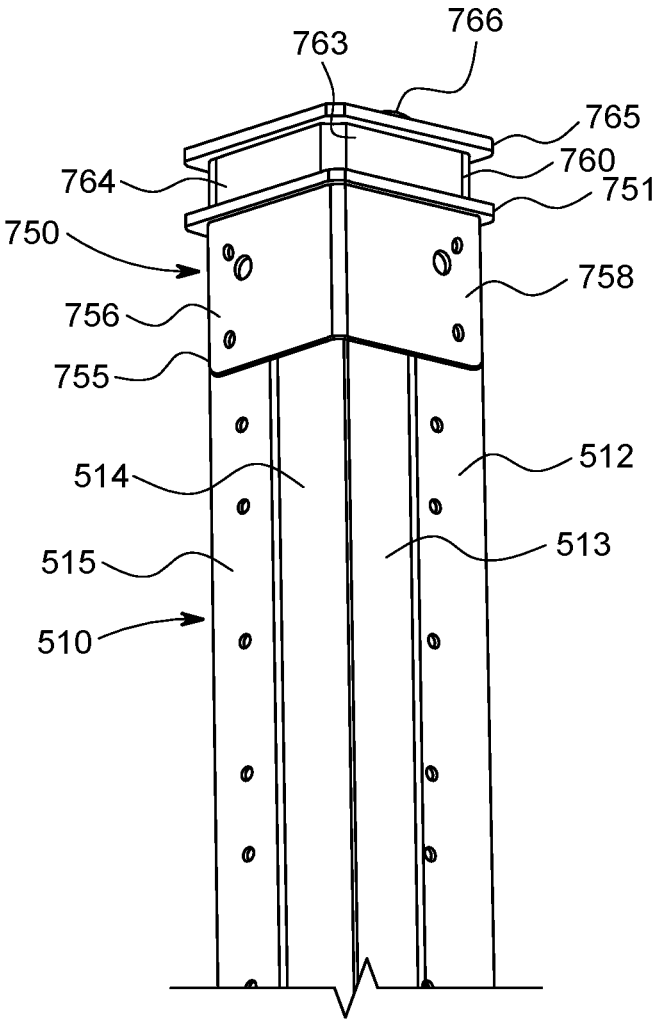
Figure 13M:
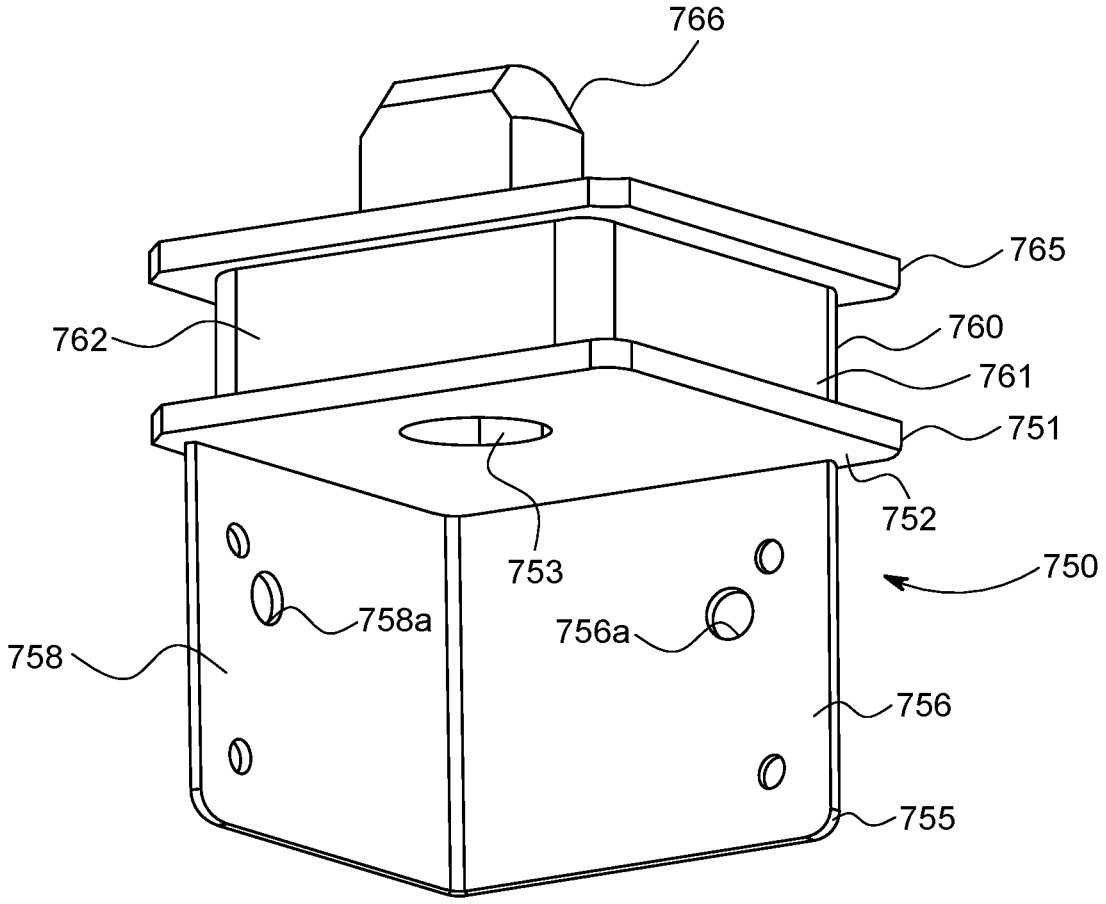
Figure 13N:
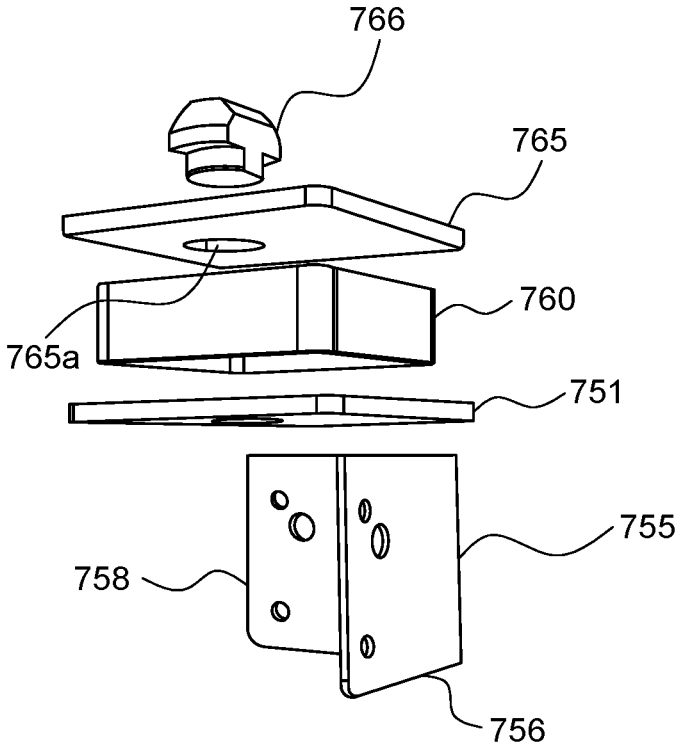
Figure 13O:
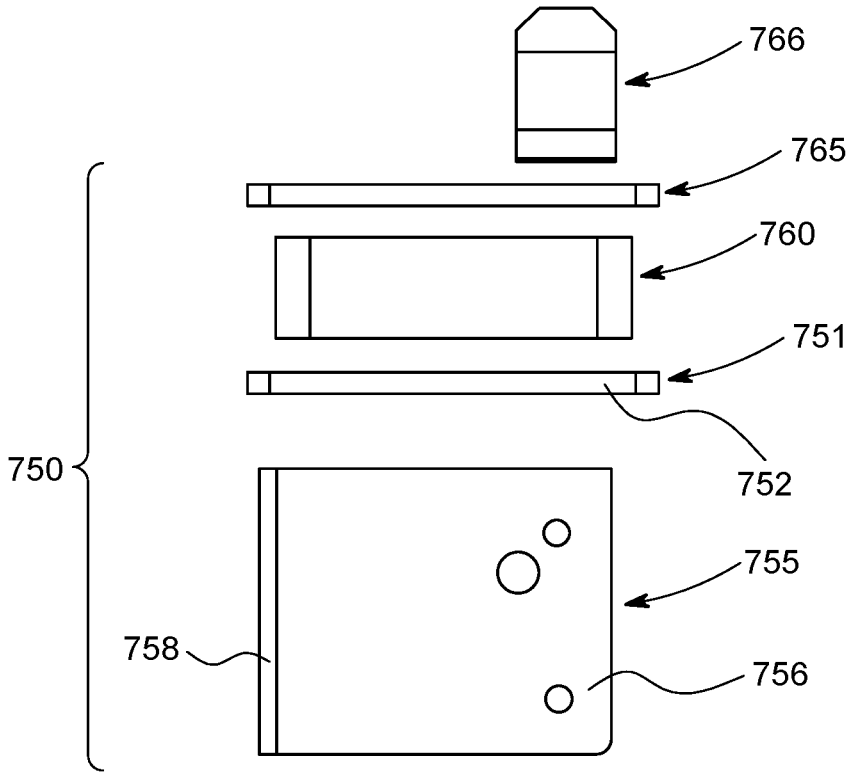
Figure 13P:
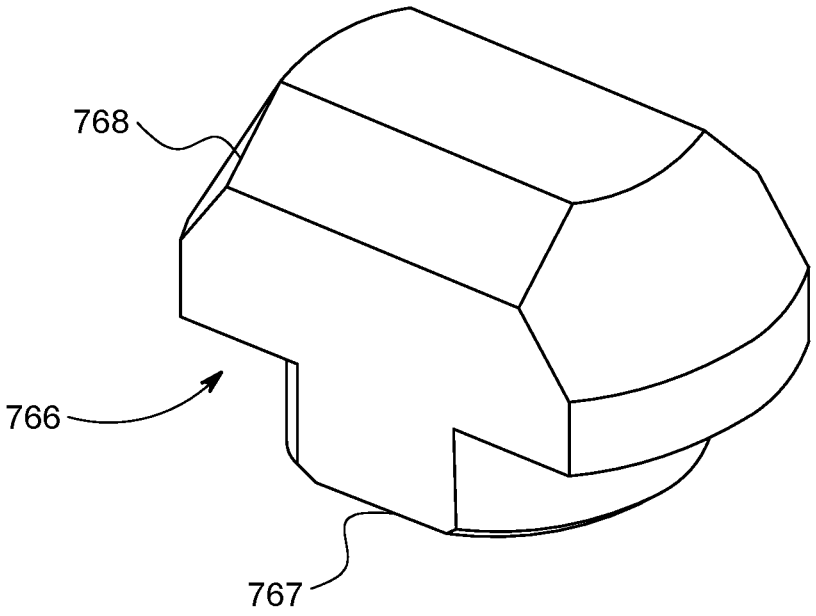
Figure 13Q:
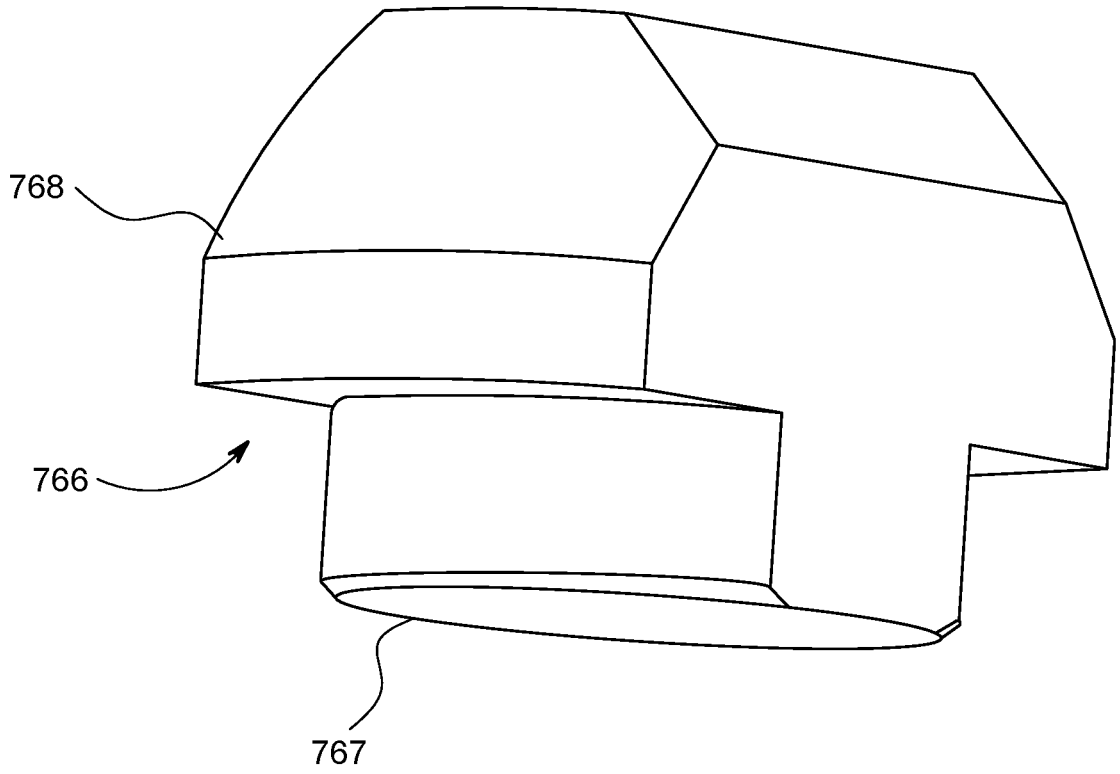
Figure 13R:
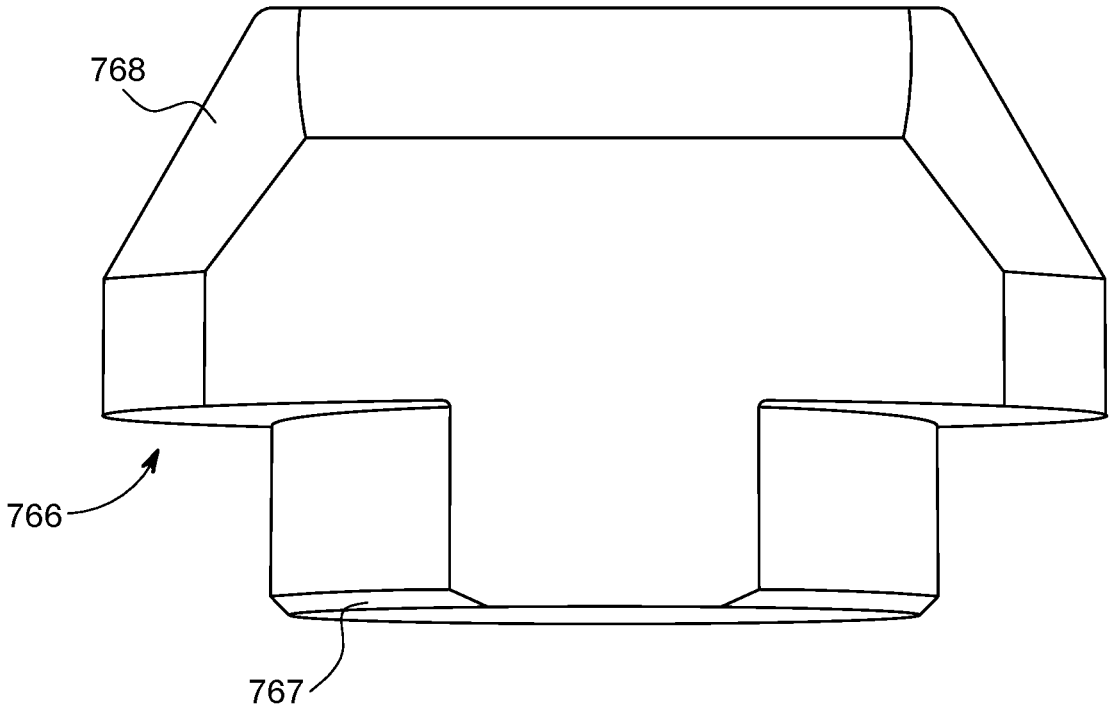
Figure 13S:
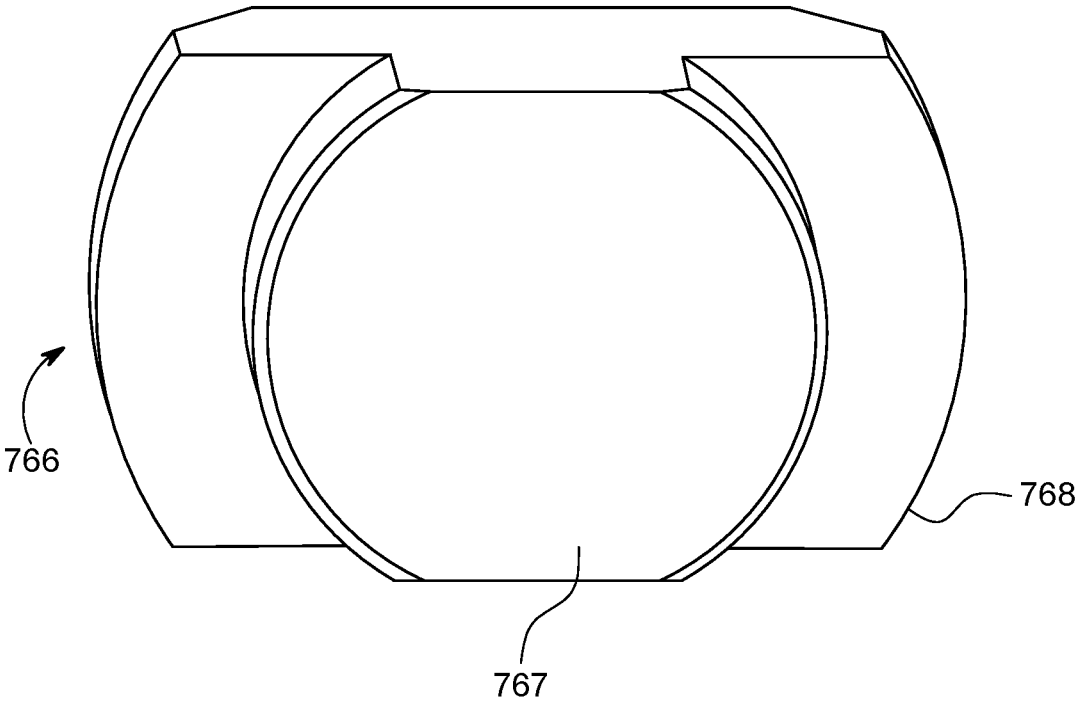
Figure 13T:
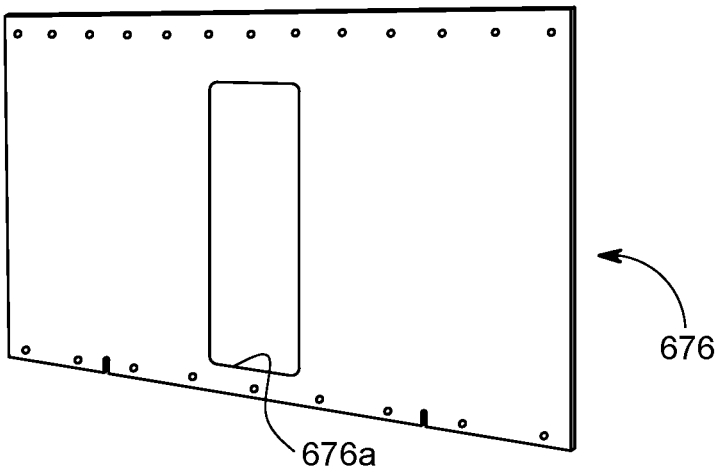
Figure 13U:
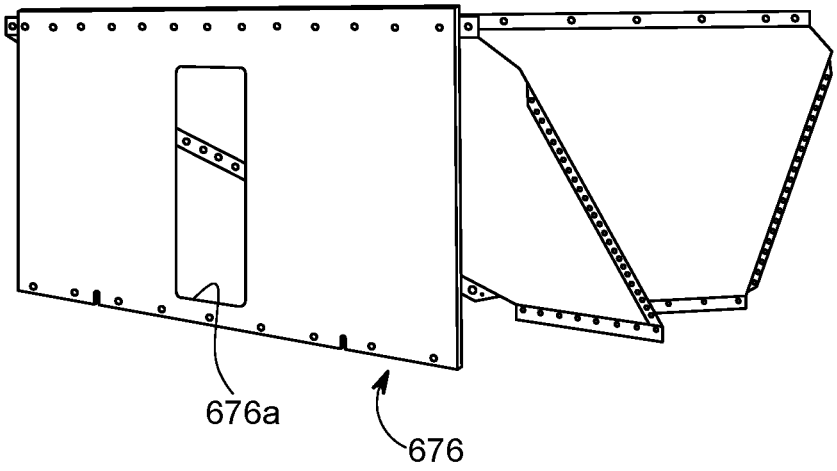
Figure 13V:
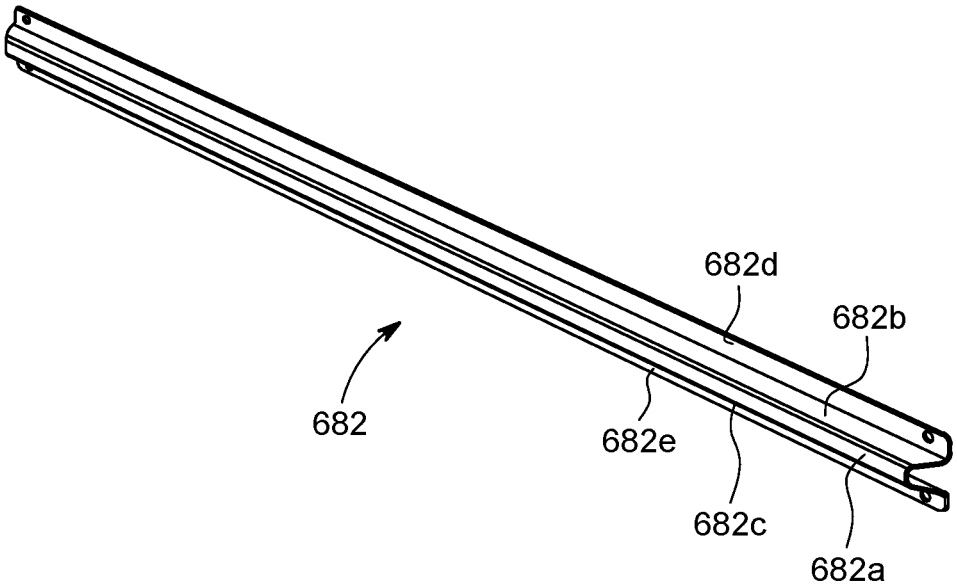
Figure 13W:
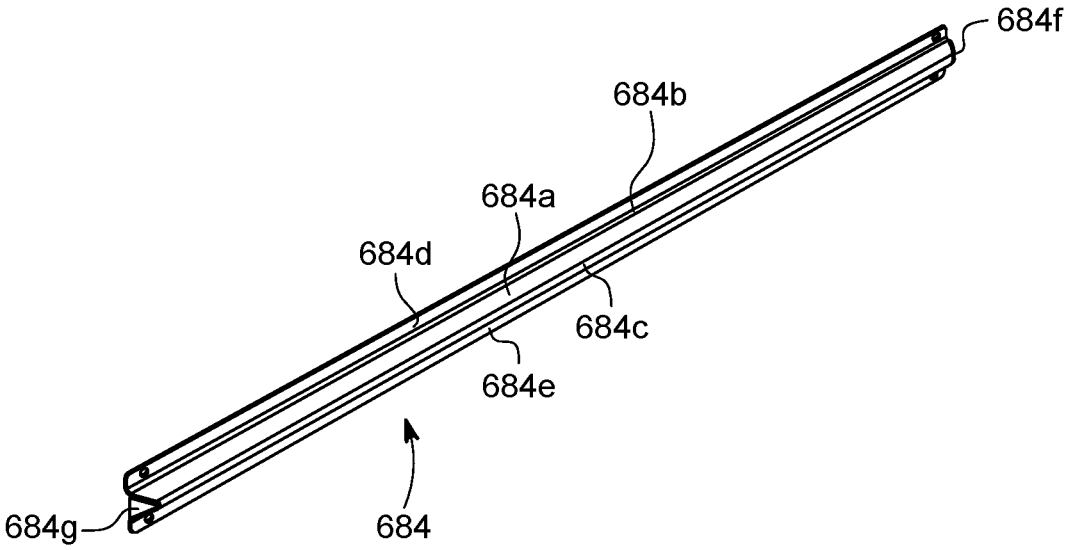
Figure 13X:
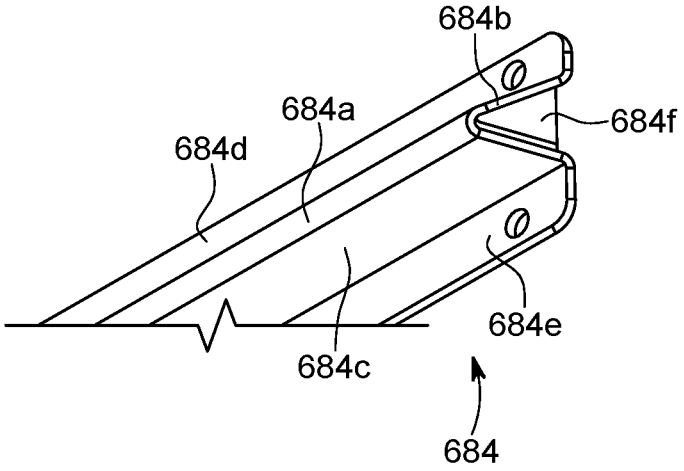
Figure 13Y:
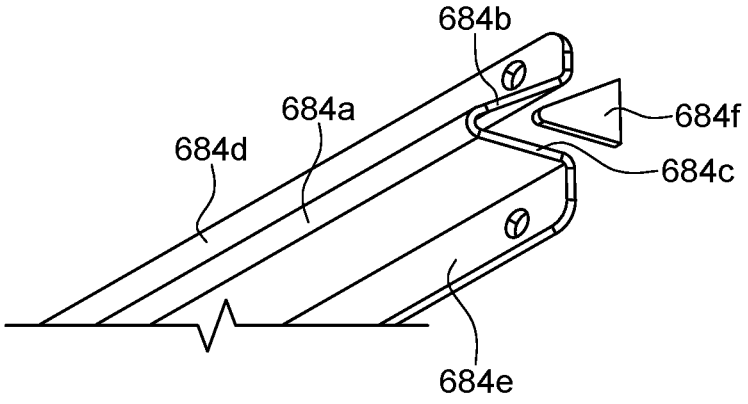
Figure 13Z:
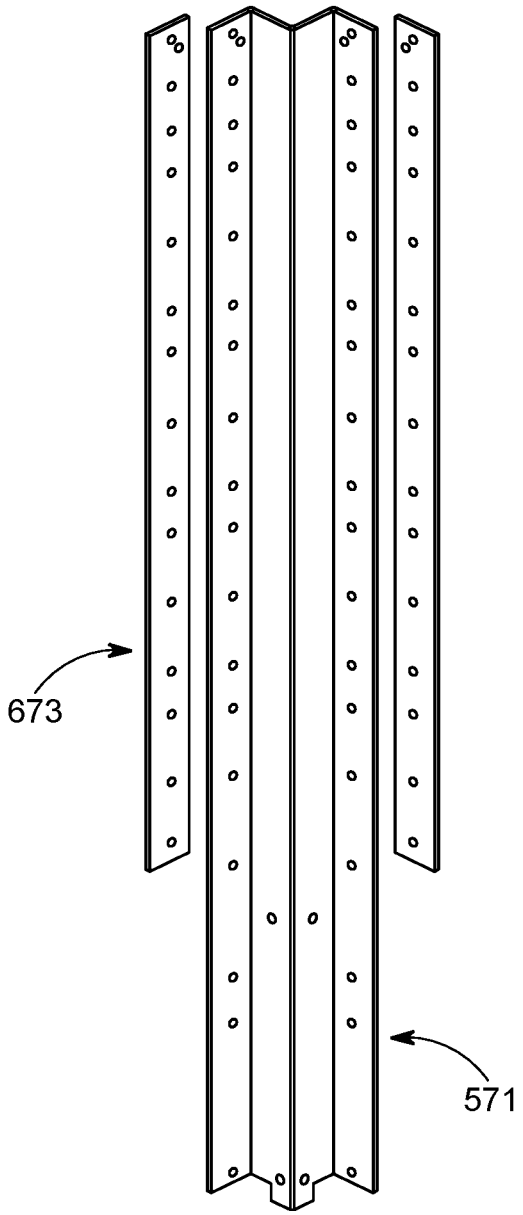

The second or intermediate elongated horizontally extending brace 684 (as shown in FIGS. 13WW, 13XX, and 13YY) includes an elongated vertically extending outer wall 684*a*, an upper elongated upwardly angled inwardly extending connection wall 684*b* integrally connected to the top of the outer wall 684*a*, a lower elongated downwardly angled inwardly extending connection wall 684*c* integrally connected to the bottom of the outer wall 684*a*, an upper elongated vertically extending base wall 682*d* integrally connected to the top of the connection wall 684*b*, and a lower elongated vertically extending base wall 684*e* integrally connected to the bottom of the connection wall 684*c*. The left side end of the brace 684, and particularly the left side end of the upper base wall 684*d* and lower base wall 684*e* are connected to the wall 572 of the corner support assembly 570 by suitable fasteners (not shown). The right side end of the brace 682, and particularly the right side end of the upper base wall 684*d* and the lower base wall 684*e* are connected to the wall 515 of the upright corner assembly 510 by suitable fasteners (not shown). The second or intermediate elongated horizontally extending brace 684 further includes end walls 684*f* and 684*g* that extend outwardly from the base walls 684*d* and 684*e* and are angled toward each other such that each end of the brace 684 includes and inwardly angled end. These inwardly angled end walls act as bumpers and prevent damage from forklift trucks and other operating equipment, and prevent damage from container to container contact.

The third intermediate elongated horizontally extending brace 686 is identical to the first or lower elongated horizontally extending brace 684, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 686, and particularly the left side end of the upper base wall and lower base wall are connected to the wall 572 of the corner support assembly by suitable fasteners (not shown). The right side end of the brace 686, and particularly the right side end of the upper base wall and the lower base wall are connected to the wall 515 of the upright corner assembly 510 by suitable fasteners (not shown). The second or intermediate elongated horizontally extending brace further includes end walls that respectively extend outwardly from the base walls and are angled toward each other such that each end of the brace includes and inwardly angled end. These inwardly angled end walls act as bumpers and prevent damage from forklift trucks and other operating equipment, and prevent damage from container to container contact.

The fourth or upper elongated horizontally extending brace 688 is identical to the first or lower elongated horizontally extending brace 682, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 688, and particularly the left side end of the upper base wall and lower base wall are connected to the wall 572 of the corner support assembly 570 by suitable fasteners (not shown). The right side end of the brace 688, and particularly the right side end of the upper base wall and the lower base wall are connected to the wall 515 of the upright corner assembly 510 by suitable fasteners (not shown).

Figure 1:
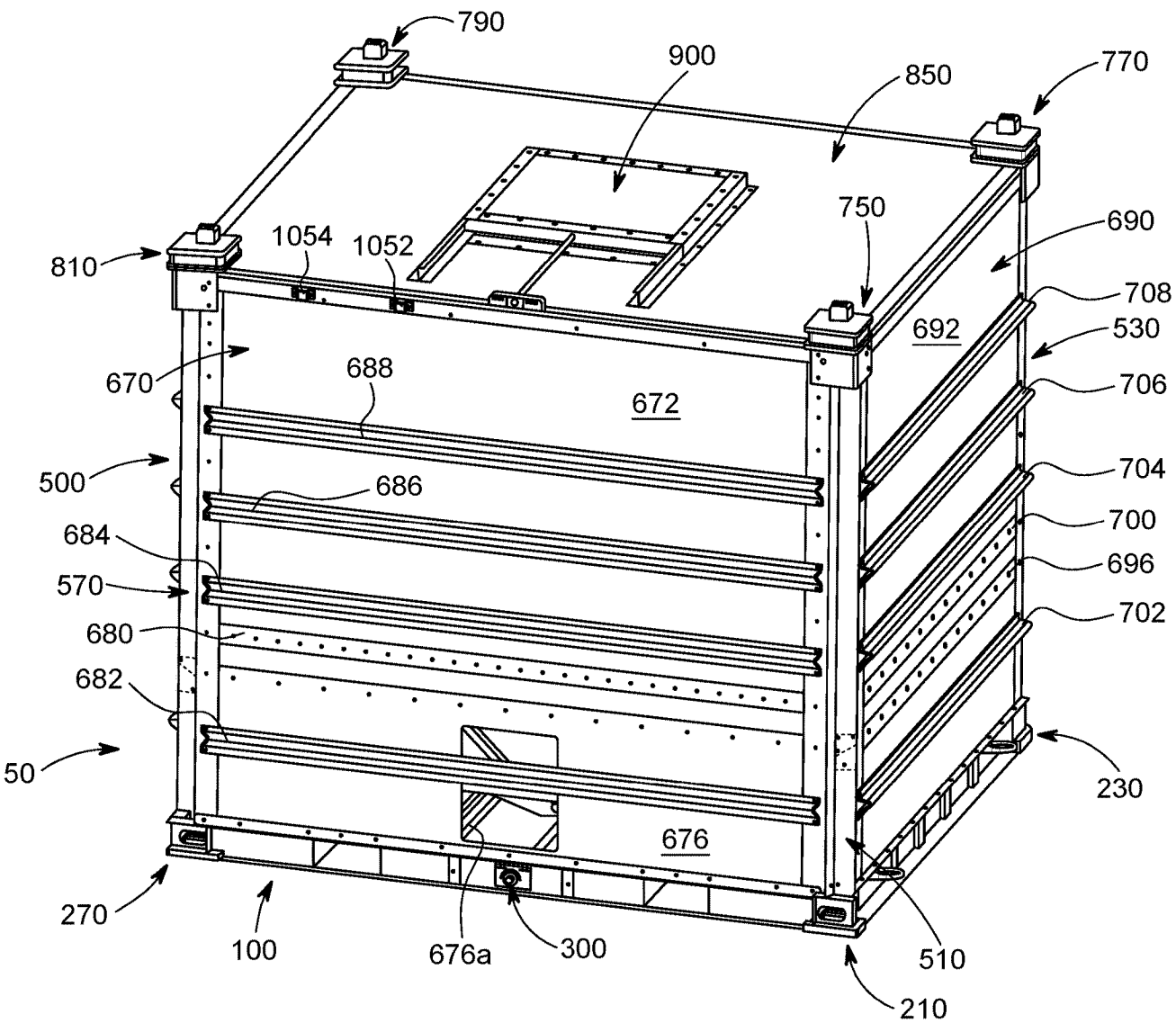
FIG. 1 is a top perspective view of the bulk material shipping container of one example embodiment of the present disclosure.
Figure 2:
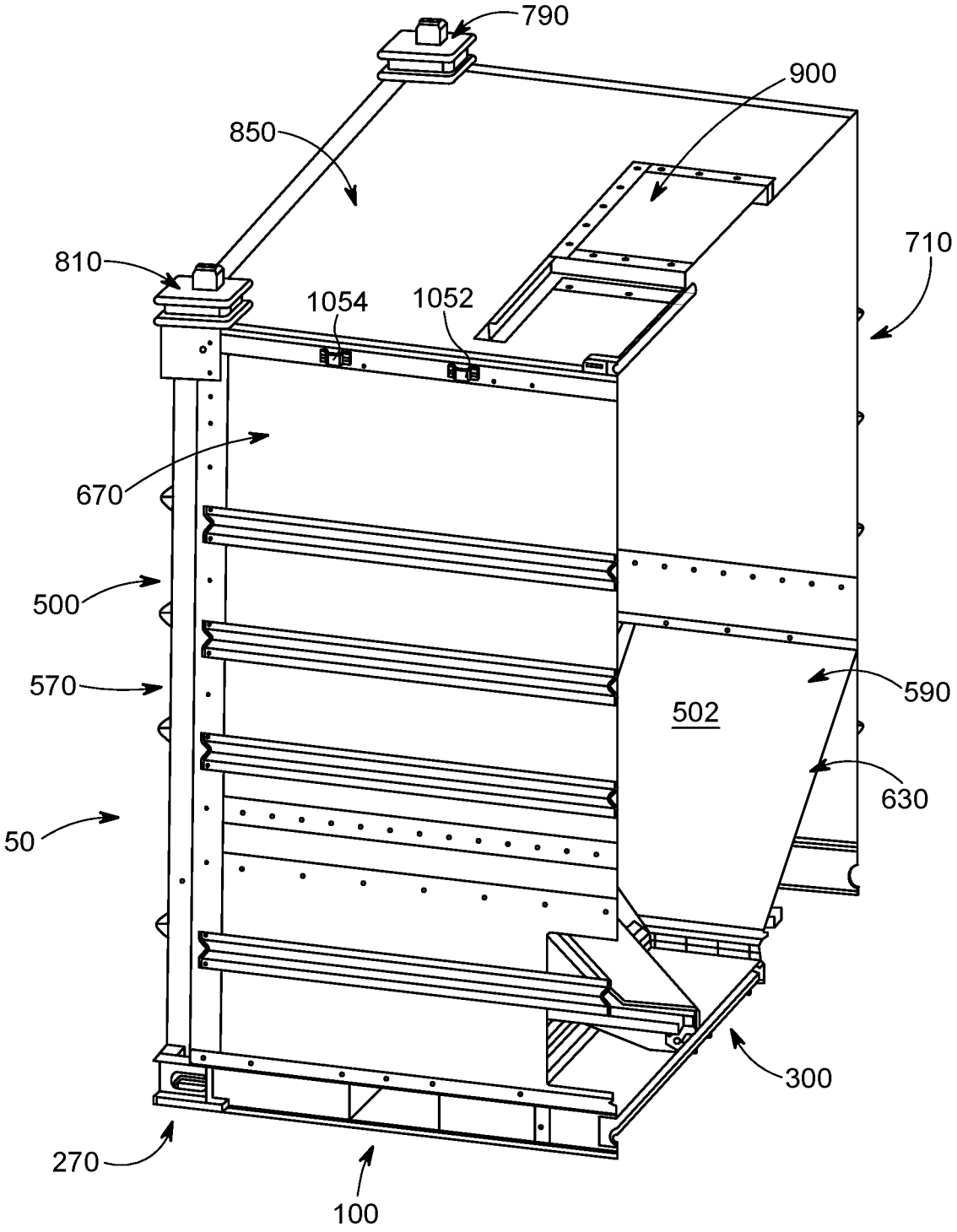
FIG. 2 is a vertical cross-sectional top front perspective view of the bulk material shipping container of FIG. 1, showing the hatch assembly of the material loading assembly in the closed position, and showing the gate assembly of the material unloading assembly in the closed position.
Figure 4:
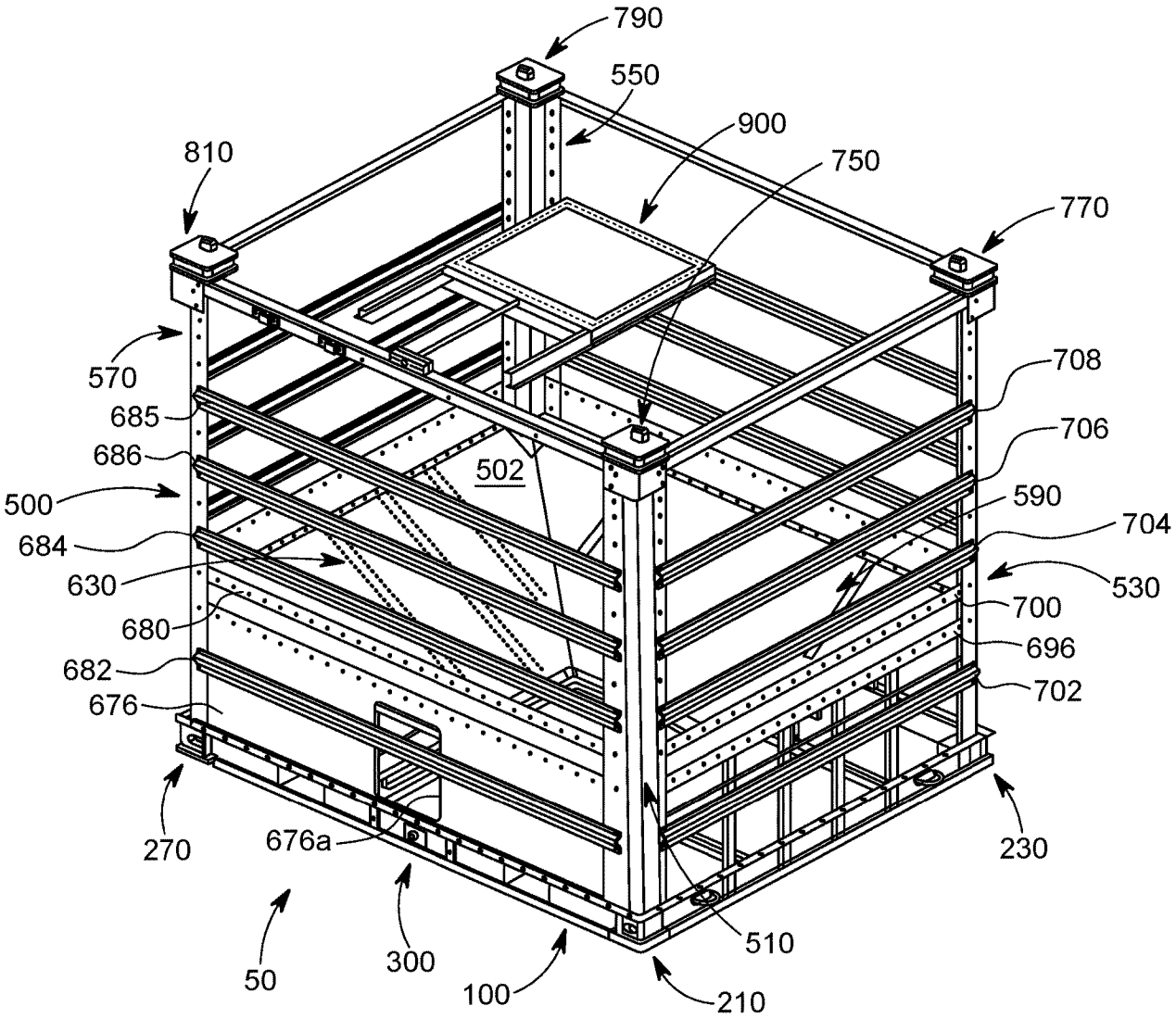
FIG. 4 is a top front perspective view of the bulk material shipping container of FIG. 1, with the top wall assembly of the compartment removed and with the composite panels of the exterior front, rear, and side wall assemblies removed.
Figure 5:
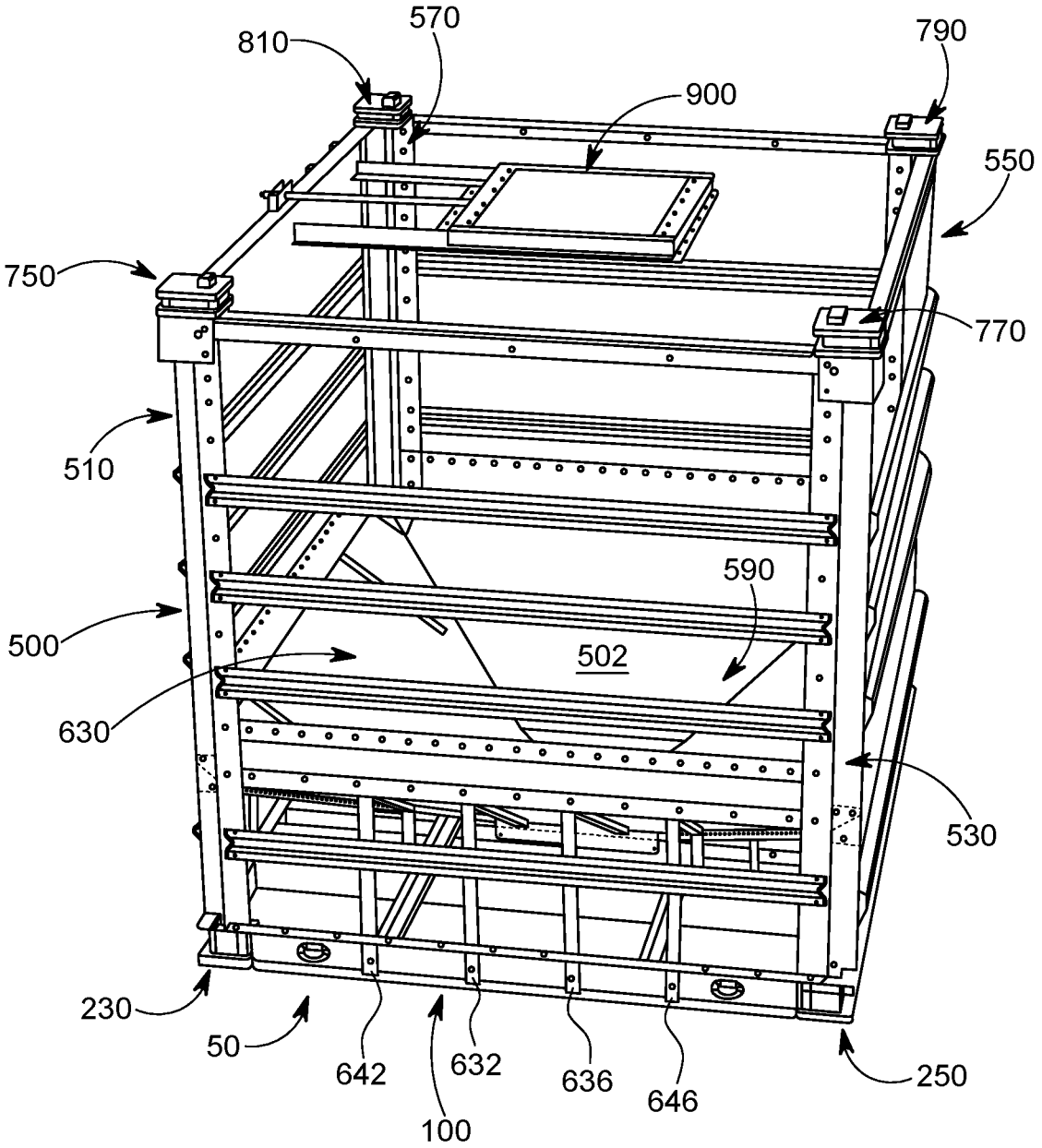
FIG. 5 is a left side top perspective view of the bulk material shipping container of FIG. 1, with the top wall assembly of the compartment removed and with the composite panels of the exterior walls removed.
Figure 6:
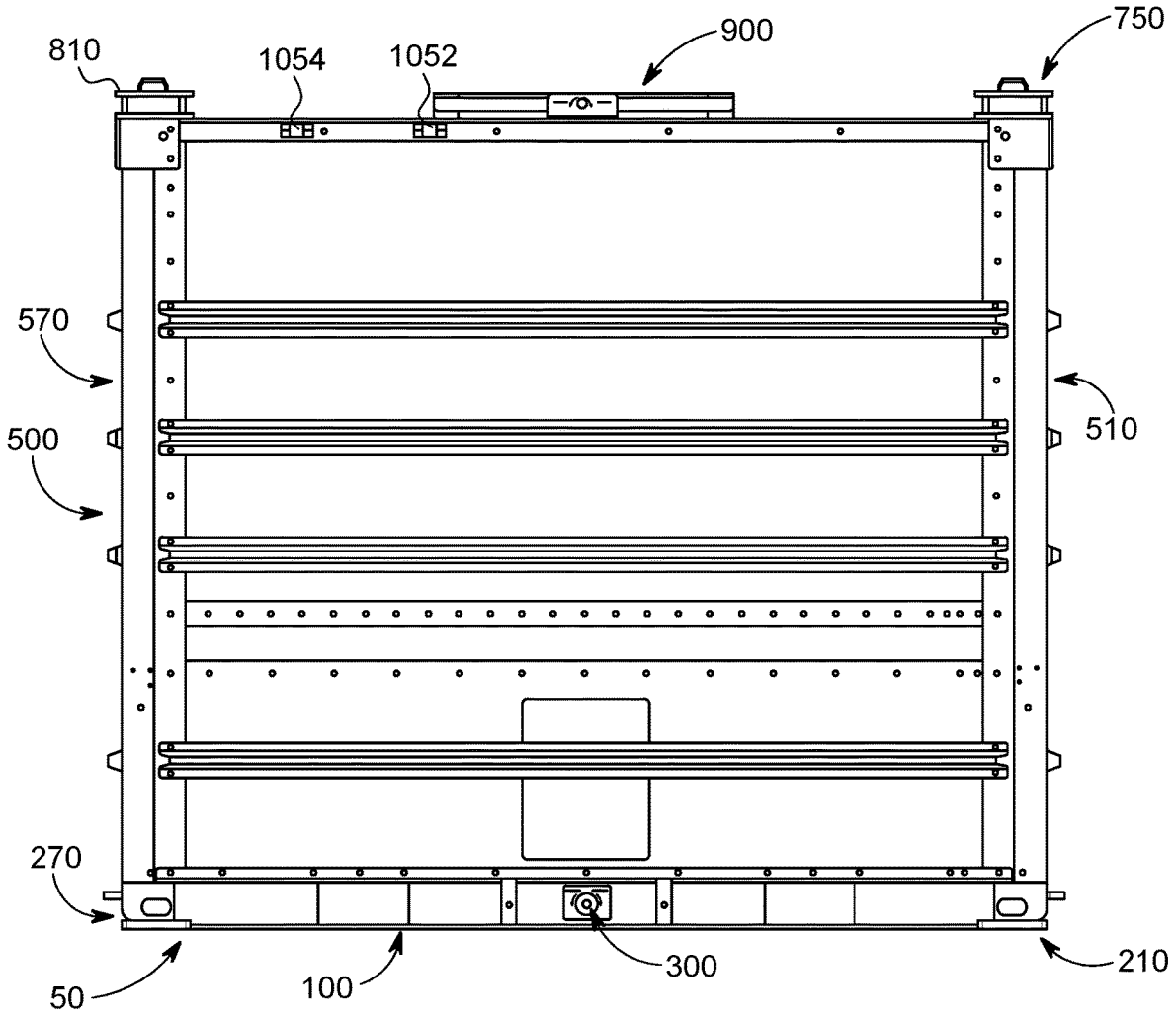
FIG. 6 is a front view of the bulk material shipping container of FIG. 1, with the top wall assembly of the compartment removed and with the composite panels of the exterior front, rear, and side wall assemblies removed.
Figure 7:
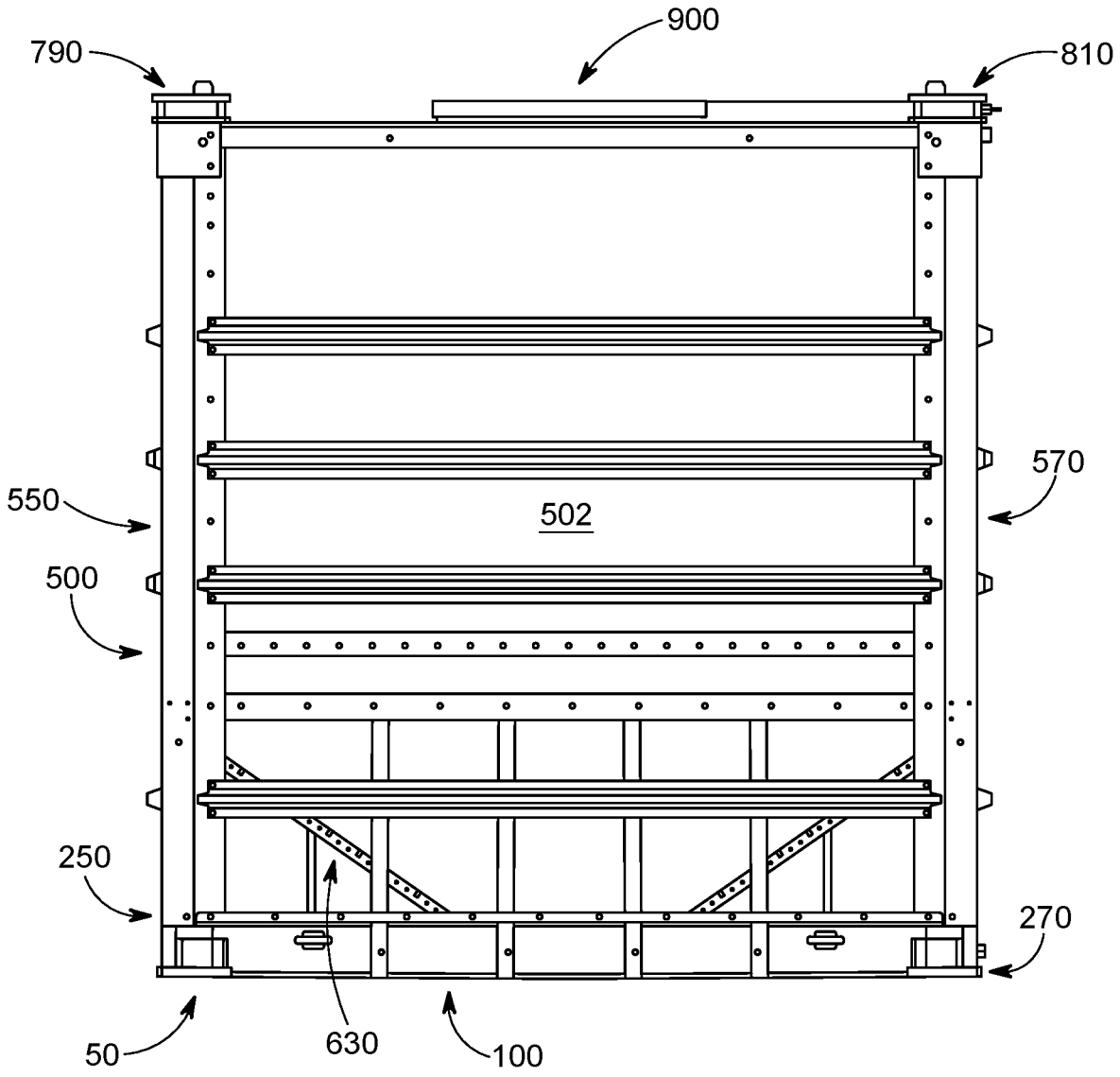
FIG. 7 is a right side view of the bulk material shipping container of FIG. 1, with the top wall assembly of the compartment removed and with the composite panels of the exterior front, rear, and side wall assemblies removed.
Figure 8:
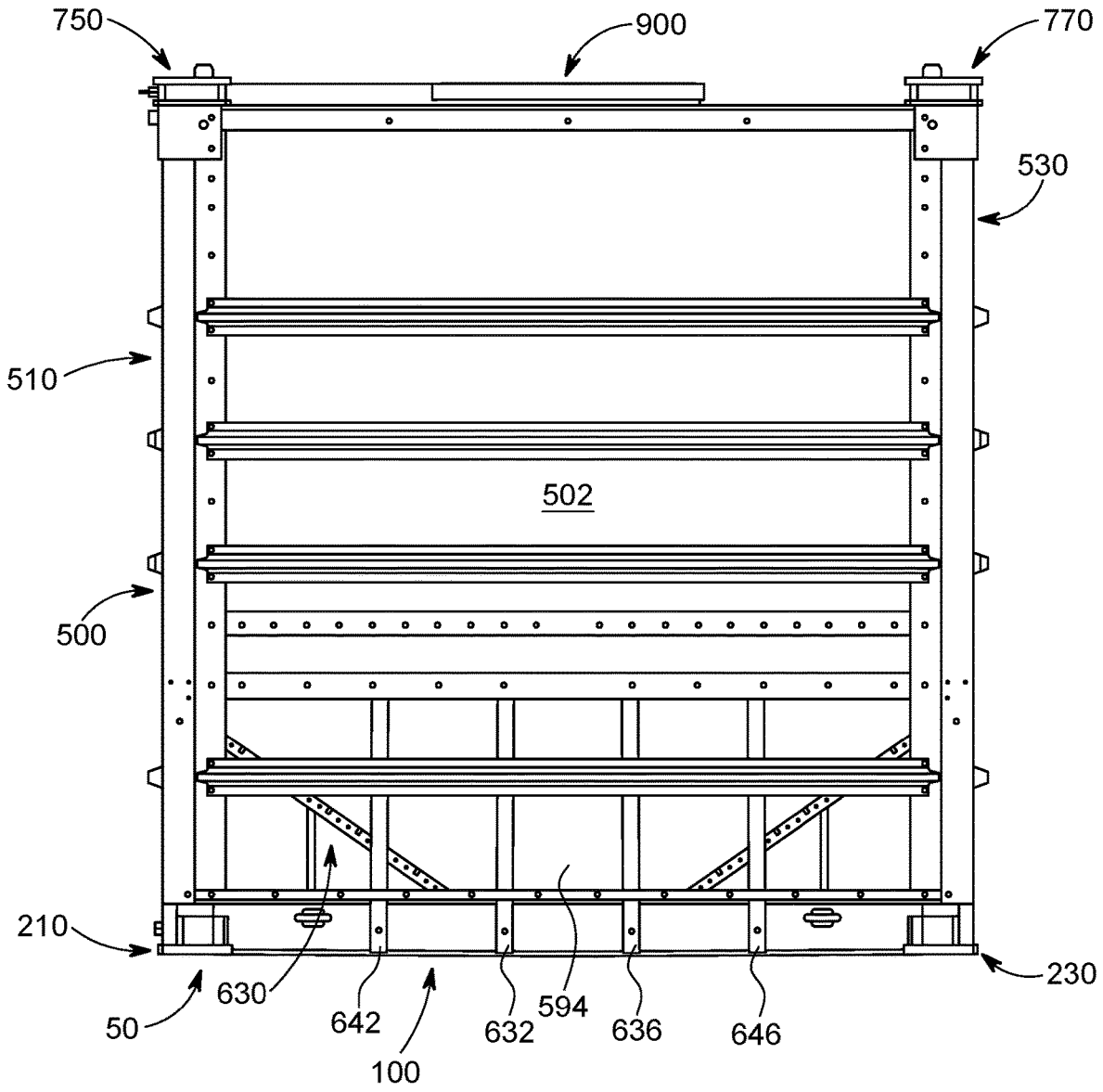
FIG. 8 is a left side view of the bulk material shipping container of FIG. 1, with the top wall assembly of the compartment removed and with the composite panels of the exterior front, rear, and side wall assemblies removed.
Figure 9:
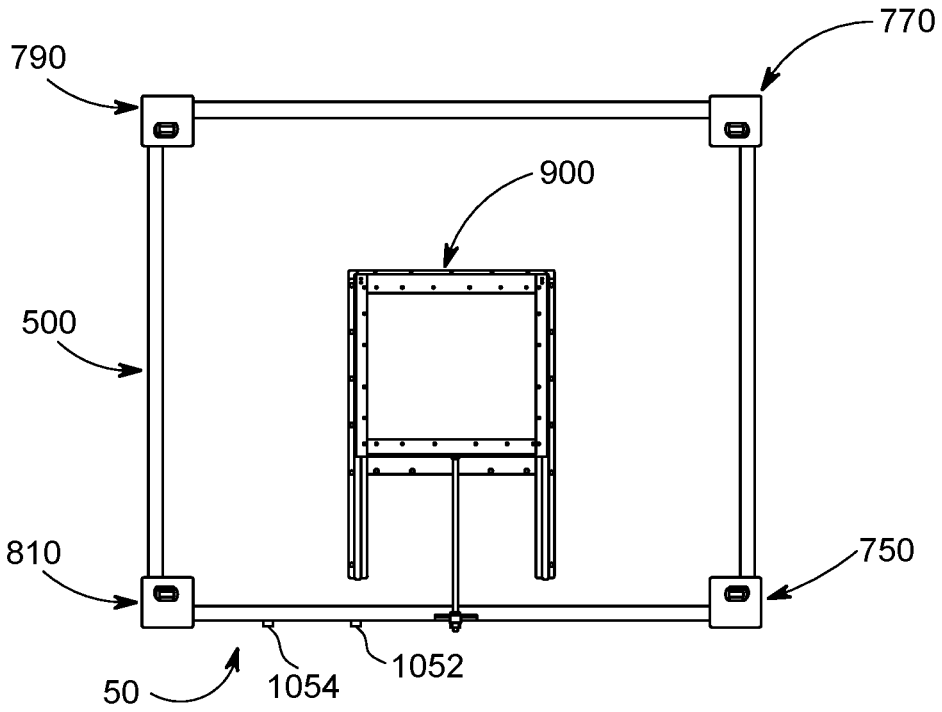
FIG. 9 is a top view of the bulk material shipping container of FIG. 1.
Figure 10:
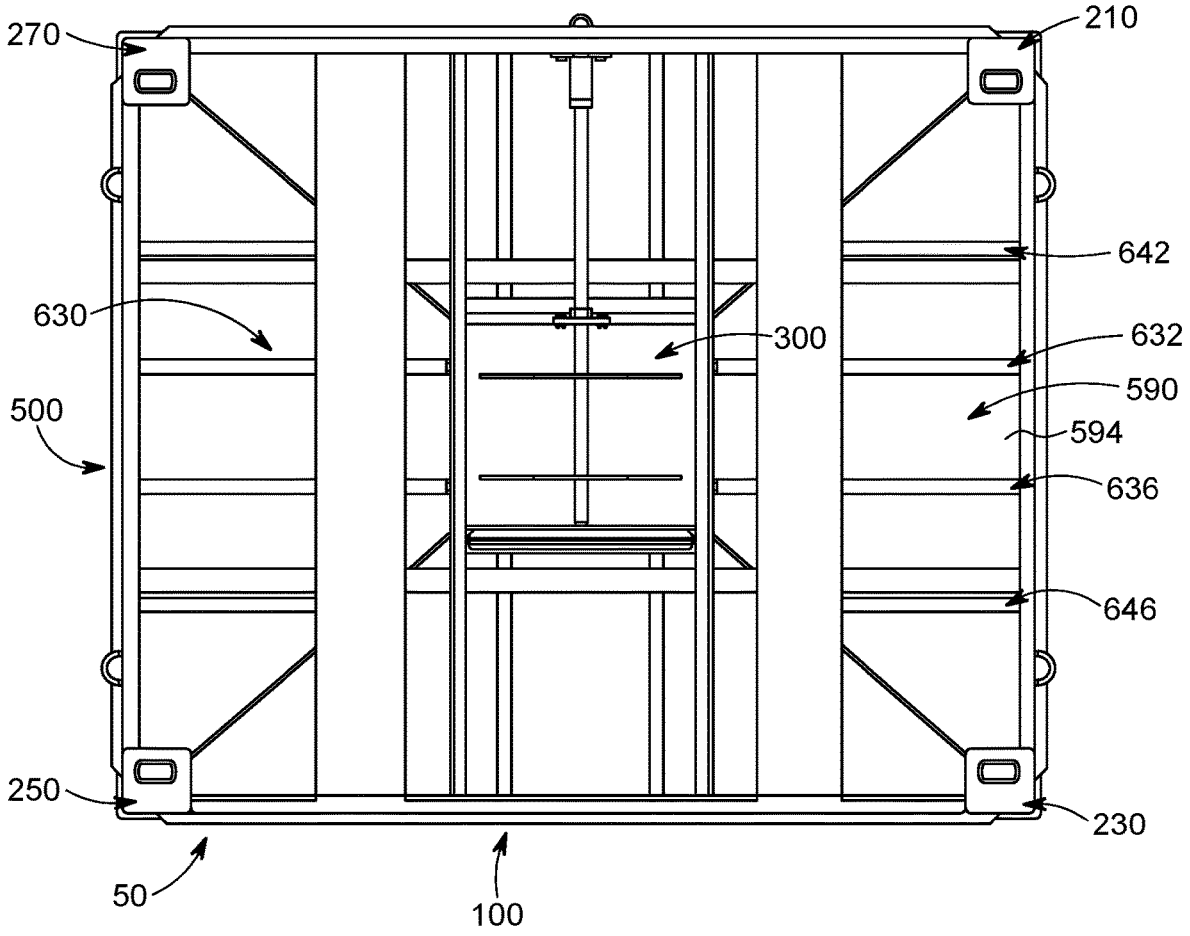
FIG. 10 is a bottom view of the bulk material shipping container of FIG. 1.

The exterior first or left side wall assembly 690 as shown in FIGS. 1, 4, and 8 includes a composite panel 692 to minimize the weight of the container, a first or intermediate elongated horizontally extending seal plate 696, a second or intermediate elongated horizontally extending seal plate 700, a first or lower elongated horizontally extending brace 702, a second or intermediate elongated horizontally extending brace 704, a third intermediate elongated horizontally extending brace 706, and a fourth or upper elongated horizontally extending brace 708. The composite panel 692 includes a top edge, a bottom edge, a left side edge, and a right side edge. The composite panel 692 extends from the upright corner assembly 510 to the upright corner assembly 530, and from the lip of the left side support 120 to the top wall assembly 850. The composite panel 692 is generally connected in the same manner as the composite panel 672.

The first or intermediate elongated horizontally extending seal plate 696 is identical or similar to the second or intermediate elongated horizontally extending plate 680 and includes a substantially flat metal plate having a top edge, a bottom edge, a left side edge, and a right side edge. The second or intermediate elongated horizontally extending seal plate 696 extends from the upright corner assembly 510 to the upright corner assembly 530. The second or intermediate elongated horizontally extending seal plate 680 facilitates attachment of the inner upwardly extending seal plate (not shown) for the left side wall assembly 690 of the compartment. The second or intermediate elongated horizontally extending seal plate 700 is identical or similar to second or intermediate elongated horizontally extending seal plate 680 and includes a substantially flat metal plate having a top edge, a bottom edge, a left side edge, and a right side edge. The second or intermediate elongated horizontally extending seal plate 700 extends from the upright corner assembly 510 to the upright corner assembly 530. The second or intermediate elongated horizontally extending seal plate 700 facilitates attachment of the inner upwardly extending seal plate (not shown) for the left side wall assembly 690 of the compartment.

The first or lower elongated horizontally extending brace 702 is identical to the first or lower elongated horizontally extending brace 682, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 702, and particularly the left side end of the upper base wall and lower base wall are connected to the wall 512 of the upright corner assembly 510 by suitable fasteners (not shown). The right side end of the brace 702, and particularly the right side end of the upper base wall and the lower base wall are connected to the wall 535 of the upright corner assembly 530 by suitable fasteners (not shown).

The second or intermediate elongated horizontally extending brace 704 is identical to the first or lower elongated horizontally extending brace 684, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 704, and particularly the left side end of the upper base wall and lower base wall are connected to the wall 512 of the upright corner assembly 510 by suitable fasteners (not shown). The right side end of the brace 704, and particularly the right side end of the upper base wall and the lower base wall are connected to the wall 535 of the corner support assembly 530 by suitable fasteners (not shown). The second or intermediate elongated horizontally extending brace 704 further includes end walls that respectively extend outwardly from the base walls and are angled toward each other such that each end of the brace includes and inwardly angled end. These inwardly angled end walls act as bumpers and prevent damage from forklift trucks and other operating equipment, and prevent damage from container to container contact.

The third intermediate elongated horizontally extending brace 706 is identical to the first or lower elongated horizontally extending brace 684, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 706, and particularly the left side end of the upper base wall and lower base wall are connected to the wall 512 of the upright corner assembly 510 by suitable fasteners (not shown). The right side end of the brace 706, and particularly the right side end of the upper base wall and the lower base wall are connected to the wall 535 of the corner support assembly 530 by suitable fasteners (not shown). The second or intermediate elongated horizontally extending brace 706 further includes end walls that respectively extend outwardly from the base walls and are angled toward each other such that each end of the brace includes and inwardly angled end. These inwardly angled end walls act as bumpers and prevent damage from forklift trucks and other operating equipment, and prevent damage from container to container contact.

The fourth or upper elongated horizontally extending brace 708 is identical to the first or lower elongated horizontally extending brace 682, and includes an elongated vertically extending outer wall, an upper elongated upwardly angled inwardly extending connection wall integrally connected to the top of the outer wall, a lower elongated downwardly angled inwardly extending connection wall integrally connected to the bottom of the outer wall, an upper elongated vertically extending base wall integrally connected to the top of the connection wall, and a lower elongated vertically extending base wall integrally connected to the bottom of the connection wall. The left side end of the brace 708, and particularly the left side end of the upper base wall and lower base wall are connected to the wall 512 of the upright corner assembly 510 by suitable fasteners (not shown). The right side end of the brace 708, and particularly the right side end of the upper base wall and the lower base wall are connected to the wall 535 of the corner support assembly 530 by suitable fasteners (not shown).

Similar to the exterior front wall assembly 670, the exterior rear wall assembly 710 includes a composite panel, a first or bottom elongated horizontally extending kick plate (with or without a viewing port), a second or intermediate elongated horizontally extending seal plate, a first or lower elongated horizontally extending brace, a second or intermediate elongated horizontally extending brace, a third intermediate elongated horizontally extending brace, and a fourth or upper elongated horizontally extending brace.

Similar to the exterior first or left side wall assembly 670, the exterior second or right side wall assembly 730 includes a composite panel, a first or intermediate elongated horizontally extending seal plate, a second or intermediate elongated horizontally extending seal plate, a first or lower elongated horizontally extending brace, a second or intermediate elongated horizontally extending brace, a third intermediate elongated horizontally extending brace, and a fourth or upper elongated horizontally extending brace.

As shown in FIGS. 13AAA and 13BBB, the top wall assembly 850 of the compartment 500 of the container 50 includes an exterior top wall including a front L-shaped angle top support 852, a first or left side L-shaped angle top support 854, a rear L-shaped angle top support 856, and a second or right side L-shaped angle top support 858.

The front L-shaped angle top support 852 includes an elongated horizontally extending top wall 852*a* integrally connected to an elongated vertically extending side wall 852*b*.

The first or left side L-shaped angle top support 854 includes an elongated horizontally extending top wall 854*a* integrally connected to an elongated vertically extending side wall 854*b*.

The rear L-shaped angle top support 856 includes an elongated horizontally extending top wall 856*a* integrally connected to an elongated vertically extending side wall 856*b*.

The second or right side L-shaped angle top support 858 includes an elongated horizontally extending top wall 858*a* integrally connected to an elongated vertically extending side wall 858*b*.

The L-shaped angle top support 852, the first or left side L-shaped angle top support 854, the rear L-shaped angle top support 856, and the second or right side L-shaped angle top support 858 are configured to support a horizontally extending panel 860.

The top wall assembly 850 of the compartment 500 of the container 50 further includes: (a) a plurality of supports (not shown); and (b) in various embodiments panel attached plates (not shown), that are suitably connected to the L-shaped angle top support 852, the first or left side L-shaped angle top support 854, the rear L-shaped angle top support 856, and the second or right side L-shaped angle top support 858 under the horizontally extending panel 860 that support the panel 860, and that provide or define the opening 851.

The top wall assembly 850 of the compartment 500 of the container 50 and specifically the plurality of supports (not shown), the L-shaped angle top support 852, the first or left side L-shaped angle top support 854, the rear L-shaped angle top support 856, and the second or right side L-shaped angle top support 858 are configured to be attached to the upright corner assemblies 510, 530, 550, and 570.

In this illustrated embodiment, the exterior top wall panel is made of fiber board to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these components can be made from other suitable materials and connected in any suitable manner.

The top wall assembly 850 defines rectangular material receipt or loading opening 851. This material receipt or loading opening 851 enables materials to flow into the compartment when the hatch assembly of the material loading assembly 900 is opened as discussed above and below.

The Illustrated Example Material Loading Assembly

Figure 14A:
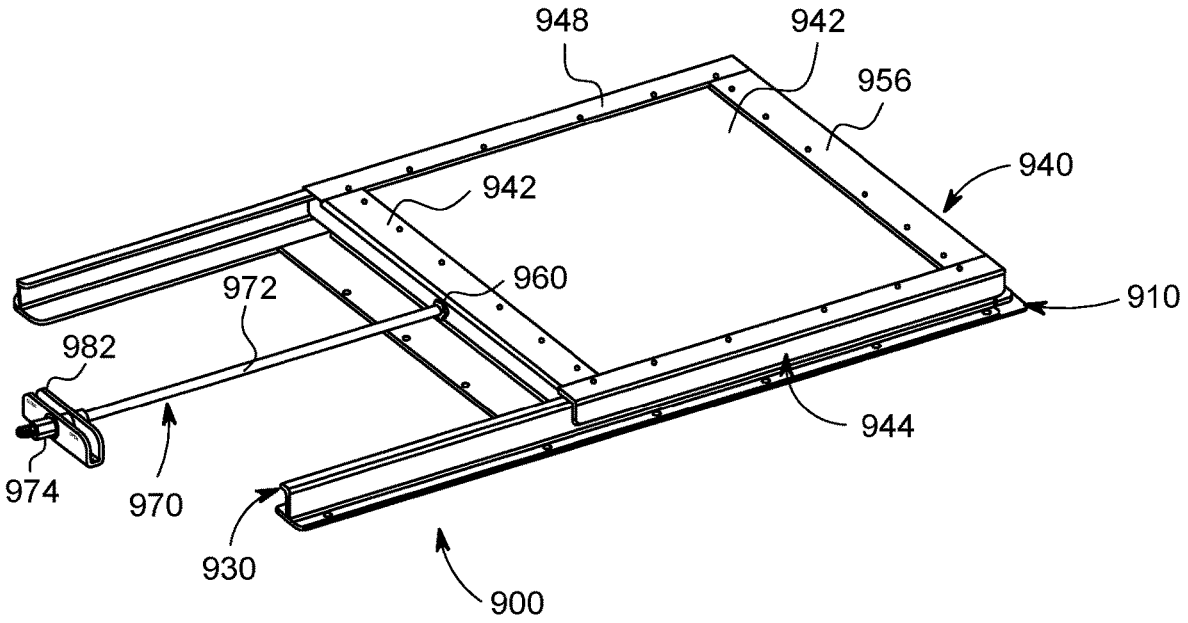
FIG. 14A is a top perspective view of the material loading assembly of the bulk material shipping container of FIG. 1, shown removed from the top wall assembly of the compartment of the container and with the hatch assembly in the closed position.
Figure 14B:
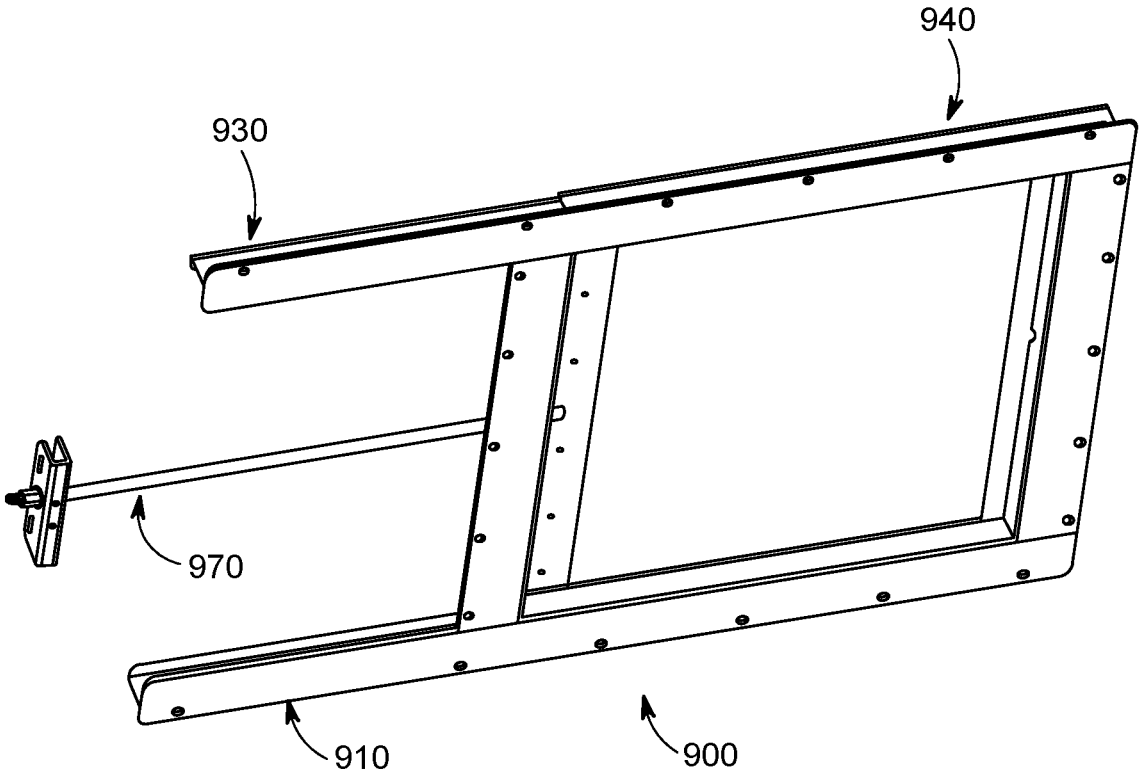
FIG. 14B is a bottom perspective view of the material loading assembly of the bulk material shipping container of FIG. 1, shown removed from the top wall assembly of the compartment of the container and with the hatch assembly in the closed position.
Figure 14C:
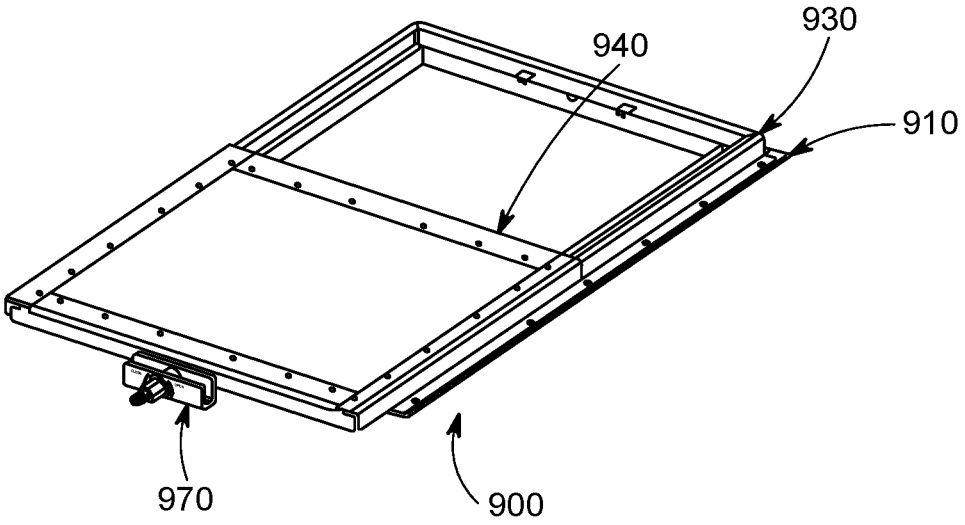
FIG. 14C is a top perspective view of the material loading assembly of the bulk material shipping container of FIG. 1, shown removed from the top wall assembly of the compartment of the container and with the hatch assembly in a fully open position.
Figure 14D:
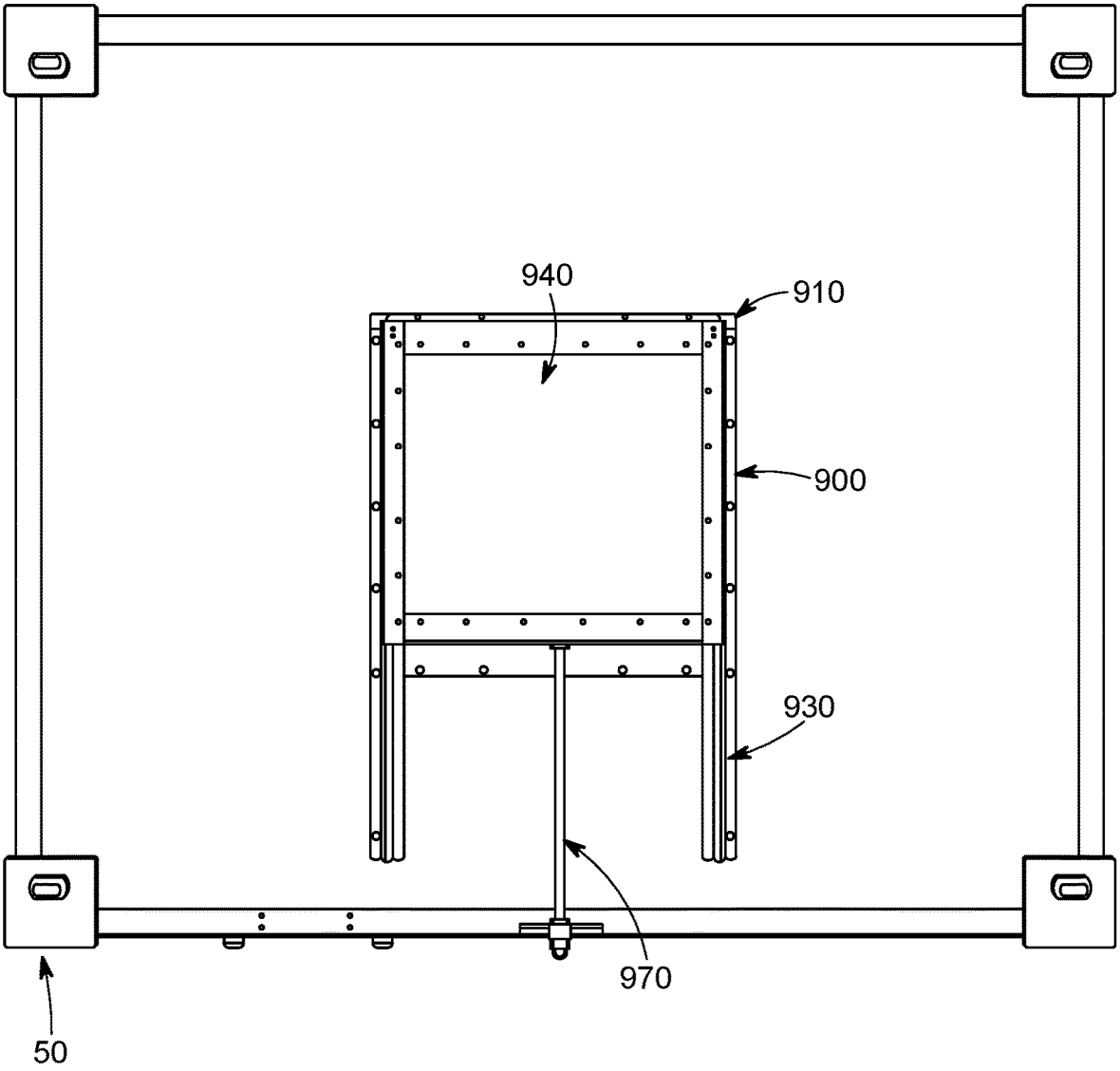
FIG. 14D is a top view of the bulk material shipping container of FIG. 1, showing the material loading assembly connected to the top wall assembly of the compartment of the container.
Figure 14E:
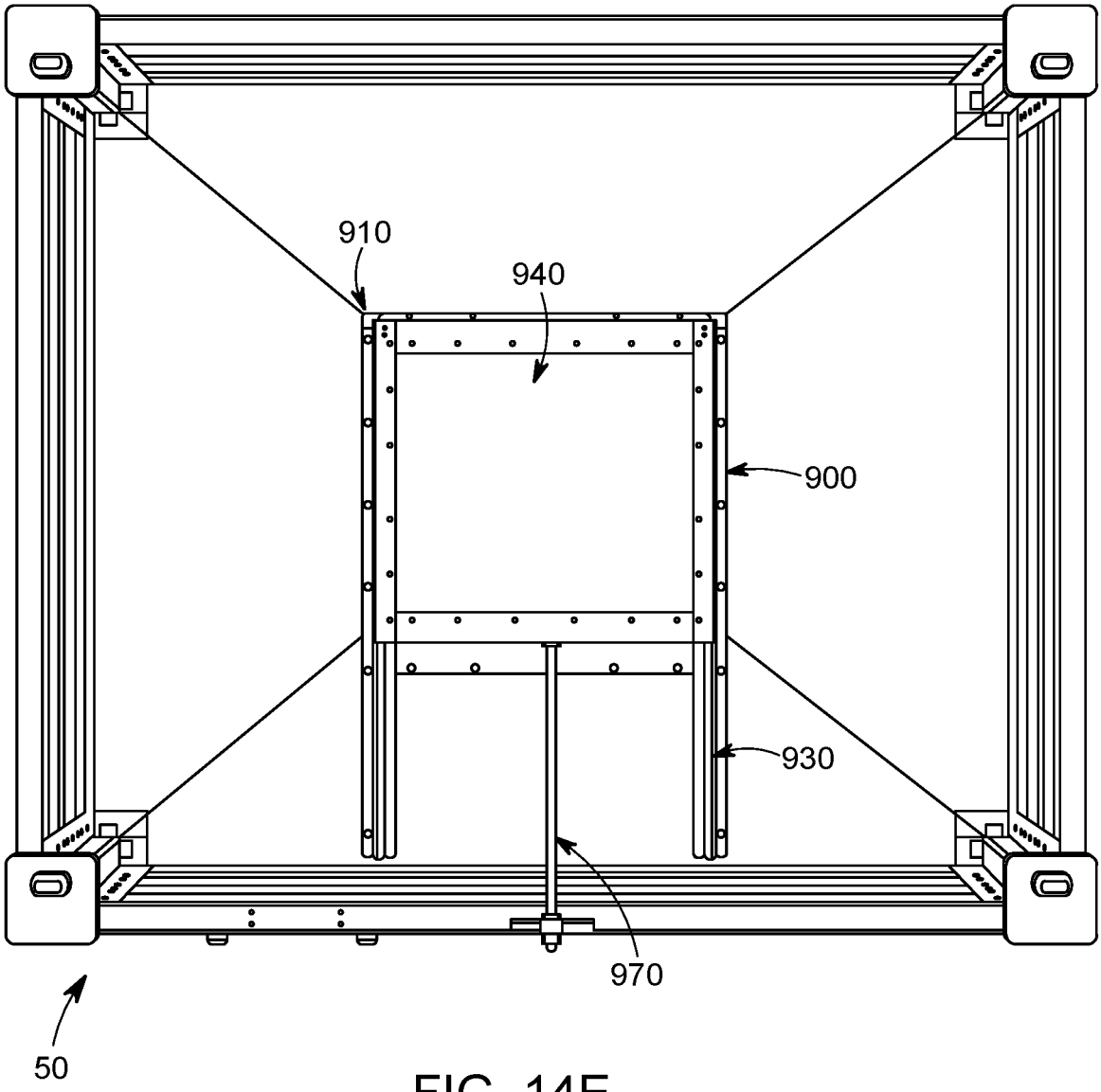
FIG. 14E is a top view of the bulk material shipping container of FIG. 1, shown without part of the top wall assembly of the compartment, and showing the material loading assembly.
Figure 14F:
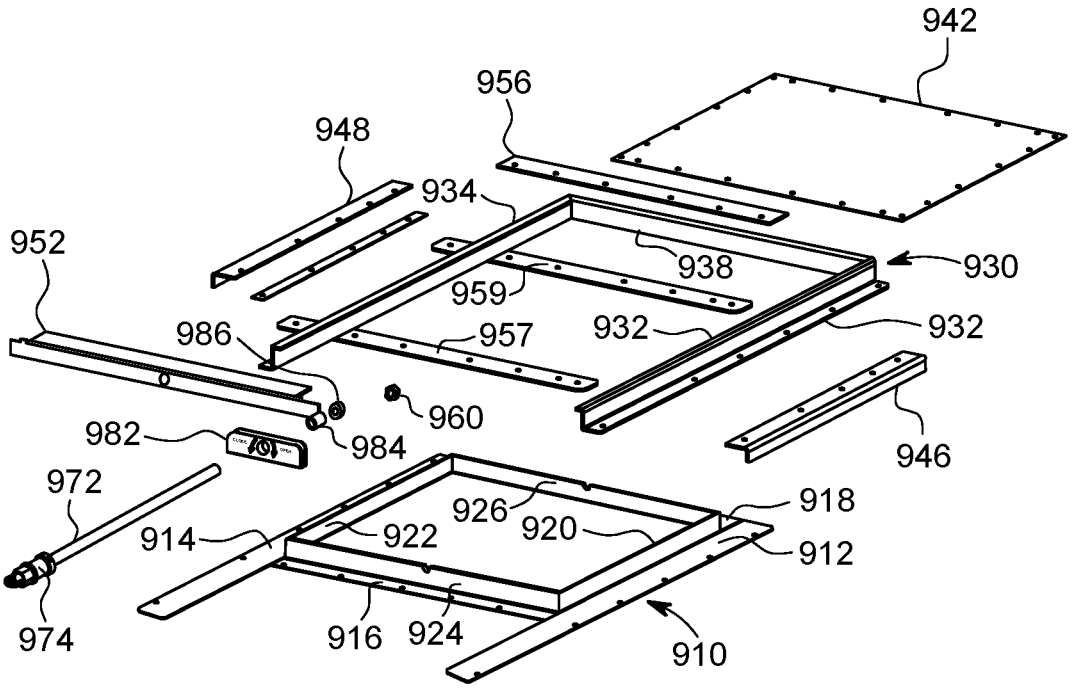
FIG. 14F is a top exploded perspective view of the material loading assembly of the bulk material shipping container of FIG. 1, shown removed from the top wall assembly of the compartment of the container.
Figure 14G:
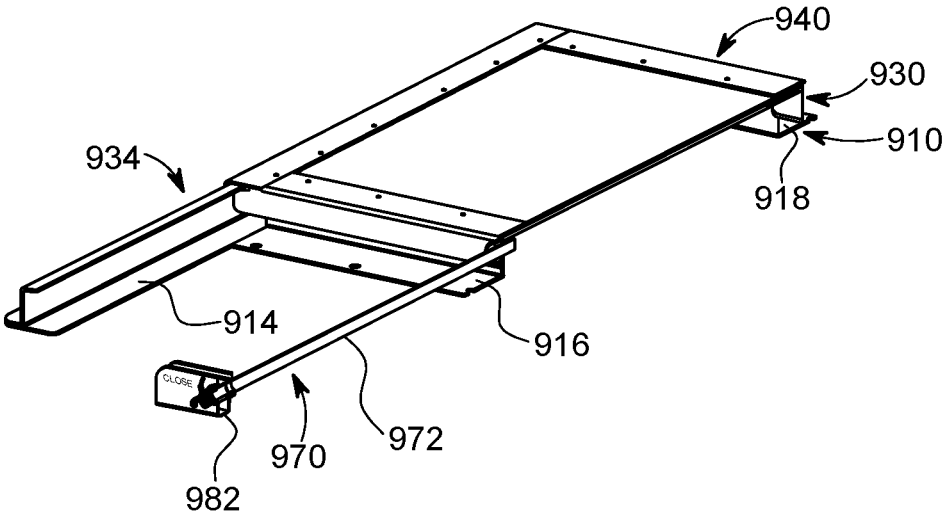
FIG. 14G is a vertical partial cross-sectional perspective view of the material loading assembly of the bulk material shipping container of FIG. 1, shown removed from the top wall assembly of the compartment of the container.
Figure 14H:
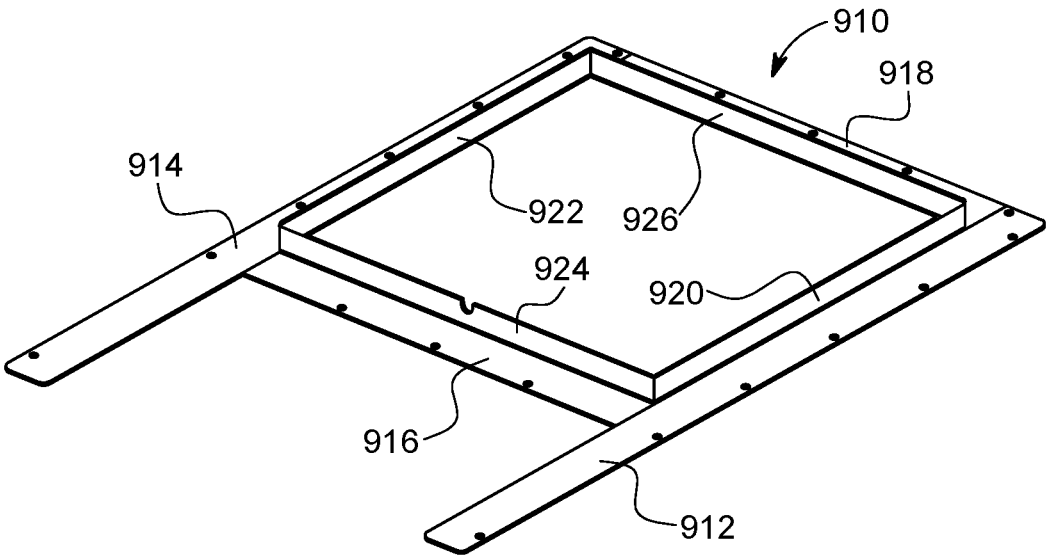
FIG. 14H is an enlarged top perspective view of the hatch collar assembly of the material loading assembly of the bulk material shipping container of FIG. 1.
Figure 14I:
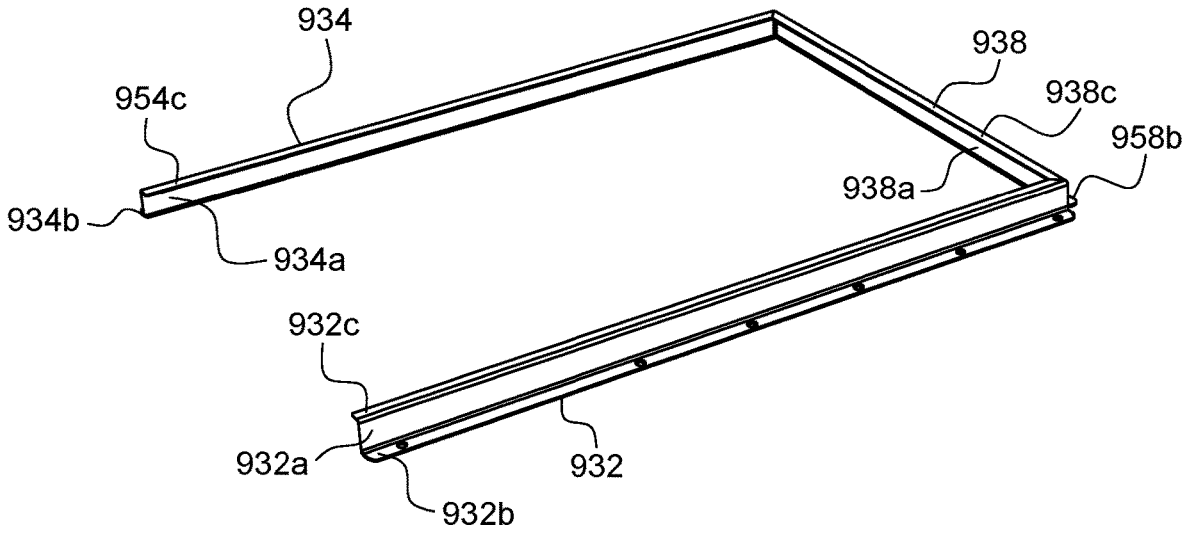
FIG. 14I is an enlarged top perspective view of the hatch rail guide assembly of the material loading assembly of the bulk material shipping container of FIG. 1.
Figure 14J:
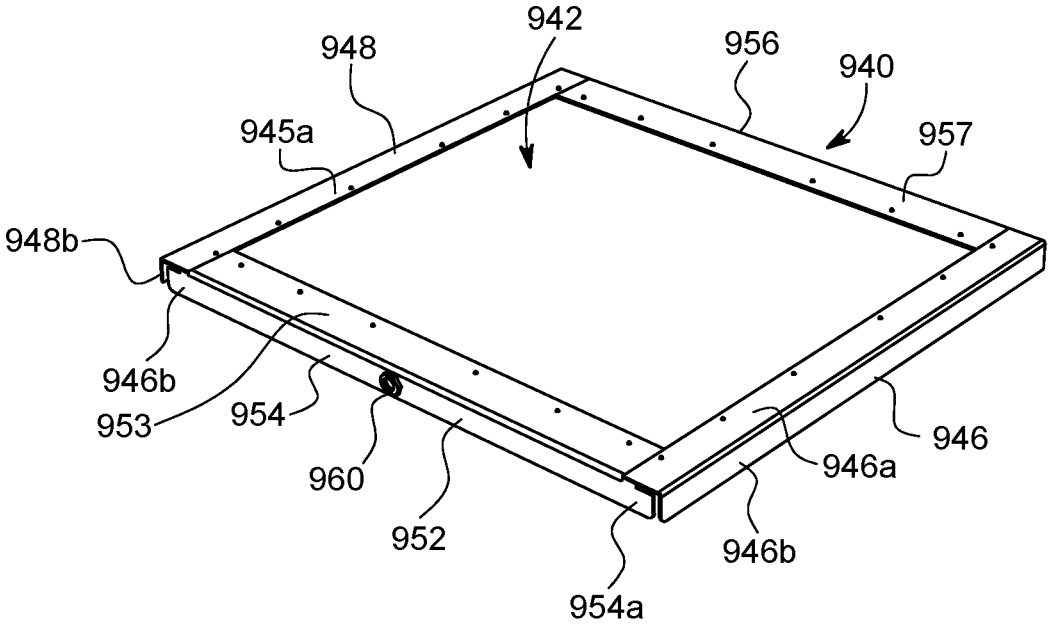
FIG. 14J is an enlarged top perspective view of the hatch assembly of the material loading assembly of the bulk material shipping container of FIG. 1.
Figure 14K:
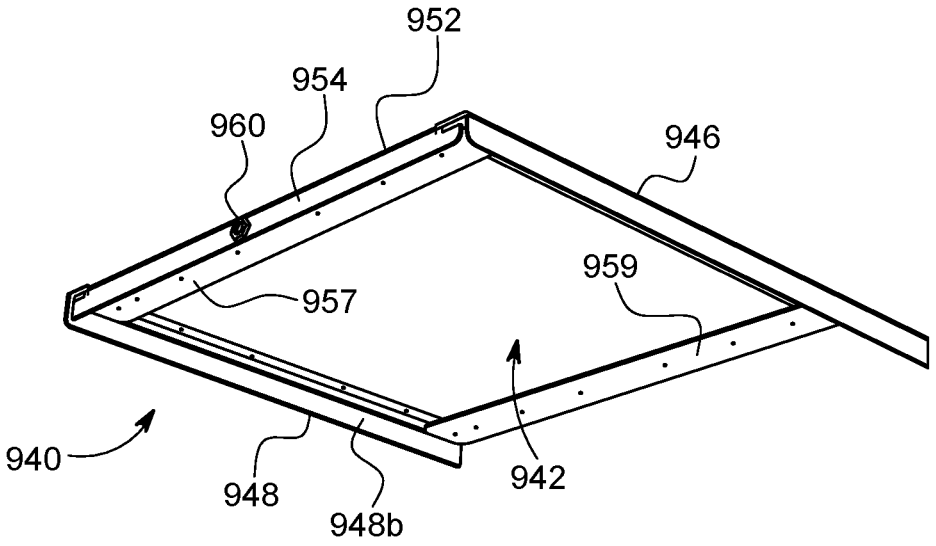
FIG. 14K is an enlarged bottom perspective view of the hatch assembly of the material loading assembly of the bulk material shipping container of FIG. 1.
Figure 14L:
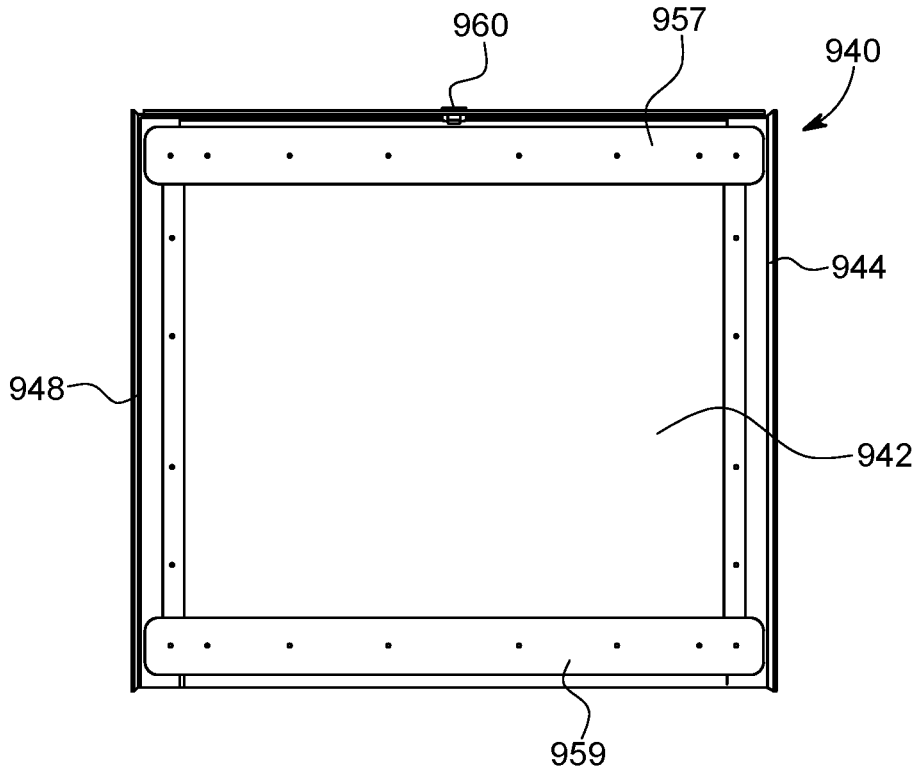
FIG. 14L is an enlarged bottom view of the hatch assembly of the material loading assembly of the bulk material shipping container of FIG. 1.
Figure 14M:
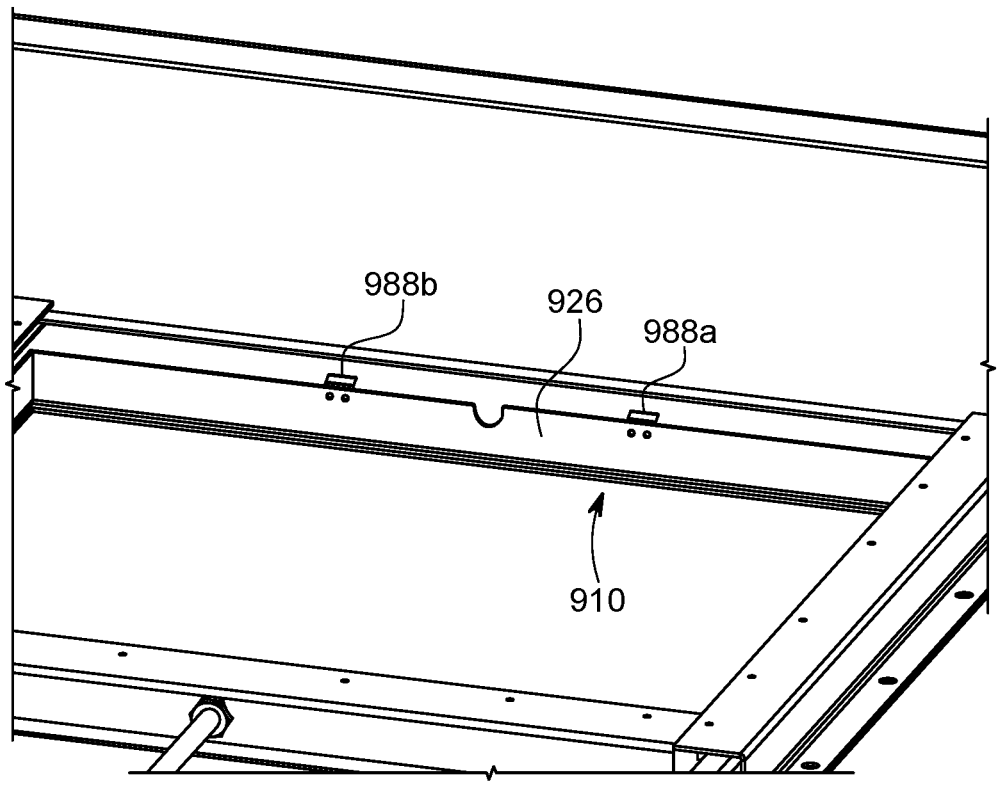
FIG. 14M is an enlarged fragmentary top perspective view of part of the hatch assembly of the material loading assembly of the bulk material shipping container of FIG. 1, showing the closing ramps of the material loading assembly.
Figure 14N:
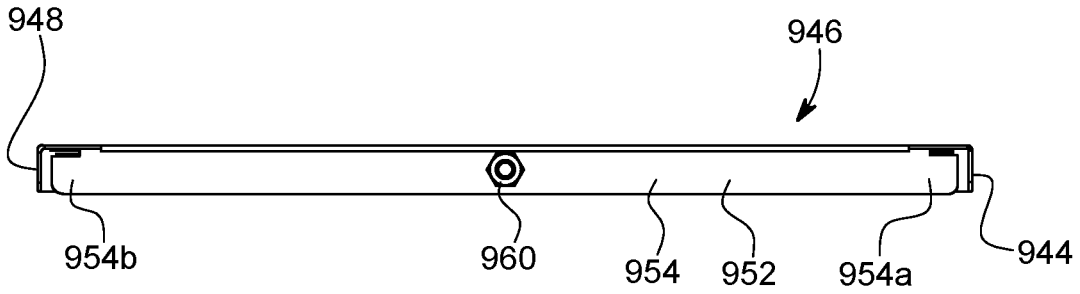
FIG. 14N is an enlarged front view of the hatch assembly of the material loading assembly of the bulk material shipping container of FIG. 1.
Figure 14O:
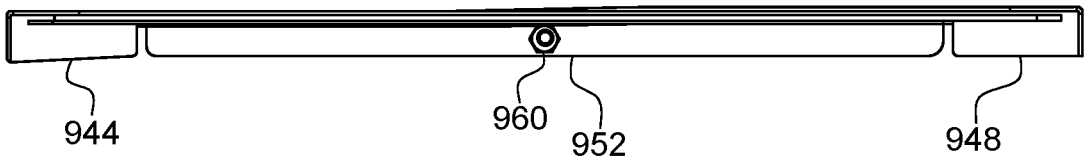
FIG. 14O is an enlarged rear view of the hatch assembly of the material loading assembly of the bulk material shipping container of FIG. 1.
Figure 14P:
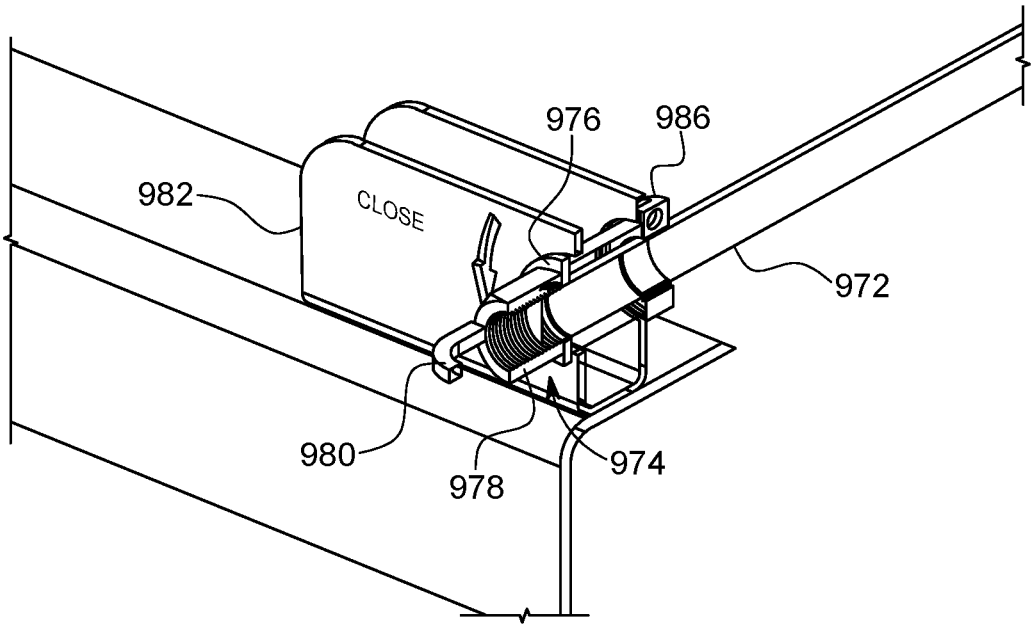
FIG. 14P is an enlarged partial cross-sectional perspective view of the front portion of the material loading assembly of the bulk material shipping container of FIG. 1.
Figure 14Q:
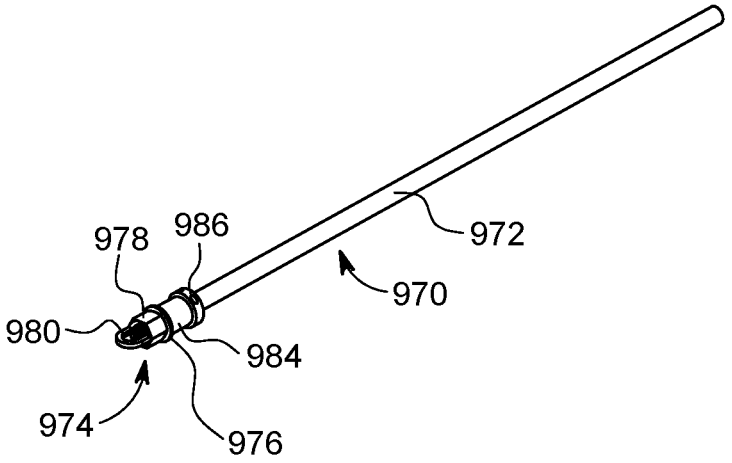
FIG. 14Q is an enlarged perspective view of the screw and screw head of the material loading assembly of the bulk material shipping container of FIG. 1.
Figure 14R:
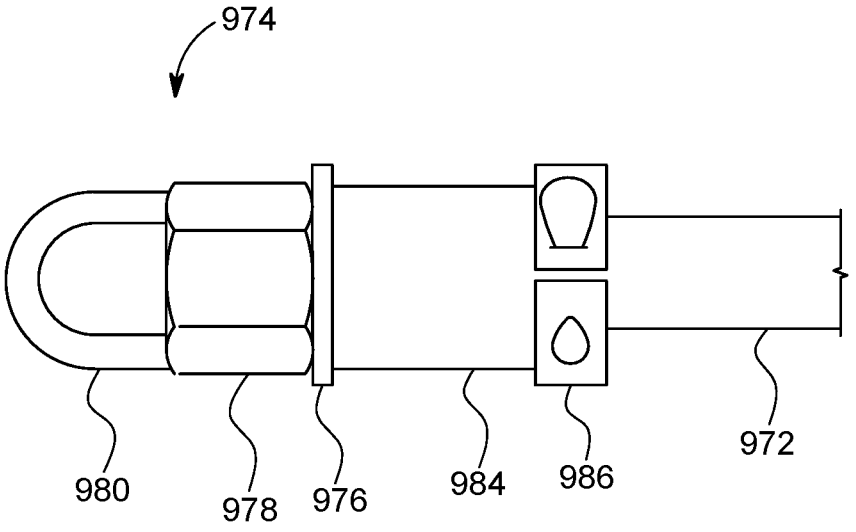
FIG. 14R is an enlarged partial fragmentary side view of the end of the screw and screw head of the hatch movement assembly of the material loading assembly of the bulk material shipping container of FIG. 1.
Figure 14S:
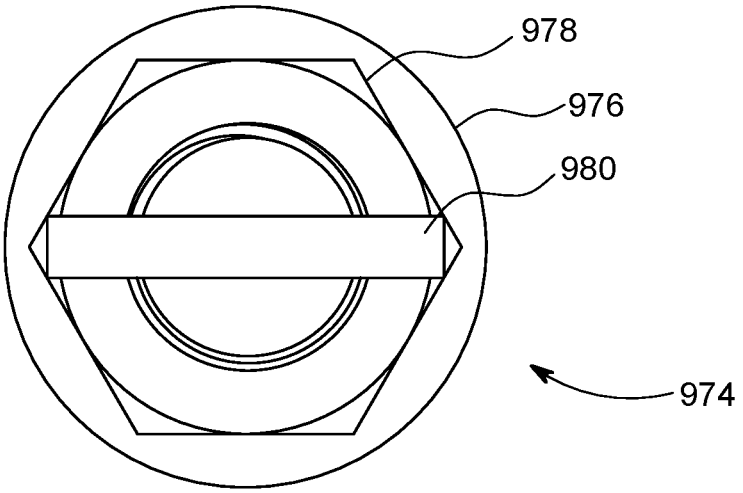
FIG. 14S is an enlarged end view of the end of the screw and screw head of the hatch movement assembly of the material loading assembly of the bulk material shipping container of FIG. 1.
Figure 14T:
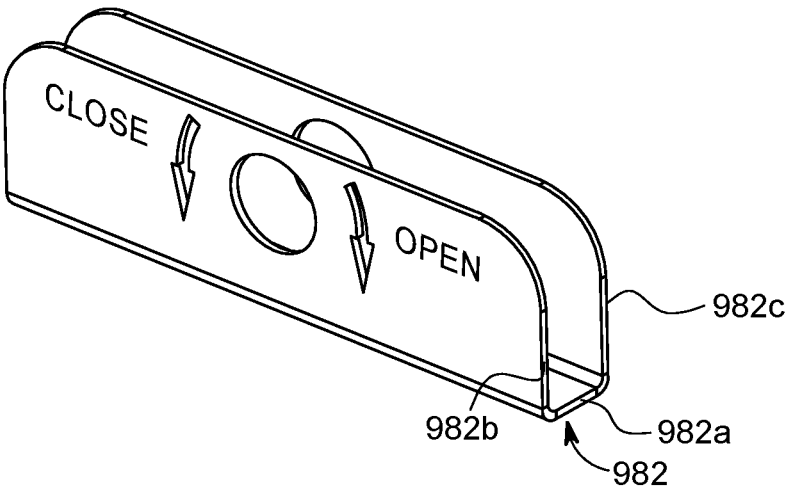
FIG. 14T is an enlarged perspective view of the direction bracket of the material loading assembly of the bulk material shipping container of FIG. 1.

The material loading assembly 900 of this illustrated example embodiment of the shipping container 50 of the present disclosure is generally illustrated in FIGS. 1 to 9, and more specifically illustrated in FIGS. 14A to 14T. The material loading assembly 900 generally includes: (a) a hatch collar assembly 910; (b) a hatch rail guide assembly 930; (c) a hatch assembly 940; and (d) a hatch movement assembly 970. The hatch assembly 940 is configured to be in a closed position (as shown in FIGS. 1, 2, 4, 5, 6, 7, 8, 9, and 14A, 14B, 14D, 14E, and 14G) to prevent materials or contaminants from entering the compartment 500 through the opening 851 in the top wall assembly 850 of the compartment 500, and to move to a plurality of different partially open positions and to a fully opened position (shown in FIGS. 3 and 14C) to enable materials to be loaded into the compartment 500 through the opening 851 in the top wall assembly 850 of the compartment 500. In this illustrated embodiment, the configuration, arrangement, and attachment of the hatch collar assembly 910, the hatch rail guide assembly 930, the hatch assembly 940, and the hatch movement assembly 970 provide material contamination prevention and secure access to the compartment 500. In this illustrated embodiment, the configuration and arrangement of the material loading assembly 900 also provides additional stability and contaminant prevention. Thus, this illustrated example embodiment of the material loading assembly of the bulk material shipping container enables the container to be stronger than various known containers, to be more durable than various known containers, to hold greater volumes of materials than various known containers, to hold greater weights of materials than various known containers, and to have a better weight to holding cargo capacity than various known containers.

In this illustrated embodiment, except as provided below, the hatch collar assembly 910, the hatch rail guide assembly 930, the hatch assembly 940, and the hatch movement assembly 970 are all formed from steel to provide suitable structural strength and rigidity. However, it should be appreciated that in alternative embodiments, the material loading assembly 900 or one or more parts thereof can be made from other suitably strong materials (such as wood, plastic, or composite or fiber glass materials).

More specifically, as shown in FIGS. 14F and 14H, the hatch collar assembly 910 includes: (a) a first or left elongated generally flat horizontally extending hatch slide 912 connected to the top wall assembly 850 of the compartment 500; (b) a second or right elongated generally flat horizontally extending hatch slide 914 connected to the top wall assembly 850 of the compartment 500 and spaced apart from the first hatch slide 912; (c) a front elongated generally flat horizontally extending hatch slide connector 916 connected to the top wall assembly 850 of the compartment 500; (d) a rear elongated generally flat horizontally extending hatch slide connector 918 connected to the top wall assembly 850 of the compartment 500; (e) a first or left elongated vertically upwardly extending lip 920 integrally connected to the hatch slide 912; (f) a second or right elongated vertically upwardly extending lip 922 integrally connected to the hatch slide 914; (g) a front elongated vertically upwardly extending lip 924 integrally connected to the hatch slide connector 916; and (h) a rear elongated vertically upwardly extending lip 926 integrally connected to the hatch slide connector 918. The first or left upwardly extending lip 920 is also integrally connected to the front upwardly extending lip 924 and the rear upwardly extending lip 926, and the second or right upwardly extending lip 922 is also integrally connected to the front upwardly extending lip 924 and the rear upwardly extending lip 926, such that the first or left upwardly extending lip 920, the second or right upwardly extending lip 922, the front upwardly extending lip 924, and the rear upwardly extending lip 926, form an integrated continuous lip that encircles the opening 851 in the top wall assembly 850 of the compartment 500. This continuous lip prevents contaminants (including solid particles and/or water or other liquids) on top assembly 850 of the compartment 500 from flowing into the compartment 500 through the opening 851 in the top wall assembly 850 of the compartment 500.

Although not shown, in this illustrated embodiment, a suitable sealant is applied on the top wall assembly under the hatch collar assembly 910 to further prevent or assist in preventing contaminants (such as solid particles and/or water or other liquids) from entering the compartment 500.

As shown in FIGS. 14A, 14F, and 14I, the hatch rail guide assembly 930 includes: (a) a first or left elongated generally horizontally extending hatch rail 932 connected to the first or left hatch slide 912 on the top wall assembly 850 of the compartment 500; (b) a second or right elongated generally horizontally extending hatch rail 934 connected to the second or right hatch slide 914 on the top wall assembly 850 of the compartment 500 and spaced apart from the first hatch rail 932; and (c) a rear elongated generally horizontally extending hatch rail connector 938 connected to the rear hatch slide connector 918 on the top wall assembly 850 of the compartment 500. The first or left hatch rail 932 includes a vertically extending body 932*a*, a horizontally outwardly extending base 932*b* integrally connected to bottom of the body 932*a*, and a horizontally inwardly extending lip 932*c* integrally connected to the top of the body 932*a*. The second or right hatch rail 934 includes a vertically extending body 934*a*, a horizontally outwardly extending base 934*b* integrally connected to bottom of the body 934*a*, and a horizontally inwardly extending lip 934*c* integrally connected to the top of the body 934*a*. The rear hatch rail connector 938 includes a vertically extending body 938*a*, a horizontally outwardly extending base 938*b* integrally connected to bottom of the body 938*a*, and a horizontally inwardly extending lip 938*c* integrally connected to the top of the body 938*a*. The first or left hatch rail 932 is integrally connected to one end of the rear hatch rail connector 938. The second or right hatch rail 934 is integrally connected to the other end of the rear hatch rail connector 938. The first or left hatch rail 932, the second or right hatch rail 934, and the rear hatch rail connector 938 are positioned respectively adjacent to and exterior to the first or left lip 920, the second or right lip 922, and the rear lip 926. The first or left hatch rail 932, the second or right hatch rail 934, and the rear hatch rail connector 938 also assist in preventing contaminants (such as solid particles and/or water or other liquids) on top assembly 850 of the compartment 500 from flowing into the compartment 500 through the opening 851 in the top wall assembly 850 of the compartment 500.

The hatch collar assembly 910 and the hatch rail guide assembly 930 co-act to provide a guide for and rails for the movement of the hatch assembly 940 from the closed position, to the plurality of different partially open positions, and to the fully opened position, as well as back to the closed position from the fully opened position.

The hatch assembly 940 includes a substantially flat hatch panel 942 and a hatch frame 944 configured to support the hatch panel 942 and configured to move or slide on the hatch rail guide assembly 930. In this illustrated embodiment, the hatch panel 942 is made from a composite material, although it could be made from any other suitable material. In this illustrated embodiment, the hatch frame 944 includes: (a) a first or left elongated hatch frame slide member 946; (b) a second or right hatch frame slide member 948 spaced apart from the first hatch frame side member 946; (c) a front elongated hatch frame member 952; and (d) a rear elongated hatch frame member 956 spaced apart from the front hatch frame member 952.

The first or left elongated hatch frame slide member 946 includes an elongated horizontally extending top member 946*a* and an elongated vertically extending side member 946*b* integrally connected to the top member 946*a*.

The second or right elongated hatch frame slide member 948 includes an elongated horizontally extending top member 948*a* and an elongated vertically extending side member 948*b* integrally connected to the top member 948*a*.

The front elongated hatch frame member 952 includes an elongated horizontally extending top member 953 and an elongated vertically extending front member 954 integrally connected to the top member 953. The elongated vertically extending front member 954 includes an outwardly extending left arm 954*a* and an outwardly extending right arm 954*b*. The hatch assembly 940 and specifically the hatch frame 944 defines a space between the end of the outwardly extending left arm 954*a* and the first or left hatch frame slide member 946 for the upwardly extending hatch rail 932. Likewise, the hatch assembly 940 and specifically the hatch frame 944 defines a space between the end of the outwardly extending right arm 954*b* and the second or right hatch frame slide member 948 for the upwardly extending hatch rail 934. The rear elongated hatch frame member 956 includes an elongated horizontally extending top member 957. As shown in FIGS. 14E and 14H, the rear elongated hatch frame member 956 does not include a downwardly extending member (or alternatively a substantially downwardly extending member) to enable the hatch assembly 940 to slide forward over the hatch collar assembly 910 and on and over the hatch rail guide assembly 930. In other words, this configuration of the hatch assembly 940 enables the sliding of the hatch assembly 940 and specifically the hatch frame 944 over the hatch collar assembly 910 and on and over the hatch rail guide assembly 930. The inwardly extending lip 932*c* of the first or left hatch rail 932 and the inwardly extending lip 938*c* of the second or right hatch rail 934 maintain the hatch assembly 940 adjacent to the top wall assembly 950.

The hatch frame slide member 946, the hatch frame slide member 948, the hatch frame member 952, and the hatch frame member 956 all include rivet holes (not labeled) that facilitate the attachment of the hatch panel 942 to the hatch frame 944. More specifically, the hatch assembly 940 further includes hatch panel attachment plates 957 and 959 that are positioned under the hatch panel 942 and under the members 946, 948, 952, and 956. Rivets (not shown) are used to connect the panel attachment plate 957 to the first or left hatch frame slide member 946, the second or right hatch frame slide member 948, and the front hatch frame member 952. Rivets (not shown) are used to connect the panel attachment plate 959 to the first or left hatch frame slide member 946, the second or right hatch frame slide member 948, and the rear elongated hatch frame member 952. In this way, the panel 942 is sandwiched between and held in place by the panel attachment plate 957, the panel attachment plate 959, the first or left hatch frame slide member 946, the second or right hatch frame slide member 948, the front hatch frame member 952 and the rear elongated hatch frame member 952. A suitable sealant such as silicone is used to create a seal between the panel 942 and the hatch frame slide member 946, the hatch frame slide member 948, the hatch frame member 952, and the hatch frame member 956.

The hatch assembly 940 also includes a screw receiver 960 integrally connected to the center of the vertically extending front member 954 of the front elongated hatch frame member 952. The screw receiver 960 in this illustrated embodiment is in the form of a threaded nut that is welded to the front member 954, and specifically positioned in screw receiver opening 954*a* in front member 954 and welded to the front member 954. The screw receiver 960 is configured to threadably receive an intermediate section and end section of the screw 972 of the hatch movement assembly 970 such that rotation of the screw 972 causes the hatch assembly 940 to move or slide over the hatch collar assembly 910 and on and over the hatch rail guide assembly 930.

In this illustrated embodiment, the hatch movement assembly 970 includes an elongated threaded hatch screw 972 having a first outer end, a threaded intermediate section, and a threaded opposite end section that is threadably received through the hatch screw receiver 960 such that rotation of the hatch screw 972 causes movement of the hatch screw receiver 996 and thus movement of the hatch assembly 940. The elongated threaded hatch screw 972 co-acts with the hatch screw receiver 960 (that is integrally connected to the hatch assembly 940) such that rotation of the hatch screw 972 causes movement of the hatch screw receiver 960 and thus movement of the hatch assembly 940 toward and away from the front of the container 50. This configuration enables the rotation of the hatch screw 972 with minimal movement of the hatch screw 972 relative to the top wall assembly 850 of the compartment 500 and to the hatch assembly 940.

More specifically, the hatch movement assembly 970 includes a screw head 974 connected to the first outer end of the elongated threaded screw 972. The screw head 974 includes a nut 978 welded to and extending from the end of the screw 972, and a loop 980 welded to the nut 978. The loop 980 is configured to be engaged by a suitable tool (such as the tool shown in FIGS. 16A and 16B) to facilitate rotation of the hatch screw 972 (and thus opening and closing of the hatch assembly 940) from a position adjacent to the container 50 without having to climb a ladder to reach the hatch screw 972 or screw head 974.

The hatch movement assembly 970 further includes a first washer 976 (and if needed one or more washers) journaled about the first end of the screw 972, a U-shaped direction bracket 982 integrally connected to the top front L-shaped angle top support 852 of the top assembly 850 of the compartment 500, a screw guide or collar 984 positioned in the U-shaped direction bracket 982, a pressure or securement clamp or collar 986 journaled about the screw 972 and connected to the screw 972. The direction bracket 982 includes a base 982*a* integrally connected to the top front L-shaped angle top support 852 of the top assembly 850 of the compartment 500, an upwardly extending front wall 982*b*, and an upwardly extending rear wall 982*c*. The front wall 982*b* and the rear wall 982*c* define aligned screw openings. The direction bracket 982, the collar 984, and the pressure or securement clamp or collar 986 enable the screw 972 co-act to relieve tightening pressure on the screw and thus enable the screw 972 to spin freely. The combination of these components enable the screw 972 to spin in either direction without further extending outside of the front to rear width of the container 50.

As shown in FIG. 14M, the material loading assembly 900 further includes upwardly and outwardly extending closing ramps 988*a* and 988*b* connected to the rear upwardly extending lip 926 of the hatch collar assembly 910. The closing ramps 988*a* and 988*b* are configured to engage the bottom of the rear portion of the hatch assembly 940 (and specifically the top member 957 of the rear elongated hatch frame member 956 of the hatch frame 944) as the hatch assembly 940 moves from an open position to the closed position to ensure that the hatch assembly 940 (and specifically the top member 957 of the rear elongated hatch frame member 956 of the hatch frame 944 of the hatch assembly 940) clears the rear upwardly extending lip 926 of the hatch collar assembly 910. For example, if snow or other material is on the top of hatch frame 944 and weighs down the hatch assembly 940, the closing ramps 988*a* and 988*b* will direct the hatch assembly 940 (and specifically the top member 957 of the rear elongated hatch frame member 956 of the hatch frame 944 of the hatch assembly 940) upwardly and over the rear upwardly extending lip 926 of the hatch collar assembly 910.

In an alternative embodiment of the material loading assembly, the direction plate is connected to an upstanding bracket (not show) integrally connected to the top front L-shaped angle top support 852 of the top assembly 850 of the compartment 500.

It should be appreciated that a suitable locking mechanism (not shown) may be employed in accordance with the present disclosure to lock the material loading assembly. For example, a lock (not shown) may be used to attach the loop 980 to a securing member (not shown) on the container 50.

It should be appreciated from that above that the material loading assembly 900 and the material unloading assembly 300 are vertically aligned, and that the arrangement of the pallet 100, the material unloading assembly 300, the compartment 500, and the material loading assembly 900, facilitate the stacking of multiple containers 50 to create a silo where the multiple stacked containers 50 seamlessly function together.

Additional Features and Components

In various embodiments, the bulk material shipping container of the present disclosure includes a ladder assembly. In various embodiments, the ladder assembly is fixed to the container. In other embodiments, the ladder assembly includes a ladder and certain ladder attachments that are removably attachable to the container.

Figure 15A:
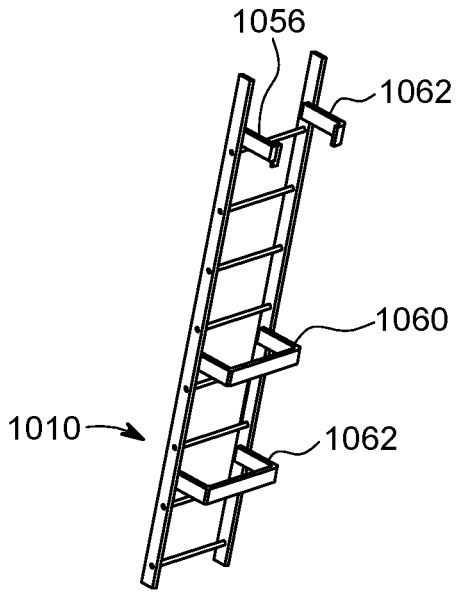
FIG. 15A is a rear perspective view of a ladder and certain of the ladder attachments of the ladder assembly of the present disclosure, shown removed from a container.
Figure 15B:
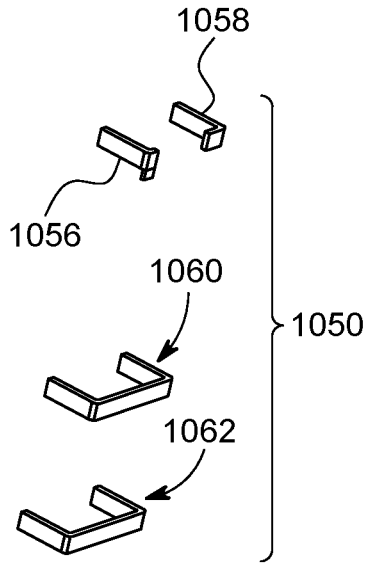
FIG. 15B is a rear perspective view of certain of the ladder attachments of the present disclosure, shown removed from the ladder.
Figure 15C:
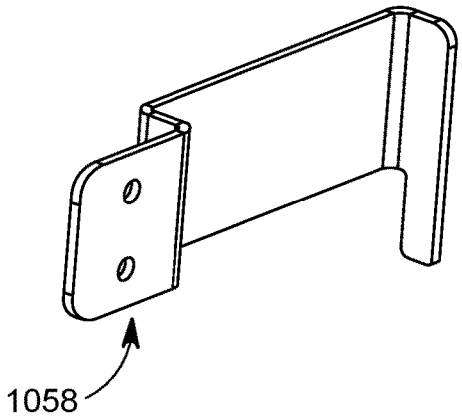
FIG. 15C is a front perspective view of one of the ladder attachments of the ladder assembly of the present disclosure, shown removed from the ladder.

In one example embodiment, the bulk material shipping container 50 of the present disclosure includes a ladder assembly 1000 as partially shown in FIGS. 1, 2, 3, 4, 6, and 9, and more fully shown in FIGS. 15A and 15B. The ladder assembly generally includes a ladder 1010 and ladder attachments 1050. Certain of the ladder attachments 1050 are configured to be connected to the container 50 and particularly the top wall assembly 850 of the compartment 500 of the container 50 and certain of the ladder attachments 1050 are configured to be integrally connected to the ladder 101. More specifically, the ladder attachments 1050 in this illustrated example embodiment include: (a) ladder support brackets 1052 and 1054 connected by fasteners (not shown)

to the top front L-shaped angle top support 852 of the top wall assembly 850 of the compartment 500 of the container 50; (b) ladder attachment arms 1056 and 1058 integrally connected to a top portion of the ladder 1010; and (c) ladder spacers 1060 and 1062 integrally connected to an intermediate portion of the ladder 1010 and to a lower portion of the ladder 1010. The ladder attachment arms 1056 and 1058 are configured to be hooked onto and rest on the ladder support brackets 1052 and 1054 to attach the ladder to the container 50. The ladder spacers 1060 and 1062 are configured to engage the front wall assembly 670 of the compartment 500 of the container 50 to maintain the ladder in a vertical or substantially vertical position.

It should be appreciated that other ladder assemblies may be employed with the container in accordance with the present disclosure.

It should be appreciated that the ladder attachments can be provided as part of a ladder attachment kit.

In various embodiments, the present disclosure further includes a hatch opening and closing tool that enables an operator to open and close the hatch assembly while standing on the ground adjacent to the container.

Figure 16A:
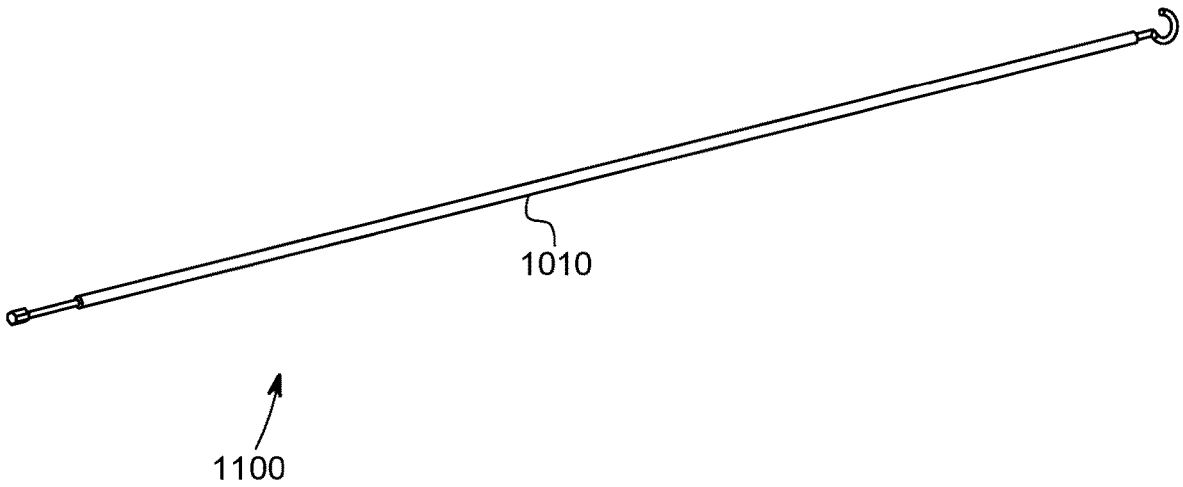
FIG. 16A is a perspective view of a hatch opening and closing tool of the present disclosure that is configured to work with the bulk material shipping container of FIG. 1.
Figure 16B:
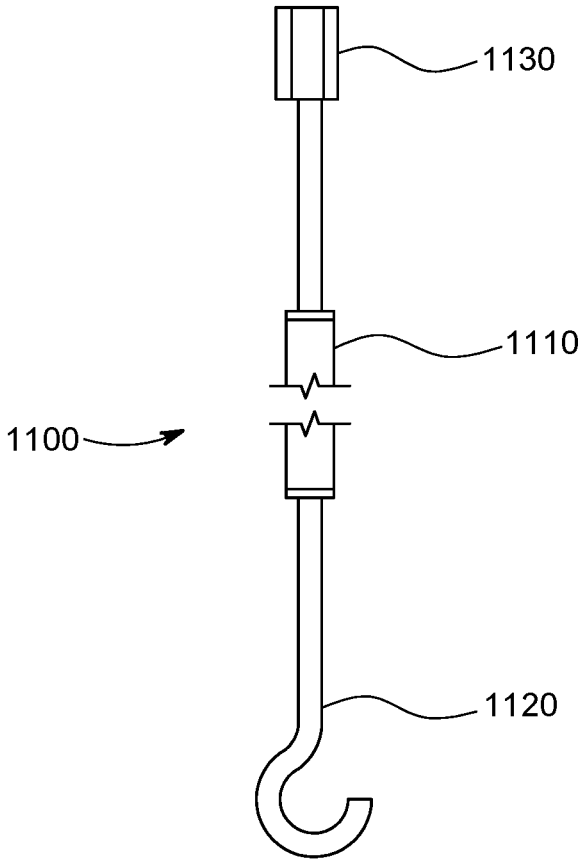
FIG. 16B is a top view of the hatch opening and closing tool of FIG. 16A.

In one example embodiment, the hatch opening and closing tool 1100 of the present disclosure is shown in FIGS. 16A and 16B. This example hatch opening and closing tool 1100 generally includes: (a) an elongated rod or pole 1110; (b) a hook 1114 connected to one end of the rod or pole 1110; and (c) a handle 1130 connected to the opposite end of the rod or pole 1110. The hook 1114 is configured to engage the loop 980 connected to the hatch screw 972 of the hatch movement assembly 970 of the material loading assembly 900 to enable the operator to connect one end of the rod or pole 1110 to the hatch screw 972 to turn the hatch screw 972 to open or close the hatch assembly 940.

Figure 17A:
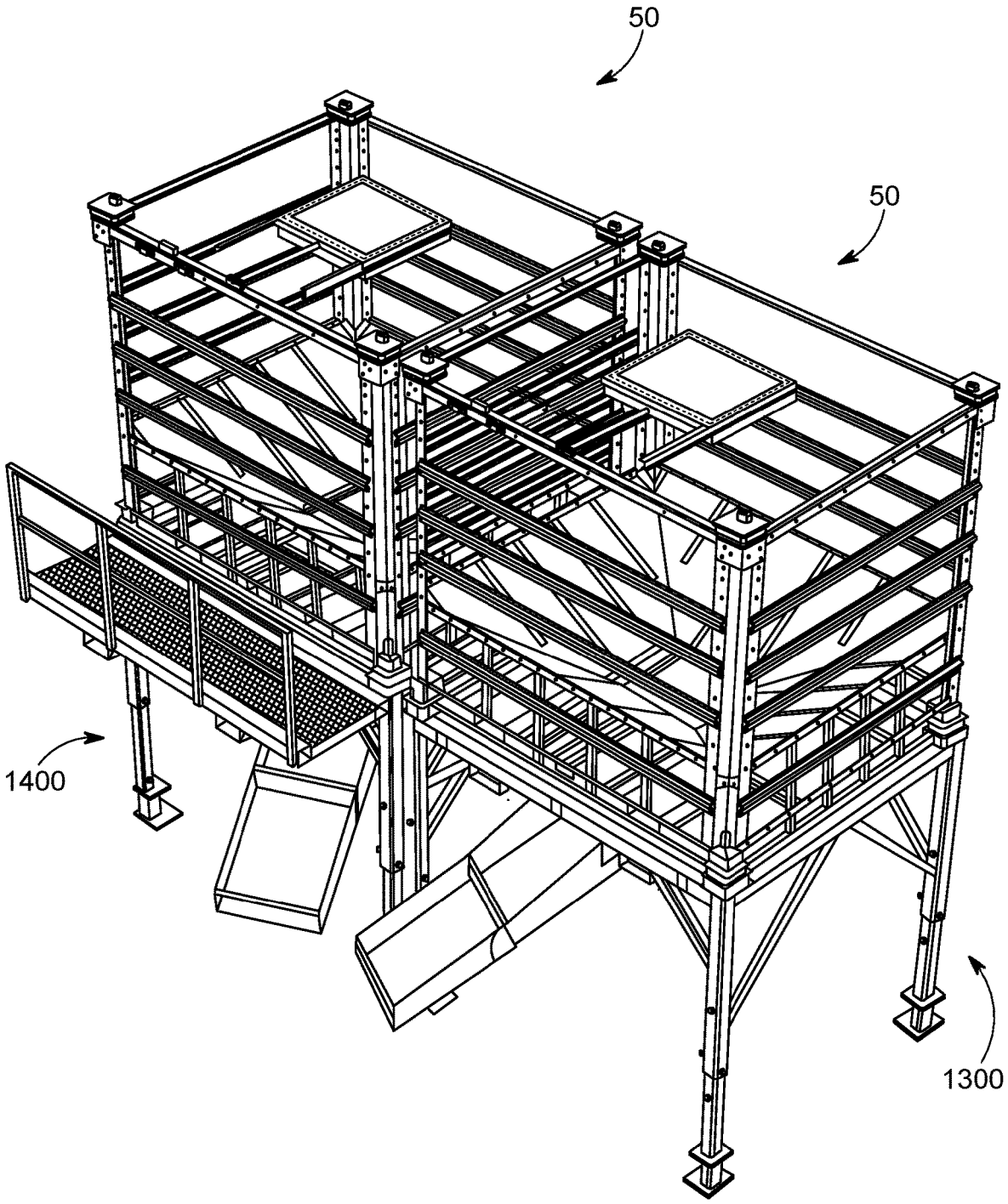
Figure 17B:
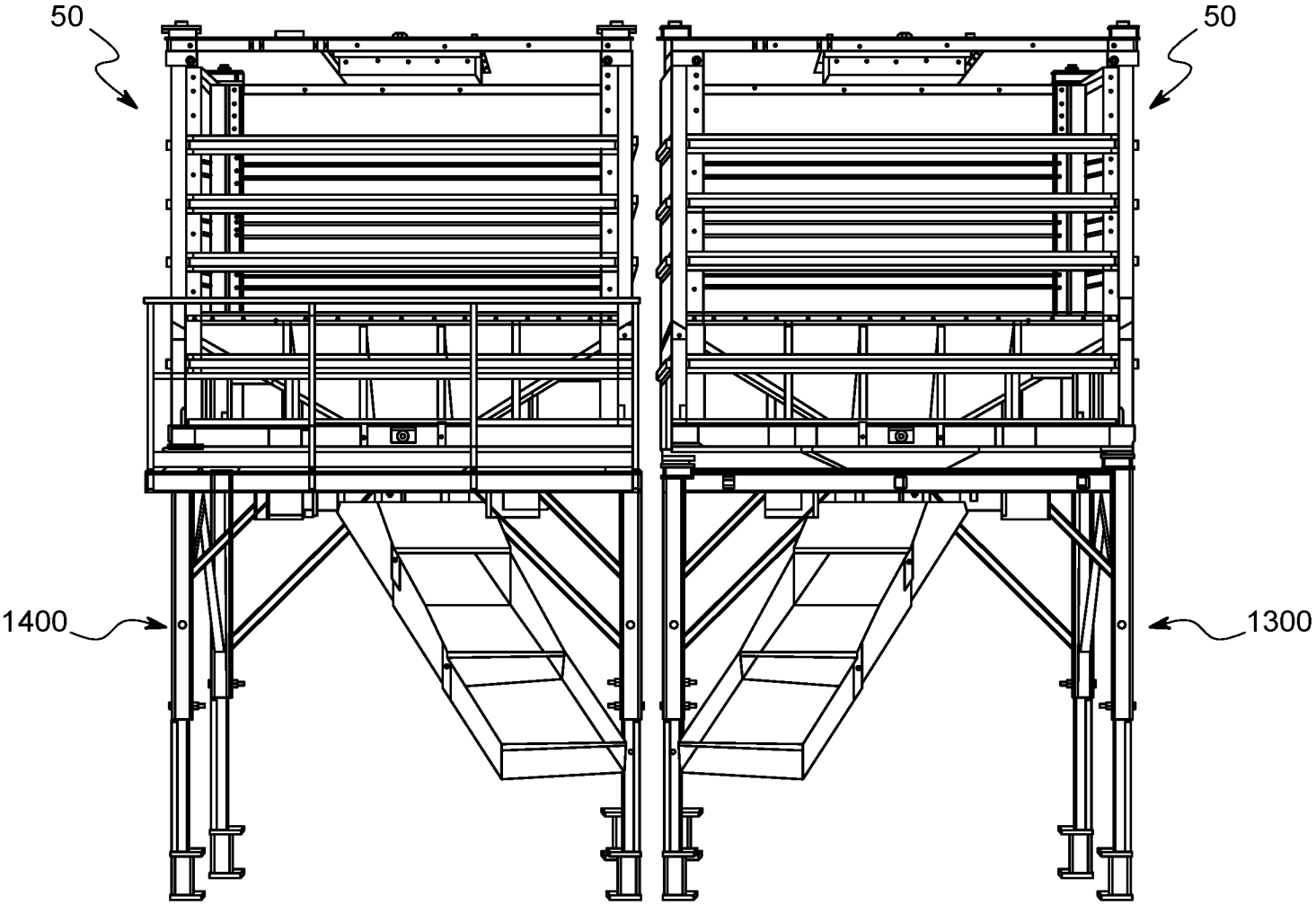
Figure 17C:
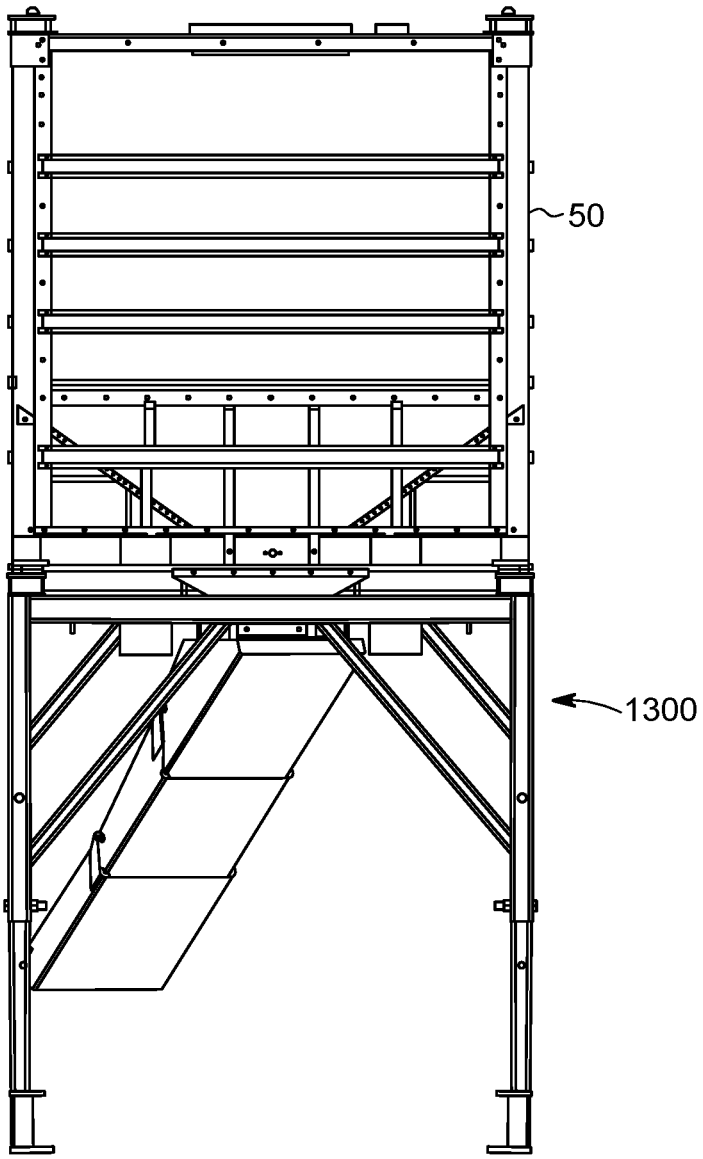
Figure 17D:
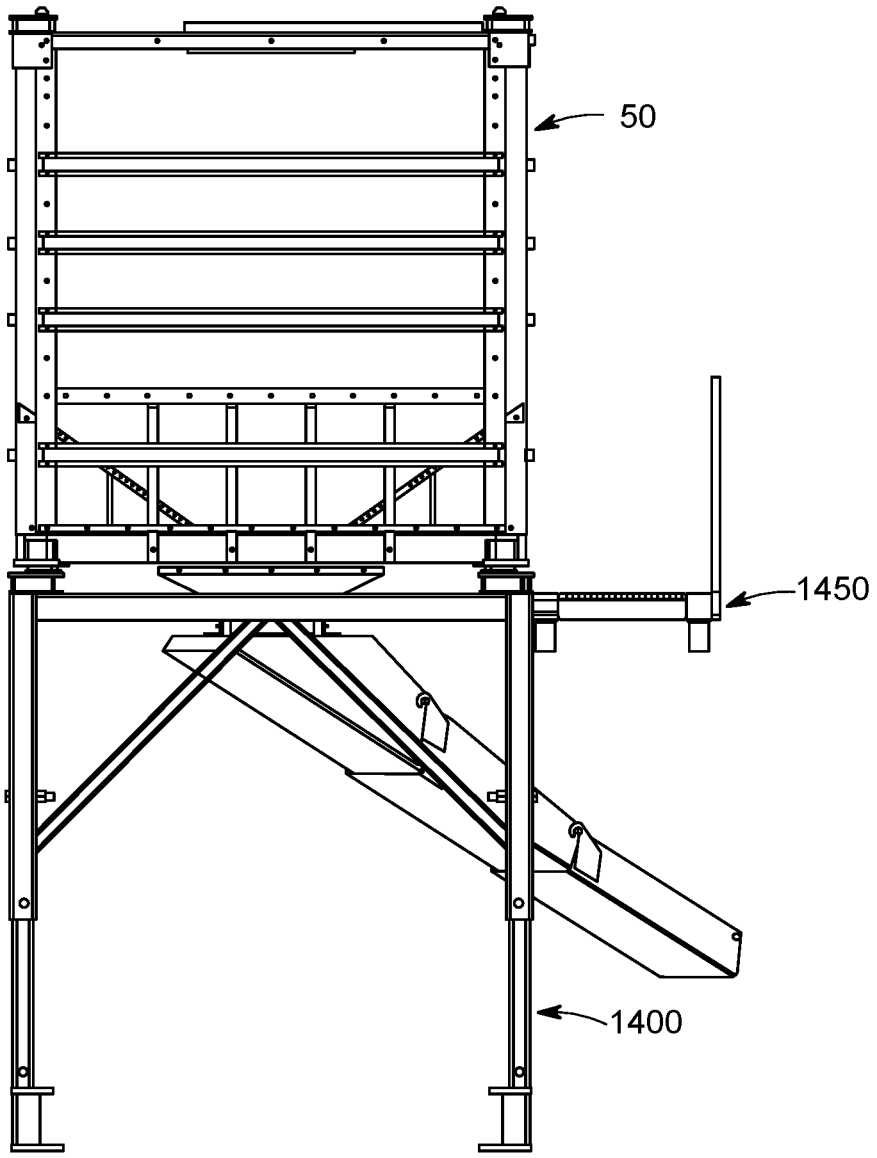
Figure 18A:
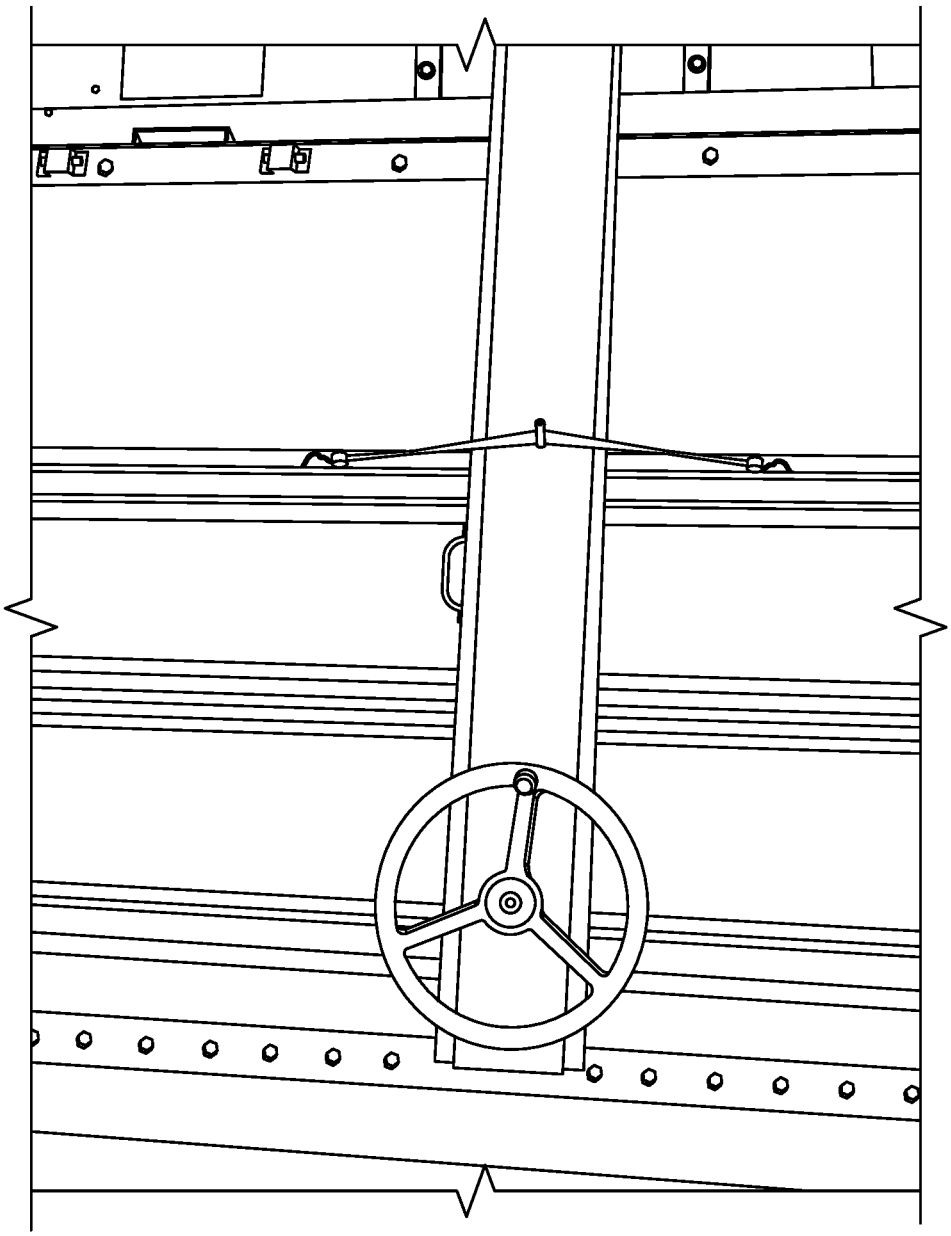
Figure 18B:
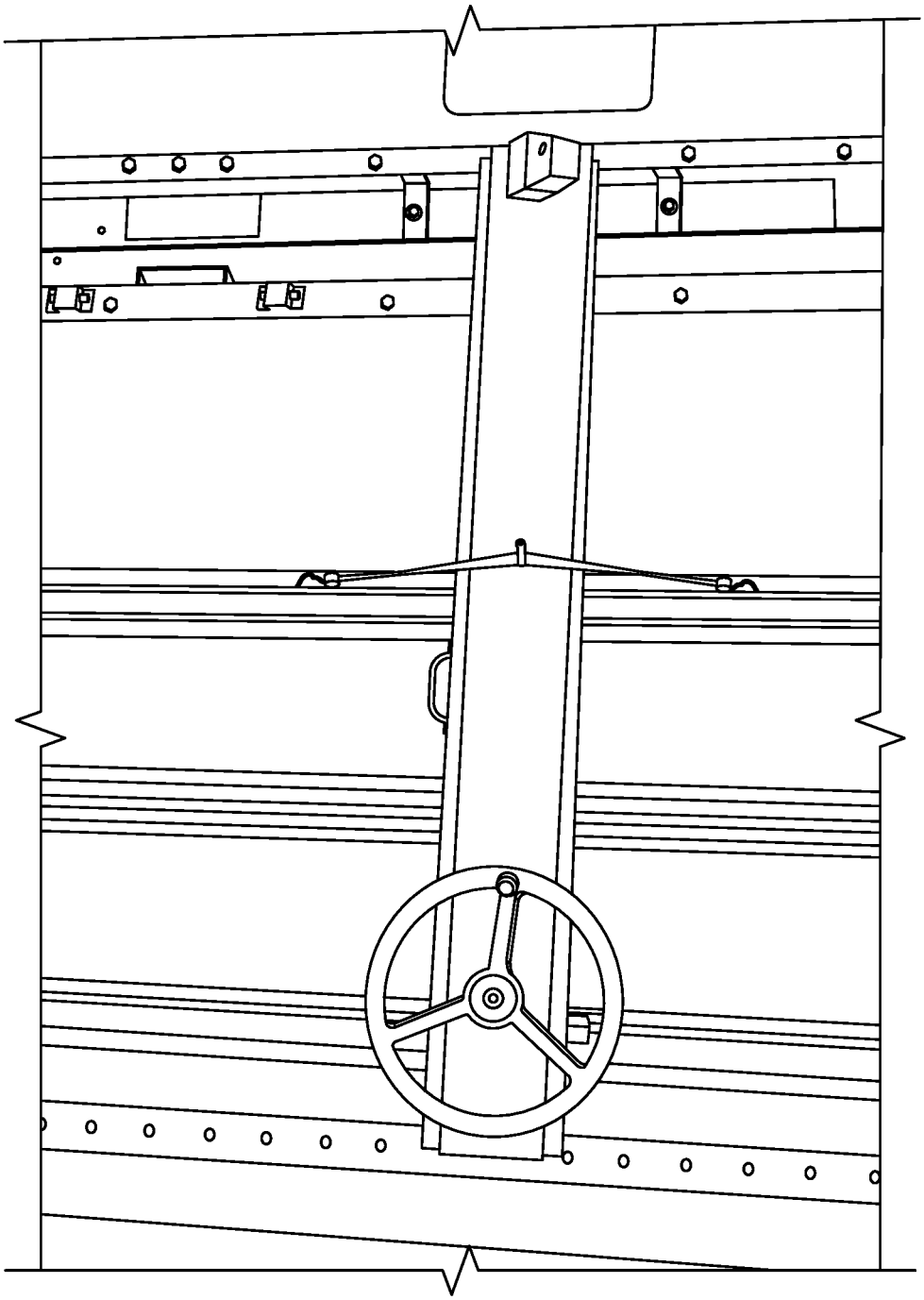
Figure 18C:
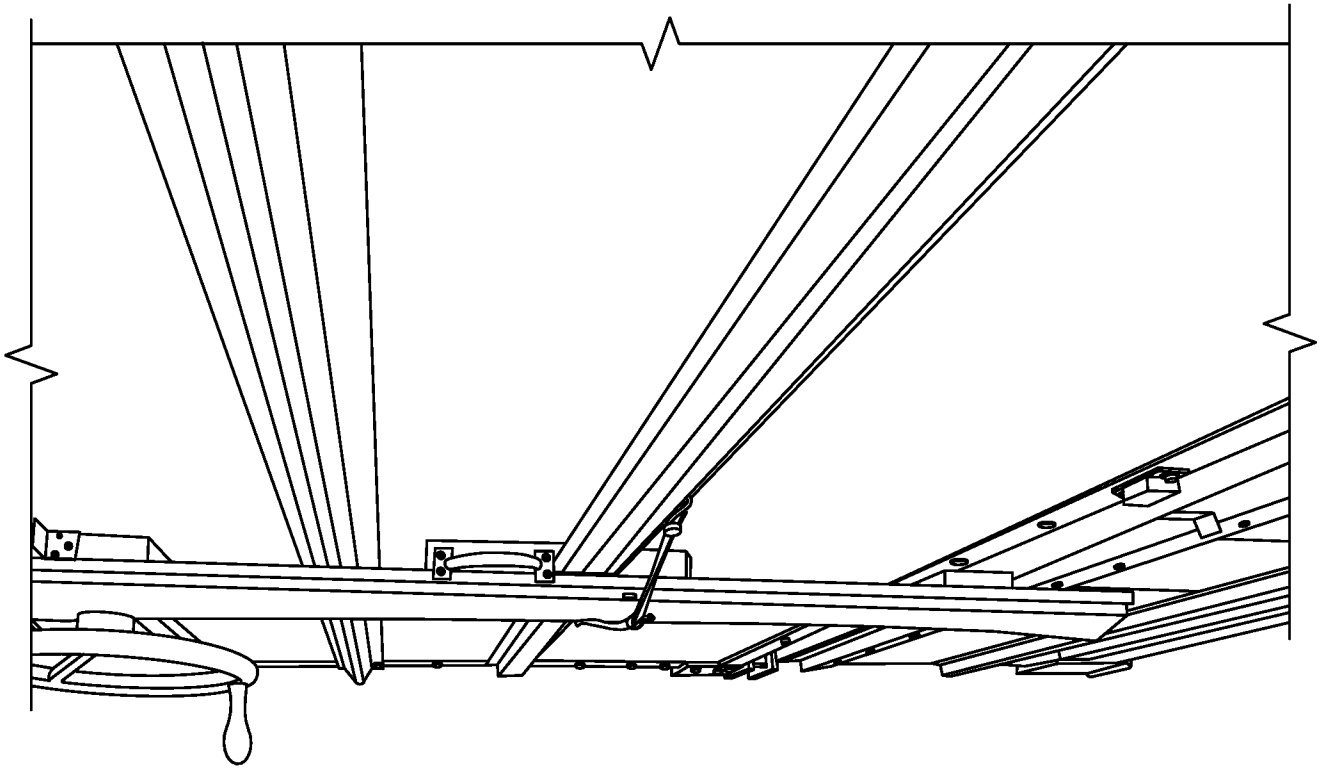
Figure 18D:
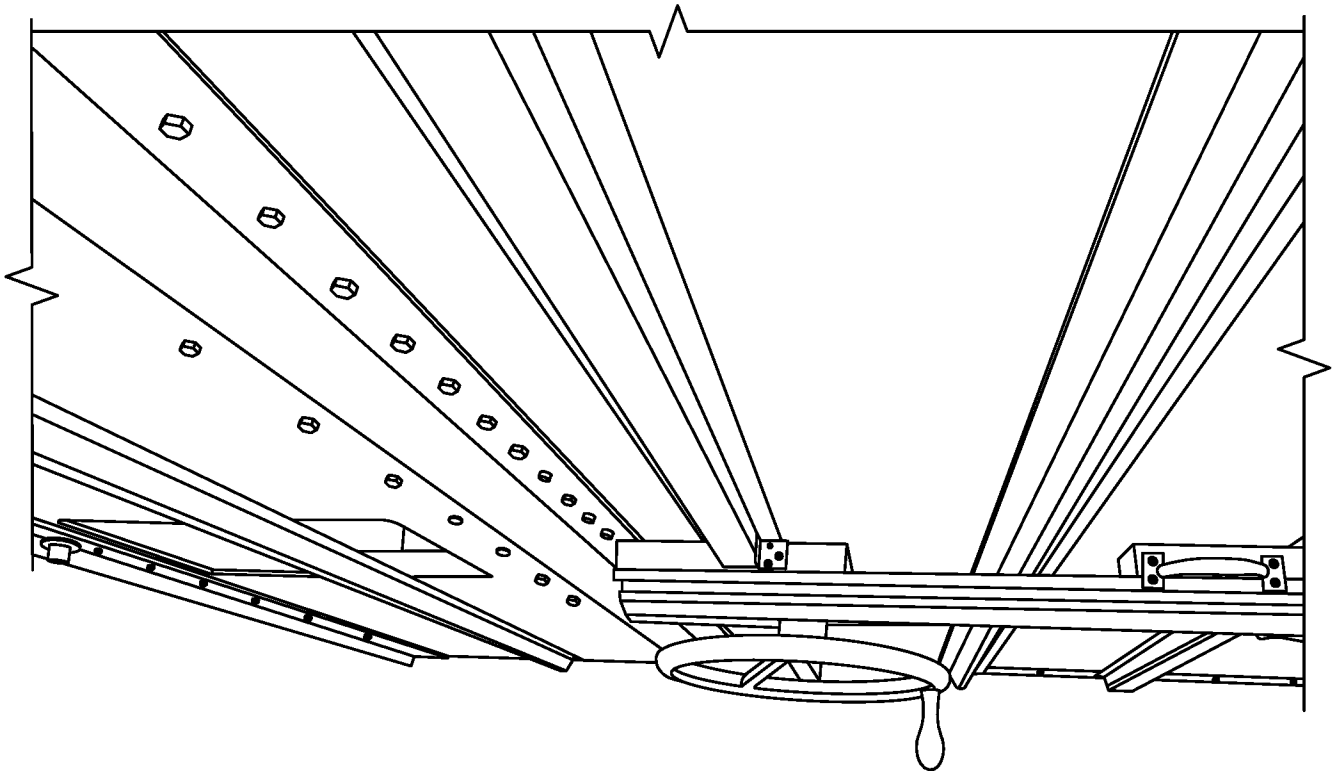

As discussed above, in various embodiments, the bulk material shipping container of the present disclosure is configured to be positioned on a material unloading device to assist in the unloading of materials from the container. FIGS. 17A and 17B illustrated two bulk material shipping containers 50 of the present disclosure positioned on two different adjacent material unloading devices of the present disclosure. FIG. 17C shows one of the bulk material shipping containers 50 positioned on a first such material unloading device 1300 and FIG. 17D shows another one of the bulk material shipping containers 50 positioned on a second different material unloading device 1400. Each of these example bulk material shipping container unloading devices is configured to support a bulk material shipping container of the present disclosure.

More specifically, each of these example bulk material shipping container unloading devices includes a supporter movable from a retracted position to at least one expanded position, wherein the supporter includes a plurality of expandable legs each including telescoping upper and lower sections, a plurality of feet respectively connected to the legs, and a plurality of locking members configured to respectively hold the legs in the at least one expanded position.

Each of these example bulk material shipping container unloading devices further includes a pallet receiver supported by the supporter and configured to receive and support the pallet of the bulk material shipping container, wherein the pallet receiver includes a plurality of pallet support bases including a front pallet support base, a rear pallet support base spaced apart from the front support base, a first side pallet support base connected to the front pallet support base and the rear pallet support base, and a second side pallet support base spaced apart from the first side pallet support base and connected to the front pallet support base and the rear pallet support base, and a plurality of nesting supports respectively connected to and extending upwardly from upper surfaces of the pallet support bases, each nesting support configured to engage a bottom section of the pallet of the bulk material shipping container.

Each of these example bulk material shipping container unloading devices further includes a material director supported by the pallet receiver, wherein the material director defines an opening, and includes (i) a first downwardly extending material directing wall, (ii) a spaced apart second downwardly extending material directing wall, (iii) a first downwardly extending material directing side wall integrally connected to the first downwardly extending material directing wall and the second downwardly extending material directing wall, and (iv) a spaced-apart second downwardly extending material directing side wall integrally connected to the first downwardly extending material directing wall and the second downwardly extending material directing wall. The first downwardly extending material directing wall, the second downwardly extending material directing wall, the first downwardly extending material directing side wall and the second downwardly extending material directing side wall define a chamber having a fixed shape for directing material from the bulk material shipping container through the pallet of the bulk material shipping container supported by the pallet receiver through the chamber.

The main difference between the first and second material unloading devices 1300 and 1400 is that the second different material unloading device 1400 includes an integrated catwalk 1450. The catwalk is provided to enable an operator to walk adjacent to multiple containers positioned on side by side adjacent material unloading devices.

In various embodiments, the present disclosure additionally includes one or more devices that enable the hatch assembly of the material loading assembly to be opened and closed by an operator standing on the ground adjacent to the container. FIGS. 18A, 18B, 18C, and 18F illustrate an example embodiment of a hatch opening and closing assembly that is attachable to the container and enables an operator standing on the ground adjacent to the container to open and close the hatch assembly of the material loading assembly. This hatch opening and closing assembly generally includes: (a) a frame removably or permanently attachable to the container; (b) a wheel assembly supported by the frame and including a wheel configured to be turned by an operator to open and close the hatch assembly; (c) a hatch screw rotation assembly supported by the frame and configure to engage or couple with the hatch screw head or the hatch screw to rotate the hatch screw; and (d) a linkage mechanism supported by the frame and coupled at one end to the wheel assembly and at the other end to the hatch screw rotation assembly.

Referring now to FIGS. 19 to 31E, another example embodiment of the bulk material shipping container of the present disclosure is illustrated. This example bulk material shipping container, which is generally indicated by numeral 2050, is configured to receive, hold, and release materials of substantial weight and volume.

This illustrated example embodiment of the shipping container 2050 of the present disclosure is similar to the shipping container 50, and generally includes substantially similar or identical components of the shipping container 50, except that it includes: (a) an alternatively configured pallet as described below; (b) an alternatively configured material unloading assembly as described below; and (c) an alternatively configured material loading assembly as described below.

Generally, as shown in FIGS. 19 to 28, this illustrated example embodiment of the shipping container 2050 of the present disclosure includes: (a) an alternative pallet 2100 (shown in FIGS. 19 to 28 and 29A to 29B); (b) a compartment 2500 (shown in FIGS. 19 to 28) connected to and supported by the pallet 2100; (c) an alternative material unloading assembly 2300 (shown in more detail in FIGS. 30A to 30G) positioned under a bottom portion of the compartment 2500 and connected to and supported by the pallet 2100; and (d) an alternative material loading assembly 2900 (shown in more detail in FIGS. 31A to 31E) connected to and supported by a top wall assembly 2850 of the compartment 2500. The pallet 2100 is configured to facilitate movement of the container 2050 and to facilitate stacking of multiple containers 2050. The material unloading assembly 2300 is connected to the pallet 2100 and configured to facilitate the release or unloading of materials from the compartment 2500 of the container 2050. The compartment 2500 is connected to and supported by the pallet 2100 and configured to receive, hold, and release materials. The material loading assembly 2900 is connected to and supported by the top wall assembly 2850 of the compartment 2500 and configured to facilitate the loading of material into the compartment 2500 and to prevent contaminants from entering the compartment 2500. It should be appreciated that the container 2050 generally includes a front side, a rear or back side opposite the front side, a right side, a left side opposite the right side, a bottom side, and a top side.

More specifically, referring now to FIGS. 29A, 29B, and 29C, the pallet 2100 of this illustrated alternative example embodiment of the shipping container 2050 is similar to the pallet 100, except that the pallet 2100 includes downwardly extending load cell engagement brackets 2102, 2104, 2106, and 2108. More specifically, the load cell engagement bracket 2102 is connected via suitable fasteners (not shown) to a first or left side support 2120 of the pallet 2100; the load cell engagement bracket 2104 is spaced apart from the load cell engagement bracket 2102 and connected via suitable fasteners (not shown) to the first or left side support 2120 of the pallet 2100; the load cell engagement bracket 2106 is connected via suitable fasteners (not shown) to a second or right side support 2140 of the pallet 2100; and the load cell engagement bracket 2108 is spaced apart from the load cell engagement bracket 2106 and connected via suitable fasteners (not shown) to the second or right side support 2140 of the pallet 2100.

Each of the downwardly extending load cell engagement brackets 2102, 2104, 2106, and 2108 is configured to extend downwardly beneath the first or left side support 2120 and the second or right side support 2140 of the pallet 2100 to the same distance and engage a bracket of a load cell.

It should be appreciated that the load cell engagement brackets 2102, 2104, 2106, and 2108 are identical. Thus, for brevity, the load cell engagement bracket 2102 is described in more detail below.

As best shown in FIG. 21C, the load cell engagement bracket 2102 includes: (a) a mounting wall 2102*a*; (b) a load cell engagement wall 2102*b*; (c) a first brace 2102*c* integrally connected to the mounting wall 2102*a* and the load cell engagement wall 2102*b*; (d) a second brace 2102*d* integrally connected to the mounting wall 2102*a* and the load cell engagement wall 2102*b*; and (e) a third brace 2102*e* integrally connected to the mounting wall 2102*a* and the load cell engagement wall 2102*b*. The mounting wall 2102*a* includes a body that defines a plurality of fastener openings each configured to receive a suitable fastener to connect the load cell engagement bracket 2102 to the first or left side support 2120 of the pallet 2100. Thus, the mounting wall 2102*a* is configured to engage and connect to the first or left side support 2120 of the pallet. The load cell engagement wall 2102*b* is configured to engage a bridge (not shown) of an unloader (not shown), so that load cells on the unloader can assist in determining the weight of the container 2050.

Referring now to FIGS. 30A to 30G, the material unloading assembly 2300 of this illustrated alternative example embodiment of the shipping container 2050 of the present disclosure generally includes: (a) a first bracket 2310; (b) a second bracket 2320; (c) a rail sealing bracket 2330; (d) a gate assembly 2350; (e) a rear material director 2450; (f) a front material director 2460; (g) an upwardly extending rear sealing wall 2360; (h) an upwardly extending front sealing wall 2730; (i) an upwardly extending first or left side sealing wall 2380; and (j) an upwardly extending second or right side sealing wall 2390.

It should be appreciated that in an alternative example embodiment (not shown), the material unloading assembly can include a gate locking assembly that is configured to lock the gate assembly of the container when the container is positioned and is resting on an unloader.

The gate assembly 2350 is specifically configured to be in a closed position (as shown in FIGS. 30A to 30G) to prevent the release of materials held in the compartment 2500, and to move to a plurality of different partially open positions and to a fully opened position to enable the release of materials held in the compartment 2500.

In this illustrated embodiment, the configuration, arrangement, and attachment of the bracket 2310, the second bracket 2320, the rail sealing bracket 2330, the gate assembly 2350, the rear material director 2450, the front material director 2460, the upwardly extending rear sealing wall 2360, the upwardly extending front sealing wall 2730, the upwardly extending first or left side sealing wall 2380, and the upwardly extending second or right side sealing wall 2390 of the material unloading assembly 2300 provide an intentional looseness that facilitates or allows a desired amount of play or side to side movement in the gate assembly 2350 that enables the gate assembly 2350 to continue to open or close if the gate assembly 2350 becomes skewed, off-center, or misaligned. In other words, the material unloading assembly is also self-correcting in this example embodiment. This enables the material unloading assembly 2300 and the entire container 2050 to be manufactured with reasonable manufacturing tolerance limits.

In this illustrated embodiment, the configuration, arrangement, and attachment of the first bracket 2310, the second bracket 2320, the third rail sealing bracket 2330, the gate assembly 2350, the rear material director 2450, the front material director 2460, the upwardly extending rear sealing wall 2360, the upwardly extending front sealing wall 2730, the upwardly extending first or left side sealing wall 2380, and the upwardly extending second or right side sealing wall 2390 of the material unloading assembly 2300 provide material leakage prevention. In this alternative illustrated example embodiment, the configuration and arrangement of the gate assembly 2350 also provides additional stability and damage prevention. Thus, this illustrated example embodiment of the material unloading assembly of the bulk material shipping container enables the container to be stronger than various known containers, to be more durable than various known containers, to hold greater volumes of materials than various known containers, to hold greater weights of materials than various known containers, and to have a better weight to holding cargo capacity than various known containers.

More specifically, in this illustrated example embodiment, except as set forth below, the first bracket 2310, the second bracket 2320, the rail sealing bracket 2330, the gate assembly 2350, the material director 2450, the front material director 2460, the upwardly extending rear sealing wall 2360, the upwardly extending front sealing wall 2730, the upwardly extending first or left side sealing wall 2380, and the upwardly extending second or right side sealing wall 2390 are all formed from steel to provide suitable structural strength and rigidity. However, it should be appreciated that in alternative embodiments, the material unloading assembly 2300 or one or more parts thereof can be made from other suitably strong materials (such as wood, plastic, or composite or fiber glass materials).

The second bracket 2320 as shown in FIGS. 30D and 30F includes an elongated vertically extending wall 2321, a vertically extending wall 2322 integrally connected to the wall 2321, and a guide rail 2323 connected via suitable fasteners to the wall 2321. The guide rail 2323 includes an elongated vertically extending wall 2323*a* that is connected via fasteners to the wall 2321. The guide rail 2323 further includes an elongated inwardly extending wall 2323*b* integrally connected to the wall 2323*a*. The wall 2323*b* is configured to support and be engaged by a lip 2354 of the gate assembly 2350 so that the gate assembly 2350 slides or moves along the wall 2323*b* of the guide rail 2323, as discussed below. The second bracket 2320, and specifically the wall 2321, is suitably connected such as by fasteners (not shown) to a second material unloading assembly support 2180 as shown in FIGS. 30A and 30B. The second bracket 2320, and therefore the guide rail 2323, extends toward a front support 2110 of the pallet 2100 to facilitate movement of the gate assembly 2350 toward the front support 2110 of the pallet 2100.

The first bracket 2310 is identical to the second bracket 2320 in this illustrated example embodiment. Thus, the first bracket 2310 includes an elongated vertically extending wall 2311, a vertically extending wall 2312 integrally connected to the wall 2311, and a guide rail 2313 connected via suitable fasteners to the wall 2311. The guide rail 2313 includes an elongated vertically extending wall 2313*a* that is connected via fasteners to the wall 2311. The guide rail 2313 further includes an elongated inwardly extending wall 2313*b* integrally connected to the wall 2313*a*. The wall 2313*b* is configured to support and be engaged by a lip 2353 of the gate assembly 2350 so that the gate assembly 2350 slides or moves along the wall 2313*b* of the guide rail 2313, as discussed below. The first bracket 2310, and specifically the wall 2311, is suitably connected such as by fasteners (not shown) to a first material unloading assembly support 2170 as shown in FIGS. 30A and 30B. The first bracket 2310, and therefore the guide rail 2313, extends toward the front support 2110 of the pallet 2100 to facilitate movement of the gate assembly 2350 toward the front support 2110 of the pallet 2100.

The guide rail 2313 of the first bracket 2310 extends parallel or substantially parallel to the guide rail 2323 of the second bracket 2320. The guide rail 2313 and the guide rail 2323 are also sized, aligned, and configured to support opposite sides of the gate assembly 2350 and to generally guide the gate assembly 2350 as the gate assembly 2350 moves from the closed position, to each of the partially open positions, to the fully open position, and back from the fully opened position to the fully closed position. The guide rail 2313 and the guide rail 2323 enable relatively free movement of the gate assembly 2350 and particularly the side lips 2353 and 2354 of a closure member 2352 of a gate 2351 of the gate assembly 2350. This partly facilitates the relatively loose interconnection of the gate 2351 on or relative to the guide rails 2313 and 2323 of the first and second brackets 2310 and 2320, respectively, to facilitate free travel of the gate 2351 relative to and on the guide rails 2313 and 2323 of the brackets 2310 and 2320, respectively, while also enabling the gate 2351 and the gate movement assembly 2350 to cause the gate 2351 to self correct if it goes askew as it continues to open or close.

The rail sealing bracket 2330 is integrally connected to and extends downwardly from the rear material director 2450. More specifically, the rail sealing bracket 2330 includes a gate engager wall 2331 that extends downwardly at an angle. The rail sealing bracket 2330 also includes a generally planar horizontally extending wall 2332 that has one end integrally connected to an elongated horizontally extending upstanding base wall 2452 of the rear material director 2450 and an opposing end integrally connected to the gate engager wall 2331. The rail sealing bracket 2330, and particularly the gate engager wall 2331, is configured to be engaged by the gate 2351 to stop the gate 2351 from engaging the rear material director 2450 when the gate 2351 moves or slides to a closed position.

The material unloading assembly 2300 of the container 2050 is thus supported by the pallet 2100 such that the gate assembly 2350 is configured to be positioned under and adjacent to a bottom opening or chute (not shown) in or defined by the compartment 2500.

As indicated above, the gate 2351 of the gate assembly 2350 includes a substantially flat generally rectangular closure member 2352, a first outwardly or left extending side lip 2353 integrally connected to a first or left side of the closure member 2352, a second outwardly or right extending side lip 2354 integrally connected to a second or right side of the closure member 2352, and a downwardly extending front end member 2355 integrally connected to a front end of the closure member 2352. The gate 2351 is movable or slidable from a closed position (as shown in FIGS. 30A and 30B), to a plurality of different partially opened positions (not shown), and then to a fully opened position.

In this illustrated embodiment, the closure member 2352 is made from steel to: (a) provide structural strength and rigidity; (b) facilitate ease of cleaning; (c) facilitate ease of repair; and (d) prevent contamination. However, it should be appreciated that in alternative embodiments, the gate and the guide rails can be made from other suitable materials.

It should be appreciated that the gate assembly can include one or more additional support members or stiffeners (not shown).

It should be appreciated that placing the gate assembly 2350 and particularly the gate 2351 in a partially open or partially closed positioned enables the user to control the rate of emptying the materials from the container 2050.

It should further be appreciated that the downwardly extending front end member 2355 can be engaged by a plurality of upwardly extending fingers (not shown) of a gate mover assembly (not shown) of an unloader (not shown) when the gate mover assembly moves. It should further be appreciated that the downwardly extending front end member 2355 can be positioned in between two front facing upwardly extending fingers and two rear facing upwardly extending fingers of the gate mover assembly of the unloader. More specifically, when the downwardly extending front end member 2355 is at first positioned between the two front facing upwardly extending fingers and two rear facing upwardly extending fingers, the downwardly extending front end member 2355 is not engaged by either or both of the two front facing upwardly extending fingers and the two rear facing upwardly extending fingers of the gate mover assembly of the unloader.

The rear material director 2450 of the material unloading assembly 2300 is integrally connected to one end of the first bracket 2310 and an opposing end of the second bracket 2320. The rear material director 2450 includes an elongated horizontally extending upstanding base wall 2452 and a downwardly and rearwardly extending material director wall 2480 integrally connected to the bottom of the upstanding base wall 2452.

The rear material director 2450 of the material unloading assembly 2300 also functions as a backstop (not labeled) to prevent the rearwardly movement of the gate assembly 2350.

The front material director 2460 is integrally connected to and extends downwardly from a bottom surface (not labeled) of the gate 2351. The front material director 2460 is also integrally connected to a portion of the first bracket 2310 and an opposing portion of the second bracket 2320.

The front material director 2460 includes an elongated horizontally extending upstanding base wall 2462, a downwardly and rearwardly extending wall 2464 integrally connected to a bottom of the upstanding base wall 2462, and a downwardly extending angled material director wall 2466 integrally connected to the upstanding base wall 2462 and the rearwardly extending wall 2464.

The rear material director 2450 and the front material director 2460 are configured to co-act (when the gate 2351 is moved to any of the plurality of different partially opened positions and to the fully opened position) to direct material held in the compartment 2500 out of the compartment 2500.

The upwardly extending rear sealing wall 2360 includes a horizontally extending base wall 2361 that is integrally connected to a top edge (not labeled) of the elongated vertically extending wall 2321 of the second bracket 2320 and an opposing top edge (not labeled) of the elongated vertically extending wall 2311 of the first bracket 2310. The upwardly extending rear sealing wall 2360 also includes a vertically extending wall 2362 that is integrally connected to the base wall 2361. The rear sealing wall 2360 is configured to prevent materials from leaking beneath the compartment 2500 when the gate assembly 2350 is in a closed position.

The upwardly extending front sealing wall 2370 includes a horizontally extending base wall 2371 that is integrally connected to a top surface (not labeled) of the closure member 2352 of the gate assembly 2350. The front sealing wall 2370 also includes a vertically extending wall 2372 that is integrally connected to and extends upwardly from the base wall 2371. The vertically extending wall is configured to engage and be slidable or movable on the top edge of the elongated vertically extending wall 2321 of the second bracket 2320 and the opposing top edge of the elongated vertically extending wall 2311 of the first bracket 2310. Thus, when the gate assembly 2350 moves from a closed position, to a plurality of partially open positions, to a fully opened position, and to a fully closed position, the vertically extending wall 2372 engages and slides or moves along the top edge of the elongated vertically extending wall 2321 of the second bracket 2320 and the opposing top edge of the elongated vertically extending wall 2311 of the first bracket 2310. The front sealing wall 2370 is configured to prevent materials from leaking beneath the compartment 2500 when the gate assembly 2350 is in a closed position.

The upwardly extending first or left side sealing wall 2380 is integrally connected the vertically extending wall 2311 of the first bracket 2310 and the elongated horizontally extending upstanding base wall 2452 of the rear material director 2450. The first or left side sealing wall 2380 is configured to prevent materials from leaking beneath the compartment 2500 when the gate assembly 2350 is in a closed position.

The upwardly extending second or right side sealing wall 2390 is integrally connected to the vertically extending wall 2321 of the second bracket 2320 and is spaced apart from the first or left side sealing wall 2380. The upwardly extending second or right side sealing wall 2390 is also integrally connected to the elongated horizontally extending upstanding base wall 2452 of the rear material director 2450. The second or right side sealing wall 2390 is configured to prevent materials from leaking beneath the compartment 2500 when the gate assembly 2350 is in a closed position.

The upwardly extending first or left side sealing wall 2380 and the upwardly extending second or right side sealing wall 2390 are each positioned above the closure member 2352 of the gate assembly 2350 in this alternative illustrated embodiment.

The material loading assembly 2900 of this alternative illustrated example embodiment of the shipping container 2050 of the present disclosure is generally illustrated in FIGS. 19 to 22, 24, 25, and 27, and more specifically illustrated in FIGS. 31A to 31E. The material loading assembly 2900 generally includes: (a) a hatch collar assembly 2910; (b) a hatch assembly 2940; (c) a first hinge assembly 2970; (d) a second hinge assembly 2976; (e) a third hinge assembly 2978; (f) a hatch movement assembly 2980; and (g) a hinge gasket 2990. The hatch assembly 2940 is configured to be in a closed position (as shown in FIGS. 19 to 22, 24, 25, and 27) to prevent materials or contaminants from entering the compartment 2500 through an opening (not shown) in the top wall assembly 2850 of the compartment 2500, and to move to a plurality of different partially open positions and to a fully opened position to enable materials to be loaded into the compartment 2500 through the opening in the top wall assembly 2850 of the compartment 2500. In this alternative illustrated example embodiment, the configuration, arrangement, and attachment of the hatch collar assembly 2910, the hatch assembly 2940, the first hinge assembly 2970, the second hinge assembly 2976, the third hinge assembly 2798, the hatch movement assembly 2980, and the hinge gasket 2990 provide material contamination prevention and secure access to the compartment 2500. In this alternative illustrated embodiment, the configuration and arrangement of the material loading assembly 2900 also provides additional stability and contaminant prevention. Thus, this alternative illustrated example embodiment of the material loading assembly of the bulk material shipping container enables the container to be stronger than various known containers, to be more durable than various known containers, to hold greater volumes of materials than various known containers, to hold greater weights of materials than various known containers, and to have a better weight to holding cargo capacity than various known containers.

In this alternative illustrated embodiment, except as provided below, the hatch collar assembly 2910, the hatch assembly 2940, the first hinge assembly 2970, the second hinge assembly 2976, the third hinge assembly 2978, the hatch movement assembly 2980, and the hinge gasket 2990 are all formed from steel to provide suitable structural strength and rigidity. However, it should be appreciated that in alternative embodiments, the material loading assembly 2900 or one or more parts thereof can be made from other suitably strong materials (such as wood, plastic, or composite or fiber glass materials).

More specifically, as shown in FIGS. 31D and 31E, the hatch collar assembly 2910 includes: (a) a first or left elongated generally flat horizontally extending hatch assembly engager bracket 2912 connected to the top wall assembly 2850 of the compartment 2500; (b) a second or right elongated generally flat horizontally extending hatch assembly engager bracket 2914 connected to the top wall assembly 2850 of the compartment 2500 and spaced apart from the first hatch assembly engager bracket 2912; (c) a front elongated generally flat horizontally extending hatch assembly engager bracket 2916 connected to the top wall assembly 2850 of the compartment 2500; (d) a rear elongated generally flat horizontally extending hatch assembly engager bracket 2918 connected to the top wall assembly 2850 of the compartment 2500; (e) a first or left elongated vertically upwardly extending lip 2920 integrally connected to the hatch assembly engager bracket 2912; (f) a second or right elongated vertically upwardly extending lip 2922 integrally connected to the hatch assembly engager bracket 2914; (g) a front elongated vertically upwardly extending lip 2924 integrally connected to the hatch assembly engager bracket 2916; and (h) a rear elongated vertically upwardly extending lip 2926 integrally connected to the hatch assembly engager bracket 2918. The first or left upwardly extending lip 2920 is also integrally connected to the front upwardly extending lip 2924 and the rear upwardly extending lip 2926, and the second or right upwardly extending lip 2922 is also integrally connected to the front upwardly extending lip 2924 and the rear upwardly extending lip 2926, such that the first or left upwardly extending lip 2920, the second or right upwardly extending lip 2922, the front upwardly extending lip 2924, and the rear upwardly extending lip 2926 form an integrated continuous lip that encircles the opening in the top wall assembly 2850 of the compartment 2500. This continuous lip prevents contaminants (including solid particles and/or water or other liquids) on top assembly 2850 of the compartment 2500 from flowing into the compartment 2500 through the opening in the top wall assembly 2850 of the compartment 2500.

The first upwardly extending lip 2920, the second upwardly extending lip 2922, the front upwardly extending lip 2924, and the rear upwardly extending lip 2926 are each configured to engage a downwardly extending lip of the hatch assembly 2940 when the hatch assembly 2940 is in a closed position, as discussed below.

Additionally, the hatch collar assembly 2910 further includes: (a) a first elongated generally flat horizontally extending gasket 2928 integrally connected to the first hatch assembly engager bracket 2912; (b) a second elongated generally flat horizontally extending gasket 2930 integrally connected to the second hatch assembly engager bracket 2914; (c) a front elongated generally flat horizontally extending gasket 2932 integrally connected to the front hatch assembly engager bracket 2916; and (d) a rear elongated generally flat horizontally extending gasket 2934 integrally connected to the rear hatch assembly engager bracket 2918. The first gasket 2928, the second gasket 2930, the front gasket 2932, and the rear gasket 2934 are each configured to engage a bottom edge of a lip of the hatch assembly 2940 (discussed below) to create a tight seal when the hatch assembly 2940 is in a closed position (as shown in FIGS. 19 to 22, 24, 25, and 27) to prevent materials or contaminants from entering the compartment 2500 through the opening in the top wall assembly 2850 of the compartment 2500.

Although not shown, in this illustrated embodiment, a suitable sealant is applied on the top wall assembly under the hatch collar assembly 2910 to further prevent or assist in preventing contaminants (such as solid particles and/or water or other liquids) from entering the compartment 2500.

The hatch assembly 2940 includes: (a) a substantially flat hatch panel 2942; (b) a first elongated downwardly extending lip or wall 2944 integrally connected to and extending downwardly from the hatch panel 2942; (c) a second elongated downwardly extending lip or wall 2946 integrally connected to and extending downwardly from the hatch panel 2942; (d) a front elongated downwardly extending lip or wall 2948 integrally connected to and extending downwardly from the hatch panel 2942; and (e) a rear elongated downwardly extending lip or wall 2950 integrally connected to and extending downwardly from the hatch panel 2942.

The first downwardly extending lip or wall 2944 of the hatch assembly 2940 is configured to engage the front and rear downwardly extending lips or walls 2948 and 2950 and the second downwardly extending lip or wall 2946 of the hatch assembly 2940 is configured to engage the front and rear downwardly extending lips or walls 2948 and 2950 to create a tight seal to prevent contaminants (including solid particles and/or water or other liquids) on top assembly 2850 of the compartment 2500 from flowing into the compartment 2500 through the opening in the top wall assembly 2850 of the compartment 2500.

Additionally, a bottom edge (not labeled) of the first downwardly extending lip or wall 2944, a bottom edge (not labeled) of the second downwardly extending lip or wall 2946, a bottom edge (not labeled) of the front downwardly extending lip or wall 2948, and a bottom edge (not labeled) of the rear downwardly extending lip or wall 2950 are each configured to engage the first, second, front, and rear gaskets 2928, 2930, 2932, and 2934, respectively, when the hatch assembly 2940 is in a closed position. This also creates a tight seal to prevent contaminants (including solid particles and/or water or other liquids) on top assembly 2850 of the compartment 2500 from flowing into the compartment 2500 through the opening in the top wall assembly 2850 of the compartment 2500.

In this alternative illustrated embodiment, the first, second, and third hinge assemblies 2970, 2976, and 2978 are each configured to enable the hatch assembly 2940 to move from a closed position to a plurality of open positions and vice versa. It should be appreciated that the first, second, and third hinge assemblies 2970, 2976, and 2978 are identical. Thus, for brevity, the first hinge assembly 2970 is described in more detail below.

The first hinge assembly 2970 includes: (a) a base bracket 2971; (b) a hinge connector bracket 2972; and (c) a movable hinge 2974.

The base bracket 2971 includes a generally flat horizontally extending wall 2971*a* integrally connected to a top surface of the rear hatch assembly engager bracket 2918. The base bracket 2971 further includes a vertically extending wall 2971*b* integrally connected to and extending upwardly from the wall 2971*a* and also integrally connected to the rear lip or wall 2950 of the hatch assembly 2940.

The hinge connector bracket 2972 is integrally connected to and extends upwardly from the wall 2971*a* of the base bracket 2971. The hinge connector bracket 2972 is also integrally connected to the vertically extending wall 2971*b* of the base bracket 2971. The hinge connector bracket 2972 includes a first hinge connector 2972*a* and an opposing second hinge connector bracket 2972*b*. The first and second hinge connectors 2972*a* and 2972*b* are configured to connect the movable hinge 2974 and enable the movable hinge 2974 to rotate about a horizontal axis that extends horizontally through the first hinge connector 2972*a* and the second hinge connector 2972*b*.

The movable hinge 2974 is configured to rotate about a horizontal axis that extends horizontally through the first and second hinge connectors 2972*a* and 2972*b* to cause the hatch assembly 2940 to move from a closed position to a plurality of open positions. The movable hinge 2974 includes a hatch panel engager portion 2974*a* and a hinge connector bracket connecting portion 2974*b* integrally connected to the hatch panel engager portion 2974*a*. The hatch panel engager portion 2974*a* is generally planar and is connected via suitable fasteners to the hatch panel 2942 of the hatch assembly 2940. The hinge connector bracket connecting portion 2974*b* is connected via a suitable pin (not shown) to the first and second hinge connectors 2972*a* and 2972*b* of the hinge connector bracket 2972.

In this alternative illustrated embodiment, the hatch movement assembly 2980 includes a generally L-shaped bracket 2982 connected via suitable fasteners (not shown) to the front hatch bracket 2916. The hatch movement assembly 2980 also includes a handle 2984 connected via suitable fasteners to the front lip 2948 of the hatch assembly 2940. The generally L-shaped bracket 2982 is configured to receive a suitable locking fastener or pin to position the hatch assembly 2940 in a locked position when the hatch assembly 2940 is in a closed position. The handle 2984 is configured to enable a user to move the hatch assembly 2940 from a closed position to a plurality of open positions and vice versa.

The hinge gasket 2990 is configured to create a tight seal between the first hinge assembly 2972 and the lip or wall 2926 of the hatch collar assembly 2910; the second hinge assembly 2976 and the lip or wall 2926 of the hatch collar assembly 2910; and the third hinge assembly 2978 and the lip or wall 2926 of the hatch collar assembly 2910. The hinge gasket 2990 is integrally connected to and extends upwardly from the rear hatch bracket 2918. The hinge gasket 2990 defines three separate and spaced apart grooves (each not labeled) to enable the hinge gasket 2990 to suitably extend upwardly from the rear hatch bracket 2918.

It should be appreciated from that above that the material loading assembly 2900 and the material unloading assembly 2300 are vertically aligned, and that the arrangement of the pallet 2100, the material unloading assembly 2300, the compartment 2500, and the material loading assembly 2900, facilitate the stacking of multiple containers 2050.

These example shipping containers of the present disclosure each provide an improved bulk material shipping container for loose materials that is stronger than various known containers, more durable than various known containers, lighter than various known containers having similar weight capacities, easier to repair than various known containers, easier to reconstruct than various known containers, configured to hold greater volumes of materials than various known containers, configured to hold greater weights of materials than various known containers, and configured to have a better weight to holding cargo capacity than various known containers.

It should be appreciated that suitable instructional marking or labels may be placed on or connected to the container of the present disclosure to instruct the users, operators, loaders, or unloaders on how to use, load, unload, and/or move the container in accordance with the present disclosure.

It should also be appreciated that suitable reflective tape strips can be connected to the container in accordance with the present disclosure.

It should further be appreciated that the container of the present disclosure can be suitably coated (such as by painting with a clear or colored protective coating). It should be appreciated that such coating may include a UV protective agent.

It should also be appreciated that one or more sections of the container may be reinforced with a suitable plating to provide additional protection and strength in accordance with the present disclosure.

It should also be appreciated that one or more vents can be formed in or attached to the container in accordance with the present disclosure.

It should further be appreciated that the attachment of the various components of the container can be performed in any suitable way such as by welding (including but not limited to laser welding) and by suitable fasteners (such as but not limited to rivets and bolts and nuts).

It should be appreciated that the present disclosure contemplates the elimination or reduction of sharp edges in the compartment and that any sharp edges can be curved or formed with a suitable radius.

It should be understood that modifications and variations may be effected without departing from the scope of the novel concepts of the present disclosure, and it should be understood that this application is to be limited only by the scope of the appended claims.

The invention is claimed as follows:

1. A material shipping container comprising:

(a) a pallet including:
- a first bottom corner assembly,
- a second bottom corner assembly,
- a third bottom corner assembly, and
- a fourth bottom corner assembly, wherein each bottom corner assembly of the pallet includes a base, a tubular body connected to and extending upwardly from the base, a cap connected to a top of the tubular body, and a corner support connected to and extending upwardly from the cap;

(b) a compartment connected to and supported by the pallet, the compartment including:
- a top wall assembly,
- a first upper corner assembly,
- a second upper corner assembly,
- a third upper corner assembly, and
- a fourth upper corner assembly;

(c) a material unloading assembly connected to a bottom portion of the compartment; and (d) a material loading assembly connected to and supported by a top wall assembly of the compartment.

2. The material shipping container of claim 1, wherein each upper corner assembly of the compartment includes a base, a corner connection bracket connected to and extending downwardly from the base, a tubular body connected to and extending upwardly from the base, a cap connected to a top of the tubular body, and a corner pin connected to and extending upwardly from the cap.

3. The material shipping container of claim 1, wherein each upper corner assembly of the compartment includes a base, a corner connection bracket connected to and extending downwardly from the base, a tubular body connected to and extending upwardly from the base, a cap connected to a top of the tubular body, and a corner pin connected to and extending upwardly from the cap.

4. The material shipping container of claim 1, wherein each bottom corner assembly includes a base, a tubular body integrally connected to and extending upwardly from the base, a cap integrally connected to a top of the tubular body, and a corner support integrally connected to and extending upwardly from the cap, the base defining an inwardly offset corner pin receiving opening configured to receive an upwardly extending corner pin, the tubular body defining a corner pin viewing opening.

5. The material shipping container of claim 4, wherein each upper corner assembly includes a base, a downwardly extending corner connection bracket integrally connected to the base, a tubular body integrally connected to and extending upwardly from a top of the base, a cap integrally connected to a top of the tubular body, and a corner pin integrally connected to the cap and extending upwardly from a top of the cap.

6. The material shipping container of claim 1, wherein each upper corner assembly includes a base, a downwardly extending corner connection bracket integrally connected to the base, a tubular body integrally connected to and extending upwardly from a top of the base, a cap integrally connected to a top of the tubular body, and a corner pin integrally connected to the cap and extending upwardly from a top of the cap.

7. The material shipping container of claim 1, wherein the pallet includes:

a front support;
a first side support;
a rear support;
a second side support;
a first fork lift tine receiving tube;
a second fork lift tine receiving tube;
a first material unloading assembly support;
a second material unloading assembly support;
a first stabilizer brace; and
a second stabilizer brace.

8. The material shipping container of claim 7, wherein opposing arms of the front support are integrally connected to the first bottom corner assembly and the fourth bottom corner assembly; opposing arms of the rear support are integrally connected to the second bottom corner assembly and the third bottom corner assembly; opposing arms of the first side support are integrally connected to the first bottom corner assembly and the second bottom corner assembly; and opposing arms of the second side support are integrally connected to the third bottom corner assembly and the fourth bottom corner assembly.

9. The material shipping container of claim 1, wherein the pallet includes a plurality of load cell engagement brackets.

10. The material shipping container of claim 7, wherein the pallet includes a first load cell engagement bracket connected to and extending downwardly from the first side support; a second load cell engagement bracket connected to and extending downwardly from the first side support; a third load cell engagement bracket connected to and extending downwardly from the second side support; and a fourth load cell engagement bracket connected to and extending downwardly from the second side support.

11. The material shipping container of claim 1, wherein the compartment includes:

a first upright corner assembly;
a second upright corner assembly;
a third upright corner assembly;
a fourth upright corner assembly;
an interior bottom wall assembly;
an interior bottom wall support assembly;
an exterior front wall assembly;
an exterior first side wall assembly;
an exterior rear wall assembly; and
an exterior second side wall assembly.

12. The material shipping container of claim 11, wherein the compartment includes a plurality of seal plates extending upwardly from the interior bottom wall assembly to provide a seal above a pressure level of the compartment.

13. The material shipping container of claim 11, wherein the compartment includes a plurality of corner V shaped leakage prevention plates.

14. The material shipping container of claim 11, wherein the compartment includes a plurality of U-shape material leakage preventers connected to downwardly extending lips of panels of the interior bottom wall assembly.

15. The material shipping container of claim 11, wherein the compartment includes a plurality of butterfly leakage prevention plates connected to the panels of the interior bottom wall assembly.

16. The material shipping container of claim 11, wherein the compartment includes a plurality of gate sealers that extend from the downwardly extending lips of panels of the interior bottom wall assembly.

17. The material shipping container of claim 11, wherein the front wall assembly of the compartment includes a kick plate having a viewing window.

18. The material shipping container of claim 11, wherein the compartment includes damage preventing braces with inwardly angled ends.

19. The material shipping container of claim 9, wherein the material unloading assembly includes a first guide rail, a second guide rail, and a gate assembly.

20. The material shipping container of claim 1, wherein the first guide rail is C-shaped and the second guide rail is C-shaped.

21. The material shipping container of claim 1, wherein the material unloading assembly includes a first guide rail, a second guide rail, and a gate assembly.

22. The material shipping container of claim 1, wherein the material unloading assembly includes a gate locking assembly.

23. The material shipping container of claim 1, wherein the material loading assembly includes a hatch collar assembly.

24. A material shipping container comprising:

(a) a pallet including:
a front support;
a first side support;
a rear support;
a second side support;
a first fork lift tine receiving tube;
a second fork lift tine receiving tube;
a first material unloading assembly support;
a second material unloading assembly support;
a first stabilizer brace;
a second stabilizer brace;
a first bottom corner assembly;
a second bottom corner assembly;
a third bottom corner assembly;
a fourth bottom corner assembly;

(b) a compartment configured to receive, hold, and release materials and connected to and supported by the pallet, the compartment including:
a first upright corner assembly;
a second upright corner assembly;

a third upright corner assembly;
a fourth upright corner assembly;
an interior bottom wall assembly;
an interior bottom wall support assembly;
an exterior front wall assembly;
an exterior first side wall assembly;
an exterior rear wall assembly;
an exterior second side wall assembly;
a first upper corner assembly;
a second upper corner assembly;
a third upper corner assembly;
a fourth upper corner assembly; and
a top wall assembly;

(c) a material unloading assembly configured to facilitate unloading of materials from the compartment, material unloading assembly connected to and supported by the pallet, the material unloading assembly including:
a first guide rail;
a second guide rail; and
a gate assembly; and (d) a material loading assembly configured to facilitate the loading of material into the compartment and connected to and supported by the top wall assembly of the compartment, the material loading assembly including:
a hatch collar assembly;
a hatch rail guide assembly; and
a hatch assembly.

25. The material shipping container of claim 24, wherein the compartment includes a plurality of seal plates extending upwardly from the interior bottom wall assembly to provide a seal above a pressure level of the compartment.

26. The material shipping container of claim 24, wherein the compartment includes a plurality of corner V shaped leakage prevention plates.

27. The material shipping container of claim 24, wherein the compartment includes a plurality of U-shape material leakage preventers connected to downwardly extending lips of panels of the interior bottom wall assembly.

28. The material shipping container of claim 24, wherein the compartment includes a plurality of gate sealers that extend from the downwardly extending lips of panels of the interior bottom wall assembly.

29. The material shipping container of claim 24, wherein the front wall assembly of the compartment includes a kick plate having a viewing window.

30. The material shipping container of claim 24, wherein the compartment includes damage preventing braces with inwardly angled ends.

31. The material shipping container of claim 24, wherein the compartment includes a plurality of butterfly leakage prevention plates connected to the panels of the interior bottom wall assembly.

32. The material shipping container of claim 24, wherein the material unloading assembly includes a gate movement assembly, the gate movement assembly configured to cause the gate assembly to move from a closed position to a fully opened position, and to move from the fully opened position to the closed position.

33. The material shipping container of claim 24, wherein the material loading assembly includes a hatch movement assembly, the hatch movement assembly configured to cause the hatch assembly to move from a closed position to a fully opened position, and to move from the fully opened position to the closed position.

* * * * *